US009372419B2

(12) United States Patent
Tsuji et al.

(10) Patent No.: US 9,372,419 B2
(45) Date of Patent: Jun. 21, 2016

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Haruyuki Tsuji, Yokohama (JP); Atsushi Fujii, Yokohama (JP); Kazuhisa Shida, Kawasaki (JP); Nobuhiro Nakamura, Numazu (JP); Hideaki Matsuoka, Mishima (JP); Hiroyuki Tomono, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/418,868

(22) PCT Filed: Aug. 29, 2013

(86) PCT No.: PCT/JP2013/073860

§ 371 (c)(1),
(2) Date: Jan. 30, 2015

(87) PCT Pub. No.: WO2014/034960

PCT Pub. Date: Mar. 6, 2014

(65) Prior Publication Data

US 2015/0205218 A1 Jul. 23, 2015

(30) Foreign Application Priority Data

Aug. 30, 2012 (JP) ..... 2012-189532
Apr. 3, 2013 (JP) ..... 2013-077617
Aug. 28, 2013 (JP) ..... 2013-177141

(51) Int. Cl.
*G03G 15/00* (2006.01)
*G03G 5/08* (2006.01)
(Continued)

(52) U.S. Cl.
CPC ..... *G03G 5/087* (2013.01); *G03G 5/104* (2013.01); *G03G 5/144* (2013.01)

(58) Field of Classification Search
CPC ..... G03G 5/087; G03G 5/104; G03G 5/144; G03G 5/05
USPC ..... 430/57.1, 60, 62, 63, 69; 399/116, 159
See application file for complete search history.

(56) References Cited

U.S. PATENT DOCUMENTS 6,168,911 B1 1/2001 Lelental et al.
7,344,810 B2 3/2008 Ito et al.
(Continued)

FOREIGN PATENT DOCUMENTS

JP 1-150150 A 6/1989
JP 1-248158 A 10/1989
(Continued)

OTHER PUBLICATIONS

PCT International Search Report and Written Opinion of the International Searching Authority, International Application No. PCT/JP2013/073860, Mailing Date Oct. 15, 2013.
(Continued)

*Primary Examiner* — Thorl Chea
(74) *Attorney, Agent, or Firm* — Fitzpatrick, Cella, Harper and Scinto

(57) ABSTRACT

Provided are an electrophotographic photosensitive member in which a residual potential hardly increases at the time of image formation, a pattern memory hardly occurs, and the crack of a conductive layer hardly occurs, and a process cartridge and an electrophotographic apparatus each including the electrophotographic photosensitive member. To this end, the conductive layer of the electrophotographic photosensitive member contains a titanium oxide particle coated with tin oxide doped with phosphorus, a tin oxide particle doped with phosphorus, and a binding material, and when a total volume of the conductive layer is represented by $V_T$, a total volume of the titanium oxide particle coated with tin oxide doped with phosphorus in the conductive layer is represented by $V_{1P}$, and a total volume of the tin oxide particle doped with phosphorus in the conductive layer is represented by $V_{2P}$, the $V_T$, the $V_{1P}$, and the $V_{2P}$ satisfy the following expressions: $2 \leq \{(V_{2P}/V_T)/(V_{1P}/V_T)\} \times 100 \leq 25$ and $15 \leq \{(V_{1P}/V_T)+(V_{2P}/V_T)\} \times 100 \leq 45$.

22 Claims, 3 Drawing Sheets

(51) Int. Cl.

| | |
|---|---|
| ***G03G 5/087*** | (2006.01) |
| ***G03G 5/10*** | (2006.01) |
| ***G03G 5/14*** | (2006.01) |

(56) References Cited

U.S. PATENT DOCUMENTS

| | | | | |
|---|---|---|---|---|
| 7,407,606 | B2 | 8/2008 | Chiba et al. | |
| 8,778,580 | B2 | 7/2014 | Tsuji et al. | |
| 8,980,510 | B2 | 3/2015 | Fujii et al. | |
| 2012/0114375 | A1 | 5/2012 | Fujii et al. | |
| 2012/0225381 | A1 * | 9/2012 | Nakamura | G03G 5/144 430/131 |
| 2013/0323632 | A1 | 12/2013 | Fujii et al. | |
| 2014/0004452 | A1 | 1/2014 | Sekiya et al. | |
| 2014/0004453 | A1 | 1/2014 | Kaku et al. | |
| 2014/0004454 | A1 | 1/2014 | Okuda et al. | |

FOREIGN PATENT DOCUMENTS

| | | | |
|---|---|---|---|
| JP | 2-197014 | A | 8/1990 |
| JP | 6-207118 | A | 7/1994 |
| JP | 9-50142 | A | 2/1997 |
| JP | 9-278445 | A | 10/1997 |
| JP | 10-53417 | A | 2/1998 |
| JP | 2000-231178 | A | 8/2000 |
| JP | 3365821 | B2 | 1/2003 |
| JP | 2004-151349 | A | 5/2004 |
| JP | 2004-349167 | A | 12/2004 |
| JP | 2007-187771 | A | 7/2007 |
| JP | 2012-18370 | A | 1/2012 |
| JP | 2012-18371 | A | 1/2012 |
| WO | 2005/008685 | A1 | 1/2005 |
| WO | 2011/027911 | A1 | 3/2011 |
| WO | 2011/027912 | A1 | 3/2011 |

OTHER PUBLICATIONS

U.S. Appl. No. 14/418,861, filed Jan. 30, 2015. Inventor: Shida, et al.

European Search Report dated Mar. 8, 2016 in European Application No. 13832990.9.

* cited by examiner

ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, and a process cartridge and an electrophotographic apparatus each including the electrophotographic photosensitive member.

BACKGROUND ART

An electrophotographic photosensitive member using an organic photo-conductive material (organic electrophotographic photosensitive member) has been intensively studied and developed in recent years.

The electrophotographic photosensitive member basically includes a support and a photosensitive layer formed on the support. In actuality, however, various layers are provided in many cases between the support and the photosensitive layer for the purposes of, for example, covering defects in the surface of the support, protecting the photosensitive layer from electrical destruction, enhancing chargeability, and improving charge injection blocking property from the support to the photosensitive layer.

Of the layers to be provided between the support and the photosensitive layer, a layer containing metal oxide particles is known as a layer to be provided for the purpose of covering defects in the surface of the support. The layer containing metal oxide particles generally has high electro-conductivity (for example, an initial volume resistivity of $1.0\times10^{8}$ to $2.0\times10^{13}$ Ω·cm) as compared to that of a layer not containing metal oxide particles, and even when the thickness of the layer is increased, a residual potential at the time of forming an image is difficult to increase. Therefore, the layer containing metal oxide particles covers defects in the surface of the support easily. When such layer having high electro-conductivity (hereinafter referred to as "conductive layer") is provided between the support and the photosensitive layer to cover defects in the surface of the support, an allowable range of defects in the surface of the support is enlarged. As a result, an allowable range of the support to be used is enlarged. Thus, an advantage of enhancing productivity of an electrophotographic photosensitive member is provided.

Patent Literature 1 discloses a technology involving using, in a conductive layer between a support and a photosensitive layer, a titanium oxide particle coated with tin oxide doped with phosphorus or tungsten. In addition, Patent Literature 2 discloses a technology involving using, in a conductive layer between a support and a photosensitive layer, a titanium oxide particle coated with tin oxide doped with phosphorus, tungsten, or fluorine.

In addition, Patent Literature 3 discloses a technology involving incorporating, into the undercoat layer of an electrophotographic photosensitive member obtained by sequentially laminating the undercoat layer, an intermediate layer, and a photosensitive layer on a conductive support, two kinds of metal oxide particles having different average particle diameters. In addition, Patent Literature 4 discloses the following technology. Two or more kinds of electro-conductive particles having different primary particle diameters are incorporated into the intermediate layer of an electrophotographic photosensitive member obtained by laminating the intermediate layer and a photosensitive layer on a conductive support in the stated order, a ratio "A:B" between the average particle diameters of primary particles A having the largest average particle diameter of the electro-conductive particles and primary particles B having the smallest average particle diameter thereof is set to 12:1 to 30:1, and the average particle diameter of the primary particles B is set to 0.05 μm or less. In addition, Patent Literature 4 discloses a technology involving using a tin oxide particle doped with tantalum in the intermediate layer of the electrophotographic photosensitive member.

In addition, Patent Literatures 5 and 6 each describe a technology involving using a tin oxide particle doped with niobium in a conductive layer or an intermediate layer between a support and a photosensitive layer.

CITATION LIST

Patent Literature

PTL 1: Japanese Patent Application Laid-Open No. 2012-18371

PTL 2: Japanese Patent Application Laid-Open No. 2012-18370

PTL 3: Japanese Patent Application Laid-Open No. 2007-187771

PTL 4: Japanese Patent Application Laid-Open No. 2004-151349

PTL 5: Japanese Patent Application Laid-Open No. H01-248158

PTL 6: Japanese Patent Application Laid-Open No. H01-150150

SUMMARY OF INVENTION

Technical Problem

In recent years, the following opportunity has been increasing: a large amount of images identical to each other are output from one and the same electrophotographic photosensitive member in a short time period.

In such case, the direction of movement of a recording medium (such as a transfer material (e.g., paper) or an intermediate transfer member) in an electrophotographic photosensitive member and a vertical direction (longitudinal direction when the electrophotographic photosensitive member is cylindrical) do not deviate from each other. Accordingly, for example, when a solid black image or a half-tone image is output after a large amount of images each including vertical lines 306 (lines parallel to the direction of movement of the recording medium) like an image 301 of FIG. 4 have been continuously output, a product called a pattern memory occurs in a portion where a vertical line has been formed. More specifically, in essence, the solid black image is output like an image 302 of FIG. 4 and the half-tone image is output like an image 303 of FIG. 4. However, when the solid black image is output after a large amount of images each including the vertical lines 306 like the image 301 of FIG. 4 have been continuously output, the output image may be an image 304 with vertical lines 307 resulting from the repetition hysteresis of the vertical lines 306 of the image 301 of FIG. 4. In the case of the half-tone image as well, as in the case of the solid black image, the output image may be an image 305 with vertical lines 308 resulting from the repetition hysteresis of the vertical lines 306 of the image 301 of FIG. 4. An image portion where the repetition hysteresis has appeared like those vertical lines 307 and 308 is called a pattern memory.

In particular, the following opportunity has been recently increasing as compared with olden times in association with the lengthening of the lifetime of an electrophotographic photosensitive member: a large amount of images identical to each other are output from one and the same electrophotographic photosensitive member in a short time period. Accordingly, even in a conventional electrophotographic photosensitive member that has heretofore been able to be sufficiently used, the case where the pattern memory occurs when a large amount of images identical to each other are output in a short time period has started to become apparent. In this respect, each of the electrophotographic photosensitive members including conventional conductive layers disclosed in Patent Literatures 1 to 6 has sometimes involved the emergence of the case where the pattern memory occurs.

On the other hand, in the case of a conductive layer containing a binding material and metal oxide particles, a crack is liable to occur in the conductive layer even when the volume resistivity of the conductive layer is reduced merely by increasing the content of the metal oxide particles in the conductive layer in order that an increase in residual potential at the time of image formation may be suppressed. Accordingly, the following necessity arises: while the occurrence of the crack of the conductive layer is suppressed, the occurrence of a pattern memory is suppressed and the increase of the residual potential is suppressed.

In view of the foregoing, the present invention is directed to providing an electrophotographic photosensitive member in which a residual potential hardly increases at the time of image formation, a pattern memory hardly occurs, and the crack of a conductive layer hardly occurs, and a process cartridge and an electrophotographic apparatus each including the electrophotographic photosensitive member.

Solution to Problem

According to one aspect of the present invention, there is provided an electrophotographic photosensitive member, including: a support; a conductive layer formed on the support; and a photosensitive layer formed on the conductive layer, in which: the conductive layer contains a titanium oxide particle coated with tin oxide doped with phosphorus, a tin oxide particle doped with phosphorus, and a binding material; and when a total volume of the conductive layer is represented by $V_T$, a total volume of the titanium oxide particle coated with tin oxide doped with phosphorus in the conductive layer is represented by $V_{1P}$, and a total volume of the tin oxide particle doped with phosphorus in the conductive layer is represented by $V_{2P}$, the $V_T$, the $V_{1P}$, and the $V_{2P}$ satisfy the following expressions (1) and (2).

$$2 \leq \{(V_{2P}/V_T)/(V_{1P}/V_T)\} \times 100 \leq 25 \quad (1)$$

$$15 \leq \{(V_{1P}/V_T)+(V_{2P}/V_T)\} \times 100 \leq 45 \quad (2)$$

According to another aspect of the present invention, there is provided an electrophotographic photosensitive member, including: a support; a conductive layer formed on the support; and a photosensitive layer formed on the conductive layer, in which: the conductive layer contains a titanium oxide particle coated with tin oxide doped with tungsten, a tin oxide particle doped with tungsten, and a binding material; and when a total volume of the conductive layer is represented by $V_T$, a total volume of the titanium oxide particle coated with tin oxide doped with tungsten in the conductive layer is represented by $V_{1W}$, and a total volume of the tin oxide particle doped with tungsten in the conductive layer is represented by $V_{2W}$, the $V_T$, the $V_{1W}$, and the $V_{2W}$ satisfy the following expressions (6) and (7).

$$2 \leq \{(V_{2W}/V_T)/(V_{1W}/V_T)\} \times 100 \times 25 \quad (6)$$

$$15 \times \{(V_{1W}/V_T)+(V_{2W}/V_T)\} \times 100 \leq 45 \quad (7)$$

According to still another aspect of the present invention, there is provided an electrophotographic photosensitive member, including: a support; a conductive layer formed on the support; and a photosensitive layer formed on the conductive layer, in which: the conductive layer contains a titanium oxide particle coated with tin oxide doped with fluorine, a tin oxide particle doped with fluorine, and a binding material; and when a total volume of the conductive layer is represented by $V_T$, a total volume of the titanium oxide particle coated with tin oxide doped with fluorine in the conductive layer is represented by $V_{1F}$, and a total volume of the tin oxide particle doped with fluorine in the conductive layer is represented by $V_{2F}$, the $V_T$, the $V_{1F}$, and the $V_{2F}$ satisfy the following expressions (11) and (12).

$$2 \leq \{(V_{2F}/V_T)/(V_{1F}/V_T)\} \times 100 \times 25 \quad (11)$$

$$15 \leq \{(V_{1F}/V_T)+(V_{2F}/V_T)\} \times 100 \leq 45 \quad (12)$$

According to still another aspect of the present invention, there is provided an electrophotographic photosensitive member, including: a support; a conductive layer formed on the support; and a photosensitive layer formed on the conductive layer, in which: the conductive layer contains a titanium oxide particle coated with tin oxide doped with niobium, a tin oxide particle doped with niobium, and a binding material; and when a total volume of the conductive layer is represented by $V_T$, a total volume of the titanium oxide particle coated with tin oxide doped with niobium in the conductive layer is represented by $V_{1Nb}$, and a total volume of the tin oxide particle doped with niobium in the conductive layer is represented by $V_{2Nb}$, the $V_T$, the $V_{1Nb}$, and the $V_{2Nb}$ satisfy the following expressions (16) and (17).

$$2 \leq \{(V_{2Nb}/V_T)/V_{1Nb}/V_T)\} \times 100 \leq 25 \quad (16)$$

$$15 \leq \{(V_{1Nb}/V_T)+(V_{2Nb}/V_T)\} \times 100 \leq 45 \quad (17)$$

According to still another aspect of the present invention, there is provided an electrophotographic photosensitive member, including: a support; a conductive layer formed on the support; and a photosensitive layer formed on the conductive layer, in which: the conductive layer contains a titanium oxide particle coated with tin oxide doped with tantalum, a tin oxide particle doped with tantalum, and a binding material; and when a total volume of the conductive layer is represented by $V_T$, a total volume of the titanium oxide particle coated with tin oxide doped with tantalum in the conductive layer is represented by $V_{1Ta}$, and a total volume of the tin oxide particle doped with tantalum in the conductive layer is represented by $V_{2Ta}$, the $V_T$, the $V_{1Ta}$, and the $V_{2Ta}$ satisfy the following expressions (21) and (22).

$$2 \leq \{(V_{2Ta}/V_T)/(V_{1Ta}/V_T)\} \times 100 \leq 25 \quad (21)$$

$$15 \leq \{(V_{1Ta}/V_T)+(V_{2Ta}/V_T)\} \times 100 \leq 45 \quad (22)$$

According to still another aspect of the present invention, there is provided a process cartridge detachably mountable to a main body of an electrophotographic apparatus, in which the process cartridge integrally supports: the above-described electrophotographic photosensitive member; and at least one device selected from the group consisting of a charging device, a developing device, a transferring device, and a cleaning device.

According to still another aspect of the present invention, there is provided an electrophotographic apparatus, including: the above-described electrophotographic photosensitive member; a charging device; an exposing device; a developing device; and a transferring device.

Advantageous Effects of Invention

According to the present invention, there is provided the electrophotographic photosensitive member in which a residual potential hardly increases at the time of image formation, a pattern memory hardly occurs, and the crack of a conductive layer hardly occurs, and the process cartridge and the electrophotographic apparatus each including the electrophotographic photosensitive member.

Further features of the present invention will become apparent from the following description of exemplary embodiments with reference to the attached drawings.

DESCRIPTION OF EMBODIMENTS

Figure 1:
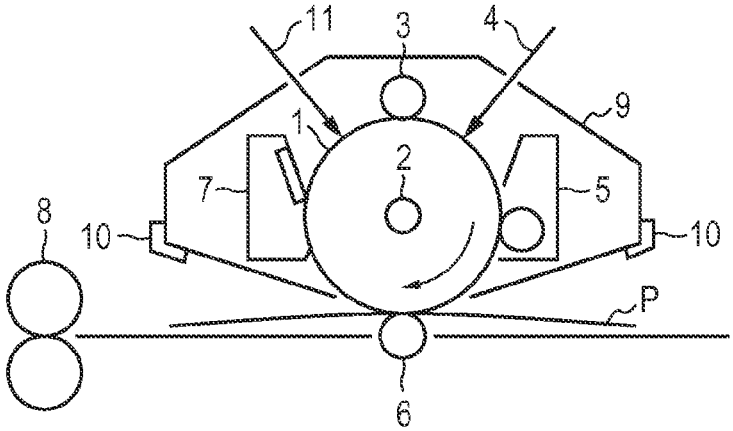
FIG. 1 is a view illustrating an example of the schematic construction of an electrophotographic apparatus including a process cartridge having an electrophotographic photosensitive member of the present invention.

An electrophotographic photosensitive member of the present invention is an electrophotographic photosensitive member including a support, a conductive layer formed on the support, and a photosensitive layer formed on the conductive layer.

The photosensitive layer may be a single-layer type photosensitive layer obtained by incorporating a charge-generating substance and a charge-transporting substance into a single layer, or may be a laminated type photosensitive layer obtained by laminating a charge-generating layer containing a charge-generating substance and a charge-transporting layer containing a charge-transporting substance. In addition, an undercoat layer may be provided between the conductive layer and photosensitive layer to be formed on the support as required.

A support having electro-conductivity (conductive support) is preferred as the support, and for example, a metal support formed of a metal such as aluminum, an aluminum alloy, or stainless steel can be used. When aluminum or an aluminum alloy is used, an aluminum tube produced by a production method including an extrusion process and a drawing process, or an aluminum tube produced by a production method including an extrusion process and an ironing process can be used. Such aluminum tube provides good dimensional accuracy and good surface smoothness without the cutting of its surface, and is advantageous in terms of cost. However, burr-like protruding defects are liable to occur on the uncut surface of the aluminum tube. Accordingly, it is particularly effective to provide the conductive layer.

In the electrophotographic photosensitive member of the present invention, any one of the following combinations of metal oxide particles as well as a binding material is used in the conductive layer to be formed on the support:

(p) a titanium oxide particle coated with tin oxide doped with phosphorus and a tin oxide particle doped with phosphorus;

(w) a titanium oxide particle coated with tin oxide doped with tungsten and a tin oxide particle doped with tungsten;

(f) a titanium oxide particle coated with tin oxide doped with fluorine and a tin oxide particle doped with fluorine;

(nb) a titanium oxide particle coated with tin oxide doped with niobium and a tin oxide particle doped with niobium; and (ta) a titanium oxide particle coated with tin oxide doped with tantalum and a tin oxide particle doped with tantalum.

One of the features lies in that in each of the combinations (p), (w), (f), (nb), and (ta) of metal oxide particles, phosphorus (P), tungsten (W), fluorine (F), niobium (Nb), or tantalum (Ta) is common to the element with which tin oxide is doped. It should be noted that the titanium oxide particles are particles of titanium oxide ($TiO_2$) and the tin oxide particles are particles of tin oxide ($SnO_2$).

Hereinafter, the titanium oxide particle coated with tin oxide doped with phosphorus is also represented as "P-doped tin oxide-coated titanium oxide particles" and the tin oxide particle doped with phosphorus is also represented as "P-doped tin oxide particles." In addition, the titanium oxide particle coated with tin oxide doped with tungsten is also represented as "W-doped tin oxide-coated titanium oxide particles" and the tin oxide particle doped with tungsten is also represented as "W-doped tin oxide particles." In addition, the titanium oxide particle coated with tin oxide doped with fluorine is also represented as "F-doped tin oxide-coated titanium oxide particles" and the tin oxide particle doped with fluorine is also represented as "F-doped tin oxide particles." In addition, the titanium oxide particle coated with tin oxide doped with niobium is also represented as "Nb-doped tin oxide-coated titanium oxide particles" and the tin oxide particle doped with niobium is also represented as "Nb-doped tin oxide particles." In addition, the titanium oxide particle coated with tin oxide doped with tantalum is also represented as "Ta-doped tin oxide-coated titanium oxide particles" and the tin oxide particle doped with tantalum is also represented as "Ta-doped tin oxide particles."

Further, in the electrophotographic photosensitive member of the present invention, in the case where the combination of metal oxide particles to be incorporated into the conductive layer is the combination (p), when the total volume of the conductive layer is represented by $V_T$, the volume of the P-doped tin oxide-coated titanium oxide particles in the conductive layer is represented by $V_{1P}$, and the volume of the P-doped tin oxide particles in the conductive layer is represented by $V_{2P}$, $V_T$, $V_{1P}$, and $V_{2P}$ satisfy the following expressions (1) and (2).

$$2 \leq \{(V_{2P}/V_T)/(V_{1P}/V_T)\} \times 100 \leq 25 \quad (1)$$

$$15 \times \{(V_{1P}/V_T)+(V_{2P}/V_T)\} \times 100 \leq 45 \quad (2)$$

Further, in the case where the combination of metal oxide particles to be incorporated into the conductive layer is the combination (w), when the total volume of the conductive layer is represented by $V_T$, the volume of the W-doped tin oxide-coated titanium oxide particles in the conductive layer is represented by $V_{1W}$, and the volume of the W-doped tin oxide particles in the conductive layer is represented by $V_{2W}$, $V_T$, $V_{1W}$, and $V_{2W}$ satisfy the following expressions (6) and (7).

$$2 \times \{(V_{2W}/V_T)/(V_{1W}/V_T)\} \times 100 \leq 25 \quad (6)$$

$$15 \leq \{(V_{1W}/V_T)+(V_{2W}/V_T)\} \times 100 \leq 45 \quad (7)$$

Further, in the case where the combination of metal oxide particles to be incorporated into the conductive layer is the combination (f), when the total volume of the conductive layer is represented by $V_T$, the volume of the F-doped tin oxide-coated titanium oxide particles in the conductive layer is represented by $V_{1F}$, and the volume of the F-doped tin oxide particles in the conductive layer is represented by $V_{2F}$, $V_T$, $V_{1F}$, and $V_{2F}$ satisfy the following expressions (11) and (12).

$$2 \leq \{(V_{2F}/V_T)/(V_{1F}/V_T)\} \times 100 \leq 25 \quad (11)$$

$$15 \leq \{(V_{1F}/V_T)+(V_{2F}/V_T)\} \times 100 \leq 45 \quad (12)$$

Further, in the case where the combination of metal oxide particles to be incorporated into the conductive layer is the combination (nb), when the total volume of the conductive layer is represented by $V_T$, the volume of the Nb-doped tin oxide-coated titanium oxide particles in the conductive layer is represented by $V_{1Nb}$, and the volume of the Nb-doped tin oxide particles in the conductive layer is represented by $V_{2Nb}$, $V_T$, $V_{1Nb}$, and $V_{2Nb}$ satisfy the following expressions (16) and (17).

$$2 \leq \{(V_{2Nb}/V_T)/(V_{1Nb}/V_T)\} \times 100 \leq 25 \quad (16)$$

$$15 \leq \{(V_{1Nb}/V_T)+(V_{2Nb}/V_T)\} \times 100 \leq 45 \quad (17)$$

Further, in the case where the combination of metal oxide particles to be incorporated into the conductive layer is the combination (ta), when the total volume of the conductive layer is represented by $V_T$, the volume of the Ta-doped tin oxide-coated titanium oxide particles in the conductive layer is represented by $V_{1Ta}$, and the volume of the Ta-doped tin oxide particles in the conductive layer is represented by $V_{2Ta}$, $V_T$, $V_{1Ta}$, and $V_{2Ta}$ satisfy the following expressions (21) and (22).

$$2 \leq \{(V_{2Ta}/V_T)/(V_{1Ta}/V_T)\} \times 100 \times 25 \quad (21)$$

$$15 \leq \{(V_{1Ta}/V_T)+(V_{2Ta}/V_T)\} \times 100 \leq 45 \quad (22)$$

Hereinafter, $V_{1P}$, $V_{1W}$, $V_{1F}$, $V_{1Nb}$, and $V_{1Ta}$ are also collectively represented as "$V_1$," and $V_{2P}$, $V_{2W}$, $V_{2F}$, $V_{2Nb}$, and $V_{2Ta}$ are also collectively represented as "$V_2$." In addition, the P-doped tin oxide-coated titanium oxide particles, the W-doped tin oxide-coated titanium oxide particles, the F-doped tin oxide-coated titanium oxide particles, the Nb-doped tin oxide-coated titanium oxide particles, and the Ta-doped tin oxide-coated titanium oxide particles are also collectively represented as "a first metal oxide particle," and the P-doped tin oxide particles, the W-doped tin oxide particles, the F-doped tin oxide particles, the Nb-doped tin oxide particles, and the Ta-doped tin oxide particles are also collectively represented as "a second metal oxide particle."

The inventors of the present invention have made extensive studies to suppress the occurrence of a pattern memory. As a result, the inventors have found that the pattern memory is suppressed by the formation of a good electro-conductive path over a wide range in the conductive layer, in other words, uniform movement of charge in the conductive layer. This is probably because local retention or storage of the charge in the conductive layer hardly occurs. However, the retention or storage of the charge may not largely correlate with the volume resistivity or electric resistance of the conductive layer because the retention or storage is a local phenomenon. The formation of a good electro-conductive path in the conductive layer for suppressing the pattern memory requires the formation of an electro-conductive path that passes both the first metal oxide particle and the second metal oxide particle. To this end, the following necessity may arise for suppressing the occurrence of the pattern memory: instead of the formation of the conductive layer containing only the first metal oxide particle or the conductive layer containing only the second metal oxide particle, the first metal oxide particle and the second metal oxide particle are caused to exist in the conductive layer at a certain ratio, and then an electro-conductive path that passes both the first metal oxide particle and the second metal oxide particle is formed. That is, it may be necessary to satisfy the expression (1), (6), (11), (16), or (21). When the value for $\{(V_2/V_T)/(V_1/V_T)\} \times 100$ is less than 2, the ratio of the amount of the second metal oxide particle to the amount of the first metal oxide particle becomes insufficient. Accordingly, it is assumed that the situation becomes close to that in the case of the conductive layer containing only the first metal oxide particle and hence an electro-conductive path good for suppressing the occurrence of the pattern memory cannot be formed. On the other hand, when the value for $\{(V_2/V_T)/(V_1/V_T)\} \times 100$ is more than 25, the ratio of the amount of the second metal oxide particle to the amount of the first metal oxide particle becomes excessive. Accordingly, it is assumed that the situation becomes close to that in the case of the conductive layer containing only the second metal oxide particle and hence an electro-conductive path good for suppressing the occurrence of the pattern memory cannot be formed. When the following expression (3), (8), (13), (18), or (23) is satisfied, a suppressing effect on the occurrence of the pattern memory becomes additionally significant because the ratio between the first metal oxide particle and the second metal oxide particle becomes the ratio at which an electro-conductive path additionally good for suppressing the occurrence of the pattern memory can be formed.

$$5 \leq \{(V_{2P}/V_T)/(V_{1P}/V_T)\} \times 100 \leq 20 \quad (3)$$

$$5 \leq \{(V_{2W}/V_T)/(V_{1W}/V_T)\} \times 100 \leq 20 \quad (8)$$

$$5 \leq \{(V_{2F}/V_T)/(V_{1F}/V_T)\} \times 100 \leq 20 \quad (13)$$

$$5 \leq \{(V_{2Nb}/V_T)/(V_{1Nb}/V_T)\} \times 100 \leq 20 \quad (18)$$

$$5 \leq \{(V_{2Ta}/V_T)/(V_{1Ta}/V_T)\} \times 100 \leq 20 \quad (23)$$

In addition, the formation of the electro-conductive path that passes the first metal oxide particle and the second metal oxide particle in the conductive layer may require that the sum of the contents of the first metal oxide particle and a second metal oxide particle in the conductive layer fall within a certain range. That is, it may be necessary to satisfy the expression (2), (7), (12), (17), or (22). When the value for $\{(V_1+V_2)/V_T\} \times 100$ is less than 15, the retention or storage of the charge in the conductive layer is liable to occur and hence an increase in residual potential is liable to be large in the case of repeated use of the electrophotographic photosensitive member. The value for $\{(V_1+V_2)/V_T\} \times 100$ is more preferably 20 or more. On the other hand, when the value for $\{(V_1+V_2)/V_T\} \times 100$ is more than 45, the amount of the binding material becomes relatively small and hence a crack is liable to occur in the conductive layer. The value for $\{(V_1+V_2)/V_T\} \times 100$ is more preferably 40 or less. That is, the following expression (4), (9), (14), (19), or (24) is more preferably satisfied.

$$20 \leq \{(V_{1P}/V_T)+(V_{2P}/V_T)\} \times 100 \leq 40 \quad (4)$$

$$20 \leq \{(V_{1W}/V_T)+(V_{2W}/V_T)\} \times 100 \leq 40 \quad (9)$$

$$20 \leq \{(V_{1F}/V_T)+(V_{2F}/V_T)\} \times 100 \leq 40 \quad (14)$$

$$20 \leq \{(V_{1Nb}/V_T)+(V_{2Nb}/V_T)\} \times 100 \leq 40 \quad (19)$$

$$20 \leq \{(V_{1Ta}/V_T)+(V_{2Ta}/V_T)\} \times 100 \leq 40 \quad (24)$$

As described above, it is necessary to satisfy the expressions (1) and (2) simultaneously, to satisfy the expressions (6) and (7) simultaneously, to satisfy the expressions (11) and (12) simultaneously, to satisfy the expressions (16) and (17) simultaneously, or to satisfy the expressions (21) and (22) simultaneously for obtaining an electrophotographic photosensitive member in which a residual potential hardly increases at the time of image formation, a pattern memory hardly occurs, and the crack of a conductive layer hardly occurs.

With regard to the present invention, in the case where the combination of the metal oxide particles to be incorporated into the conductive layer is, for example, a combination of a titanium oxide particle coated with tin oxide doped with antimony and a tin oxide particle doped with antimony, or a combination of titanium oxide particles coated with oxygen-deficient tin oxide and oxygen-deficient tin oxide particles, the suppressing effect on the occurrence of the pattern memory deteriorates as compared with that in the case where the combination of the metal oxide particles to be incorporated into the conductive layer is the combination (p), (w), (f), (nb), or (ta).

In addition, even when a species (dopant) to be doped into tin oxide is phosphorus, tungsten, fluorine, niobium, or tantalum, in the case where a species to be doped into tin oxide of the first metal oxide particle and a species to be doped into tin oxide of the second metal oxide particle differ from each other such as the case where the combination of the metal oxide particles to be incorporated into the conductive layer is a combination of a titanium oxide particle coated with tin oxide doped with phosphorus and a tin oxide particle doped with tungsten, the suppressing effect on the occurrence of the pattern memory similarly deteriorates as compared with that in the case of the combination (p), (w), (f), (nb), or (ta) in which the species to be doped are identical to each other. This is probably because of the following reason: when the species to be doped into tin oxide of the first metal oxide particle and the species to be doped into tin oxide of the second metal oxide particle are identical to each other, the electrical properties, surface properties, and work functions of the first metal oxide particle and a second metal oxide particle become physical properties closest to each other in a comprehensive manner, and hence it becomes easy for the charge to move uniformly in the conductive layer.

In addition, in the case where the combination of the metal oxide particles to be incorporated into the conductive layer is the combination (p), when the abundance ratio of phosphorus to tin oxide in the P-doped tin oxide-coated titanium oxide particles is represented by $R_{1P}$ [atom %] and the abundance ratio of phosphorus to tin oxide in the P-doped tin oxide particles is represented by $R_{2P}$ [atom %], the following expression (5) is preferably satisfied.

$$0.9 \leq R_{2P}/R_{1P} \leq 1.1 \quad (5)$$

In addition, in the case where the combination of the metal oxide particles to be incorporated into the conductive layer is the combination (w), when the abundance ratio of tungsten to tin oxide in the W-doped tin oxide-coated titanium oxide particles is represented by $R_{1W}$ [atom %] and the abundance ratio of tungsten to tin oxide in the W-doped tin oxide particles is represented by $R_{2W}$ [atom %], the following expression (10) is preferably satisfied.

$$0.9 \leq R_{2W}/R_{1W} \leq 1.1 \quad (10)$$

In addition, in the case where the combination of the metal oxide particles to be incorporated into the conductive layer is the combination (f), when the abundance ratio of fluorine to tin oxide in the F-doped tin oxide-coated titanium oxide particles is represented by $R_{1F}$ [atom %] and the abundance ratio of fluorine to tin oxide in the F-doped tin oxide particles is represented by $R_{2F}$ [atom %], the following expression (15) is preferably satisfied.

$$0.9 \leq R_{2F}/R_{1F} \leq 1.1 \quad (15)$$

In addition, in the case where the combination of the metal oxide particles to be incorporated into the conductive layer is the combination (nb), when the abundance ratio of niobium to tin oxide in the Nb-doped tin oxide-coated titanium oxide particles is represented by $R_{1Nb}$ [atom %] and the abundance ratio of niobium to tin oxide in the Nb-doped tin oxide particles is represented by $R_{2Nb}$ [atom %], the following expression (20) is preferably satisfied.

$$0.9 \leq R_{2Nb}/R_{1Nb} \leq 1.1 \quad (20)$$

In addition, in the case where the combination of the metal oxide particles to be incorporated into the conductive layer is the combination (ta), when the abundance ratio of tantalum to tin oxide in the Ta-doped tin oxide-coated titanium oxide particles is represented by $R_{1Ta}$ [atom %] and the abundance ratio of tantalum to tin oxide in the Ta-doped tin oxide particles is represented by $R_{2Ta}$ [atom %], the following expression (25) is preferably satisfied.

$$0.9 \leq R_{2Ta}/R_{1Ta} \leq 1.1 \quad (25)$$

Hereinafter, $R_{1P}$, $R_{1W}$, $R_{1F}$, $R_{1Nb}$, and $R_{1Ta}$ are also collectively represented as "$R_1$," and $R_{2P}$, $R_{2W}$, $R_{2F}$, $R_{2Nb}$, and $R_{2Ta}$ are also collectively represented as "$R_2$."

As represented by the expression (5), (10), (15), (20), or (25), the abundance ratios of phosphorus, tungsten, fluorine, niobium, or tantalum in tin oxide of the first metal oxide particle and tin oxide of the second metal oxide particle are preferably as close as possible to each other. In other words, the ratio $R_2/R_1$ is preferably as close as possible to 1.0, and specifically, the ratio is preferably 0.9 or more and 1.1 or less. When the ratio $R_2/R_1$ is 0.9 or more and 1.1 or less, an electro-conductive path additionally good for suppressing the occurrence of the pattern memory is formed and hence the suppressing effect on the occurrence of the pattern memory becomes additionally significant.

The measurement of $R_1$ and $R_2$ can be performed by STEM-EDX after taking out the conductive layer of the electrophotographic photosensitive member according to an FIB method. In addition, the measurement of $V_1$ and $V_2$ can be performed by the slice and view of an FIB-SEM after taking out the conductive layer of the electrophotographic photosensitive member according to the FIB method.

First, the measurement of $R_1$ and $R_2$ is described.

Sampling for the STEM-EDX analysis was performed as described below.

The sampling is performed with a supporting base made of copper (Cu) by an FIB-μ sampling method. An apparatus used by the inventors of the present invention is an FB-2000A μ-Sampling System (trade name) manufactured by Hitachi High-Technologies Corporation. The sampling was performed so that the horizontal and longitudinal sizes of a sample became such sizes that a measurement range could be secured, and the thickness of the sample became 150 nm.

The STEM-EDX analysis was performed as described below.

The inventors of the present invention have performed the analysis with a field emission electron microscope (HRTEM) (trade name: JEM2100F) manufactured by JEOL Ltd. and a JED-2300T (trade name) (having a resolution of 133 eV or less) (energy dispersive X-ray spectroscopy) manufactured by JEOL Ltd. as an EDX portion.

Analysis conditions were set as described below.

System: Analysis Station

Image acquisition: Digital Micrograph

Measurement conditions: Acceleration voltage: 200 kV, beam diameter (diameter): 1.0 nm, measurement time: 50 seconds (in point analysis) and 40 minutes (in area analysis)

The measurement range measured 3.6 μm long by 3.4 μm wide by 150 nm thick.

The abundance ratio of phosphorus to tin oxide in the P-doped tin oxide particles, the abundance ratio of phosphorus to tin oxide in the P-doped tin oxide-coated titanium oxide particles, the abundance ratio of tungsten to tin oxide in the W-doped tin oxide particles, the abundance ratio of tungsten to tin oxide in the W-doped tin oxide-coated titanium oxide particles, the abundance ratio of fluorine to tin oxide in the F-doped tin oxide particles, the abundance ratio of fluorine to tin oxide in the F-doped tin oxide-coated titanium oxide particles, the abundance ratio of niobium to tin oxide in the Nb-doped tin oxide particles, the abundance ratio of niobium to tin oxide in the Nb-doped tin oxide-coated titanium oxide particles, the abundance ratio of tantalum to tin oxide in the Ta-doped tin oxide particles, or the abundance ratio of tantalum to tin oxide in the Ta-doped tin oxide-coated titanium oxide particles can be determined from an atomic ratio because the identification of an element can be performed by the STEM-EDX.

The sampling was similarly performed ten times to provide ten samples, followed by the measurement. The average of a total of ten $R_1$'s and the average of a total of ten $R_2$'s were each defined as a value for $R_1$ or $R_2$ in the conductive layer of the electrophotographic photosensitive member as a measuring object.

Next, the measurement of the ratios ($V_1/V_T$) and ($V_2/V_T$) is described.

The volume of the P-doped tin oxide-coated titanium oxide particles and the volume of the P-doped tin oxide particles, and their ratios in the conductive layer can be determined by identifying tin oxide doped with phosphorus and titanium oxide based on their difference in contrast of the slice and view of the FIB-SEM. When the species to be doped into tin oxide is an element except phosphorus such as tungsten, fluorine, niobium, or tantalum, the volumes and the ratios in the conductive layer can be similarly determined.

Conditions for the slice and view in the present invention were set as described below.

Sampling for analysis: FIB method

Processing and observation apparatus: NVision 40 manufactured by SII-Zeiss

Slice interval: 10 nm

Observation conditions:

Acceleration voltage: 1.0 kV

Sample tilt: 54°

WD: 5 mm

Detector: BSE detector

Aperture: 60 μm, high current

ABC: ON

Image resolution: 1.25 nm/pixel

The analysis is performed in a region measuring 2 μm wide by 2 μm long, information on each cross-section is integrated, and the volumes $V_1$ and $V_2$ per space measuring 2 μm wide by 2 μm long by 2 μm thick ($V_T$=8 $\mu m^3$) are determined. In addition, the measurement is performed under an environment having a temperature of 23° C. and a pressure of $1\times10^{-4}$ Pa. It should be noted that a Strata 400S (sample tilt: 52°) manufactured by FEI Company can also be used as a processing and observation apparatus.

The sampling was similarly performed ten times to provide ten samples, followed by the measurement. A value obtained by dividing the average of a total of ten volumes $V_1$ per 8 $\mu m^3$ by $V_T$ (8 $\mu m^3$) was defined as the ratio ($V_1/V_T$) in the conductive layer of the electrophotographic photosensitive member as a measuring object. In addition, a value obtained by dividing the average of a total of ten volumes $V_2$ per 8 $\mu m^3$ by $V_T$ (8 $\mu m^3$) was defined as a value for the ratio ($V_2/V_T$) in the conductive layer of the electrophotographic photosensitive member as a measuring object.

It should be noted that the areas of identified tin oxide doped with phosphorus and titanium oxide were obtained from the information on each cross-section through image analysis. The image analysis was performed with the following image processing software.

Image processing software: Image-Pro Plus manufactured by Media Cybernetics

Of the metal oxide particles to be used in the present invention, the first metal oxide particle has a coating layer constituted of tin oxide doped with phosphorus, tungsten, fluorine, niobium, or tantalum, and a core particle constituted of titanium oxide. In addition, the first metal oxide particle is such a structure that the core particle is coated with the coating layer.

The ratio (coating ratio) of tin oxide ($SnO_2$) in the first metal oxide particle to be used in the present invention is preferably 10 to 60% by mass. A tin raw material needed for producing tin oxide ($SnO_2$) needs to be blended at the time of the production of the first metal oxide particle for controlling the coating ratio of tin oxide ($SnO_2$). For example, when tin chloride ($SnCl_4$) as a tin raw material is used, the blending needs to be performed in consideration of the amount of tin oxide ($SnO_2$) to be produced from tin chloride ($SnCl_4$). Although tin oxide ($SnO_2$) constituting the coating layer of each of the first metal oxide particle to be used in the present invention is doped with phosphorus (P), tungsten (W), fluorine (F), niobium (Nb), or tantalum (Ta), the coating ratio is a value calculated from the mass of tin oxide ($SnO_2$) with respect to the total mass of tin oxide ($SnO_2$) and titanium oxide ($TiO_2$) without any consideration of the mass of phosphorus (P), tungsten (W), fluorine (F), niobium (Nb), or tantalum (Ta) with which tin oxide ($SnO_2$) is doped.

In addition, it is preferred that tin oxide ($SnO_2$) in the first metal oxide particle or a second metal oxide particle be doped with phosphorus (P), tungsten (W), fluorine (F), niobium (Nb), or tantalum (Ta) in an amount (doping ratio) of 0.1 to 10 mass % with respect to tin oxide ($SnO_2$) (in terms of mass of the tin oxide containing no phosphorus (P), tungsten (W), fluorine (F), niobium (Nb), and tantalum (Ta)).

It should be noted that a method of producing the first metal oxide particle (P-doped tin oxide-coated titanium oxide particles, W-doped tin oxide-coated titanium oxide particles, F-doped tin oxide-coated titanium oxide particles, Nb-doped tin oxide-coated titanium oxide particles, or Ta-doped tin oxide-coated titanium oxide particles) is also disclosed in Japanese Patent Application Laid-Open No. H06-207118 and Japanese Patent Application Laid-Open No. 2004-349167.

In addition, a method of producing the second metal oxide particle (P-doped tin oxide particles, W-doped tin oxide particles, F-doped tin oxide particles, Nb-doped tin oxide particles, or Ta-doped tin oxide particles) is also disclosed in Japanese Patent No. 3365821, Japanese Patent Application Laid-Open No. H02-197014, Japanese Patent Application Laid-Open No. H09-278445, and Japanese Patent Application Laid-Open No. H10-53417.

A particulate shape, a spherical shape, a needle shape, a fibrous shape, a columnar shape, a rod shape, a spindle shape, a plate shape, and other analogous shapes can each be used as the shape of a titanium oxide ($TiO_2$) particle as the core particle in each of the first metal oxide particle to be used in the present invention. Of those, a spherical shape is preferred from such a viewpoint that an image defect such as a black spot hardly occurs.

In addition, any one of the crystal forms such as rutile, anatase, brookite, and amorphous forms can be used as the crystal form of the titanium oxide ($TiO_2$) particle as the core particle in each of the first metal oxide particle to be used in the present invention. In addition, any one of the production methods such as a sulfuric acid method and a hydrochloric acid method can be adopted as the production method.

In the present invention, a first reason why the first metal oxide particle having the core particles (titanium oxide ($TiO_2$) particles) are used is as described below. Tin oxide ($SnO_2$) constituting the coating layer of each of the first metal oxide particle has higher electro-conductivity than that of titanium oxide ($TiO_2$) constituting each core particle and charge received by the second metal oxide particle containing tin oxide ($SnO_2$) propagates mainly through the coating layer containing tin oxide ($SnO_2$) in each of the first metal oxide particle, i.e., the transfer of the charge between tin oxide ($SnO_2$) is mainly performed, and hence the transfer of the charge between the first metal oxide particle and the second metal oxide particle becomes smooth, and the charge uniformly moves in the conductive layer.

A second reason why the first metal oxide particle having the core particles (titanium oxide ($TiO_2$) particles) are used is that an improvement in dispersibility of the second metal oxide particle in a conductive-layer coating solution is achieved. When the second metal oxide particle is used without the use of the first metal oxide particle, the aggregation of the second metal oxide particle is liable to occur in the conductive-layer coating solution to enlarge their average particle diameter, and hence protrusive seeding defects occur in the surface of the conductive layer to be formed or the stability of the conductive-layer coating solution reduces in some cases. In addition, the suppressing effect on the pattern memory is not sufficiently obtained.

A third reason why the first metal oxide particle having the core particles (titanium oxide ($TiO_2$) particles) are used is that the titanium oxide ($TiO_2$) particles as the core particles of the first metal oxide particle each have low transparency as a particle and hence easily cover defects in the surface of the support. In contrast, for example, when barium sulfate particles are used as the core particles, the particles each have high transparency as a particle and hence a material for covering the defects in the surface of the support may be separately needed.

The particle diameter of each of the titanium oxide ($TiO_2$) particles as the core particles of the first metal oxide particle to be used in the present invention is preferably 0.05 μm or more and 0.40 μm or less from the viewpoint of adjusting the average particle diameter of the first metal oxide particle to a preferred range to be described later.

The powder resistivity of the first metal oxide particle to be used in the present invention is preferably $1.0\times10^1$ Ω·cm or more and $1.0\times10^6$ Ω·cm or less, more preferably $1.0\times10^2$ Ω·cm or more and $1.0\times10^5$ Ω·cm or less.

The powder resistivity of the second metal oxide particle to be used in the present invention is preferably $1.0\times10^0$ Ω·cm or more and $1.0\times10^5$ Ω·cm or less, more preferably $1.0\times10^1$ Ω·cm or more and $1.0\times10^4$ Ω·cm or less.

The powder resistivity of the first metal oxide particle to be used in the present invention is preferably lower than the powder resistivity of the titanium oxide ($TiO_2$) particles as the core particles of the first metal oxide particle.

A method of measuring the powder resistivity of metal oxide particles such as the first metal oxide particle or a second metal oxide particle to be used in the present invention is as described below.

The powder resistivity of metal oxide particles such as the first metal oxide particle or a second metal oxide particle to be used in the present invention, or of the core particles of composite particles like the first metal oxide particle to be used in the present invention is measured under a normal-temperature and normal-humidity (23° C./50% RH) environment. In the present invention, a resistivity meter manufactured by Mitsubishi Chemical Corporation (trade name: Loresta GP (Hiresta UP when the powder resistivity exceeded $1.0\times10^7$ Ω·cm)) was used as a measuring apparatus. The metal oxide particles as measuring objects are compressed into a pellet-shaped sample for measurement at a pressure of 500 kg/cm$^2$. A voltage of 100 V is applied. The core particles are subjected to the measurement before the formation of the coating layer.

The conductive layer can be formed by applying the conductive-layer coating solution containing a solvent, the binding material, and the first metal oxide particle and the second metal oxide particle onto the support, and drying and/or curing the resultant coating film.

The conductive-layer coating solution can be prepared by dispersing the first metal oxide particle and the second metal oxide particle together with the binding material into the solvent. As a dispersion method, there are given, for example, methods using a paint shaker, a sand mill, a ball mill, and a liquid collision type high-speed disperser.

Examples of the binding material to be used in the conductive layer include resins such as a phenol resin, polyurethane, polyamide, polyimide, polyamide-imide, polyvinyl acetal, an epoxy resin, an acrylic resin, a melamine resin, and polyester. The resins may be used alone or in combination of two or more kinds thereof. Further, of those resins, from the viewpoints of, for example, suppression of migration (dissolution) into another layer, adhesiveness with the support, dispersibility and dispersion stability of the particles of the present invention, and solvent resistance after layer formation, a curable resin is preferred, and a thermosetting resin is more preferred. Further, of the thermosetting resins, a thermosetting phenol resin and thermosetting polyurethane are preferred. In the case of using the curable resin as the binding material in the conductive layer, the binding material to be contained in the conductive-layer coating solution is a monomer and/or an oligomer of the curable resin.

Examples of the solvent to be used in the conductive-layer coating solution include alcohols such as methanol, ethanol, and isopropanol, ketones such as acetone, methyl ethyl ketone, and cyclohexanone, ethers such as tetrahydrofuran, dioxane, ethylene glycol monomethyl ether, and propylene glycol monomethyl ether, esters such as methyl acetate and ethyl acetate, and aromatic hydrocarbons such as toluene and xylene.

In addition, a surface roughness providing material for roughening the surface of the conductive layer may be incorporated into the conductive-layer coating solution in order to suppress the occurrence of interference fringes on an output image due to the interference of light reflected at the surface of the conductive layer. Resin particles having an average particle diameter of 1 μm or more and 5 μm or less are preferred as the surface roughness providing material.

Examples of the resin particles include particles of curable resins such as a curable rubber, a polyurethane, an epoxy resin, an alkyd resin, a phenol resin, a polyester, a silicone resin, and an acryl-melamine resin. Of those, particles of a silicone resin that hardly aggregate are preferred. The density (0.5 to 2 g/cm$^3$) of the resin particles is small as compared with the densities (4 to 8 g/cm$^3$) of the first metal oxide particle and a second metal oxide particle to be used in the present invention, and hence the surface of the conductive layer can be efficiently roughened at the time of the formation of the conductive layer. In this regard, however, when the content of the surface roughness providing material in the conductive layer increases, the volume resistivity of the conductive layer tends to increase in some cases. Accordingly, the content of the surface roughness providing material in the conductive-layer coating solution is preferably 1 to 80% by mass with respect to the binding material in the conductive-layer coating solution for adjusting the volume resistivity of the conductive layer to $2.0\times10^{13}$ Ω·cm or less. In the present invention, the densities [g/cm$^3$] of the first metal oxide particle, the second metal oxide particle, the binding material (provided that when the binding material was liquid, a cured product thereof was subjected to the measurement), the silicone particles, and the like were determined with a dry auto-densimeter as described below. A helium gas purge was performed ten times as a pretreatment for particles as measuring objects at a temperature of 23° C. and a maximum pressure of 19.5 psig with a dry auto-densimeter manufactured by Shimadzu Corporation (trade name: Accupyc 1330) and a container having a capacity of 10 cm$^3$. After that, a fluctuation in pressure in a sample chamber of 0.0050 psig/min was used as a pressure equilibrium judgment value as to whether a pressure in the container reached equilibrium. When the fluctuation was equal to or less than the value, the pressure was defined as being in an equilibrium state and then the measurement was initiated to measure any such density [g/cm$^3$] automatically.

In addition, a leveling agent for improving the surface property of the conductive layer may be incorporated into the conductive-layer coating solution. In addition, pigment particles may be incorporated into the conductive-layer coating solution for additionally improving the coverage of the conductive layer.

In addition, the average particle diameter of the first metal oxide particle (P-doped tin oxide-coated titanium oxide particles, W-doped tin oxide-coated titanium oxide particles, F-doped tin oxide-coated titanium oxide particles, Nb-doped tin oxide-coated titanium oxide particles, or Ta-doped tin oxide-coated titanium oxide particles) in the conductive-layer coating solution is preferably 0.10 μm or more and 0.45 μm or less, more preferably 0.15 μm or more and 0.40 μm or less. When the average particle diameter is less than 0.10 μm, the reaggregation of the first metal oxide particle is liable to occur after the preparation of the conductive-layer coating solution and hence the stability of the conductive-layer coating solution may reduce. When the average particle diameter is more than 0.45 μm, the surface of the conductive layer roughens to promote the occurrence of local injection of charge into the photosensitive layer, and hence a black spot on the white background of an output image may become conspicuous.

In addition, the average particle diameter of the second metal oxide particle (P-doped tin oxide particles, W-doped tin oxide particles, F-doped tin oxide particles, Nb-doped tin oxide particles, or Ta-doped tin oxide particles) in the conductive-layer coating solution is preferably 0.01 μm or more and 0.45 μm or less, more preferably 0.01 μm or more and 0.10 μm or less.

The average particle diameters of metal oxide particles such as the first metal oxide particle and a second metal oxide particle in the conductive-layer coating solution can be determined by the following liquid phase sedimentation method or cross-sectional observation with an SEM.

First, the conductive-layer coating solution is diluted with the solvent used for its preparation so that its transmittance may fall within the range of 0.8 to 1.0. Next, a histogram of the average particle diameter (volume average particle diameter) and particle size distribution of the metal oxide particles is created with an ultracentrifugal automatic particle size distribution analyzer. In the present invention, the measurement was performed with an ultracentrifugal automatic particle size distribution analyzer (trade name: CAPA 700) manufactured by HORIBA, Ltd. as the ultracentrifugal automatic particle size distribution analyzer under the condition of a number of rotation of 3,000 rpm.

From the viewpoint of covering defects in the surface of the support, the thickness of the conductive layer is preferably 10 μm or more and 40 μm or less, more preferably 15 μm or more and 35 μm or less.

It should be noted that, in the present invention, as an apparatus for measuring the thickness of each layer of the electrophotographic photosensitive member including the conductive layer, FISHERSCOPE mms manufactured by Fisher Instruments K.K. was used.

The volume resistivity of the conductive layer is preferably $1.0\times10^{8}$ Ω·cm or more and $2.0\times10^{13}$ Ω·cm or less. When a layer having a volume resistivity of $2.0\times10^{13}$ Ω·cm or less is provided on the support as a layer for covering the defects in the surface of the support, the flow of charge is hardly disrupted at the time of image formation and hence a residual potential hardly increases. Meanwhile, when the volume resistivity of the conductive layer is $1.0\times10^{8}$ Ω·cm or more, the quantity of the charge flowing in the conductive layer at the time of the charging of the electrophotographic photosensitive member does not become excessively large and hence fogging due to an increase in dark attenuation of the electrophotographic photosensitive member hardly occurs.

Figure 2:
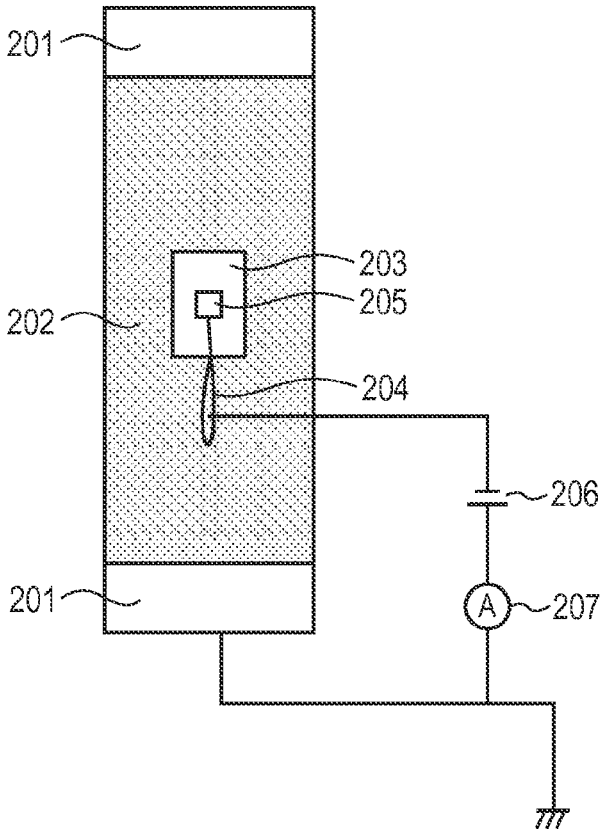
FIG. 2 is a view (top view) for illustrating a method of measuring the volume resistivity of a conductive layer.
Figure 3:
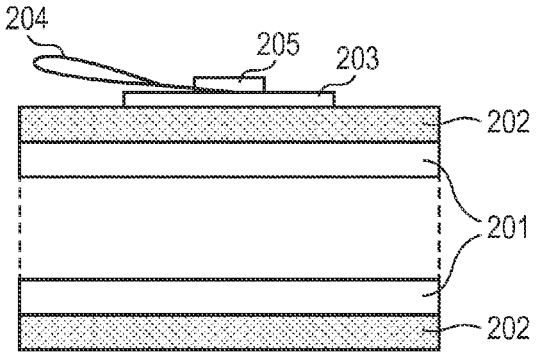
FIG. 3 is a view (cross-sectional view) for illustrating the method of measuring the volume resistivity of a conductive layer.
Figure 4:
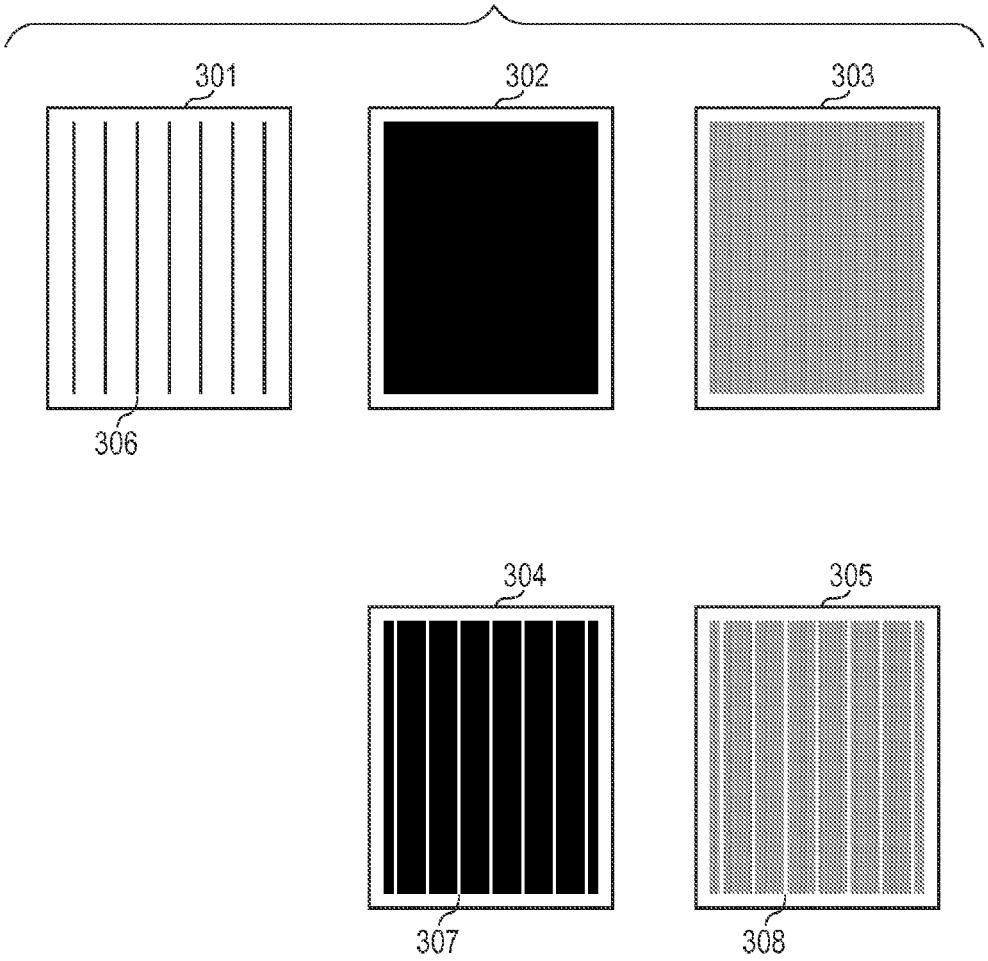
FIG. 4 is a view (image example) for illustrating a pattern memory.

A method of measuring the volume resistivity of the conductive layer of the electrophotographic photosensitive member is described with reference to FIGS. 2 and 3. FIG. 2 is a top view for illustrating the method of measuring the volume resistivity of the conductive layer and FIG. 3 is a cross-sectional view for illustrating the method of measuring the volume resistivity of the conductive layer.

The volume resistivity of the conductive layer is measured under a normal-temperature and normal-humidity (23° C./50% RH) environment. A copper tape 203 (manufactured by Sumitomo 3M Limited, Type No. 1181) is attached to the surface of a conductive layer 202 and is used as an electrode on the front surface side of the conductive layer 202. In addition, a support 201 is used as an electrode on the back side of the conductive layer 202. A power source 206 for applying a voltage between the copper tape 203 and the support 201, and a current measurement appliance 207 for measuring a current flowing between the copper tape 203 and the support 201 are placed. In addition, a copper wire 204 is mounted on the copper tape 203 for applying a voltage to the copper tape 203 and then the copper wire 204 is fixed to the copper tape 203 by attaching a copper tape 205 similar to the copper tape 203 from above the copper wire 204 so that the copper wire 204 may not protrude from the copper tape 203. A voltage is applied to the copper tape 203 with the copper wire 204.

When a background current value in the case where no voltage is applied between the copper tape 203 and the support 201 is represented by $I_0$ [A], a current value in the case where a voltage of −1 V formed only of a DC voltage (DC component) is applied is represented by I [A], the thickness of the conductive layer 202 is represented by d [cm], and the area of the electrode (copper tape 203) on the front surface side of the conductive layer 202 is represented by S [$cm^2$], a value represented by the following expression (26) is defined as a volume resistivity p [Ω·cm] of the conductive layer 202.

$$\rho=1/(I-I_0)\times S/d\ [\Omega\cdot cm] \quad (26)$$

This measurement is preferably performed with an appliance capable of measuring a minute current as the current measurement appliance 207 because a minute current quantity whose absolute value is $1\times10^{-6}$ A or less is measured in the measurement. Examples of such appliance include a pA meter (trade name: 4140B) manufactured by Yokogawa Hewlett-Packard and a high resistance meter (trade name: 4339B) manufactured by Agilent Technologies.

It should be noted that the volume resistivity of the conductive layer measured in a state where only the conductive layer is formed on the support and that measured in a state where only the conductive layer is left on the support by peeling each layer (such as the photosensitive layer) on the conductive layer from the electrophotographic photosensitive member show the same value.

In order to prevent the injection of a charge from the conductive layer to the photosensitive layer, an undercoat layer (barrier layer) having electric barrier property may be provided between the conductive layer and the photosensitive layer.

The undercoat layer can be formed by coating the conductive layer with an undercoat-layer coating solution containing a resin (binder material) and drying the resultant coating film.

Examples of the resin (binder material) to be used in the undercoat layer include a polyvinyl alcohol, a polyvinyl methyl ether, a polyacrylic acids, a methylcellulose, an ethylcellulose, a polyglutamic acid, casein, starch, and other water-soluble resins, a polyamide, a polyimide, a polyamide-imide, a polyamic acid, a melamine resin, an epoxy resin, a polyurethane, and a polyglutamate. Of those, thermoplastic resins are preferred to effectively express the electric barrier property of the undercoat layer. Of the thermoplastic resins, a thermoplastic polyamide is preferred. The polyamide is preferably a copolymerized nylon.

The thickness of the undercoat layer is preferably 0.1 μm or more and 2.0 μm or less.

In addition, an electron-transporting substance (electron-accepting substance such as an acceptor) may be contained in the undercoat layer to prevent the flow of charge from being disrupted in the undercoat layer.

Examples of the electron-transporting substance include electron-withdrawing substances such as 2,4,7-trinitrofluorenone, 2,4,5,7-tetranitrofluorenone, chloranil, and tetracyanoquinodimethane, and polymers of those electron-withdrawing substances.

The photosensitive layer is provided on the conductive layer (undercoat layer).

Examples of the charge-generating substance to be used in the photosensitive layer include: azo pigments such as monoazo, disazo, and trisazo; phthalocyanine pigments such as metal phthalocyanine and non-metal phthalocyanine; indigo pigments such as indigo and thioindigo; perylene pigments such as perylene acid anhydride and perylene acid imide; polycyclic quinone pigments such as anthraquinone and pyrenequinone; squarylium dyes; pyrylium salts and thiapyrylium salts; triphenylmethane dyes; quinacridone pigments; azulenium salt pigments; cyanine dyes; xanthene dyes; quinonimine dyes; and styryl dyes. Of those, metal phthalocyanines such as oxytitanium phthalocyanine, hydroxygallium phthalocyanine, and chlorogallium phthalocyanine are preferred.

When the photosensitive layer is a laminated type photosensitive layer, the charge-generating layer can be formed by applying a charge-generating-layer coating solution, which is prepared by dispersing a charge-generating substance into a solvent together with a binder material, and then drying the resultant coating film. As a dispersion method, there are given, for example, methods using a homogenizer, an ultrasonic wave, a ball mill, a sand mill, an attritor, and a roll mill.

Examples of the binder material to be used in the charge-generating layer include a polycarbonate, a polyester, a polyarylate, a butyral resin, a polystyrene, a polyvinyl acetal, a diallyl phthalate resin, an acrylic resin, a methacrylic resin, a vinyl acetate resin, a phenol resin, a silicone resin, a polysulfone, a styrene-butadiene copolymer, an alkyd resin, an epoxy resin, a urea resin, and a vinyl chloride-vinyl acetate copolymer. Those binder materials may be used alone or as a mixture or a copolymer of two or more kinds thereof.

The ratio of the charge-generating substance to the binder material (charge-generating substance:binder material) falls within the range of preferably 10:1 to 1:10 (mass ratio), more preferably 5:1 to 1:1 (mass ratio).

Examples of the solvent to be used in the charge-generating-layer coating solution include an alcohol, a sulfoxide, a ketone, an ether, an ester, an aliphatic halogenated hydrocarbon, and an aromatic compound.

The thickness of the charge-generating layer is preferably 5 μm or less, more preferably 0.1 μm or more and 2 μm or less.

Further, any of various sensitizers, antioxidants, UV absorbers, plasticizers, and the like may be added to the charge-generating layer as required. Further, an electron-transporting substance (electron-accepting substance such as an acceptor) may be contained in the charge-generating layer to prevent the flow of charge from being disrupted in the charge-generating layer.

Examples of the electron-transporting substance include electron-withdrawing substances such as 2,4,7-trinitrofluorenone, 2,4,5,7-tetranitrofluorenone, chloranil, and tetracyanoquinodimethane, and polymers of those electron-withdrawing substances.

Examples of the charge-transporting substance to be used in the photosensitive layer include a triarylamine compound, a hydrazone compound, a styryl compound, a stilbene compound, a pyrazoline compound, an oxazole compound, a thiazole compound, and a triarylmethane compound.

When the photosensitive layer is a laminated type photosensitive layer, the charge-transporting layer can be formed by applying a charge-transporting-layer coating solution, which is prepared by dissolving a charge-transporting substance and a binder material in a solvent, and then drying the resultant coating film.

Examples of the binder material to be used in the charge-transporting layer include an acrylic resin, a styrene resin, a polyester, a polycarbonate, a polyarylate, a polysulfone, a polyphenylene oxide, an epoxy resin, a polyurethane, an alkyd resin, and an unsaturated resin. Those binder materials may be used alone or as a mixture or a copolymer of two or more kinds thereof.

The ratio of the charge-transporting substance to the binder material (charge-transporting substance:binder material) preferably falls within the range of 2:1 to 1:2 (mass ratio).

Examples of the solvent to be used in the charge-transporting-layer coating solution include: ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons each substituted by a halogen atom, such as chlorobenzene, chloroform, and carbon tetrachloride.

The thickness of the charge-transporting layer is preferably 3 μm or more and 40 μm or less, more preferably 4 μm or more and 30 μm or less from the viewpoints of charging uniformity and image reproducibility.

Further, an antioxidant, a UV absorber, or a plasticizer may be added to the charge-transporting layer as required.

When the photosensitive layer is a single-layer type photosensitive layer, the single-layer type photosensitive layer can be formed by applying a single-layer-type-photosensitive-layer coating solution containing a charge-generating substance, a charge-transporting substance, a binder material, and a solvent, and then drying the resultant coating film. As the charge-generating substance, the charge-transporting substance, the binder material, and the solvent, for example, those of various kinds described above can be used.

Further, a protective layer may be formed on the photosensitive layer to protect the photosensitive layer. The protective layer can be formed by applying a protective-layer coating solution containing a resin (binder material), and then drying and/or curing the resultant coating film.

The thickness of the protective layer is preferably 0.5 μm or more and 10 μm or less, more preferably 1 μm or more and 8 μm to less.

In the application of each of the coating solutions corresponding to the respective layers, coating methods such as dip coating, spray coating, spinner coating, roller coating, Meyer bar coating, and blade coating may be employed.

FIG. 1 illustrates an example of the schematic construction of an electrophotographic apparatus including a process cartridge having an electrophotographic photosensitive member.

In FIG. 1, an electrophotographic photosensitive member 1 having a drum shape (cylindrical shape) is driven to rotate around an axis 2 in a direction indicated by the arrow at a predetermined peripheral speed.

The circumferential surface of the electrophotographic photosensitive member 1 to be driven to rotate is uniformly charged at a positive or negative predetermined potential by a charging device (such as a primary charging device or a charging roller) 3, and then receives exposure light (image exposure light) 4 emitted from an exposing device (not shown) such as a slit exposure or a laser-beam scanning exposure. Thus, electrostatic latent images corresponding to images of interest are sequentially formed on the circumferential surface of the electrophotographic photosensitive member 1. A voltage to be applied to the charging device 3 may be only a DC voltage, or may be a DC voltage superimposed with an AC voltage.

The electrostatic latent images formed on the circumferential surface of the electrophotographic photosensitive member 1 are converted into toner images by development with toner of a developing device 5. Subsequently, the toner images formed on the circumferential surface of the electrophotographic photosensitive member 1 are transferred to a transfer material (such as paper) P by a transfer bias from a transferring device (such as a transfer roller) 6. The transfer material P is fed with a transfer material feeding device (not shown) to a portion (abutment portion) between the electrophotographic photosensitive member 1 and the transferring device 6 in synchronization with the rotation of the electrophotographic photosensitive member 1.

The transfer material P which has received the transfer of the toner images is separated from the circumferential surface of the electrophotographic photosensitive member 1, introduced to a fixing device 8, subjected to image fixation, and then printed as an image-formed product (print or copy) out of the apparatus.

The circumferential surface of the electrophotographic photosensitive member 1 after the transfer of the toner images undergoes removal of the remaining toner after the transfer by a cleaning device (such as a cleaning blade) 7. Further, the circumferential surface of the electrophotographic photosensitive member 1 is subjected to a neutralization process with pre-exposure light 11 from a pre-exposing device (not shown) and then repeatedly used in image formation. It should be noted that, when the charging device is a contact-charging device such as a charging roller, the pre-exposure is not always required. It should also be noted that, when the electrophotographic apparatus adopts a cleaner-less system, the cleaning device is not always required.

The electrophotographic photosensitive member 1 and at least one structural component selected from the charging device 3, the developing device 5, the transferring device 6, the cleaning device 7, and the like may be housed in a container and then integrally supported as a process cartridge. In addition, the process cartridge may be detachably mountable to the main body of an electrophotographic apparatus. In FIG. 1, the electrophotographic photosensitive member 1, and the charging device 3, the developing device 5, and the cleaning device 7 are integrally supported as a cartridge, thereby forming a process cartridge 9, which is detachably mountable to the main body of an electrophotographic apparatus, through use of a guiding device 10 such as a rail of the main body of the electrophotographic apparatus. Further, the electrophotographic apparatus may have a construction including the electrophotographic photosensitive member 1, and the charging device 3, the exposing device, the developing device 5, and the transferring device 6.

EXAMPLE

Hereinafter, the present invention is described in more detail by way of specific examples, provided that the present invention is not limited thereto. It should be noted that the term "part(s)" in each of Examples and Comparative Examples means "part(s) by mass," the term "average particle diameter" means "average primary particle diameter," the unit "%" of a coating ratio in each table means "% by mass," and the unit "%" of a doping ratio (doping amount) means "% by mass." In addition, densities in Examples and the tables are each a value determined by the foregoing method and are each represented in the unit of "g/cm$^3$."

<Preparation Examples of Conductive-Layer Coating Solutions>

(Preparation Example of Conductive-Layer Coating Solution CP-1)

112.00 Parts of P-doped tin oxide-coated titanium oxide particles (average primary particle diameter: 230 nm, powder resistivity: 5,000 Ω·cm, amount (doping ratio) of phosphorus doped into tin oxide: 4.50% by mass, coating ratio: 45% by mass, density: 5.1 g/cm$^3$) as a first metal oxide particle, 3.00 parts of P-doped tin oxide particles (average primary particle diameter: 20 nm, powder resistivity: 300 Ω·cm, amount (doping ratio) of phosphorus doped into tin oxide: 3.60% by mass, density: 6.8 g/cm$^3$) as a second metal oxide particle, 266.67 parts of a phenol resin (trade name: PLYOPHEN J-325, manufactured by DIC Corporation, resin solid content: 60% by mass) as a binding material, and 120 parts of 1-methoxy-2-propanol as a solvent were loaded into a sand mill using 465 parts of glass beads each having a diameter of 0.8 mm, and were then subjected to a dispersion treatment under the following dispersion treatment conditions to provide a dispersion solution: a disc rotation number of 2,000 rpm, a dispersion treatment time of 4.5 hours, and a setting temperature of cooling water of 18° C.

The glass beads were removed from the dispersion solution with a mesh. After that, 5.00 parts of silicone resin particles (trade name: TOSPEARL 120, manufactured by Momentive Performance Materials Inc., average particle diameter: 2 μm) as a surface roughness providing material and 0.30 part of a silicone oil (trade name: SH28PA, manufactured by Dow Corning Toray Silicone Co., Ltd.) as a leveling agent were added to the dispersion solution, and then the mixture was stirred for 30 minutes to prepare a conductive-layer coating solution CP-1.

(Preparation Examples of Conductive-Layer Coating Solutions CP-2 to CP-93, CP-141 to CP-233, CP-281 to CP-373, CP-421 to CP-513, and CP-561 to CP-653)

Conductive-layer coating solutions CP-2 to CP-93, CP-141 to CP-233, CP-281 to CP-373, CP-421 to CP-513, and CP-561 to CP-653 were prepared by the same operations as those of the preparation example of the conductive-layer coating solution CP-1 except that the kind (including a coating ratio, a doping ratio, and a density, the same holds true for the following) and amount of the first metal oxide particle, the kind (including a doping ratio and a density, the same holds true for the following) and amount of the second metal oxide particle, and the amount of the binding material were changed as shown in Tables 1 to 3, 8 to 10, 15 to 17, 44 to 46, and 49 to 51.

It should be noted that P-doped tin oxide-coated titanium oxide particles used as the first metal oxide particle in the preparation of the conductive-layer coating solutions CP-2 to CP-93 had a powder resistivity of 5,000 Ω·cm.

In addition, P-doped tin oxide particles used as the second metal oxide particle in the preparation of the conductive-layer coating solutions CP-7, CP-13, CP-19, CP-24, CP-29, CP-35, CP-40, CP-45, CP-50, CP-55, CP-61, CP-66, CP-71, CP-77, CP-83, and CP-89 had a powder resistivity of 300 Ω·cm.

In addition, P-doped tin oxide particles used as the second metal oxide particle in the preparation of the conductive-layer coating solutions CP-2, CP-8, CP-14, CP-20, CP-25, CP-30, CP-36, CP-41, CP-46, CP-51, CP-56, CP-62, CP-67, CP-72, CP-78, CP-84, and CP-90 had a powder resistivity of 250 Ω·cm. In addition, P-doped tin oxide particles used as the second metal oxide particle in the preparation of the conductive-layer coating solutions CP-3, CP-6, CP-9, CP-12, CP-15, CP-18, CP-21, CP-26, CP-31, CP-34, CP-37, CP-42, CP-47, CP-52, CP-57, CP-60, CP-63, CP-68, CP-73, CP-76, CP-79, CP-82, CP-85, CP-88, and CP-91 had a powder resistivity of 200 Ω·cm.

In addition, P-doped tin oxide particles used as the second metal oxide particle in the preparation of the conductive-layer coating solutions CP-4, CP-10, CP-16, CP-22, CP-27, CP-32, CP-38, CP-43, CP-48, CP-53, CP-58, CP-64, CP-69, CP-74, CP-80, CP-86, and CP-92 had a powder resistivity of 150 Ω·cm.

In addition, P-doped tin oxide particles used as the second metal oxide particle in the preparation of the conductive-layer coating solutions CP-5, CP-11, CP-17, CP-23, CP-28, CP-33, CP-39, CP-44, CP-49, CP-54, CP-59, CP-65, CP-70, CP-75, CP-81, CP-87, and CP-93 had a powder resistivity of 100 Ω·cm.

In addition, W-doped tin oxide-coated titanium oxide particles used as the first metal oxide particle in the preparation of the conductive-layer coating solutions CP-141 to CP-233 had a powder resistivity of 3,000 Ω·cm.

In addition, W-doped tin oxide particles used as the second metal oxide particle in the preparation of the conductive-layer coating solutions CP-141, CP-147, CP-153, CP-159, CP-164, CP-169, CP-175, CP-180, CP-185, CP-190, CP-195, CP-201, CP-206, CP-211, CP-217, CP-223, and CP-229 had a powder resistivity of 180 Ω·cm.

In addition, W-doped tin oxide particles used as the second metal oxide particle in the preparation of the conductive-layer coating solutions CP-142, CP-148, CP-154, CP-160, CP-165, CP-170, CP-176, CP-181, CP-186, CP-191, CP-196, CP-202, CP-207, CP-212, CP-218, CP-224, and CP-230 had a powder resistivity of 140 Ω·cm.

In addition, W-doped tin oxide particles used as the second metal oxide particle in the preparation of the conductive-layer coating solutions CP-143, CP-146, CP-149, CP-152, CP-155, CP-158, CP-161, CP-166, CP-171, CP-174, CP-177, CP-182, CP-187, CP-192, CP-197, CP-200, CP-203, CP-208, CP-213, CP-216, CP-219, CP-222, CP-225, CP-228, and CP-231 had a powder resistivity of 100 Ω·cm.

In addition, W-doped tin oxide particles used as the second metal oxide particle in the preparation of the conductive-layer coating solutions CP-144, CP-150, CP-156, CP-162, CP-167, CP-172, CP-178, CP-183, CP-188, CP-193, CP-198, CP-204, CP-209, CP-214, CP-220, CP-226, and CP-232 had a powder resistivity of 70 Ω·cm.

In addition, W-doped tin oxide particles used as the second metal oxide particle in the preparation of the conductive-layer coating solutions CP-145, CP-151, CP-157, CP-163, CP-168, CP-173, CP-179, CP-184, CP-189, CP-194, CP-199, CP-205, CP-210, CP-215, CP-221, CP-227, and CP-233 had a powder resistivity of 30 Ω·cm.

In addition, F-doped tin oxide-coated titanium oxide particles used as the first metal oxide particle in the preparation of the conductive-layer coating solutions CP-281 to CP-373 had a powder resistivity of 5,000 Ω·cm.

In addition, F-doped tin oxide particles used as the second metal oxide particle in the preparation of the conductive-layer coating solutions CP-281, CP-287, CP-293, CP-299, CP-304, CP-309, CP-315, CP-320, CP-325, CP-330, CP-335, CP-341, CP-346, CP-351, CP-357, CP-363, and CP-369 had a powder resistivity of 300 Ω·cm.

In addition, F-doped tin oxide particles used as the second metal oxide particle in the preparation of the conductive-layer coating solutions CP-282, CP-288, CP-294, CP-300, CP-305, CP-310, CP-316, CP-321, CP-326, CP-331, CP-336, CP-342, CP-347, CP-352, CP-358, CP-364 and CP-370 had a powder resistivity of 270 Ω·cm.

In addition, F-doped tin oxide particles used as the second metal oxide particle in the preparation of the conductive-layer coating solutions CP-283, CP-286, CP-289, CP-292, CP-295, CP-298, CP-301, CP-306, CP-311, CP-314, CP-317, CP-322, CP-327, CP-332, CP-337, CP-340, CP-343, CP-348, CP-353, CP-356, CP-359, CP-362, CP-365, CP-368, and CP-371 had a powder resistivity of 220 Ω·cm.

In addition, F-doped tin oxide particles used as the second metal oxide particle in the preparation of the conductive-layer coating solutions CP-284, CP-290, CP-296, CP-302, CP-307, CP-312, CP-318, CP-323, CP-328, CP-333, CP-338, CP-344, CP-349, CP-354, CP-360, CP-366, and CP-372 had a powder resistivity of 170 Ω·cm.

In addition, F-doped tin oxide particles used as the second metal oxide particle in the preparation of the conductive-layer coating solutions CP-285, CP-291, CP-297, CP-303, CP-308, CP-313, CP-319, CP-324, CP-329, CP-334, CP-339, CP-345, CP-350, CP-355, CP-361, CP-367, and CP-373 had a powder resistivity of 130 Ω·cm.

In addition, Nb-doped tin oxide-coated titanium oxide particles used as the first metal oxide particle in the preparation of the conductive-layer coating solutions CP-421 to CP-513 had a powder resistivity of 6,500 Ω·cm.

In addition, Nb-doped tin oxide particles used as the second metal oxide particle in the preparation of the conductive-layer coating solutions CP-421, CP-427, CP-433, CP-439, CP-444, CP-449, CP-455, CP-460, CP-465, CP-470, CP-475, CP-481, CP-486, CP-491, CP-497, CP-503, and CP-509 had a powder resistivity of 400 Ω·cm.

In addition, Nb-doped tin oxide particles used as the second metal oxide particle in the preparation of the conductive-layer coating solutions CP-422, CP-428, CP-434, CP-440, CP-445, CP-450, CP-456, CP-461, CP-466, CP-471, CP-476, CP-482, CP-487, CP-492, CP-498, CP-504, and CP-510 had a powder resistivity of 360 Ω·cm.

In addition, Nb-doped tin oxide particles used as the second metal oxide particle in the preparation of the conductive-layer coating solutions CP-423, CP-426, CP-429, CP-432, CP-435, CP-438, CP-441, CP-446, CP-451, CP-454, CP-457, CP-462, CP-467, CP-472, CP-477, CP-480, CP-483, CP-488, CP-493, CP-496, CP-499, CP-502, CP-505, CP-508, and CP-511 had a powder resistivity of 330 Ω·cm.

In addition, Nb-doped tin oxide particles used as the second metal oxide particle in the preparation of the conductive-layer coating solutions CP-424, CP-430, CP-436, CP-442, CP-447, CP-452, CP-458, CP-463, CP-468, CP-473, CP-478, CP-484, CP-489, CP-494, CP-500, CP-506, and CP-512 had a powder resistivity of 300 Ω·cm.

In addition, Nb-doped tin oxide particles used as the second metal oxide particle in the preparation of the conductive-layer coating solutions CP-425, CP-431, CP-437, CP-443, CP-448, CP-453, CP-459, CP-464, CP-469, CP-474, CP-479, CP-485, CP-490, CP-495, CP-501, CP-507, and CP-513 had a powder resistivity of 270 Ω·cm.

In addition, Ta-doped tin oxide-coated titanium oxide particles used as the first metal oxide particle in the preparation of the conductive-layer coating solutions CP-561 to CP-653 had a powder resistivity of 4,500 Ω·cm.

In addition, Ta-doped tin oxide particles used as the second metal oxide particle in the preparation of the conductive-layer coating solutions CP-561, CP-567, CP-573, CP-579, CP-584, CP-589, CP-595, CP-600, CP-605, CP-610, CP-615, CP-621, CP-626, CP-631, CP-637, CP-643, and CP-649 had a powder resistivity of 270 Ω·cm.

In addition, Ta-doped tin oxide particles used as the second metal oxide particle in the preparation of the conductive-layer coating solutions CP-562, CP-568, CP-574, CP-580, CP-585, CP-590, CP-596, CP-601, CP-606, CP-611, CP-616, CP-622, CP-627, CP-632, CP-638, CP-644, and CP-650 had a powder resistivity of 200 Ω·cm.

In addition, Ta-doped tin oxide particles used as the second metal oxide particle in the preparation of the conductive-layer coating solutions CP-563, CP-566, CP-569, CP-572, CP-575, CP-578, CP-581, CP-586, CP-591, CP-594, CP-597, CP-602, CP-607, CP-612, CP-617, CP-620, CP-623, CP-628, CP-633, CP-636, CP-639, CP-642, CP-645, CP-648, and CP-651 had a powder resistivity of 160 Ω·cm.

In addition, Ta-doped tin oxide particles used as the second metal oxide particle in the preparation of the conductive-layer coating solutions CP-564, CP-570, CP-576, CP-582, CP-587, CP-592, CP-598, CP-603, CP-608, CP-613, CP-618, CP-624, CP-629, CP-634, CP-640, CP-646, and CP-652 had a powder resistivity of 110 Ω·cm.

In addition, Ta-doped tin oxide particles used as the second metal oxide particle in the preparation of the conductive-layer coating solutions CP-565, CP-571, CP-577, CP-583, CP-588, CP-593, CP-599, CP-604, CP-609, CP-614, CP-619, CP-625, CP-630, CP-635, CP-641, CP-647, and CP-653 had a powder resistivity of 65 Ω·cm.

(Preparation Examples of Conductive-Layer Coating Solutions CP-94 to CP-140, CP-234 to CP-280, CP-374 to CP-420, CP-514 to CP-560, and CP-654 to CP-700)

Conductive-layer coating solutions CP-94 to CP-140, CP-234 to CP-280, CP-374 to CP-420, CP-514 to CP-560, and CP-654 to CP-700 were prepared by the same operations as those of the preparation example of the conductive-layer coating solution CP-1 except that: the kind and amount of the first metal oxide particle, the kind and amount of the second metal oxide particle, the amount of the binding material, and the amount of the silicone resin particles were changed as shown in Tables 3, 4, 11, 12, 18, 19, 46, 47, 52, and 53; and the operation for the dispersion treatment was carried out by adding 30.00 parts of uncoated titanium oxide particles (powder resistivity: $5.0\times10^7$ Ω·cm, average particle diameter: 210 nm, density: 4.2 g/cm$^3$) at the time of the operation for the dispersion treatment. It should be noted that when the conductive-layer coating solutions CP-139, CP-279, CP-419, CP-559, and CP-699 were prepared, the disc rotation number and dispersion treatment time in the dispersion treatment conditions were changed to 2,500 rpm and 10 hours, respectively. In addition, when the conductive-layer coating solutions CP-140, CP-280, CP-420, CP-560, and CP-700 were prepared, the disc rotation number and dispersion treatment time in the dispersion treatment conditions were changed to 2,500 rpm and 30 hours, respectively.

It should be noted that P-doped tin oxide-coated titanium oxide particles used as the first metal oxide particle in the preparation of the conductive-layer coating solutions CP-94 to CP-140 had a powder resistivity of 5,000 Ω·cm.

In addition, P-doped tin oxide particles used as the second metal oxide particle in the preparation of the conductive-layer coating solutions CP-94, CP-99, CP-104, CP-109, CP-114, CP-119, CP-124, CP-129, and CP-134 had a powder resistivity of 300 Ω·cm.

In addition, P-doped tin oxide particles used as the second metal oxide particle in the preparation of the conductive-layer coating solutions CP-95, CP-100, CP-105, CP-110, CP-115, CP-120, CP-125, CP-130, and CP-135 had a powder resistivity of 250 Ω·cm.

In addition, P-doped tin oxide particles used as the second metal oxide particle in the preparation of the conductive-layer coating solutions CP-96, CP-101, CP-106, CP-111, CP-116, CP-121, CP-126, CP-131, CP-136, CP-139, and CP-140 had a powder resistivity of 200 Ω·cm.

In addition, P-doped tin oxide particles used as the second metal oxide particle in the preparation of the conductive-layer coating solutions CP-97, CP-102, CP-107, CP-112, CP-117, CP-122, CP-127, CP-132, and CP-137 had a powder resistivity of 150 Ω·cm.

In addition, P-doped tin oxide particles used as the second metal oxide particle in the preparation of the conductive-layer coating solutions CP-98, CP-103, CP-108, CP-113, CP-118, CP-123, CP-128, CP-133, and CP-138 had a powder resistivity of 100 Ω·cm.

In addition, W-doped tin oxide-coated titanium oxide particles used as the first metal oxide particle in the preparation of the conductive-layer coating solutions CP-234 to CP-280 had a powder resistivity of 3,000 Ω·cm.

In addition, W-doped tin oxide particles used as the second metal oxide particle in the preparation of the conductive-layer coating solutions CP-234, CP-239, CP-244, CP-249, CP-254, CP-259, CP-264, CP-269, and CP-274 had a powder resistivity of 180 Ω·cm.

In addition, W-doped tin oxide particles used as the second metal oxide particle in the preparation of the conductive-layer coating solutions CP-235, CP-240, CP-245, CP-250, CP-255, CP-260, CP-265, CP-270, and CP-275 had a powder resistivity of 140 Ω·cm.

In addition, W-doped tin oxide particles used as the second metal oxide particle in the preparation of the conductive-layer coating solutions CP-236, CP-241, CP-246, CP-251, CP-256, CP-261, CP-266, CP-271, CP-276, CP-279, and CP-280 had a powder resistivity of 100 Ω·cm.

In addition, W-doped tin oxide particles used as the second metal oxide particle in the preparation of the conductive-layer coating solutions CP-237, CP-242, CP-247, CP-252, CP-257, CP-262, CP-267, CP-272, and CP-277 had a powder resistivity of 70 Ω·cm.

In addition, W-doped tin oxide particles used as the second metal oxide particle in the preparation of the conductive-layer coating solutions CP-238, CP-243, CP-248, CP-253, CP-258, CP-263, CP-268, CP-273, and CP-278 had a powder resistivity of 30 Ω·cm.

In addition, F-doped tin oxide-coated titanium oxide particles used as the first metal oxide particle in the preparation of the conductive-layer coating solutions CP-374 to CP-420 had a powder resistivity of 5,000 Ω·cm.

In addition, F-doped tin oxide particles used as the second metal oxide particle in the preparation of the conductive-layer coating solutions CP-374, CP-379, CP-384, CP-389, CP-394, CP-399, CP-404, CP-409, and CP-414 had a powder resistivity of 300 Ω·cm.

In addition, F-doped tin oxide particles used as the second metal oxide particle in the preparation of the conductive-layer coating solutions CP-375, CP-380, CP-385, CP-390, CP-395, CP-400, CP-405, CP-410, and CP-415 had a powder resistivity of 270 Ω·cm.

In addition, F-doped tin oxide particles used as the second metal oxide particle in the preparation of the conductive-layer coating solutions CP-376, CP-381, CP-386, CP-391, CP-396, CP-401, CP-406, CP-411, CP-416, CP-419, and CP-420 had a powder resistivity of 220 Ω·cm.

In addition, F-doped tin oxide particles used as the second metal oxide particle in the preparation of the conductive-layer coating solutions CP-377, CP-382, CP-387, CP-392, CP-397, CP-402, CP-407, CP-412, and CP-417 had a powder resistivity of 170 Ω·cm.

In addition, F-doped tin oxide particles used as the second metal oxide particle in the preparation of the conductive-layer coating solutions CP-378, CP-383, CP-388, CP-393, CP-398, CP-403, CP-408, CP-413, and CP-418 had a powder resistivity of 130 Ω·cm.

In addition, Nb-doped tin oxide-coated titanium oxide particles used as the first metal oxide particle in the preparation of the conductive-layer coating solutions CP-514 to CP-560 had a powder resistivity of 6,500 Ω·cm.

In addition, Nb-doped tin oxide particles used as the second metal oxide particle in the preparation of the conductive-layer coating solutions CP-514, CP-519, CP-524, CP-529, CP-534, CP-539, CP-544, CP-549, and CP-554 had a powder resistivity of 400 Ω·cm. In addition, Nb-doped tin oxide particles used as the second metal oxide particle in the preparation of the conductive-layer coating solutions CP-515, CP-520, CP-525, CP-530, CP-535, CP-540, CP-545, CP-550, and CP-555 had a powder resistivity of 360 Ω·cm.

In addition, Nb-doped tin oxide particles used as the second metal oxide particle in the preparation of the conductive-layer coating solutions CP-516, CP-521, CP-526, CP-531, CP-536, CP-541, CP-546, CP-551, CP-556, CP-559, and CP-560 had a powder resistivity of 330 Ω·cm.

In addition, Nb-doped tin oxide particles used as the second metal oxide particle in the preparation of the conductive-layer coating solutions CP-517, CP-522, CP-527, CP-532, CP-537, CP-542, CP-547, CP-552, and CP-557 had a powder resistivity of 300 Ω·cm.

In addition, Nb-doped tin oxide particles used as the second metal oxide particle in the preparation of the conductive-layer coating solutions CP-518, CP-523, CP-528, CP-533, CP-538, CP-543, CP-548, CP-553, and CP-558 had a powder resistivity of 270 Ω·cm.

In addition, Ta-doped tin oxide-coated titanium oxide particles used as the first metal oxide particle in the preparation of the conductive-layer coating solutions CP-654 to CP-700 had a powder resistivity of 4,500 Ω·cm.

In addition, Ta-doped tin oxide particles used as the second metal oxide particle in the preparation of the conductive-layer coating solutions CP-654, CP-659, CP-664, CP-669, CP-674, CP-679, CP-684, CP-689, and CP-694 had a powder resistivity of 270 Ω·cm.

In addition, Ta-doped tin oxide particles used as the second metal oxide particle in the preparation of the conductive-layer coating solutions CP-655, CP-660, CP-665, CP-670, CP-675, CP-680, CP-685, CP-690, and CP-695 had a powder resistivity of 200 Ω·cm.

In addition, Ta-doped tin oxide particles used as the second metal oxide particle in the preparation of the conductive-layer coating solutions CP-656, CP-661, CP-666, CP-671, CP-676, CP-681, CP-686, CP-691, CP-696, CP-699, and CP-700 had a powder resistivity of 160 Ω·cm.

In addition, Ta-doped tin oxide particles used as the second metal oxide particle in the preparation of the conductive-layer coating solutions CP-657, CP-662, CP-667, CP-672, CP-677, CP-682, CP-687, CP-692, and CP-697 had a powder resistivity of 110 Ω·cm.

In addition, Ta-doped tin oxide particles used as the second metal oxide particle in the preparation of the conductive-layer coating solutions CP-658, CP-663, CP-668, CP-673, CP-678, CP-683, CP-688, CP-693, and CP-698 had a powder resistivity of 65 Ω·cm.

(Preparation Examples of Conductive-Layer Coating Solutions CP-C1 to CP-C22, CP-C42 to CP-C63, CP-C76 to CP-C97, CP-C107 to CP-C128, and CP-C129 to CP-C150)

Conductive-layer coating solutions CP-C1 to CP-C22, CP-C42 to CP-C63, CP-C76 to CP-C97, CP-C107 to CP-C128, and CP-C129 to CP-C150 were prepared by the same operations as those of the preparation example of the conductive-layer coating solution CP-1 except that the kind and amount of the first metal oxide particle, the kind and amount of the second metal oxide particle, and the amount of the binding material were changed (including a change as to whether or not the first metal oxide particle or the second metal oxide particle were used, the same holds true for the following) as shown in Tables 5, 13, 20, 48, and 54.

It should be noted that P-doped tin oxide-coated titanium oxide particles used as the first metal oxide particle in the preparation of the conductive-layer coating solutions CP-C1 to CP-C9 and CP-C13 to CP-C22 had a powder resistivity of 5,000 Ω·cm.

In addition, P-doped tin oxide particles used as the second metal oxide particle in the preparation of the conductive-layer coating solutions CP-C4 to CP-C22 had a powder resistivity of 200 Ω·cm.

In addition, W-doped tin oxide-coated titanium oxide particles used as the first metal oxide particle in the preparation of the conductive-layer coating solutions CP-C42 to CP-050 and CP-054 to CP-C63 had a powder resistivity of 3,000 Ω·cm.

In addition, W-doped tin oxide particles used as the second metal oxide particle in the preparation of the conductive-layer coating solutions CP-C45 to CP-C63 had a powder resistivity of 100 Ω·cm.

In addition, F-doped tin oxide-coated titanium oxide particles used as the first metal oxide particle in the preparation of the conductive-layer coating solutions CP-C76 to CP-C84 and CP-C88 to CP-C97 had a powder resistivity of 5,000 Ω·cm.

In addition, F-doped tin oxide particles used as the second metal oxide particle in the preparation of the conductive-layer coating solutions CP-C79 to CP-C97 had a powder resistivity of 220 Ω·cm.

In addition, Nb-doped tin oxide-coated titanium oxide particles used as the first metal oxide particle in the preparation of the conductive-layer coating solutions CP-C107 to CP-C115 and CP-C119 to CP-C128 had a powder resistivity of 6,500 Ω·cm.

In addition, Nb-doped tin oxide particles used as the second metal oxide particle in the preparation of the conductive-layer coating solutions CP-C110 to CP-C128 had a powder resistivity of 330 Ω·cm.

In addition, Ta-doped tin oxide-coated titanium oxide particles used as the first metal oxide particle in the preparation of the conductive-layer coating solutions CP-C129 to CP-C137 and CP-C141 to CP-C150 had a powder resistivity of 4,500 Ω·cm.

In addition, Ta-doped tin oxide particles used as the second metal oxide particle in the preparation of the conductive-layer coating solutions CP-C132 to CP-C150 had a powder resistivity of 160 Ω·cm.

(Preparation Examples of Conductive-Layer Coating Solutions CP-C23 to CP-C35, CP-C64 to CP-C71, CP-C98 to CP-C105, CP-C151 to CP-C178, and CP-C179)

Conductive-layer coating solutions CP-C23 to CP-C35, CP-C64 to CP-C71, CP-C98 to CP-C105, and CP-C151 to CP-C179 were prepared by the same operations as those of the preparation example of the conductive-layer coating solution CP-1 except that the kind and amount of the first metal oxide particle, the kind and amount of the second metal oxide particle, and the amount of the binding material were changed as shown in Tables 6, 7, 14, 21, and 55 to 58. It should be noted that in the tables, for example, titanium oxide particles coated with oxygen-deficient tin oxide (oxygen-deficient tin oxide-coated titanium oxide particles) do not correspond to the first metal oxide particle according to the present invention and oxygen-deficient tin oxide particles do not correspond to the second metal oxide particle according to the present invention, but the particles were shown in the respective columns for convenience as examples to be compared with the present invention. The same holds true for the following.

It should be noted that P-doped tin oxide-coated titanium oxide particles used in the preparation of the conductive-layer coating solutions CP-C26 to CP-C28, CP-C31 to CP-C32, CP-C153, and CP-C154 had a powder resistivity of 5,000 Ω·cm.

In addition, P-doped tin oxide-coated barium sulfate particles used in the preparation of the conductive-layer coating solution CP-C35 had a powder resistivity of 5,000 Ω·cm.

In addition, P-doped tin oxide particles used in the preparation of the conductive-layer coating solutions CP-C23 to CP-C25, CP-C29, CP-C30, CP-C35, CP-151, and CP-152 had a powder resistivity of 200 Ω·cm.

In addition, W-doped tin oxide-coated titanium oxide particles used in the preparation of the conductive-layer coating solutions CP-C67 to CP-C69, CP-C104, CP-C157, and CP-C158 had a powder resistivity of 3,000 Ω·cm.

In addition, W-doped tin oxide-coated barium sulfate particles used in the preparation of the conductive-layer coating solution CP-C71 had a powder resistivity of 3,000 Ω·cm.

In addition, W-doped tin oxide particles used in the preparation of the conductive-layer coating solutions CP-C31, CP-C64 to CP-C66, CP-C70, CP-C71, CP-C155, and CP-C156 had a powder resistivity of 100 Ω·cm.

In addition, F-doped tin oxide-coated titanium oxide particles used in the preparation of the conductive-layer coating solutions CP-C30, CP-C70, CP-C101 to CP-C103, CP-C161, and CP-C162 had a powder resistivity of 5,000 Ω·cm.

In addition, F-doped tin oxide-coated barium sulfate particles used in the preparation of the conductive-layer coating solution CP-C105 had a powder resistivity of 5,000 Ω·cm.

In addition, F-doped tin oxide particles used in the preparation of the conductive-layer coating solutions CP-C32, CP-C159, and CP-C160 had a powder resistivity of 220 Ω·cm.

In addition, Nb-doped tin oxide-coated titanium oxide particles used in the preparation of the conductive-layer coating solutions CP-C151, CP-C155, CP-C159, CP-C166 to CP-C168, and CP-C170 had a powder resistivity of 6,500 Ω·cm.

In addition, Nb-doped tin oxide-coated barium sulfate particles used in the preparation of the conductive-layer coating solution CP-C171 had a powder resistivity of 6,500 Ω·cm.

In addition, Nb-doped tin oxide particles used in the preparation of the conductive-layer coating solutions CP-C153, CP-C157, CP-C161, CP-C163 to CP-C165, CP-C169, and CP-C171 had a powder resistivity of 330 Ω·cm.

In addition, Ta-doped tin oxide-coated titanium oxide particles used in the preparation of the conductive-layer coating solutions CP-C152, CP-C156, CP-C160, CP-C169, and CP-C175 to CP-C177 had a powder resistivity of 4,500 Ω·cm.

In addition, Ta-doped tin oxide-coated barium sulfate particles used in the preparation of the conductive-layer coating solution CP-C178 had a powder resistivity of 4,500 Ω·cm.

In addition, Ta-doped tin oxide particles used in the preparation of the conductive-layer coating solutions CP-C154, CP-C158, CP-C162, CP-C170, CP-C172 to CP-C174, and CP-C178 had a powder resistivity of 160 Ω·cm.

In addition, oxygen-deficient tin oxide-coated titanium oxide particles used in the preparation of the conductive-layer coating solutions CP-C23, CP-C64, CP-C98, CP-C163, and CP-C172 had a powder resistivity of 5,000 Ω·cm.

In addition, oxygen-deficient tin oxide-coated barium sulfate particles used in the preparation of the conductive-layer coating solutions CP-C24, CP-C33, CP-C65, CP-C99, CP-C164, CP-C173, and CP-C179 had a powder resistivity of 5,000 Ω·cm.

In addition, Sb-doped tin oxide-coated titanium oxide particles used in the preparation of the conductive-layer coating solutions CP-C25, CP-C34, CP-C66, CP-C100, CP-C165, and CP-C174 had a powder resistivity of 3,000 Ω·cm.

In addition, oxygen-deficient tin oxide particles used in the preparation of the conductive-layer coating solutions CP-C26, CP-C33, CP-C67, CP-C101, CP-C166, CP-C175, and CP-C179 had a powder resistivity of 200 Ω·cm.

In addition, indium tin oxide particles used in the preparation of the conductive-layer coating solutions CP-C27, CP-C68, CP-C102, CP-C167, and CP-C176 had a powder resistivity of 100 Ω·cm.

In addition, Sb-doped tin oxide particles used in the preparation of the conductive-layer coating solutions CP-C28, CP-C34, CP-C69, CP-C103, CP-C168, and CP-C177 had a powder resistivity of 100 Ω·cm.

(Preparation Example of Conductive-Layer Coating Solution CP-C36)

The intermediate-layer coating liquid of Example 1 described in Patent Literature 4 was prepared by the following operations and defined as a conductive-layer coating solution CP-C36.

That is, 20 parts of barium sulfate particles coated with oxygen-deficient tin oxide (coating ratio: 50% by mass, average primary particle diameter: 600 nm, specific gravity: 5.1 (density=5.1 g/cm$^3$)), 100 parts of a tin oxide particle doped with antimony (trade name: T-1, manufactured by Mitsubishi Materials Corporation, average primary particle diameter: 20 nm, powder resistivity: 5 Ω·cm, specific gravity: 6.6 (density=6.6 g/cm$^3$)), 70 parts of a resol-type phenol resin (trade name: PLYOPHEN J-325, manufactured by DIC Corporation, resin solid content: 60%) as a binding material, and 100 parts of 2-methoxy-1-propanol were loaded into a ball mill, and were then subjected to a dispersion treatment for 20 hours to prepare a conductive-layer coating solution CP-C36.

(Preparation Example of Conductive-Layer Coating Solution CP-C37)

A conductive-layer coating solution CP-C37 was prepared by the same operations as those of the preparation example of the conductive-layer coating solution CP-C36 except that the tin oxide particle doped with antimony were changed to a tin oxide particle doped with tantalum (average primary particle diameter: 20 nm, specific gravity: 6.1 (density=6.1 g/cm$^3$)).

(Preparation Example of Conductive-Layer Coating Solution CP-C38)

The conductive layer coating fluid L-7 described in Patent Literature 2 was prepared by the following operations and defined as a conductive-layer coating solution CP-C38.

That is, 46 parts of P-doped tin oxide-coated titanium oxide particles (average primary particle diameter: 220 nm, powder resistivity: 100 Ω·cm, amount (doping ratio) of phosphorus doped into tin oxide: 7% by mass, coating ratio: 15%), 36.5 parts of a phenol resin (trade name: PLYOPHEN J-325, manufactured by DIC Corporation, resin solid content: 60% by mass) as a binding material, and 50 parts of 1-methoxy-2-propanol as a solvent were loaded into a sand mill using glass beads each having a diameter of 0.5 mm, and were then subjected to a dispersion treatment under the following dispersion treatment conditions to provide a dispersion solution: a disc rotation number of 2,500 rpm and a dispersion treatment time of 3.5 hours.

3.9 Parts of silicone resin particles (trade name: TOSPEARL 120, manufactured by Momentive Performance Materials Inc., average particle diameter: 2 μm) as a surface roughness providing material and 0.001 part of a silicone oil (trade name: SH28PA, manufactured by Dow Corning Toray Silicone Co., Ltd.) as a leveling agent were added to the dispersion solution, and then the mixture was stirred to prepare a conductive-layer coating solution CP-C38.

(Preparation Example of Conductive-Layer Coating Solution CP-C39)

The conductive layer coating fluid L-21 described in Patent Literature 2 was prepared by the following operations and defined as a conductive-layer coating solution CP-C39.

That is, 44 parts of P-doped tin oxide-coated titanium oxide particles (average primary particle diameter: 40 nm, powder resistivity: 500 Ω·cm, amount (doping ratio) of phosphorus doped into tin oxide: 8% by mass, coating ratio: 20%), 36.5 parts of a phenol resin (trade name: PLYOPHEN J-325, manufactured by DIC Corporation, resin solid content: 60% by mass) as a binding material, and 50 parts of 1-methoxy-2-propanol as a solvent were loaded into a sand mill using glass beads each having a diameter of 0.5 mm, and were then subjected to a dispersion treatment under the following dispersion treatment conditions to provide a dispersion solution: a disc rotation number of 2,500 rpm and a dispersion treatment time of 3.5 hours.

3.9 Parts of silicone resin particles (trade name: TOSPEARL 120, manufactured by Momentive Performance Materials Inc., average particle diameter: 2 μm) as a surface roughness providing material and 0.001 part of a silicone oil (trade name: SH28PA, manufactured by Dow Corning Toray Silicone Co., Ltd.) as a leveling agent were added to the dispersion solution, and then the mixture was stirred to prepare a conductive-layer coating solution CP-C39.

(Preparation Example of Conductive-Layer Coating Solution CP-C40)

The conductive layer coating fluid 1 described in Patent Literature 1 was prepared by the following operations and defined as a conductive-layer coating solution CP-C40.

That is, 204 parts of P-doped tin oxide-coated titanium oxide particles (powder resistivity: 40 Ω·cm, coating ratio: 35% by mass, amount (doping ratio) of phosphorus doped into tin oxide: 3% by mass), 148 parts of a phenol resin (trade name: PLYOPHEN J-325, manufactured by DIC Corporation, resin solid content: 60% by mass) as a binding material, and 98 parts of 1-methoxy-2-propanol as a solvent were loaded into a sand mill using 450 parts of glass beads each having a diameter of 0.8 mm, and were then subjected to a dispersion treatment under the following dispersion treatment conditions to provide a dispersion solution: a number of rotation of 2,000 rpm, a dispersion treatment time of 4 hours, and a setting temperature of cooling water of 18° C.

The glass beads were removed from the dispersion solution with a mesh. After that, 13.8 parts of silicone resin particles (trade name: TOSPEARL 120, manufactured by Momentive Performance Materials Inc., average particle diameter: 2 μm) as a surface roughness providing material, 0.014 part of a silicone oil (trade name: SH28PA, manufactured by Dow Corning Toray Silicone Co., Ltd.) as a leveling agent, 6 parts of methanol, and 6 parts of 1-methoxy-2-propanol were added to the dispersion solution, and then the mixture was stirred to prepare a conductive-layer coating solution CP-C40.

(Preparation Example of Conductive-Layer Coating Solution CP-C41)

The conductive layer coating fluid 4 described in Patent Literature 1 was prepared by the following operations and defined as a conductive-layer coating solution CP-C41.

That is, 204 parts of P-doped tin oxide-coated titanium oxide particles (powder resistivity: 500 Ω·cm, coating ratio: 35% by mass, amount (doping ratio) of phosphorus (P) doped into tin oxide ($SnO_2$): 0.05% by mass), 148 parts of a phenol resin (trade name: PLYOPHEN J-325, manufactured by DIC Corporation, resin solid content: 60% by mass) as a binding material, and 98 parts of 1-methoxy-2-propanol as a solvent were loaded into a sand mill using 450 parts of glass beads each having a diameter of 0.8 mm, and were then subjected to a dispersion treatment under the following dispersion treatment conditions to provide a dispersion solution: a number of rotation of 2,000 rpm, a dispersion treatment time of 4 hours, and a setting temperature of cooling water of 18° C.

The glass beads were removed from the dispersion solution with a mesh. After that, 13.8 parts of silicone resin particles (trade name: TOSPEARL 120, manufactured by Momentive Performance Materials Inc., average particle diameter: 2 μm)

as a surface roughness providing material, 0.014 part of a silicone oil (trade name: SH28PA, manufactured by Dow Corning Toray Silicone Co., Ltd.) as a leveling agent, 6 parts of methanol, and 6 parts of 1-methoxy-2-propanol were added to the dispersion solution, and then the mixture was stirred to prepare a conductive-layer coating solution CP-C41.

(Preparation Example of Conductive-Layer Coating Solution CP-C72)

The conductive layer coating fluid L-10 described in Patent Literature 2 was prepared by the following operations and defined as a conductive-layer coating solution CP-C72.

That is, 53 parts of W-doped tin oxide-coated titanium oxide particles (average primary particle diameter: 220 nm, powder resistivity: 150 Ω·cm, amount (doping ratio) of tungsten doped into tin oxide: 7% by mass, coating ratio: 15%), 36.5 parts of a phenol resin (trade name: PLYOPHEN J-325, manufactured by DIC Corporation, resin solid content: 60% by mass) as a binding material, and 50 parts of 1-methoxy-2-propanol as a solvent were loaded into a sand mill using glass beads each having a diameter of 0.5 mm, and were then subjected to a dispersion treatment under the following dispersion treatment conditions to provide a dispersion solution: a disc rotation number of 2,500 rpm and a dispersion treatment time of 3.5 hours.

The glass beads were removed from the dispersion solution with a mesh. After that, 3.9 parts of silicone resin particles (trade name: TOSPEARL 120, manufactured by Momentive Performance Materials Inc., average particle diameter: 2 μm) as a surface roughness providing material and 0.001 part of a silicone oil (trade name: SH28PA, manufactured by Dow Corning Toray Silicone Co., Ltd.) as a leveling agent were added to the dispersion solution, and then the mixture was stirred to prepare a conductive-layer coating solution CP-C72.

(Preparation Example of Conductive-Layer Coating Solution CP-C73)

The conductive layer coating fluid L-22 described in Patent Literature 2 was prepared by the following operations and defined as a conductive-layer coating solution CP-C73.

That is, 46 parts of W-doped tin oxide-coated titanium oxide particles (average primary particle diameter: 40 nm, powder resistivity: 550 Ω·cm, amount (doping ratio) of tungsten doped into tin oxide: 8% by mass, coating ratio: 20%), 36.5 parts of a phenol resin (trade name: PLYOPHEN J-325, manufactured by DIC Corporation, resin solid content: 60% by mass) as a binding material, and 50 parts of 1-methoxy-2-propanol as a solvent were loaded into a sand mill using glass beads each having a diameter of 0.5 mm, and were then subjected to a dispersion treatment under the following dispersion treatment conditions to provide a dispersion solution: a disc rotation number of 2,500 rpm and a dispersion treatment time of 3.5 hours.

3.9 Parts of silicone resin particles (trade name: TOSPEARL 120, manufactured by Momentive Performance Materials Inc., average particle diameter: 2 μm) as a surface roughness providing material and 0.001 part of a silicone oil (trade name: SH28PA, manufactured by Dow Corning Toray Silicone Co., Ltd.) as a leveling agent were added to the dispersion solution, and then the mixture was stirred to prepare the conductive layer coating fluid L-22 described in Patent Literature 2. The coating solution was defined as the conductive-layer coating solution CP-C73.

(Preparation Example of Conductive-Layer Coating Solution CP-C74)

The conductive layer coating fluid 10 described in Patent Literature 1 was prepared by the following operations and defined as a conductive-layer coating solution CP-C74.

That is, 204 parts of W-doped tin oxide-coated titanium oxide particles (powder resistivity: 25 Ω·cm, coating ratio: 33% by mass, amount (doping ratio) of tungsten doped into tin oxide: 3% by mass), 148 parts of a phenol resin (trade name: PLYOPHEN J-325, manufactured by DIC Corporation, resin solid content: 60% by mass) as a binding material, and 98 parts of 1-methoxy-2-propanol as a solvent were loaded into a sand mill using 450 parts of glass beads each having a diameter of 0.8 mm, and were then subjected to a dispersion treatment under the following dispersion treatment conditions to provide a dispersion solution: a number of rotation of 2,000 rpm, a dispersion treatment time of 4 hours, and a setting temperature of cooling water of 18° C.

The glass beads were removed from the dispersion solution with a mesh. After that, 13.8 parts of silicone resin particles (trade name: TOSPEARL 120, manufactured by Momentive Performance Materials Inc., average particle diameter: 2 μm) as a surface roughness providing material, 0.014 part of a silicone oil (trade name: SH28PA, manufactured by Dow Corning Toray Silicone Co., Ltd.) as a leveling agent, 6 parts of methanol, and 6 parts of 1-methoxy-2-propanol were added to the dispersion solution, and then the mixture was stirred to prepare a conductive-layer coating solution CP-C74.

(Preparation Example of Conductive-Layer Coating Solution CP-C75)

The conductive layer coating fluid 13 described in Patent Literature 1 was prepared by the following operations and defined as a conductive-layer coating solution CP-C75.

That is, 204 parts of W-doped tin oxide-coated titanium oxide particles (powder resistivity: 69 Ω·cm, coating ratio: 33% by mass, amount (doping ratio) of tungsten doped into tin oxide: 0.1% by mass), 148 parts of a phenol resin (trade name: PLYOPHEN J-325, manufactured by DIC Corporation, resin solid content: 60% by mass) as a binding material, and 98 parts of 1-methoxy-2-propanol as a solvent were loaded into a sand mill using 450 parts of glass beads each having a diameter of 0.8 mm, and were then subjected to a dispersion treatment under the following dispersion treatment conditions to provide a dispersion solution: a number of rotation of 2,000 rpm, a dispersion treatment time of 4 hours, and a setting temperature of cooling water of 18° C.

The glass beads were removed from the dispersion solution with a mesh. After that, 13.8 parts of silicone resin particles (trade name: TOSPEARL 120, manufactured by Momentive Performance Materials Inc., average particle diameter: 2 um) as a surface roughness providing material, 0.014 part of a silicone oil (trade name: SH28PA, manufactured by Dow Corning Toray Silicone Co., Ltd.) as a leveling agent, 6 parts of methanol, and 6 parts of 1-methoxy-2-propanol were added to the dispersion solution, and then the mixture was stirred to prepare a conductive-layer coating solution CP-C75.

(Preparation Example of Conductive-Layer Coating Solution CP-C106)

The conductive layer coating fluid L-30 described in Patent Literature 2 was prepared by the following operations and defined as a conductive-layer coating solution CP-C106.

That is, 60 parts of F-doped tin oxide-coated titanium oxide particles (average primary particle diameter: 75 nm, powder resistivity: 300 Ω·cm, amount (doping ratio) of fluorine doped into tin oxide: 7% by mass, coating ratio: 15%), 36.5 parts of a phenol resin (trade name: PLYOPHEN J-325, manufactured by DIC Corporation, resin solid content: 60% by mass) as a binding material, and 50 parts of 1-methoxy-2-propanol as a solvent were loaded into a sand mill using glass beads each having a diameter of 0.5 mm, and were then subjected to a dispersion treatment under the following dispersion treatment conditions to provide a dispersion solution: a disc rotation number of 2,500 rpm and a dispersion treatment time of 3.5 hours.

The glass beads were removed from the dispersion solution with a mesh. After that, 3.9 parts of silicone resin particles (trade name: TOSPEARL 120, manufactured by Momentive Performance Materials Inc., average particle diameter: 2 μm) as a surface roughness providing material and 0.001 part of a silicone oil (trade name: SH28PA, manufactured by Dow Corning Toray Silicone Co., Ltd.) as a leveling agent were added to the dispersion solution, and then the mixture was stirred to prepare a conductive-layer coating solution CP-C106.

TABLE 1

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-1 | P-doped | 45 | 4.50 | 5.1 | 112.00 | P-doped | 3.60 | 6.8 | 3.00 | 1.3 | 266.67 | 1.3 | 5.00 | | None | |
| CP-2 | tin | 45 | 4.50 | 5.1 | 112.00 | tin oxide | 4.05 | 6.7 | 2.95 | 1.3 | 266.75 | 1.3 | 5.00 | | | |
| CP-3 | oxide- | 45 | 4.50 | 5.1 | 112.00 | particles | 4.50 | 6.7 | 2.95 | 1.3 | 266.75 | 1.3 | 5.00 | | | |
| CP-4 | coated | 45 | 4.50 | 5.1 | 112.00 | (average | 4.95 | 6.7 | 2.95 | 1.3 | 266.75 | 1.3 | 5.00 | | | |
| CP-5 | titanium | 45 | 4.50 | 5.1 | 112.00 | particle | 5.40 | 6.7 | 2.95 | 1.3 | 266.75 | 1.3 | 5.00 | | | |
| CP-6 | oxide | 45 | 4.50 | 5.1 | 108.50 | diameter: | 4.50 | 6.7 | 7.15 | 1.3 | 265.58 | 1.3 | 5.00 | | | |
| CP-7 | particles | 45 | 4.50 | 5.1 | 99.80 | 20 nm | 3.60 | 6.8 | 17.30 | 1.3 | 263.17 | 1.3 | 5.00 | | | |
| CP-8 | (average | 45 | 4.50 | 5.1 | 99.90 | | 4.05 | 6.7 | 17.06 | 1.3 | 263.40 | 1.3 | 5.00 | | | |
| CP-9 | particle | 45 | 4.50 | 5.1 | 99.90 | | 4.50 | 6.7 | 17.06 | 1.3 | 263.40 | 1.3 | 5.00 | | | |
| CP-10 | diameter: | 45 | 4.50 | 5.1 | 99.90 | | 4.95 | 6.7 | 17.06 | 1.3 | 263.40 | 1.3 | 5.00 | | | |
| CP-11 | 230 nm) | 45 | 4.50 | 5.1 | 99.90 | | 5.40 | 6.7 | 17.06 | 1.3 | 263.40 | 1.3 | 5.00 | | | |
| CP-12 | | 45 | 4.50 | 5.1 | 93.50 | | 4.50 | 6.7 | 24.60 | 1.3 | 261.50 | 1.3 | 5.00 | | | |
| CP-13 | | 45 | 4.50 | 5.1 | 89.30 | | 3.60 | 6.8 | 29.80 | 1.3 | 259.83 | 1.3 | 5.00 | | | |
| CP-14 | | 45 | 4.50 | 5.1 | 89.40 | | 4.05 | 6.7 | 29.40 | 1.3 | 260.33 | 1.3 | 5.00 | | | |
| CP-15 | | 45 | 4.50 | 5.1 | 89.40 | | 4.50 | 6.7 | 29.40 | 1.3 | 260.33 | 1.3 | 5.00 | | | |
| CP-16 | | 45 | 4.50 | 5.1 | 89.40 | | 4.95 | 6.7 | 29.40 | 1.3 | 260.33 | 1.3 | 5.00 | | | |
| CP-17 | | 45 | 4.50 | 5.1 | 89.40 | | 5.40 | 6.7 | 29.40 | 1.3 | 260.33 | 1.3 | 5.00 | | | |
| CP-18 | | 45 | 4.50 | 5.1 | 135.50 | | 4.50 | 6.7 | 3.00 | 1.3 | 226.50 | 1.3 | 5.00 | | | |
| CP-19 | | 45 | 4.50 | 5.1 | 131.00 | | 3.60 | 6.8 | 8.75 | 1.3 | 225.42 | 1.3 | 5.00 | | | |
| CP-20 | | 45 | 4.50 | 5.1 | 131.10 | | 4.05 | 6.7 | 8.65 | 1.3 | 225.42 | 1.3 | 5.00 | | | |
| CP-21 | | 45 | 4.50 | 5.1 | 131.10 | | 4.50 | 6.7 | 8.65 | 1.3 | 225.42 | 1.3 | 5.00 | | | |
| CP-22 | | 45 | 4.50 | 5.1 | 131.10 | | 4.95 | 6.7 | 8.65 | 1.3 | 225.42 | 1.3 | 5.00 | | | |
| CP-23 | | 45 | 4.50 | 5.1 | 131.10 | | 5.40 | 6.7 | 8.65 | 1.3 | 225.42 | 1.3 | 5.00 | | | |
| CP-24 | | 45 | 4.50 | 5.1 | 120.50 | | 3.60 | 6.8 | 20.90 | 1.3 | 222.67 | 1.3 | 5.00 | | | |
| CP-25 | | 45 | 4.50 | 5.1 | 120.60 | | 4.05 | 6.7 | 20.60 | 1.3 | 223.00 | 1.3 | 5.00 | | | |
| CP-26 | | 45 | 4.50 | 5.1 | 120.60 | | 4.50 | 6.7 | 20.60 | 1.3 | 223.00 | 1.3 | 5.00 | | | |
| CP-27 | | 45 | 4.50 | 5.1 | 120.60 | | 4.95 | 6.7 | 20.60 | 1.3 | 223.00 | 1.3 | 5.00 | | | |
| CP-28 | | 45 | 4.50 | 5.1 | 120.60 | | 5.40 | 6.7 | 20.60 | 1.3 | 223.00 | 1.3 | 5.00 | | | |
| CP-29 | | 45 | 4.50 | 5.1 | 112.50 | | 3.60 | 6.8 | 30.00 | 1.3 | 220.83 | 1.3 | 5.00 | | | |
| CP-30 | | 45 | 4.50 | 5.1 | 112.60 | | 4.05 | 6.7 | 29.60 | 1.3 | 221.33 | 1.3 | 5.00 | | | |
| CP-31 | | 45 | 4.50 | 5.1 | 112.60 | | 4.50 | 6.7 | 29.60 | 1.3 | 221.33 | 1.3 | 5.00 | | | |
| CP-32 | | 45 | 4.50 | 5.1 | 112.60 | | 4.95 | 6.7 | 29.60 | 1.3 | 221.33 | 1.3 | 5.00 | | | |
| CP-33 | | 45 | 4.50 | 5.1 | 112.60 | | 5.40 | 6.7 | 29.60 | 1.3 | 221.33 | 1.3 | 5.00 | | | |
| CP-34 | | 45 | 4.50 | 5.1 | 107.60 | | 4.50 | 6.7 | 35.35 | 1.3 | 220.08 | 1.3 | 5.00 | | | |
| CP-35 | | 45 | 4.30 | 5.1 | 171.50 | | 3.60 | 6.8 | 4.60 | 1.3 | 164.83 | 1.3 | 5.00 | | | |
| CP-36 | | 45 | 4.50 | 5.1 | 171.50 | | 4.05 | 6.7 | 4.50 | 1.3 | 165.00 | 1.3 | 5.00 | | | |
| CP-37 | | 45 | 4.50 | 5.1 | 171.50 | | 4.50 | 6.7 | 4.50 | 1.3 | 165.00 | 1.3 | 5.00 | | | |
| CP-38 | | 45 | 4.50 | 5.1 | 171.50 | | 4.95 | 6.7 | 4.50 | 1.3 | 165.00 | 1.3 | 5.00 | | | |
| CP-39 | | 45 | 4.50 | 5.1 | 171.50 | | 5.40 | 6.7 | 4.50 | 1.3 | 165.00 | 1.3 | 5.00 | | | |
| CP-40 | | 45 | 4.50 | 5.1 | 165.60 | | 3.60 | 6.8 | 11.05 | 1.3 | 163.92 | 1.3 | 5.00 | | | |

TABLE 2

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-41 | P-doped | 45 | 4.50 | 5.1 | 165.70 | P-doped | 4.05 | 6.7 | 10.90 | 1.3 | 164.00 | 1.3 | 5.00 | | None | |
| CP-42 | tin | 45 | 4.50 | 5.1 | 165.70 | tin oxide | 4.50 | 6.7 | 10.90 | 1.3 | 164.00 | 1.3 | 5.00 | | | |
| CP-43 | oxide- | 45 | 4.50 | 5.1 | 165.70 | particles | 4.95 | 6.7 | 10.90 | 1.3 | 164.00 | 1.3 | 5.00 | | | |
| CP-44 | coated | 45 | 4.50 | 5.1 | 165.70 | (average | 5.40 | 6.7 | 10.90 | 1.3 | 164.00 | 1.3 | 5.00 | | | |
| CP-45 | titanium | 45 | 4.50 | 5.1 | 151.80 | particle | 3.60 | 6.8 | 26.35 | 1.3 | 161.42 | 1.3 | 5.00 | | | |
| CP-46 | oxide | 45 | 4.50 | 5.1 | 151.95 | diameter: | 4.05 | 6.7 | 25.95 | 1.3 | 161.83 | 1.3 | 5.00 | | | |
| CP-47 | particles | 45 | 4.50 | 5.1 | 151.95 | 20 nm | 4.50 | 6.7 | 25.95 | 1.3 | 161.83 | 1.3 | 5.00 | | | |
| CP-48 | (average | 45 | 4.50 | 5.1 | 151.95 | | 4.95 | 6.7 | 25.95 | 1.3 | 161.83 | 1.3 | 5.00 | | | |
| CP-49 | particle | 45 | 4.50 | 5.1 | 151.95 | | 5.40 | 6.7 | 25.95 | 1.3 | 161.83 | 1.3 | 5.00 | | | |
| CP-50 | diameter: | 45 | 4.50 | 5.1 | 141.40 | | 3.60 | 6.8 | 37.70 | 1.3 | 159.83 | 1.3 | 5.00 | | | |
| CP-51 | 230 nm) | 45 | 4.50 | 5.1 | 141.70 | | 4.05 | 6.7 | 37.25 | 1.3 | 160.08 | 1.3 | 5.00 | | | |
| CP-52 | | 45 | 4.50 | 5.1 | 141.70 | | 4.50 | 6.7 | 37.25 | 1.3 | 160.08 | 1.3 | 5.00 | | | |
| CP-53 | | 45 | 4.50 | 5.1 | 141.70 | | 4.95 | 6.7 | 37.25 | 1.3 | 160.08 | 1.3 | 5.00 | | | |
| CP-54 | | 45 | 4.50 | 5.1 | 141.70 | | 5.40 | 6.7 | 37.25 | 1.3 | 160.08 | 1.3 | 5.00 | | | |
| CP-55 | | 45 | 4.50 | 5.1 | 134.80 | | 3.60 | 6.8 | 45.00 | 1.3 | 158.67 | 1.3 | 5.00 | | | |
| CP-56 | | 45 | 4.50 | 5.1 | 135.15 | | 4.05 | 6.7 | 44.40 | 1.3 | 159.08 | 1.3 | 5.00 | | | |
| CP-57 | | 45 | 4.50 | 5.1 | 135.15 | | 4.50 | 6.7 | 44.40 | 1.3 | 159.08 | 1.3 | 5.00 | | | |
| CP-58 | | 45 | 4.50 | 5.1 | 135.15 | | 4.95 | 6.7 | 44.40 | 1.3 | 159.08 | 1.3 | 5.00 | | | |
| CP-59 | | 45 | 4.50 | 5.1 | 135.15 | | 5.40 | 6.7 | 44.40 | 1.3 | 159.08 | 1.3 | 5.00 | | | |
| CP-60 | | 45 | 4.50 | 5.1 | 197.70 | | 4.50 | 6.7 | 5.20 | 1.3 | 120.17 | 1.3 | 5.00 | | | |
| CP-61 | | 45 | 4.50 | 5.1 | 190.70 | | 3.60 | 6.8 | 12.75 | 1.3 | 119.25 | 1.3 | 5.00 | | | |
| CP-62 | | 45 | 4.50 | 5.1 | 190.85 | | 4.05 | 6.7 | 12.55 | 1.3 | 119.33 | 1.3 | 5.00 | | | |
| CP-63 | | 45 | 4.50 | 5.1 | 190.85 | | 4.50 | 6.7 | 12.55 | 1.3 | 119.33 | 1.3 | 5.00 | | | |
| CP-64 | | 45 | 4.50 | 5.1 | 190.85 | | 4.95 | 6.7 | 12.55 | 1.3 | 119.33 | 1.3 | 5.00 | | | |
| CP-65 | | 45 | 4.50 | 5.1 | 190.85 | | 5.40 | 6.7 | 12.55 | 1.3 | 119.33 | 1.3 | 5.00 | | | |
| CP-66 | | 45 | 4.50 | 5.1 | 174.40 | | 3.60 | 6.8 | 30.30 | 1.3 | 117.17 | 1.3 | 5.00 | | | |
| CP-67 | | 45 | 4.50 | 5.1 | 174.70 | | 4.05 | 6.7 | 29.90 | 1.3 | 117.33 | 1.3 | 5.00 | | | |
| CP-68 | | 45 | 4.50 | 5.1 | 174.70 | | 4.50 | 6.7 | 29.90 | 1.3 | 117.33 | 1.3 | 5.00 | | | |
| CP-69 | | 45 | 4.50 | 5.1 | 174.70 | | 4.95 | 6.7 | 29.90 | 1.3 | 117.33 | 1.3 | 5.00 | | | |
| CP-70 | | 45 | 4.50 | 5.1 | 174.70 | | 5.40 | 6.7 | 29.90 | 1.3 | 117.33 | 1.3 | 5.00 | | | |
| CP-71 | | 45 | 4.50 | 5.1 | 162.30 | | 3.60 | 6.8 | 43.30 | 1.3 | 115.67 | 1.3 | 5.00 | | | |
| CP-72 | | 45 | 4.50 | 5.1 | 162.70 | | 4.05 | 6.7 | 42.75 | 1.3 | 115.92 | 1.3 | 5.00 | | | |
| CP-73 | | 45 | 4.50 | 5.1 | 162.70 | | 4.50 | 6.7 | 42.75 | 1.3 | 115.92 | 1.3 | 5.00 | | | |
| CP-74 | | 45 | 4.50 | 5.1 | 162.70 | | 4.95 | 6.7 | 42.75 | 1.3 | 115.92 | 1.3 | 5.00 | | | |
| CP-75 | | 45 | 4.50 | 5.1 | 162.70 | | 5.40 | 6.7 | 42.75 | 1.3 | 115.92 | 1.3 | 5.00 | | | |
| CP-76 | | 45 | 4.50 | 5.1 | 155.05 | | 4.50 | 6.7 | 50.95 | 1.3 | 115.00 | 1.3 | 5.00 | | | |
| CP-77 | | 45 | 4.50 | 5.1 | 208.30 | | 3.60 | 6.8 | 5.60 | 1.3 | 101.83 | 1.3 | 5.00 | | | |
| CP-78 | | 45 | 4.50 | 5.1 | 208.25 | | 4.05 | 6.7 | 5.56 | 1.3 | 101.98 | 1.3 | 5.00 | | | |
| CP-79 | | 45 | 4.50 | 5.1 | 208.25 | | 4.50 | 6.7 | 5.56 | 1.3 | 101.98 | 1.3 | 5.00 | | | |
| CP-80 | | 45 | 4.50 | 5.1 | 208.25 | | 4.95 | 6.7 | 5.56 | 1.3 | 101.98 | 1.3 | 5.00 | | | |

TABLE 3

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-81 | P-doped | 45 | 4.50 | 5.1 | 208.25 | P-doped | 5.40 | 6.7 | 5.56 | 1.3 | 101.98 | 1.3 | 5.00 | | None | |
| CP-82 | tin | 45 | 4.50 | 5.1 | 201.10 | tin oxide | 4.50 | 6.7 | 13.20 | 1.3 | 101.17 | 1.3 | 5.00 | | | |
| CP-83 | oxide- | 45 | 4.50 | 5.1 | 183.55 | particles | 3.60 | 6.8 | 31.90 | 1.3 | 99.25 | 1.3 | 5.00 | | | |
| CP-84 | coated | 45 | 4.50 | 5.1 | 183.90 | (average | 4.05 | 6.7 | 31.40 | 1.3 | 99.50 | 1.3 | 5.00 | | | |
| CP-85 | titanium | 45 | 4.50 | 5.1 | 183.90 | particle | 4.50 | 6.7 | 31.40 | 1.3 | 99.50 | 1.3 | 5.00 | | | |
| CP-86 | oxide | 45 | 4.50 | 5.1 | 183.90 | diameter: | 4.95 | 6.7 | 31.40 | 1.3 | 99.50 | 1.3 | 5.00 | | | |
| CP-87 | particles | 45 | 4.50 | 5.1 | 183.90 | 20 nm | 5.40 | 6.7 | 31.40 | 1.3 | 99.50 | 1.3 | 5.00 | | | |
| CP-88 | (average | 45 | 4.50 | 5.1 | 171.10 | | 4.50 | 6.7 | 45.00 | 1.3 | 98.17 | 1.3 | 5.00 | | | |
| CP-89 | particle | 45 | 4.50 | 5.1 | 162.50 | | 3.60 | 6.8 | 54.20 | 1.3 | 97.17 | 1.3 | 5.00 | | | |
| CP-90 | diameter: | 45 | 4.50 | 5.1 | 163.00 | | 4.05 | 6.7 | 53.55 | 1.3 | 97.42 | 1.3 | 5.00 | | | |
| CP-91 | 230 nm) | 45 | 4.50 | 5.1 | 163.00 | | 4.50 | 6.7 | 53.55 | 1.3 | 97.42 | 1.3 | 5.00 | | | |
| CP-92 | | 45 | 4.50 | 5.1 | 163.00 | | 4.95 | 6.7 | 53.55 | 1.3 | 97.42 | 1.3 | 5.00 | | | |
| CP-93 | | 45 | 4.50 | 5.1 | 163.00 | | 5.40 | 6.7 | 53.55 | 1.3 | 97.42 | 1.3 | 5.00 | | | |
| CP-94 | | 45 | 4.50 | 5.1 | 135.40 | | 3.60 | 6.8 | 9.05 | 1.3 | 159.25 | 1.3 | 40.00 | Uncoated | 4.2 | 30.00 |
| CP-95 | | 45 | 4.50 | 5.1 | 135.40 | | 4.05 | 6.7 | 8.90 | 1.3 | 159.50 | 1.3 | 40.00 | titanium | 4.2 | 30.00 |
| CP-96 | | 45 | 4.50 | 5.1 | 135.40 | | 4.50 | 6.7 | 8.90 | 1.3 | 159.50 | 1.3 | 40.00 | oxide | 4.2 | 30.00 |
| CP-97 | | 45 | 4.50 | 5.1 | 135.40 | | 4.95 | 6.7 | 8.90 | 1.3 | 159.50 | 1.3 | 40.00 | particles | 4.2 | 30.00 |
| CP-98 | | 45 | 4.50 | 5.1 | 135.40 | | 5.40 | 6.7 | 8.90 | 1.3 | 159.50 | 1.3 | 40.00 | (average | 4.2 | 30.00 |
| CP-99 | | 45 | 4.50 | 5.1 | 124.50 | | 3.60 | 6.8 | 21.60 | 1.3 | 156.50 | 1.3 | 40.00 | particle | 4.2 | 30.00 |
| CP-100 | | 45 | 4.50 | 5.1 | 124.50 | | 4.05 | 6.7 | 21.30 | 1.3 | 157.00 | 1.3 | 40.00 | diameter: | 4.2 | 30.00 |
| CP-101 | | 45 | 4.50 | 5.1 | 124.50 | | 4.50 | 6.7 | 21.30 | 1.3 | 157.00 | 1.3 | 40.00 | 210 nm | 4.2 | 30.00 |
| CP-102 | | 45 | 4.50 | 5.1 | 124.50 | | 4.95 | 6.7 | 21.30 | 1.3 | 157.00 | 1.3 | 40.00 | | 4.2 | 30.00 |
| CP-103 | | 45 | 4.50 | 5.1 | 124.50 | | 5.40 | 6.7 | 21.30 | 1.3 | 157.00 | 1.3 | 40.00 | | 4.2 | 30.00 |
| CP-104 | | 45 | 4.50 | 5.1 | 116.20 | | 3.60 | 6.8 | 31.00 | 1.3 | 154.67 | 1.3 | 40.00 | | 4.2 | 30.00 |
| CP-105 | | 45 | 4.50 | 5.1 | 116.40 | | 4.05 | 6.7 | 30.60 | 1.3 | 155.00 | 1.3 | 40.00 | | 4.2 | 30.00 |
| CP-106 | | 45 | 4.50 | 5.1 | 116.40 | | 4.50 | 6.7 | 30.60 | 1.3 | 155.00 | 1.3 | 40.00 | | 4.2 | 30.00 |
| CP-107 | | 45 | 4.50 | 5.1 | 116.40 | | 4.95 | 6.7 | 30.60 | 1.3 | 155.00 | 1.3 | 40.00 | | 4.2 | 30.00 |
| CP-108 | | 45 | 4.50 | 5.1 | 116.40 | | 5.40 | 6.7 | 30.60 | 1.3 | 155.00 | 1.3 | 40.00 | | 4.2 | 30.00 |
| CP-109 | | 45 | 4.50 | 5.1 | 171.10 | | 3.60 | 6.8 | 11.40 | 1.3 | 95.83 | 1.3 | 40.00 | | 4.2 | 30.00 |
| CP-110 | | 45 | 4.50 | 5.1 | 171.20 | | 4.05 | 6.7 | 11.25 | 1.3 | 95.92 | 1.3 | 40.00 | | 4.2 | 30.00 |
| CP-111 | | 45 | 4.50 | 5.1 | 171.20 | | 4.50 | 6.7 | 11.25 | 1.3 | 95.92 | 1.3 | 40.00 | | 4.2 | 30.00 |
| CP-112 | | 45 | 4.50 | 5.1 | 171.20 | | 4.95 | 6.7 | 11.25 | 1.3 | 95.92 | 1.3 | 40.00 | | 4.2 | 30.00 |
| CP-113 | | 45 | 4.50 | 5.1 | 171.20 | | 5.40 | 6.7 | 11.25 | 1.3 | 95.92 | 1.3 | 40.00 | | 4.2 | 30.00 |
| CP-114 | | 45 | 4.50 | 5.1 | 156.80 | | 3.60 | 6.8 | 27.20 | 1.3 | 93.33 | 1.3 | 40.00 | | 4.2 | 30.00 |
| CP-115 | | 45 | 4.50 | 5.1 | 157.00 | | 4.05 | 6.7 | 26.85 | 1.3 | 93.58 | 1.3 | 40.00 | | 4.2 | 30.00 |
| CP-116 | | 45 | 4.50 | 5.1 | 157.00 | | 4.50 | 6.7 | 26.85 | 1.3 | 93.58 | 1.3 | 40.00 | | 4.2 | 30.00 |
| CP-117 | | 45 | 4.50 | 5.1 | 157.00 | | 4.95 | 6.7 | 26.85 | 1.3 | 93.58 | 1.3 | 40.00 | | 4.2 | 30.00 |
| CP-118 | | 45 | 4.50 | 5.1 | 157.00 | | 5.40 | 6.7 | 26.85 | 1.3 | 93.58 | 1.3 | 40.00 | | 4.2 | 30.00 |
| CP-119 | | 45 | 4.50 | 5.1 | 146.10 | | 3.60 | 6.8 | 39.00 | 1.3 | 91.50 | 1.3 | 40.00 | | 4.2 | 30.00 |
| CP-120 | | 45 | 4.50 | 5.1 | 146.40 | | 4.05 | 6.7 | 38.50 | 1.3 | 91.83 | 1.3 | 40.00 | | 4.2 | 30.00 |

TABLE 4

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-121 | P-doped | 45 | 4.50 | 5.1 | 146.40 | P-doped | 4.50 | 6.7 | 38.50 | 1.3 | 91.83 | 1.3 | 40.00 | Uncoated | 4.2 | 30.00 |
| CP-122 | tin | 45 | 4.50 | 5.1 | 146.40 | tin oxide | 4.95 | 6.7 | 38.50 | 1.3 | 91.83 | 1.3 | 40.00 | titanium | 4.2 | 30.00 |
| CP-123 | oxide- | 45 | 4.50 | 5.1 | 146.40 | particles | 5.40 | 6.7 | 38.50 | 1.3 | 91.83 | 1.3 | 40.00 | oxide | 4.2 | 30.00 |
| CP-124 | coated | 45 | 4.50 | 5.1 | 197.05 | (average | 3.60 | 6.8 | 13.15 | 1.3 | 49.67 | 1.3 | 40.00 | particles | 4.2 | 30.00 |
| CP-125 | titanium | 45 | 4.50 | 5.1 | 197.20 | particle | 4.05 | 6.7 | 13.00 | 1.3 | 49.67 | 1.3 | 40.00 | (average | 4.2 | 30.00 |
| CP-126 | oxide | 45 | 4.50 | 5.1 | 197.20 | diameter: | 4.50 | 6.7 | 13.00 | 1.3 | 49.67 | 1.3 | 40.00 | particle | 4.2 | 30.00 |
| CP-127 | particles | 45 | 4.50 | 5.1 | 197.20 | 20 nm | 4.95 | 6.7 | 13.00 | 1.3 | 49.67 | 1.3 | 40.00 | diameter: | 4.2 | 30.00 |
| CP-128 | (average | 45 | 4.50 | 5.1 | 197.20 | | 5.40 | 6.7 | 13.00 | 1.3 | 49.67 | 1.3 | 40.00 | 210 nm | 4.2 | 30.00 |
| CP-129 | particle | 45 | 4.50 | 5.1 | 180.20 | | 3.60 | 6.8 | 31.30 | 1.3 | 47.50 | 1.3 | 40.00 | | 4.2 | 30.00 |
| CP-130 | diameter: | 45 | 4.50 | 5.1 | 180.50 | | 4.05 | 6.7 | 30.85 | 1.3 | 47.75 | 1.3 | 40.00 | | 4.2 | 30.00 |
| CP-131 | 230 nm) | 45 | 4.50 | 5.1 | 180.50 | | 4.50 | 6.7 | 30.85 | 1.3 | 47.75 | 1.3 | 40.00 | | 4.2 | 30.00 |
| CP-132 | | 45 | 4.50 | 5.1 | 180.50 | | 4.95 | 6.7 | 30.85 | 1.3 | 47.75 | 1.3 | 40.00 | | 4.2 | 30.00 |
| CP-133 | | 45 | 4.50 | 5.1 | 180.50 | | 5.40 | 6.7 | 30.85 | 1.3 | 47.75 | 1.3 | 40.00 | | 4.2 | 30.00 |
| CP-134 | | 45 | 4.50 | 5.1 | 167.65 | | 3.60 | 6.8 | 44.75 | 1.3 | 46.00 | 1.3 | 40.00 | | 4.2 | 30.00 |
| CP-135 | | 45 | 4.50 | 5.1 | 168.05 | | 4.05 | 6.7 | 44.16 | 1.3 | 46.32 | 1.3 | 40.00 | | 4.2 | 30.00 |
| CP-136 | | 45 | 4.50 | 5.1 | 168.05 | | 4.50 | 6.7 | 44.16 | 1.3 | 46.32 | 1.3 | 40.00 | | 4.2 | 30.00 |
| CP-137 | | 45 | 4.50 | 5.1 | 168.05 | | 4.95 | 6.7 | 44.16 | 1.3 | 46.32 | 1.3 | 40.00 | | 4.2 | 30.00 |
| CP-138 | | 45 | 4.50 | 5.1 | 168.05 | | 5.40 | 6.7 | 44.16 | 1.3 | 46.32 | 1.3 | 40.00 | | 4.2 | 30.00 |
| CP-139 | | 45 | 4.50 | 5.1 | 157.00 | | 4.50 | 6.7 | 26.85 | 1.3 | 93.58 | 1.3 | 40.00 | | 4.2 | 30.00 |
| CP-140 | | 45 | 4.50 | 5.1 | 161.00 | | 4.50 | 6.7 | 22.85 | 1.3 | 93.58 | 1.3 | 40.00 | | 4.2 | 30.00 |

TABLE 5

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-C1 | P-doped tin | 45 | 4.50 | 5.1 | 114.60 | | None | | | 1.3 | 267.33 | 1.3 | 5.00 | | None | |
| CP-C2 | oxide-coated | 45 | 4.50 | 5.1 | 175.60 | | | | | 1.3 | 165.67 | 1.3 | 5.00 | | | |
| CP-C3 | titanium | 45 | 4.50 | 5.1 | 213.50 | | | | | 1.3 | 102.50 | 1.3 | 5.00 | | | |
| CP-C4 | oxide | 45 | 4.50 | 5.1 | 113.25 | P-doped | 4.50 | 6.7 | 1.49 | 1.3 | 267.10 | 1.3 | 5.00 | | | |
| CP-C5 | particles | 45 | 4.50 | 5.1 | 173.50 | tin oxide | 4.50 | 6.7 | 2.27 | 1.3 | 165.38 | 1.3 | 5.00 | | | |
| CP-C6 | (average | 45 | 4.50 | 5.1 | 210.90 | particles | 4.50 | 6.7 | 2.80 | 1.3 | 102.17 | 1.3 | 5.00 | | | |
| CP-C7 | particle | 45 | 4.50 | 5.1 | 85.60 | (average | 4.50 | 6.7 | 33.75 | 1.3 | 259.42 | 1.3 | 5.00 | | | |
| CP-C8 | diameter: | 45 | 4.50 | 5.1 | 129.20 | particle | 4.50 | 6.7 | 50.95 | 1.3 | 158.08 | 1.3 | 5.00 | | | |
| CP-C9 | 230 nm) | 45 | 4.50 | 5.1 | 155.65 | diameter: | 4.50 | 6.7 | 61.35 | 1.3 | 96.67 | 1.3 | 5.00 | | | |
| CP-C10 | | | None | | | 20 nm | 4.50 | 6.7 | 133.40 | 1.3 | 236.00 | 1.3 | 5.00 | | | |
| CP-C11 | | | | | | | 4.50 | 6.7 | 192.80 | 1.3 | 137.00 | 1.3 | 5.00 | | | |
| CP-C12 | | | | | | | 4.50 | 6.7 | 226.40 | 1.3 | 81.00 | 1.3 | 5.00 | | | |
| CP-C13 | P-doped tin | 45 | 4.50 | 5.1 | 83.20 | | 4.50 | 6.7 | 2.20 | 1.3 | 316.00 | 1.3 | 5.00 | | | |
| CP-C14 | oxide-coated | 45 | 4.50 | 5.1 | 80.60 | | 4.50 | 6.7 | 5.30 | 1.3 | 315.17 | 1.3 | 5.00 | | | |
| CP-C15 | titanium | 45 | 4.50 | 5.1 | 74.50 | | 4.50 | 6.7 | 12.75 | 1.3 | 312.92 | 1.3 | 5.00 | | | |
| CP-C16 | oxide | 45 | 4.50 | 5.1 | 69.75 | | 4.50 | 6.7 | 18.35 | 1.3 | 311.50 | 1.3 | 5.00 | | | |
| CP-C17 | particles | 45 | 4.50 | 5.1 | 66.70 | | 4.50 | 6.7 | 21.92 | 1.3 | 310.63 | 1.3 | 5.00 | | | |
| CP-C18 | (average | 45 | 4.50 | 5.1 | 217.70 | | 4.50 | 6.7 | 5.75 | 1.3 | 85.92 | 1.3 | 5.00 | | | |
| CP-C19 | particle | 45 | 4.50 | 5.1 | 210.05 | | 4.50 | 6.7 | 13.80 | 1.3 | 85.25 | 1.3 | 5.00 | | | |
| CP-C20 | diameter: | 45 | 4.50 | 5.1 | 191.95 | | 4.50 | 6.7 | 32.80 | 1.3 | 83.75 | 1.3 | 5.00 | | | |
| CP-C21 | 230 nm) | 45 | 4.50 | 5.1 | 178.50 | | 4.50 | 6.7 | 46.95 | 1.3 | 82.58 | 1.3 | 5.00 | | | |
| CP-C22 | | 45 | 4.50 | 5.1 | 169.98 | | 4.50 | 6.7 | 55.85 | 1.3 | 81.95 | 1.3 | 5.00 | | | |

TABLE 6

| Conductive-layer coating solution | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part(s)] | Kind | Density | Amount [part(s)] |
| CP-C23 | Oxygen-deficient tin oxide-coated titanium oxide particles (average particle diameter: 230 nm) | 45 | — | 5.1 | 152.00 | P-doped tin oxide particles (average particle diameter 20 nm) | 4.50 | 6.7 | 26.00 | 1.3 | 161.67 | 1.3 | 5.00 | None | | |
| CP-C24 | Oxygen-deficient tin oxide-coated barium sulfate particles (average particle diameter: 230 nm) | 45 | — | 5.1 | 152.00 | | 4.50 | 6.7 | 26.00 | 1.3 | 161.67 | 1.3 | 5.00 | | | |
| CP-C25 | Sb-doped tin oxide-coated titanium oxide particles (average particle diameter: 230 nm) | 45 | 4.50 | 5.1 | 152.00 | | 4.50 | 6.7 | 26.00 | 1.3 | 161.67 | 1.3 | 5.00 | | | |
| CP-C26 | P-doped tin oxide-coated titanium oxide particles (average particle diameter: 230 nm) | 45 | 4.50 | 5.1 | 152.20 | Oxygen-deficient tin oxide particles (average particle diameter: 20 nm) | — | 6.6 | 25.60 | 1.3 | 162.00 | 1.3 | 5.00 | | | |
| CP-C27 | P-doped tin oxide-coated titanium oxide particles (average particle diameter: 230 nm) | 45 | 4.50 | 5.1 | 152.10 | Indium tin oxide particles (average particle diameter: 20 nm) | 4.50 | 7.1 | 27.35 | 1.3 | 160.92 | 1.3 | 5.00 | | | |
| CP-C28 | | 45 | 4.50 | 5.1 | 152.20 | Sb-doped tin oxide particles (average | 4.50 | 6.6 | 25.60 | 1.3 | 162.00 | 1.3 | 5.00 | | | |

TABLE 6-continued

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-C29 | W-doped tin oxide-coated titanium oxide particles (average particle diameter: 230 nm) | 45 | 4.50 | 52 | 153.30 | particle diameter: 20 nm) P-doped tin oxide particles (average particle diameter: 20 nm) | 4.50 | 6.7 | 25.70 | 1.3 | 160.00 | 1.3 | 5.00 | | | |

TABLE 7

| Conductive-layer coating solution | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part(s)] | Kind | Density | Amount [part(s)] |
| CP-C30 | F-doped tin oxide-coated titanium oxide particles (average particle diameter: 230 nm) | 45 | 4.50 | 5.0 | 150.60 | P-doped tin oxide particles (average particle diameter: 20 nm) | 4.50 | 6.7 | 26.25 | 1.3 | 163.58 | 1.3 | 5.00 | | None | |
| CP-C31 | P-doped tin oxide-coated titanium oxide particles (average particle diameter: 230 nm) | 45 | 4.50 | 5.1 | 150.20 | W-doped tin oxide particles (average particle diameter: 20 nm) | 4.50 | 7.5 | 28.80 | 1.3 | 160.00 | 1.3 | 5.00 | | | |
| CP-C32 | | 45 | 4.50 | 5.1 | 152.20 | F-doped tin oxide particles (average particle diameter: 20 nm) | 4.50 | 6.6 | 25.60 | 1.3 | 162.00 | 1.3 | 5.00 | | | |
| CP-C33 | Oxygen-deficient tin oxide-coated barium sulfate particles (average particle diameter: 230 nm) | 45 | — | 5.1 | 152.20 | Oxygen-deficient tin oxide particles (average particle diameter: 20 nm) | — | 6.6 | 25.60 | 1.3 | 162.00 | 1.3 | 5.00 | | | |
| CP-C34 | Sb-doped tin oxide-coated titanium oxide particles (average particle diameter: 230 nm) | 45 | 4.50 | 5.1 | 152.20 | Sb-doped tin oxide particles (average particle diameter: 20 nm) | 4.50 | 6.6 | 25.60 | 1.3 | 162.00 | 1.3 | 5.00 | | | |
| CP-C35 | P-doped tin oxide-coated barium sulfate particles (average particle | 45 | 4.50 | 5.1 | 151.90 | P-doped tin oxide particles (average particle diameter: | 4.50 | 6.7 | 26.00 | 1.3 | 161.83 | 1.3 | 5.00 | | | |

TABLE 7-continued

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| | diameter: 230 nm) | | | | | 20 nm) | | | | | | | | | | |

TABLE 8

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-141 | W-doped | 45 | 4.50 | 5.2 | 113.20 | W-doped | 3.60 | 7.4 | 3.22 | 1.3 | 264.30 | 1.3 | 5.00 | | None | |
| CP-142 | tin | 45 | 4.50 | 5.2 | 113.20 | tin oxide | 4.05 | 7.5 | 3.26 | 1.3 | 264.23 | 1.3 | 5.00 | | | |
| CP-143 | oxide- | 45 | 4.50 | 5.2 | 113.20 | particles | 4.50 | 7.5 | 3.26 | 1.3 | 264.23 | 1.3 | 5.00 | | | |
| CP-144 | coated | 45 | 4.50 | 5.2 | 113.20 | (average | 4.95 | 7.6 | 3.31 | 1.3 | 264.15 | 1.3 | 5.00 | | | |
| CP-145 | titanium | 45 | 4.50 | 5.2 | 113.20 | particle | 5.40 | 7.6 | 3.31 | 1.3 | 264.15 | 1.3 | 5.00 | | | |
| CP-146 | oxide | 45 | 4.50 | 5.2 | 109.40 | diameter: | 4.50 | 7.5 | 7.90 | 1.3 | 262.83 | 1.3 | 5.00 | | | |
| CP-147 | particles | 45 | 4.50 | 5.2 | 100.50 | 20 nm | 3.60 | 7.4 | 18.60 | 1.3 | 259.83 | 1.3 | 5.00 | | | |
| CP-148 | (average | 45 | 4.50 | 5.2 | 100.50 | | 4.05 | 7.5 | 18.85 | 1.3 | 259.42 | 1.3 | 5.00 | | | |
| CP-149 | particle | 45 | 4.50 | 5.2 | 100.50 | | 4.50 | 7.5 | 18.85 | 1.3 | 259.42 | 1.3 | 5.00 | | | |
| CP-150 | diameter: | 45 | 4.50 | 5.2 | 100.40 | | 4.95 | 7.6 | 19.10 | 1.3 | 259.17 | 1.3 | 5.00 | | | |
| CP-151 | 230 nm) | 45 | 4.50 | 5.2 | 100.40 | | 5.40 | 7.6 | 19.10 | 1.3 | 259.17 | 1.3 | 5.00 | | | |
| CP-152 | | 45 | 4.50 | 5.2 | 93.70 | | 4.50 | 7.5 | 27.05 | 1.3 | 257.08 | 1.3 | 5.00 | | | |
| CP-153 | | 45 | 4.50 | 5.2 | 89.55 | | 3.60 | 7.4 | 31.86 | 1.3 | 255.98 | 1.3 | 5.00 | | | |
| CP-154 | | 45 | 4.50 | 5.2 | 89.48 | | 4.05 | 7.5 | 32.26 | 1.3 | 255.43 | 1.3 | 5.00 | | | |
| CP-155 | | 45 | 4.50 | 5.2 | 89.48 | | 4.50 | 7.5 | 32.26 | 1.3 | 255.43 | 1.3 | 5.00 | | | |
| CP-156 | | 45 | 4.50 | 5.2 | 89.30 | | 4.95 | 7.6 | 32.65 | 1.3 | 255.08 | 1.3 | 5.00 | | | |
| CP-157 | | 45 | 4.50 | 5.2 | 89.30 | | 5.40 | 7.6 | 32.65 | 1.3 | 255.08 | 1.3 | 5.00 | | | |
| CP-158 | | 45 | 4.50 | 5.2 | 136.65 | | 4.50 | 7.5 | 3.97 | 1.3 | 223.97 | 1.3 | 5.00 | | | |
| CP-159 | | 45 | 4.50 | 5.2 | 132.00 | | 3.60 | 7.4 | 9.40 | 1.3 | 222.67 | 1.3 | 5.00 | | | |
| CP-160 | | 45 | 4.50 | 5.2 | 132.00 | | 4.05 | 7.5 | 9.55 | 1.3 | 222.42 | 1.3 | 5.00 | | | |
| CP-161 | | 45 | 4.50 | 5.2 | 132.00 | | 4.50 | 7.5 | 9.55 | 1.3 | 222.42 | 1.3 | 5.00 | | | |
| CP-162 | | 45 | 4.50 | 5.2 | 131.90 | | 4.95 | 7.6 | 9.65 | 1.3 | 222.42 | 1.3 | 5.00 | | | |
| CP-163 | | 45 | 4.50 | 5.2 | 131.90 | | 5.40 | 7.6 | 9.65 | 1.3 | 222.42 | 1.3 | 5.00 | | | |
| CP-164 | | 45 | 4.50 | 5.2 | 121.00 | | 3.60 | 7.4 | 22.40 | 1.3 | 219.33 | 1.3 | 5.00 | | | |
| CP-165 | | 45 | 4.50 | 5.2 | 120.85 | | 4.05 | 7.5 | 22.67 | 1.3 | 219.13 | 1.3 | 5.00 | | | |
| CP-166 | | 45 | 4.50 | 5.2 | 120.85 | | 4.50 | 7.5 | 22.67 | 1.3 | 219.13 | 1.3 | 5.00 | | | |
| CP-167 | | 45 | 4.50 | 5.2 | 120.70 | | 4.95 | 7.6 | 22.95 | 1.3 | 218.92 | 1.3 | 5.00 | | | |
| CP-168 | | 45 | 4.50 | 5.2 | 120.70 | | 5.40 | 7.6 | 22.95 | 1.3 | 218.92 | 1.3 | 5.00 | | | |
| CP-169 | | 45 | 4.50 | 5.2 | 112.75 | | 3.60 | 7.4 | 32.10 | 1.3 | 216.92 | 1.3 | 5.00 | | | |
| CP-170 | | 45 | 4.50 | 5.2 | 112.55 | | 4.05 | 7.5 | 32.50 | 1.3 | 216.58 | 1.3 | 5.00 | | | |
| CP-171 | | 45 | 4.50 | 5.2 | 112.55 | | 4.50 | 7.5 | 32.50 | 1.3 | 216.58 | 1.3 | 5.00 | | | |
| CP-172 | | 45 | 4.50 | 5.2 | 112.40 | | 4.95 | 7.6 | 32.85 | 1.3 | 216.25 | 1.3 | 5.00 | | | |
| CP-173 | | 45 | 4.50 | 5.2 | 112.40 | | 5.40 | 7.6 | 32.85 | 1.3 | 216.25 | 1.3 | 5.00 | | | |
| CP-174 | | 45 | 4.50 | 5.2 | 107.30 | | 4.50 | 7.5 | 38.70 | 1.3 | 215.00 | 1.3 | 5.00 | | | |
| CP-175 | | 45 | 4.50 | 5.2 | 172.50 | | 3.60 | 7.4 | 4.90 | 1.3 | 162.67 | 1.3 | 5.00 | | | |
| CP-176 | | 45 | 4.50 | 5.2 | 172.40 | | 4.05 | 7.5 | 5.00 | 1.3 | 162.67 | 1.3 | 5.00 | | | |
| CP-177 | | 45 | 4.50 | 5.2 | 172.40 | | 4.50 | 7.5 | 5.00 | 1.3 | 162.67 | 1.3 | 5.00 | | | |
| CP-178 | | 45 | 4.50 | 5.2 | 172.40 | | 4.95 | 7.6 | 5.05 | 1.3 | 162.58 | 1.3 | 5.00 | | | |
| CP-179 | | 45 | 4.50 | 5.2 | 172.40 | | 5.40 | 7.6 | 5.05 | 1.3 | 162.58 | 1.3 | 5.00 | | | |
| CP-180 | | 45 | 4.50 | 5.2 | 166.30 | | 3.60 | 7.4 | 11.05 | 1.3 | 161.42 | 1.3 | 5.00 | | | |

TABLE 9

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-181 | W-doped | 45 | 4.50 | 5.2 | 166.20 | W-doped | 4.05 | 7.5 | 12.00 | 1.3 | 161.33 | 1.3 | 5.00 | | None | |
| CP-182 | tin | 45 | 4.50 | 5.2 | 166.20 | tin oxide | 4.50 | 7.5 | 12.00 | 1.3 | 161.33 | 1.3 | 5.00 | | | |
| CP-183 | oxide- | 45 | 4.50 | 5.2 | 166.10 | particles | 4.95 | 7.6 | 12.15 | 1.3 | 161.25 | 1.3 | 5.00 | | | |
| CP-184 | coated | 45 | 4.50 | 5.2 | 166.10 | (average | 5.40 | 7.6 | 12.15 | 1.3 | 161.25 | 1.3 | 5.00 | | | |
| CP-185 | titanium | 45 | 4.50 | 5.2 | 151.80 | particle | 3.60 | 7.4 | 28.15 | 1.3 | 158.42 | 1.3 | 5.00 | | | |
| CP-186 | oxide | 45 | 4.50 | 5.2 | 151.60 | diameter: | 4.05 | 7.5 | 28.45 | 1.3 | 158.25 | 1.3 | 5.00 | | | |
| CP-187 | particles | 45 | 4.50 | 5.2 | 151.60 | 20 nm | 4.50 | 7.5 | 28.45 | 1.3 | 158.25 | 1.3 | 5.00 | | | |
| CP-188 | (average | 45 | 4.50 | 5.2 | 151.45 | | 4.95 | 7.6 | 28.80 | 1.3 | 157.92 | 1.3 | 5.00 | | | |
| CP-189 | particle | 45 | 4.50 | 5.2 | 151.45 | | 5.40 | 7.6 | 28.80 | 1.3 | 157.92 | 1.3 | 5.00 | | | |
| CP-190 | diameter: | 45 | 4.50 | 5.2 | 141.10 | | 3.60 | 7.4 | 40.20 | 1.3 | 156.17 | 1.3 | 5.00 | | | |
| CP-191 | 230 nm) | 45 | 4.50 | 5.2 | 140.85 | | 4.05 | 7.5 | 40.65 | 1.3 | 155.83 | 1.3 | 5.00 | | | |
| CP-192 | | 45 | 4.50 | 5.2 | 140.85 | | 4.50 | 7.5 | 40.65 | 1.3 | 155.83 | 1.3 | 5.00 | | | |
| CP-193 | | 45 | 4.50 | 5.2 | 140.55 | | 4.95 | 7.6 | 41.10 | 1.3 | 155.58 | 1.3 | 5.00 | | | |
| CP-194 | | 45 | 4.50 | 5.2 | 140.55 | | 5.40 | 7.6 | 41.10 | 1.3 | 155.58 | 1.3 | 5.00 | | | |
| CP-195 | | 45 | 4.50 | 5.2 | 134.30 | | 3.60 | 7.4 | 47.80 | 1.3 | 154.83 | 1.3 | 5.00 | | | |
| CP-196 | | 45 | 4.50 | 5.2 | 134.05 | | 4.05 | 7.5 | 48.35 | 1.3 | 154.33 | 1.3 | 5.00 | | | |
| CP-197 | | 45 | 4.50 | 5.2 | 134.05 | | 4.50 | 7.5 | 48.35 | 1.3 | 154.33 | 1.3 | 5.00 | | | |
| CP-198 | | 45 | 4.50 | 5.2 | 133.70 | | 4.95 | 7.6 | 48.90 | 1.3 | 154.00 | 1.3 | 5.00 | | | |
| CP-199 | | 45 | 4.50 | 5.2 | 133.70 | | 5.40 | 7.6 | 48.90 | 1.3 | 154.00 | 1.3 | 5.00 | | | |
| CP-200 | | 45 | 4.50 | 5.2 | 198.40 | | 4.50 | 7.5 | 5.75 | 1.3 | 118.08 | 1.3 | 5.00 | | | |
| CP-201 | | 45 | 4.50 | 5.2 | 191.15 | | 3.60 | 7.4 | 13.60 | 1.3 | 117.08 | 1.3 | 5.00 | | | |
| CP-202 | | 45 | 4.50 | 5.2 | 191.00 | | 4.05 | 7.5 | 13.80 | 1.3 | 117.00 | 1.3 | 5.00 | | | |
| CP-203 | | 45 | 4.50 | 5.2 | 191.00 | | 4.50 | 7.5 | 13.80 | 1.3 | 117.00 | 1.3 | 5.00 | | | |
| CP-204 | | 45 | 4.50 | 5.2 | 190.90 | | 4.95 | 7.6 | 13.95 | 1.3 | 116.92 | 1.3 | 5.00 | | | |
| CP-205 | | 45 | 4.50 | 5.2 | 190.90 | | 5.40 | 7.6 | 13.95 | 1.3 | 116.92 | 1.3 | 5.00 | | | |
| CP-206 | | 45 | 4.50 | 5.2 | 174.10 | | 3.60 | 7.4 | 32.20 | 1.3 | 114.50 | 1.3 | 5.00 | | | |
| CP-207 | | 45 | 4.50 | 5.2 | 173.76 | | 4.05 | 7.5 | 32.60 | 1.3 | 114.50 | 1.3 | 5.00 | | | |
| CP-208 | | 45 | 4.50 | 5.2 | 173.76 | | 4.50 | 7.5 | 32.60 | 1.3 | 114.50 | 1.3 | 5.00 | | | |
| CP-209 | | 45 | 4.50 | 5.2 | 173.50 | | 4.95 | 7.6 | 33.00 | 1.3 | 114.17 | 1.3 | 5.00 | | | |
| CP-210 | | 45 | 4.50 | 5.2 | 173.50 | | 5.40 | 7.6 | 33.00 | 1.3 | 114.17 | 1.3 | 5.00 | | | |
| CP-211 | | 45 | 4.50 | 5.2 | 161.45 | | 3.60 | 7.4 | 45.95 | 1.3 | 112.67 | 1.3 | 5.00 | | | |
| CP-212 | | 45 | 4.50 | 5.2 | 161.05 | | 4.05 | 7.5 | 46.50 | 1.3 | 112.42 | 1.3 | 5.00 | | | |
| CP-213 | | 45 | 4.50 | 5.2 | 161.05 | | 4.50 | 7.5 | 46.50 | 1.3 | 112.42 | 1.3 | 5.00 | | | |
| CP-214 | | 45 | 4.50 | 5.2 | 160.70 | | 4.95 | 7.6 | 47.00 | 1.3 | 112.17 | 1.3 | 5.00 | | | |
| CP-215 | | 45 | 4.30 | 5.2 | 160.70 | | 5.40 | 7.6 | 47.00 | 1.3 | 112.17 | 1.3 | 5.00 | | | |
| CP-216 | | 45 | 4.50 | 5.2 | 153.10 | | 4.50 | 7.5 | 55.20 | 1.3 | 111.17 | 1.3 | 5.00 | | | |
| CP-217 | | 45 | 4.50 | 5.2 | 208.90 | | 3.60 | 7.4 | 6.00 | 1.3 | 100.17 | 1.3 | 5.00 | | | |
| CP-218 | | 45 | 4.50 | 5.2 | 208.85 | | 4.05 | 7.5 | 6.07 | 1.3 | 100.13 | 1.3 | 5.00 | | | |
| CP-219 | | 45 | 4.50 | 5.2 | 208.85 | | 4.50 | 7.5 | 6.07 | 1.3 | 100.13 | 1.3 | 5.00 | | | |
| CP-220 | | 45 | 4.50 | 5.2 | 208.85 | | 4.95 | 7.6 | 6.10 | 1.3 | 100.08 | 1.3 | 5.00 | | | |

TABLE 10

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-221 | W-doped | 45 | 4.50 | 5.2 | 208.85 | W-doped | 5.40 | 7.6 | 6.10 | 1.3 | 100.08 | 1.3 | 5.00 | | None | |
| CP-222 | tin | 45 | 4.50 | 5.2 | 201.00 | tin oxide | 4.50 | 7.5 | 14.50 | 1.3 | 99.17 | 1.3 | 5.00 | | | |
| CP-223 | oxide- | 45 | 4.50 | 5.2 | 183.00 | particles | 3.60 | 7.4 | 33.85 | 1.3 | 96.92 | 1.3 | 5.00 | | | |
| CP-224 | coated | 45 | 4.50 | 5.2 | 182.65 | (average | 4.05 | 7.5 | 34.30 | 1.3 | 96.75 | 1.3 | 5.00 | | | |
| CP-225 | titanium | 45 | 4.50 | 5.2 | 182.65 | particle | 4.50 | 7.5 | 34.30 | 1.3 | 96.75 | 1.3 | 5.00 | | | |
| CP-226 | oxide | 45 | 4.50 | 5.2 | 182.35 | diameter: | 4.95 | 7.6 | 34.70 | 1.3 | 96.58 | 1.3 | 5.00 | | | |
| CP-227 | particles | 45 | 4.50 | 5.2 | 182.35 | 20 nm | 5.40 | 7.6 | 34.70 | 1.3 | 96.58 | 1.3 | 5.00 | | | |
| CP-228 | (average | 45 | 4.50 | 5.2 | 169.20 | | 4.50 | 7.5 | 48.80 | 1.3 | 95.00 | 1.3 | 5.00 | | | |
| CP-229 | particle | 45 | 4.50 | 5.2 | 161.10 | | 3.60 | 7.4 | 57.35 | 1.3 | 94.25 | 1.3 | 5.00 | | | |
| CP-230 | diameter: | 45 | 4.50 | 5.2 | 160.67 | | 4.05 | 7.5 | 57.95 | 1.3 | 93.97 | 1.3 | 5.00 | | | |
| CP-231 | 230 nm) | 45 | 4.50 | 5.2 | 160.67 | | 4.50 | 7.5 | 57.95 | 1.3 | 93.97 | 1.3 | 5.00 | | | |
| CP-232 | | 45 | 4.50 | 5.2 | 160.25 | | 4.95 | 7.6 | 58.55 | 1.3 | 93.67 | 1.3 | 5.00 | | | |
| CP-233 | | 45 | 4.50 | 5.2 | 160.25 | | 5.40 | 7.6 | 58.55 | 1.3 | 93.67 | 1.3 | 5.00 | | | |

TABLE 11

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-234 | W-doped | 45 | 4.50 | 5.2 | 136.40 | W-doped | 3.60 | 7.4 | 9.72 | 1.3 | 156.47 | 1.3 | 40.00 | Uncoated | 4.2 | 30.00 |
| CP-235 | tin | 45 | 4.50 | 5.2 | 136.40 | tin oxide | 4.05 | 7.5 | 9.85 | 1.3 | 156.25 | 1.3 | 40.00 | titanium | 4.2 | 30.00 |
| CP-236 | oxide- | 45 | 4.50 | 5.2 | 136.40 | particles | 4.50 | 7.5 | 9.85 | 1.3 | 156.25 | 1.3 | 40.00 | oxide | 4.2 | 30.00 |
| CP-237 | coated | 45 | 4.50 | 5.2 | 136.30 | (average | 4.95 | 7.6 | 9.98 | 1.3 | 156.20 | 1.3 | 40.00 | particles | 4.2 | 30.00 |
| CP-238 | titanium | 45 | 4.50 | 5.2 | 136.30 | particle | 5.40 | 7.6 | 9.98 | 1.3 | 156.20 | 1.3 | 40.00 | (average | 4.2 | 30.00 |
| CP-239 | oxide | 45 | 4.50 | 5.2 | 125.00 | diameter: | 3.60 | 7.4 | 23.15 | 1.3 | 153.08 | 1.3 | 40.00 | particles | 4.2 | 30.00 |
| CP-240 | particles | 45 | 4.50 | 5.2 | 124.90 | 20 nm | 4.05 | 7.5 | 23.44 | 1.3 | 152.77 | 1.3 | 40.00 | diameter | 4.2 | 30.00 |
| CP-241 | (average | 45 | 4.50 | 5.2 | 124.90 | | 4.50 | 7.5 | 23.44 | 1.3 | 152.77 | 1.3 | 40.00 | 210 nm) | 4.2 | 30.00 |
| CP-242 | particle | 45 | 4.50 | 5.2 | 124.70 | | 4.95 | 7.6 | 23.70 | 1.3 | 152.67 | 1.3 | 40.00 | | 4.2 | 30.00 |
| CP-243 | diameter: | 45 | 4.50 | 5.2 | 124.70 | | 5.40 | 7.6 | 23.70 | 1.3 | 152.67 | 1.3 | 40.00 | | 4.2 | 30.00 |
| CP-244 | 230 nm) | 45 | 4.50 | 5.2 | 116.50 | | 3.60 | 7.4 | 33.15 | 1.3 | 150.58 | 1.3 | 40.00 | | 4.2 | 30.00 |
| CP-245 | | 45 | 4.50 | 5.2 | 116.30 | | 4.05 | 7.5 | 33.55 | 1.3 | 150.25 | 1.3 | 40.00 | | 4.2 | 30.00 |
| CP-246 | | 45 | 4.50 | 5.2 | 116.30 | | 4.50 | 7.5 | 33.55 | 1.3 | 150.25 | 1.3 | 40.00 | | 4.2 | 30.00 |
| CP-247 | | 45 | 4.50 | 5.2 | 116.10 | | 4.95 | 7.6 | 33.95 | 1.3 | 149.92 | 1.3 | 40.00 | | 4.2 | 30.00 |
| CP-248 | | 45 | 4.50 | 5.2 | 116.10 | | 5.40 | 7.6 | 33.95 | 1.3 | 149.92 | 1.3 | 40.00 | | 4.2 | 30.00 |
| CP-249 | | 45 | 4.50 | 5.2 | 171.80 | | 3.60 | 7.4 | 12.25 | 1.3 | 93.25 | 1.3 | 40.00 | | 4.2 | 30.00 |
| CP-250 | | 45 | 4.50 | 5.2 | 171.70 | | 4.05 | 7.5 | 12.40 | 1.3 | 93.17 | 1.3 | 40.00 | | 4.2 | 30.00 |
| CP-251 | | 45 | 4.50 | 5.2 | 171.70 | | 4.50 | 7.5 | 12.40 | 1.3 | 93.17 | 1.3 | 40.00 | | 4.2 | 30.00 |
| CP-252 | | 45 | 4.50 | 5.2 | 171.65 | | 4.95 | 7.6 | 12.55 | 1.3 | 93.00 | 1.3 | 40.00 | | 4.2 | 30.00 |
| CP-253 | | 45 | 4.50 | 5.2 | 171.65 | | 5.40 | 7.6 | 12.55 | 1.3 | 93.00 | 1.3 | 40.00 | | 4.2 | 30.00 |
| CP-254 | | 45 | 4.50 | 5.2 | 156.85 | | 3.60 | 7.4 | 29.05 | 1.3 | 90.17 | 1.3 | 40.00 | | 4.2 | 30.00 |
| CP-255 | | 45 | 4.50 | 5.2 | 156.65 | | 4.05 | 7.5 | 29.40 | 1.3 | 89.92 | 1.3 | 40.00 | | 4.2 | 30.00 |
| CP-256 | | 45 | 4.50 | 5.2 | 156.65 | | 4.50 | 7.5 | 29.40 | 1.3 | 89.92 | 1.3 | 40.00 | | 4.2 | 30.00 |
| CP-257 | | 45 | 4.50 | 5.2 | 156.45 | | 4.95 | 7.6 | 29.75 | 1.3 | 89.67 | 1.3 | 40.00 | | 4.2 | 30.00 |
| CP-258 | | 45 | 4.50 | 5.2 | 156.45 | | 5.40 | 7.6 | 29.75 | 1.3 | 89.67 | 1.3 | 40.00 | | 4.2 | 30.00 |
| CP-259 | | 45 | 4.50 | 5.2 | 145.80 | | 3.60 | 7.4 | 41.40 | 1.3 | 87.83 | 1.3 | 40.00 | | 4.2 | 30.00 |
| CP-260 | | 45 | 4.50 | 5.2 | 145.50 | | 4.05 | 7.5 | 42.00 | 1.3 | 87.50 | 1.3 | 40.00 | | 4.2 | 30.00 |
| CP-261 | | 45 | 4.50 | 5.2 | 145.50 | | 4.50 | 7.5 | 42.00 | 1.3 | 87.50 | 1.3 | 40.00 | | 4.2 | 30.00 |
| CP-262 | | 45 | 4.50 | 5.2 | 145.20 | | 4.95 | 7.6 | 42.45 | 1.3 | 87.25 | 1.3 | 40.00 | | 4.2 | 30.00 |
| CP-263 | | 45 | 4.50 | 5.2 | 145.20 | | 5.40 | 7.6 | 42.45 | 1.3 | 87.25 | 1.3 | 40.00 | | 4.2 | 30.00 |
| CP-264 | | 45 | 4.50 | 5.2 | 197.50 | | 3.60 | 7.4 | 14.10 | 1.3 | 47.33 | 1.3 | 40.00 | | 4.2 | 30.00 |
| CP-265 | | 45 | 4.50 | 5.2 | 197.35 | | 4.05 | 7.5 | 14.25 | 1.3 | 47.33 | 1.3 | 40.00 | | 4.2 | 30.00 |
| CP-266 | | 45 | 4.50 | 5.2 | 197.35 | | 4.50 | 7.5 | 14.25 | 1.3 | 47.33 | 1.3 | 40.00 | | 4.2 | 30.00 |
| CP-267 | | 45 | 4.50 | 5.2 | 197.20 | | 4.95 | 7.6 | 14.45 | 1.3 | 47.25 | 1.3 | 40.00 | | 4.2 | 30.00 |
| CP-268 | | 45 | 4.50 | 5.2 | 197.20 | | 5.40 | 7.6 | 14.45 | 1.3 | 47.25 | 1.3 | 40.00 | | 4.2 | 30.00 |
| CP-269 | | 45 | 4.50 | 5.2 | 179.80 | | 3.60 | 7.4 | 33.30 | 1.3 | 44.83 | 1.3 | 40.00 | | 4.2 | 30.00 |
| CP-270 | | 45 | 4.50 | 5.2 | 179.55 | | 4.05 | 7.5 | 33.70 | 1.3 | 44.58 | 1.3 | 40.00 | | 4.2 | 30.00 |

TABLE 12

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-271 | W-doped | 45 | 4.50 | 5.2 | 179.55 | W-doped | 4.50 | 7.5 | 33.70 | 1.3 | 44.58 | 1.3 | 40.00 | Uncoated | 4.2 | 30.00 |
| CP-272 | tin | 45 | 4.50 | 5.2 | 179.30 | tin oxide | 4.95 | 7.6 | 34.10 | 1.3 | 44.33 | 1.3 | 40.00 | titanium | 4.2 | 30.00 |
| CP-273 | oxide- | 45 | 4.50 | 5.2 | 179.30 | particles | 5.40 | 7.6 | 34.10 | 1.3 | 44.33 | 1.3 | 40.00 | oxide | 4.2 | 30.00 |
| CP-274 | coated | 45 | 4.50 | 5.2 | 166.75 | (average | 3.60 | 7.4 | 47.50 | 1.3 | 42.92 | 1.3 | 40.00 | particles | 4.2 | 30.00 |
| CP-275 | titanium | 45 | 4.50 | 5.2 | 166.40 | particle | 4.05 | 7.5 | 48.00 | 1.3 | 42.67 | 1.3 | 40.00 | (average | 4.2 | 30.00 |
| CP-276 | oxide | 45 | 4.50 | 5.2 | 166.40 | diameter: | 4.50 | 7.5 | 48.00 | 1.3 | 42.67 | 1.3 | 40.00 | particles | 4.2 | 30.00 |
| CP-277 | particles | 45 | 4.50 | 5.2 | 166.05 | 20 nm | 4.95 | 7.6 | 48.55 | 1.3 | 42.33 | 1.3 | 40.00 | diameter | 4.2 | 30.00 |
| CP-278 | (average | 45 | 4.50 | 5.2 | 166.05 | | 5.40 | 7.6 | 48.55 | 1.3 | 42.33 | 1.3 | 40.00 | 210 nm) | 4.2 | 30.00 |
| CP-279 | particle | 45 | 4.50 | 5.2 | 156.65 | | 4.50 | 7.5 | 29.40 | 1.3 | 89.92 | 1.3 | 40.00 | | 4.2 | 30.00 |
| CP-280 | diameter: 230 nm) | 45 | 4.50 | 5.2 | 160.55 | | 4.50 | 7.5 | 25.50 | 1.3 | 89.92 | 1.3 | 40.00 | | 4.2 | 30.00 |

TABLE 13

| | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| Conductive-layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-C42 | W-doped tin | 45 | 4.50 | 5.2 | 115.85 | | None | | | 1.3 | 265.25 | 1.3 | 5.00 | | None | |
| CP-C43 | oxide-coated | 45 | 4.50 | 5.2 | 176.85 | | | | | 1.3 | 163.58 | 1.3 | 5.00 | | | |
| CP-C44 | titanium | 45 | 4.50 | 5.2 | 214.46 | | | | | 1.3 | 100.90 | 1.3 | 5.00 | | | |
| CP-C45 | oxide | 45 | 4.50 | 5.2 | 114.50 | W-doped | 4.50 | 7.5 | 1.65 | 5.00 | 264.75 | 1.3 | 5.00 | | | |
| CP-C46 | particles | 45 | 4.50 | 5.2 | 174.62 | tin oxide | 4.50 | 7.5 | 2.51 | 1.3 | 163.12 | 1.3 | 5.00 | | | |
| CP-C47 | (average | 45 | 4.50 | 5.2 | 211.63 | particles | 4.50 | 7.5 | 3.05 | 1.3 | 100.53 | 1.3 | 5.00 | | | |
| CP-C48 | particle | 45 | 4.50 | 5.2 | 85.50 | (average | 4.50 | 7.5 | 37.00 | 1.3 | 254.17 | 1.3 | 5.00 | | | |
| CP-C49 | diameter: | 45 | 4.50 | 5.2 | 127.80 | particle | 4.50 | 7.5 | 55.30 | 1.3 | 153.17 | 1.3 | 5.00 | | | |
| CP-C50 | 230 nm) | 45 | 4.50 | 5.2 | 153.01 | diameter: | 4.50 | 7.5 | 66.21 | 1.3 | 92.97 | 1.3 | 5.00 | | | |
| CP-C51 | | | None | | | 20 nm | 4.50 | 7.5 | 141.25 | 1.3 | 222.92 | 1.3 | 5.00 | | | |
| CP-C52 | | | | | | | 4.50 | 7.5 | 199.36 | 1.3 | 126.07 | 1.3 | 5.00 | | | |
| CP-C53 | | | | | | | 4.50 | 7.5 | 231.05 | 1.3 | 73.25 | 1.3 | 5.00 | | | |
| CP-C54 | W-doped tin | 45 | 4.50 | 5.2 | 85.25 | | 4.50 | 7.5 | 2.43 | 1.3 | 313.87 | 1.3 | 5.00 | | | |
| CP-C55 | oxide-coated | 45 | 4.50 | 5.2 | 81.50 | | 4.50 | 7.5 | 5.88 | 1.3 | 312.70 | 1.3 | 5.00 | | | |
| CP-C56 | titanium | 45 | 4.50 | 5.2 | 75.05 | | 4.50 | 7.5 | 14.07 | 1.3 | 309.80 | 1.3 | 5.00 | | | |
| CP-C57 | oxide | 45 | 4.50 | 5.2 | 70.20 | | 4.50 | 7.5 | 20.25 | 1.3 | 307.58 | 1.3 | 5.00 | | | |
| CP-C58 | particles | 45 | 4.50 | 5.2 | 67.10 | | 4.50 | 7.5 | 24.19 | 1.3 | 306.18 | 1.3 | 5.00 | | | |
| CP-C59 | (average | 45 | 4.50 | 5.2 | 218.08 | | 4.50 | 7.5 | 6.30 | 1.3 | 84.37 | 1.3 | 5.00 | | | |
| CP-C60 | particle | 45 | 4.50 | 5.2 | 209.80 | | 4.50 | 7.5 | 15.12 | 1.3 | 83.47 | 1.3 | 5.00 | | | |
| CP-C61 | diameter: | 45 | 4.50 | 5.2 | 190.47 | | 4.50 | 7.5 | 35.72 | 1.3 | 81.35 | 1.3 | 5.00 | | | |
| CP-C62 | 230 nm) | 45 | 4.50 | 5.2 | 176.27 | | 4.50 | 7.5 | 50.85 | 1.3 | 79.80 | 1.3 | 5.00 | | | |
| CP-C63 | | 45 | 4.50 | 5.2 | 167.35 | | 4.50 | 7.5 | 60.35 | 1.3 | 78.83 | 1.3 | 5.00 | | | |

TABLE 14

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-C64 | Oxygen-deficient tin oxide-coated titanium oxide particles (average particle diameter: 230 nm) | 45 | — | 5.1 | 150.26 | W-doped tin oxide particles (average particle diameter: 20 nm) | 4.50 | 7.5 | 28.73 | 1.3 | 160.02 | 1.3 | 5.00 | | None | |
| CP-C65 | Oxygen-deficient tin oxide-coated barium sulfate particles (average particle diameter: 230 nm) | 45 | — | 5.1 | 150.26 | | 4.50 | 7.5 | 28.73 | 1.3 | 160.02 | 1.3 | 5.00 | | | |
| CP-C66 | Sb-doped tin oxide-coated titanium oxide particles (average particle diameter: 230 nm) | 45 | 4.50 | 5.2 | 151.61 | | 4.50 | 7.5 | 28.43 | 1.3 | 158.27 | 1.3 | 5.00 | | | |
| CP-C67 | W-doped tin oxide-coated titanium oxide particles (average particle diameter: 230 nm) | 45 | 4.50 | 5.2 | 153.50 | Oxygen-deficient tin oxide particles (average particle diameter: 20 nm) | — | 6.6 | 25.32 | 1.3 | 160.30 | 1.3 | 5.00 | | | |
| CP-C68 | W-doped tin oxide-coated titanium oxide particles (average particle diameter: 230 nm) | 45 | 4.50 | 5.2 | 152.45 | Indium tin oxide particles (average particle diameter: 20 nm) | 4.50 | 7.1 | 27.05 | 1.3 | 159.17 | 1.3 | 5.00 | | | |
| CP-C69 | W-doped tin oxide-coated titanium oxide | 45 | 4.50 | 5.2 | 153.50 | Sb-doped tin oxide particles | 4.50 | 6.6 | 25.32 | 1.3 | 160.30 | 1.3 | 5.00 | | | |

TABLE 14-continued

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| | particles (average particle diameter: 230 nm) | | | | | (average particle diameter: 20 nm) | | | | | | | | | | |
| CP-C70 | F-doped tin oxide-coated titanium oxide particles (average particle diameter: 230 nm) | 45 | 4.50 | 5.0 | 148.90 | W-doped tin oxide particles (average particle diameter: 20 nm) | 4.50 | 7.5 | 29.03 | 1.3 | 161.78 | 1.3 | 5.00 | | | |
| CP-C71 | W-doped tin oxide-coated barium sulfate particles (average particle diameter: 230 nm) | 45 | 4.50 | 5.2 | 151.61 | | 4.50 | 7.5 | 28.43 | 1.3 | 158.27 | 1.3 | 5.00 | | | |

TABLE 15

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-281 | F-doped | 45 | 4.50 | 5.0 | 110.70 | F-doped | 3.60 | 6.7 | 2.97 | 1.3 | 268.88 | 1.3 | 5.00 | | None | |
| CP-282 | tin | 45 | 4.50 | 5.0 | 110.70 | tin oxide | 4.05 | 6.7 | 2.97 | 1.3 | 268.88 | 1.3 | 5.00 | | | |
| CP-283 | oxide- | 45 | 4.50 | 5.0 | 110.70 | particles | 4.50 | 6.6 | 2.93 | 1.3 | 268.95 | 1.3 | 5.00 | | | |
| CP-284 | coated | 45 | 4.50 | 5.0 | 110.70 | (average | 4.95 | 6.6 | 2.93 | 1.3 | 268.95 | 1.3 | 5.00 | | | |
| CP-285 | titanium | 45 | 4.50 | 5.0 | 110.70 | particle | 5.40 | 6.6 | 2.93 | 1.3 | 268.95 | 1.3 | 5.00 | | | |
| CP-286 | oxide | 45 | 4.50 | 5.0 | 107.15 | diameter: | 4.50 | 6.6 | 7.08 | 1.3 | 267.95 | 1.3 | 5.00 | | | |
| CP-287 | particles | 45 | 4.50 | 5.0 | 98.70 | 20 nm) | 3.60 | 6.7 | 17.20 | 1.3 | 265.17 | 1.3 | 5.00 | | | |
| CP-288 | (average | 45 | 4.50 | 5.0 | 98.70 | | 4.05 | 6.7 | 17.20 | 1.3 | 265.17 | 1.3 | 5.00 | | | |
| CP-289 | particle | 45 | 4.50 | 5.0 | 98.70 | | 4.50 | 6.6 | 16.95 | 1.3 | 265.58 | 1.3 | 5.00 | | | |
| CP-290 | diameter: | 45 | 4.50 | 5.0 | 98.70 | | 4.95 | 6.6 | 16.95 | 1.3 | 265.58 | 1.3 | 5.00 | | | |
| CP-291 | 230 nm) | 45 | 4.50 | 5.0 | 98.70 | | 5.40 | 6.6 | 16.95 | 1.3 | 265.58 | 1.3 | 5.00 | | | |
| CP-292 | | 45 | 4.50 | 5.0 | 92.40 | | 4.50 | 6.6 | 24.40 | 1.3 | 263.67 | 1.3 | 5.00 | | | |
| CP-293 | | 45 | 4.50 | 5.0 | 88.20 | | 3.60 | 6.7 | 29.55 | 1.3 | 262.08 | 1.3 | 5.00 | | | |
| CP-294 | | 45 | 4.50 | 5.0 | 88.20 | | 4.05 | 6.7 | 29.55 | 1.3 | 262.08 | 1.3 | 5.00 | | | |
| CP-295 | | 45 | 4.50 | 5.0 | 88.30 | | 4.50 | 6.6 | 29.15 | 1.3 | 262.58 | 1.3 | 5.00 | | | |
| CP-296 | | 45 | 4.50 | 5.0 | 88.30 | | 4.95 | 6.6 | 29.15 | 1.3 | 262.58 | 1.3 | 5.00 | | | |
| CP-297 | | 45 | 4.50 | 5.0 | 88.30 | | 5.40 | 6.6 | 29.15 | 1.3 | 262.58 | 1.3 | 5.00 | | | |
| CP-298 | | 45 | 4.50 | 5.0 | 134.20 | | 4.50 | 6.6 | 3.55 | 1.3 | 228.75 | 1.3 | 5.00 | | | |
| CP-299 | | 45 | 4.50 | 5.0 | 129.70 | | 3.60 | 6.7 | 8.70 | 1.3 | 227.67 | 1.3 | 5.00 | | | |
| CP-300 | | 45 | 4.50 | 5.0 | 129.70 | | 4.05 | 6.7 | 8.70 | 1.3 | 227.67 | 1.3 | 5.00 | | | |
| CP-301 | | 45 | 4.50 | 5.0 | 129.73 | | 4.50 | 6.6 | 8.57 | 1.3 | 227.83 | 1.3 | 5.00 | | | |
| CP-302 | | 45 | 4.50 | 5.0 | 129.73 | | 4.95 | 6.6 | 8.57 | 1.3 | 227.83 | 1.3 | 5.00 | | | |
| CP-303 | | 45 | 4.50 | 5.0 | 129.73 | | 5.40 | 6.6 | 8.57 | 1.3 | 227.83 | 1.3 | 5.00 | | | |
| CP-304 | | 45 | 4.50 | 5.0 | 119.20 | | 3.60 | 6.7 | 20.80 | 1.3 | 225.00 | 1.3 | 5.00 | | | |
| CP-305 | | 45 | 4.50 | 5.0 | 119.20 | | 4.05 | 6.7 | 20.80 | 1.3 | 225.00 | 1.3 | 5.00 | | | |
| CP-306 | | 45 | 4.50 | 5.0 | 119.30 | | 4.50 | 6.6 | 20.50 | 1.3 | 225.33 | 1.3 | 5.00 | | | |
| CP-307 | | 45 | 4.50 | 5.0 | 119.30 | | 4.95 | 6.6 | 20.50 | 1.3 | 225.33 | 1.3 | 5.00 | | | |
| CP-308 | | 45 | 4.50 | 5.0 | 119.30 | | 5.40 | 6.6 | 20.50 | 1.3 | 225.33 | 1.3 | 5.00 | | | |
| CP-309 | | 45 | 4.50 | 5.0 | 111.40 | | 3.60 | 6.7 | 29.85 | 1.3 | 222.92 | 1.3 | 5.00 | | | |
| CP-310 | | 45 | 4.50 | 5.0 | 111.40 | | 4.05 | 6.7 | 29.85 | 1.3 | 222.92 | 1.3 | 5.00 | | | |
| CP-311 | | 45 | 4.50 | 5.0 | 111.45 | | 4.50 | 6.6 | 29.45 | 1.3 | 223.50 | 1.3 | 5.00 | | | |
| CP-312 | | 45 | 4.50 | 5.0 | 111.45 | | 4.95 | 6.6 | 29.45 | 1.3 | 223.50 | 1.3 | 5.00 | | | |
| CP-313 | | 45 | 4.50 | 5.0 | 111.45 | | 5.40 | 6.6 | 29.45 | 1.3 | 223.50 | 1.3 | 5.00 | | | |
| CP-314 | | 45 | 4.50 | 5.0 | 106.50 | | 4.50 | 6.6 | 35.15 | 1.3 | 222.25 | 1.3 | 5.00 | | | |
| CP-315 | | 45 | 4.50 | 5.0 | 170.20 | | 3.60 | 6.7 | 4.57 | 1.3 | 167.05 | 1.3 | 5.00 | | | |
| CP-316 | | 45 | 4.50 | 5.0 | 170.20 | | 4.05 | 6.7 | 4.57 | 1.3 | 167.05 | 1.3 | 5.00 | | | |
| CP-317 | | 45 | 4.50 | 5.0 | 170.20 | | 4.50 | 6.6 | 4.50 | 1.3 | 167.17 | 1.3 | 5.00 | | | |
| CP-318 | | 45 | 4.50 | 5.0 | 170.20 | | 4.95 | 6.6 | 4.50 | 1.3 | 167.17 | 1.3 | 5.00 | | | |
| CP-319 | | 45 | 4.50 | 5.0 | 170.20 | | 5.40 | 6.6 | 4.50 | 1.3 | 167.17 | 1.3 | 5.00 | | | |
| CP-320 | | 45 | 4.50 | 5.0 | 164.30 | | 3.60 | 6.7 | 11.05 | 1.3 | 166.08 | 1.3 | 5.00 | | | |

TABLE 16

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-321 | F-doped | 45 | 4.50 | 5.0 | 164.30 | F-doped | 4.05 | 6.7 | 11.05 | 1.3 | 166.08 | 1.3 | 5.00 | | None | |
| CP-322 | tin | 45 | 4.50 | 5.0 | 164.45 | tin oxide | 4.50 | 6.7 | 10.86 | 1.3 | 166.15 | 1.3 | 5.00 | | | |
| CP-323 | oxide- | 45 | 4.50 | 5.0 | 164.45 | particles | 4.95 | 6.6 | 10.86 | 1.3 | 166.15 | 1.3 | 5.00 | | | |
| CP-324 | coated | 45 | 4.50 | 5.0 | 164.45 | (average | 5.40 | 6.6 | 10.86 | 1.3 | 166.15 | 1.3 | 5.00 | | | |
| CP-325 | titanium | 45 | 4.50 | 5.0 | 150.60 | particle | 3.60 | 6.7 | 26.25 | 1.3 | 163.58 | 1.3 | 5.00 | | | |
| CP-326 | oxide | 45 | 4.50 | 5.0 | 150.60 | diameter: | 4.05 | 6.7 | 26.25 | 1.3 | 163.58 | 1.3 | 5.00 | | | |
| CP-327 | particles | 45 | 4.50 | 5.0 | 150.80 | 20 nm) | 4.50 | 6.6 | 25.90 | 1.3 | 163.83 | 1.3 | 5.00 | | | |
| CP-328 | (average | 45 | 4.50 | 5.0 | 150.80 | | 4.95 | 6.6 | 25.90 | 1.3 | 163.83 | 1.3 | 5.00 | | | |
| CP-329 | particle | 45 | 4.50 | 5.0 | 150.80 | | 5.40 | 6.6 | 25.90 | 1.3 | 163.83 | 1.3 | 5.00 | | | |
| CP-330 | diameter: | 45 | 4.50 | 5.0 | 140.30 | | 3.60 | 6.7 | 37.60 | 1.3 | 161.83 | 1.3 | 5.00 | | | |
| CP-331 | 230 nm) | 45 | 4.50 | 5.0 | 140.30 | | 4.05 | 6.7 | 37.60 | 1.3 | 161.83 | 1.3 | 5.00 | | | |
| CP-332 | | 45 | 4.50 | 5.0 | 140.55 | | 4.50 | 6.6 | 37.15 | 1.3 | 162.17 | 1.3 | 5.00 | | | |
| CP-333 | | 45 | 4.50 | 5.0 | 140.55 | | 4.95 | 6.6 | 37.15 | 1.3 | 162.17 | 1.3 | 5.00 | | | |
| CP-334 | | 45 | 4.50 | 5.0 | 140.55 | | 5.40 | 6.6 | 37.15 | 1.3 | 162.17 | 1.3 | 5.00 | | | |
| CP-335 | | 45 | 4.50 | 5.0 | 133.80 | | 3.60 | 6.7 | 44.82 | 1.3 | 160.63 | 1.3 | 5.00 | | | |
| CP-336 | | 45 | 4.50 | 5.0 | 133.80 | | 4.05 | 6.7 | 44.82 | 1.3 | 160.63 | 1.3 | 5.00 | | | |
| CP-337 | | 45 | 4.50 | 5.0 | 134.10 | | 4.50 | 6.6 | 44.25 | 1.3 | 161.08 | 1.3 | 5.00 | | | |
| CP-338 | | 45 | 4.50 | 5.0 | 134.10 | | 4.95 | 6.6 | 44.25 | 1.3 | 161.08 | 1.3 | 5.00 | | | |
| CP-339 | | 45 | 4.50 | 5.0 | 134.10 | | 5.40 | 6.6 | 44.25 | 1.3 | 161.08 | 1.3 | 5.00 | | | |
| CP-340 | | 45 | 4.50 | 5.0 | 196.60 | | 4.50 | 6.6 | 5.19 | 1.3 | 122.02 | 1.3 | 5.00 | | | |
| CP-341 | | 45 | 4.50 | 5.0 | 189.70 | | 3.60 | 6.7 | 12.74 | 1.3 | 120.93 | 1.3 | 5.00 | | | |
| CP-342 | | 45 | 4.50 | 5.0 | 189.70 | | 4.05 | 6.7 | 12.74 | 1.3 | 120.93 | 1.3 | 5.00 | | | |
| CP-343 | | 45 | 4.50 | 5.0 | 189.75 | | 4.50 | 6.6 | 12.55 | 1.3 | 121.17 | 1.3 | 5.00 | | | |
| CP-344 | | 45 | 4.50 | 5.0 | 189.75 | | 4.95 | 6.6 | 12.55 | 1.3 | 121.17 | 1.3 | 5.00 | | | |
| CP-345 | | 45 | 4.50 | 5.0 | 189.75 | | 5.40 | 6.6 | 12.55 | 1.3 | 121.17 | 1.3 | 5.00 | | | |
| CP-346 | | 45 | 4.50 | 5.0 | 173.40 | | 3.60 | 6.7 | 30.20 | 1.3 | 119.00 | 1.3 | 5.00 | | | |
| CP-347 | | 45 | 4.50 | 5.0 | 173.40 | | 4.05 | 6.7 | 30.20 | 1.3 | 119.00 | 1.3 | 5.00 | | | |
| CP-348 | | 45 | 4.50 | 5.0 | 173.70 | | 4.50 | 6.6 | 29.80 | 1.3 | 119.17 | 1.3 | 5.00 | | | |
| CP-349 | | 45 | 4.50 | 5.0 | 173.70 | | 4.95 | 6.6 | 29.80 | 1.3 | 119.17 | 1.3 | 5.00 | | | |
| CP-350 | | 45 | 4.50 | 5.0 | 173.70 | | 5.40 | 6.6 | 29.80 | 1.3 | 119.17 | 1.3 | 5.00 | | | |
| CP-351 | | 45 | 4.50 | 5.0 | 161.30 | | 3.60 | 6.7 | 43.25 | 1.3 | 117.42 | 1.3 | 5.00 | | | |
| CP-352 | | 45 | 4.50 | 5.0 | 161.30 | | 4.05 | 6.7 | 43.25 | 1.3 | 117.42 | 1.3 | 5.00 | | | |
| CP-353 | | 45 | 4.50 | 5.0 | 161.70 | | 4.50 | 6.6 | 42.70 | 1.3 | 117.67 | 1.3 | 5.00 | | | |
| CP-354 | | 45 | 4.50 | 5.0 | 161.70 | | 4.95 | 6.6 | 42.70 | 1.3 | 117.67 | 1.3 | 5.00 | | | |
| CP-355 | | 45 | 4.50 | 5.0 | 161.70 | | 5.40 | 6.6 | 42.70 | 1.3 | 117.67 | 1.3 | 5.00 | | | |
| CP-356 | | 45 | 4.50 | 5.0 | 154.10 | | 4.50 | 6.6 | 50.85 | 1.3 | 116.75 | 1.3 | 5.00 | | | |
| CP-357 | | 45 | 4.50 | 5.0 | 204.30 | | 3.60 | 6.7 | 5.56 | 1.3 | 103.57 | 1.3 | 5.00 | | | |
| CP-358 | | 45 | 4.50 | 5.0 | 207.30 | | 4.05 | 6.7 | 5.56 | 1.3 | 103.57 | 1.3 | 5.00 | | | |
| CP-359 | | 45 | 4.50 | 5.0 | 207.35 | | 4.50 | 6.6 | 5.48 | 1.3 | 103.62 | 1.3 | 5.00 | | | |
| CP-360 | | 45 | 4.50 | 5.0 | 207.35 | | 4.95 | 6.6 | 5.48 | 1.3 | 103.62 | 1.3 | 5.00 | | | |

TABLE 17

| Conductive-layer coating solution | (1) A first metal oxide particle | | | | | (2) A second metal oxide particle | | | |
|---|---|---|---|---|---|---|---|---|---|
| | Kind | Coating ratio [%] | Doping ratio [%] | Density | Amount [part(s)] | Kind | Doping ratio [%] | Density | Amount [part(s)] |
| CP-361 | F-doped tin oxide-coated titanium oxide particles (average particle diameter: 230 nm) | 45 | 4.50 | 5.0 | 207.35 | F-doped tin oxide particles (average particle diameter: 20 nm) | 5.40 | 6.6 | 5.48 |
| CP-362 | | 45 | 4.50 | 5.0 | 200.07 | | 4.50 | 6.6 | 13.21 |
| CP-363 | | 45 | 4.50 | 5.0 | 182.62 | | 3.60 | 6.7 | 31.82 |
| CP-364 | | 45 | 4.50 | 5.0 | 182.62 | | 4.05 | 6.7 | 31.82 |
| CP-365 | | 45 | 4.50 | 5.0 | 182.95 | | 4.50 | 6.6 | 31.40 |
| CP-366 | | 45 | 4.50 | 5.0 | 182.95 | | 4.95 | 6.6 | 31.40 |
| CP-367 | | 45 | 4.50 | 5.0 | 182.95 | | 5.40 | 6.6 | 31.40 |
| CP-368 | | 45 | 4.50 | 5.0 | 170.15 | | 4.50 | 6.6 | 44.95 |
| CP-369 | | 45 | 4.50 | 5.0 | 161.65 | | 3.60 | 6.7 | 54.18 |
| CP-370 | | 45 | 4.50 | 5.0 | 161.65 | | 4.05 | 6.7 | 54.18 |
| CP-371 | | 45 | 4.50 | 5.0 | 162.10 | | 4.50 | 6.6 | 53.50 |
| CP-372 | | 45 | 4.50 | 5.0 | 162.10 | | 4.95 | 6.6 | 53.50 |
| CP-373 | | 45 | 4.50 | 5.0 | 162.10 | | 5.40 | 6.6 | 53.50 |

| Conductive-layer coating solution | (3) Binding material (phenol resin) | | (4) Silicone resin particles | | (5) Particles except (1) to (4) | | |
|---|---|---|---|---|---|---|---|
| | Density | Amount [part(s)] (resin solid content thereof is 60% by mass of the following) | Density | Amount [part(s)] | Kind | Density | Amount [part(s)] |
| CP-361 | 1.3 | 103.62 | 1.3 | 5.00 | | None | |
| CP-362 | 1.3 | 102.87 | 1.3 | 5.00 | | | |
| CP-363 | 1.3 | 100.93 | 1.3 | 5.00 | | | |
| CP-364 | 1.3 | 100.93 | 1.3 | 5.00 | | | |
| CP-365 | 1.3 | 101.08 | 1.3 | 5.00 | | | |
| CP-366 | 1.3 | 101.08 | 1.3 | 5.00 | | | |
| CP-367 | 1.3 | 101.08 | 1.3 | 5.00 | | | |
| CP-368 | 1.3 | 99.83 | 1.3 | 5.00 | | | |
| CP-369 | 1.3 | 98.62 | 1.3 | 5.00 | | | |
| CP-370 | 1.3 | 98.62 | 1.3 | 5.00 | | | |
| CP-371 | 1.3 | 99.00 | 1.3 | 5.00 | | | |
| CP-372 | 1.3 | 99.00 | 1.3 | 5.00 | | | |
| CP-373 | 1.3 | 99.00 | 1.3 | 5.00 | | | |

TABLE 18

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-374 | F-doped | 45 | 4.50 | 5.0 | 134.00 | F-doped | 3.60 | 6.7 | 9.00 | 1.3 | 161.67 | 1.3 | 40.00 | Uncoated | 4.2 | 30.00 |
| CP-375 | tin | 45 | 4.50 | 5.0 | 134.00 | tin oxide | 4.05 | 6.7 | 9.00 | 1.3 | 161.67 | 1.3 | 40.00 | titanium | 4.2 | 30.00 |
| CP-376 | oxide- | 45 | 4.50 | 5.0 | 134.10 | particles | 4.50 | 6.6 | 8.85 | 1.3 | 161.75 | 1.3 | 40.00 | oxide | 4.2 | 30.00 |
| CP-377 | coated | 45 | 4.50 | 5.0 | 134.10 | (average | 4.95 | 6.6 | 8.85 | 1.3 | 161.75 | 1.3 | 40.00 | particles | 4.2 | 30.00 |
| CP-378 | titanium | 45 | 4.50 | 5.0 | 134.10 | particle | 5.40 | 6.6 | 8.85 | 1.3 | 161.75 | 1.3 | 40.00 | (average | 4.2 | 30.00 |
| CP-379 | oxide | 45 | 4.50 | 5.0 | 123.15 | diameter: | 3.60 | 6.7 | 21.45 | 1.3 | 159.00 | 1.3 | 40.00 | particle | 4.2 | 30.00 |
| CP-380 | particles | 45 | 4.50 | 5.0 | 123.15 | 20 nm) | 4.05 | 6.7 | 21.45 | 1.3 | 159.00 | 1.3 | 40.00 | diameter: | 4.2 | 30.00 |
| CP-381 | (average | 45 | 4.50 | 5.0 | 123.25 | | 4.50 | 6.6 | 21.15 | 1.3 | 159.33 | 1.3 | 40.00 | 210 nm) | 4.2 | 30.00 |
| CP-382 | particle | 45 | 4.50 | 5.0 | 123.25 | | 4.95 | 6.6 | 21.15 | 1.3 | 159.33 | 1.3 | 40.00 | | 4.2 | 30.00 |
| CP-383 | diameter: | 45 | 4.50 | 5.0 | 123.25 | | 5.40 | 6.6 | 21.15 | 1.3 | 159.33 | 1.3 | 40.00 | | 4.2 | 30.00 |
| CP-384 | 230 nm) | 45 | 4.50 | 5.0 | 115.00 | | 3.60 | 6.7 | 30.85 | 1.3 | 156.92 | 1.3 | 40.00 | | 4.2 | 30.00 |
| CP-385 | | 45 | 4.50 | 5.0 | 115.00 | | 4.05 | 6.7 | 30.85 | 1.3 | 156.92 | 1.3 | 40.00 | | 4.2 | 30.00 |
| CP-386 | | 45 | 4.50 | 5.0 | 115.20 | | 4.50 | 6.6 | 30.45 | 1.3 | 157.25 | 1.3 | 40.00 | | 4.2 | 30.00 |
| CP-387 | | 45 | 4.50 | 5.0 | 115.20 | | 4.95 | 6.6 | 30.45 | 1.3 | 157.25 | 1.3 | 40.00 | | 4.2 | 30.00 |
| CP-388 | | 45 | 4.50 | 5.0 | 115.20 | | 5.40 | 6.6 | 30.45 | 1.3 | 157.25 | 1.3 | 40.00 | | 4.2 | 30.00 |
| CP-389 | | 45 | 4.50 | 5.0 | 169.80 | | 3.60 | 6.7 | 11.40 | 1.3 | 98.00 | 1.3 | 40.00 | | 4.2 | 30.00 |
| CP-390 | | 45 | 4.50 | 5.0 | 169.80 | | 4.05 | 6.7 | 11.40 | 1.3 | 98.00 | 1.3 | 40.00 | | 4.2 | 30.00 |
| CP-391 | | 45 | 4.50 | 5.0 | 169.85 | | 4.50 | 6.6 | 11.25 | 1.3 | 98.17 | 1.3 | 40.00 | | 4.2 | 30.00 |
| CP-392 | | 45 | 4.50 | 5.0 | 169.85 | | 4.95 | 6.6 | 11.25 | 1.3 | 98.17 | 1.3 | 40.00 | | 4.2 | 30.00 |
| CP-393 | | 45 | 4.50 | 5.0 | 169.85 | | 5.40 | 6.6 | 11.25 | 1.3 | 98.17 | 1.3 | 40.00 | | 4.2 | 30.00 |
| CP-394 | | 45 | 4.50 | 5.0 | 155.60 | | 3.60 | 6.7 | 27.10 | 1.3 | 95.50 | 1.3 | 40.00 | | 4.2 | 30.00 |
| CP-395 | | 45 | 4.50 | 5.0 | 155.60 | | 4.05 | 6.7 | 27.10 | 1.3 | 95.50 | 1.3 | 40.00 | | 4.2 | 30.00 |
| CP-396 | | 45 | 4.50 | 5.0 | 155.75 | | 4.50 | 6.6 | 26.75 | 1.3 | 95.83 | 1.3 | 40.00 | | 4.2 | 30.00 |
| CP-397 | | 45 | 4.50 | 5.0 | 155.75 | | 4.95 | 6.6 | 26.75 | 1.3 | 95.83 | 1.3 | 40.00 | | 4.2 | 30.00 |
| CP-398 | | 45 | 4.50 | 5.0 | 155.75 | | 5.40 | 6.6 | 26.75 | 1.3 | 95.83 | 1.3 | 40.00 | | 4.2 | 30.00 |
| CP-399 | | 45 | 4.50 | 5.0 | 144.95 | | 3.60 | 6.7 | 38.85 | 1.3 | 93.67 | 1.3 | 40.00 | | 4.2 | 30.00 |
| CP-400 | | 45 | 4.50 | 5.0 | 144.95 | | 4.05 | 6.7 | 38.85 | 1.3 | 93.67 | 1.3 | 40.00 | | 4.2 | 30.00 |
| CP-401 | | 45 | 4.50 | 5.0 | 145.20 | | 4.50 | 6.6 | 38.85 | 1.3 | 94.08 | 1.3 | 40.00 | | 4.2 | 30.00 |
| CP-402 | | 45 | 4.50 | 5.0 | 145.20 | | 4.95 | 6.6 | 38.35 | 1.3 | 94.08 | 1.3 | 40.00 | | 4.2 | 30.00 |
| CP-403 | | 45 | 4.50 | 5.0 | 145.20 | | 5.40 | 6.6 | 38.35 | 1.3 | 94.08 | 1.3 | 40.00 | | 4.2 | 30.00 |
| CP-404 | | 45 | 4.50 | 5.0 | 195.90 | | 3.60 | 6.7 | 13.15 | 1.3 | 51.58 | 1.3 | 40.00 | | 4.2 | 30.00 |

TABLE 19

| Conductive-layer coating solution | (1) A first metal oxide particle Kind | Coating ratio [%] | Doping ratio [%] | Density | Amount [part(s)] | (2) A second metal oxide particle Kind | Doping ratio [%] | Density | Amount [part(s)] |
|---|---|---|---|---|---|---|---|---|---|
| CP-405 | F-doped | 45 | 4.50 | 5.0 | 195.90 | F-doped | 4.05 | 6.7 | 13.15 |
| CP-406 | tin | 45 | 4.50 | 5.0 | 196.10 | tin oxide | 4.50 | 6.6 | 12.95 |
| CP-407 | oxide- | 45 | 4.50 | 5.0 | 196.10 | particles | 4.95 | 6.6 | 12.95 |
| CP-408 | coated | 45 | 4.50 | 5.0 | 196.10 | (average | 5.40 | 6.6 | 12.95 |
| CP-409 | titanium | 45 | 4.50 | 5.0 | 179.15 | particle | 3.60 | 6.7 | 31.20 |
| CP-410 | oxide | 45 | 4.50 | 5.0 | 179.15 | diameter: | 4.05 | 6.7 | 31.20 |
| CP-411 | particles | 45 | 4.50 | 5.0 | 179.45 | 20 nm) | 4.50 | 6.6 | 30.80 |
| CP-412 | (average | 45 | 4.50 | 5.0 | 179.45 | | 4.95 | 6.6 | 30.80 |
| CP-413 | particle | 45 | 4.50 | 5.0 | 179.45 | | 5.40 | 6.6 | 30.80 |
| CP-414 | diameter: | 45 | 4.50 | 5.0 | 166.60 | | 3.60 | 6.7 | 44.70 |
| CP-415 | 230 nm) | 45 | 4.50 | 5.0 | 166.60 | | 4.05 | 6.7 | 44.70 |
| CP-416 | | 45 | 4.50 | 5.0 | 167.05 | | 4.50 | 6.6 | 44.10 |
| CP-417 | | 45 | 4.50 | 5.0 | 167.05 | | 4.95 | 6.6 | 44.10 |
| CP-418 | | 45 | 4.50 | 5.0 | 167.05 | | 5.40 | 6.6 | 44.10 |
| CP-419 | | 45 | 4.50 | 5.0 | 155.75 | | 4.50 | 6.6 | 26.75 |
| CP-420 | | 45 | 4.50 | 5.0 | 159.00 | | 4.50 | 6.6 | 23.20 |

| Conductive-layer coating solution | (3) Binding material (phenol resin) Density | Amount [part(s)] (resin solid content thereof is 60% by mass of the following) | (4) Silicone resin particles Density | Amount [part(s)] | (5) Particles except (1) to (4) Kind | Density | Amount [part(s)] |
|---|---|---|---|---|---|---|---|
| CP-405 | 1.3 | 51.58 | 1.3 | 40.00 | Uncoated | 4.2 | 30.00 |
| CP-406 | 1.3 | 51.58 | 1.3 | 40.00 | titanium | 4.2 | 30.00 |
| CP-407 | 1.3 | 51.58 | 1.3 | 40.00 | oxide | 4.2 | 30.00 |
| CP-408 | 1.3 | 51.58 | 1.3 | 40.00 | particles | 4.2 | 30.00 |
| CP-409 | 1.3 | 49.42 | 1.3 | 40.00 | (average | 4.2 | 30.00 |
| CP-410 | 1.3 | 49.42 | 1.3 | 40.00 | particle | 4.2 | 30.00 |
| CP-411 | 1.3 | 49.58 | 1.3 | 40.00 | diameter: | 4.2 | 30.00 |
| CP-412 | 1.3 | 49.58 | 1.3 | 40.00 | 210 nm) | 4.2 | 30.00 |
| CP-413 | 1.3 | 49.58 | 1.3 | 40.00 | | 4.2 | 30.00 |
| CP-414 | 1.3 | 47.83 | 1.3 | 40.00 | | 4.2 | 30.00 |
| CP-415 | 1.3 | 47.83 | 1.3 | 40.00 | | 4.2 | 30.00 |
| CP-416 | 1.3 | 48.08 | 1.3 | 40.00 | | 4.2 | 30.00 |
| CP-417 | 1.3 | 48.08 | 1.3 | 40.00 | | 4.2 | 30.00 |
| CP-418 | 1.3 | 48.08 | 1.3 | 40.00 | | 4.2 | 30.00 |
| CP-419 | 1.3 | 95.83 | 1.3 | 40.00 | | 4.2 | 30.00 |
| CP-420 | 1.3 | 96.33 | 1.3 | 40.00 | | 4.2 | 30.00 |

TABLE 20

| Conductive-layer coating solution | (1) A first metal oxide particle Kind | Coating ratio [%] | Doping ratio [%] | Density | Amount [part(s)] | (2) A second metal oxide particle Kind | Doping ratio [%] | Density | Amount [part(s)] |
|---|---|---|---|---|---|---|---|---|---|
| CP-C76 | F-doped tin | 45 | 4.50 | 5.0 | 113.20 | | None | | |
| CP-C77 | oxide-coated | 45 | 4.50 | 5.0 | 174.30 | | | | |
| CP-C78 | titanium | 45 | 4.50 | 5.0 | 212.50 | | | | |
| CP-C79 | oxide | 45 | 4.50 | 5.0 | 112.00 | F-doped | 4.50 | 6.6 | 1.48 |
| CP-C80 | particles | 45 | 4.50 | 5.0 | 172.20 | tin oxide | 4.50 | 6.6 | 2.29 |
| CP-C81 | (average | 45 | 4.50 | 5.0 | 209.90 | particles | 4.50 | 6.6 | 2.78 |
| CP-C82 | particle | 45 | 4.50 | 5.0 | 84.60 | (average | 4.50 | 6.6 | 33.50 |
| CP-C83 | diameter: | 45 | 4.50 | 5.0 | 128.20 | particle | 4.50 | 6.6 | 50.76 |
| CP-C84 | 230 nm) | 45 | 4.50 | 5.0 | 154.80 | diameter: | 4.50 | 6.6 | 61.30 |
| CP-C85 | | | None | | | 20 nm) | 4.50 | 6.6 | 132.30 |
| CP-C86 | | | | | | | 4.50 | 6.6 | 191.85 |
| CP-C87 | | | | | | | 4.50 | 6.6 | 225.67 |
| CP-C88 | F-doped tin | 45 | 4.50 | 5.0 | 82.10 | | 4.50 | 6.6 | 2.17 |
| CP-C89 | oxide-coated | 45 | 4.50 | 5.0 | 79.50 | | 4.50 | 6.6 | 5.25 |
| CP-C90 | titanium | 45 | 4.50 | 5.0 | 73.50 | | 4.50 | 6.6 | 12.61 |
| CP-C91 | oxide | 45 | 4.50 | 5.0 | 68.80 | | 4.50 | 6.6 | 18.18 |
| CP-C92 | particles | 45 | 4.50 | 5.0 | 65.90 | | 4.50 | 6.6 | 21.75 |
| CP-C93 | (average | 45 | 4.50 | 5.0 | 216.76 | | 4.50 | 6.6 | 5.75 |
| CP-C94 | particle | 45 | 4.50 | 5.0 | 209.10 | | 4.50 | 6.6 | 13.81 |
| CP-C95 | diameter: | 45 | 4.50 | 5.0 | 191.10 | | 4.50 | 6.6 | 32.80 |

TABLE 20-continued

| Conductive-layer coating solution | (1) A first metal oxide particle | | | | | (2) A second metal oxide particle | | | |
|---|---|---|---|---|---|---|---|---|---|
| | Kind | Coating ratio [%] | Doping ratio [%] | Density | Amount [part(s)] | Kind | Doping ratio [%] | Density | Amount [part(s)] |
| CP-C96 | 230 nm) | 45 | 4.50 | 5.0 | 177.65 | | 4.50 | 6.6 | 46.95 |
| CP-C97 | | 45 | 4.50 | 5.0 | 169.20 | | 4.50 | 6.6 | 55.85 |

| Conductive-layer coating solution | (3) Binding material (phenol resin) | | (4) Silicone resin particles | | (5) Particles except (1) to (4) | | |
|---|---|---|---|---|---|---|---|
| | Density | Amount [part(s)] (resin solid content thereof is 60% by mass of the following) | Density | Amount [part(s)] | Kind | Density | Amount [part(s)] |
| CP-C76 | 1.3 | 269.67 | 1.3 | 5.00 | | None | |
| CP-C77 | 1.3 | 167.83 | 1.3 | 5.00 | | | |
| CP-C78 | 1.3 | 104.17 | 1.3 | 5.00 | | | |
| CP-C79 | 1.3 | 269.20 | 1.3 | 5.00 | | | |
| CP-C80 | 1.3 | 167.52 | 1.3 | 5.00 | | | |
| CP-C81 | 1.3 | 103.87 | 1.3 | 5.00 | | | |
| CP-C82 | 1.3 | 261.50 | 1.3 | 5.00 | | | |
| CP-C83 | 1.3 | 160.07 | 1.3 | 5.00 | | | |
| CP-C84 | 1.3 | 98.17 | 1.3 | 5.00 | | | |
| CP-C85 | 1.3 | 237.83 | 1.3 | 5.00 | | | |
| CP-C86 | 1.3 | 138.58 | 1.3 | 5.00 | | | |
| CP-C87 | 1.3 | 82.22 | 1.3 | 5.00 | | | |
| CP-C88 | 1.3 | 317.88 | 1.3 | 5.00 | | | |
| CP-C89 | 1.3 | 317.08 | 1.3 | 5.00 | | | |
| CP-C90 | 1.3 | 314.82 | 1.3 | 5.00 | | | |
| CP-C91 | 1.3 | 313.37 | 1.3 | 5.00 | | | |
| CP-C92 | 1.3 | 312.25 | 1.3 | 5.00 | | | |
| CP-C93 | 1.3 | 87.48 | 1.3 | 5.00 | | | |
| CP-C94 | 1.3 | 86.82 | 1.3 | 5.00 | | | |
| CP-C95 | 1.3 | 85.17 | 1.3 | 5.00 | | | |
| CP-C96 | 1.3 | 84.00 | 1.3 | 5.00 | | | |
| CP-C97 | 1.3 | 83.25 | 1.3 | 5.00 | | | |

TABLE 21

| Conductive-layer coating solution | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part(s)] | Kind | Density | Amount [part(s)] |
| CP-C98 | Oxygen-deficient tin oxide-coated titanium oxide particles (average particle diameter: 230 nm) | 45 | — | 5.1 | 152.20 | F-doped tin oxide particles (average particle diameter: 20 nm) | 4.50 | 6.6 | 25.60 | 1.3 | 162.00 | 1.3 | 5.00 | | None | |
| CP-C99 | Oxygen-deficient tin oxide-coated barium sulfate particles (average particle diameter: 230 nm) | 45 | — | 5.1 | 152.20 | | 4.50 | 6.6 | 25.60 | 1.3 | 162.00 | 1.3 | 5.00 | | | |
| CP-C100 | Sb-doped tin oxide-coated titanium oxide particles (average particle diameter: 230 nm) | 45 | 4.50 | 5.2 | 153.50 | | 4.50 | 6.6 | 25.35 | 1.3 | 160.25 | 1.3 | 5.00 | | | |
| CP-C101 | F-doped tin oxide-coated titanium oxide particles (average particle diameter: 230 nm) | 45 | 4.50 | 5.0 | 150.75 | Oxygen-deficient tin oxide particles (average particle diameter: 20 nm) | — | 6.6 | 25.90 | 1.3 | 163.92 | 1.3 | 5.00 | | | |
| CP-C102 | | 45 | 4.50 | 5.0 | 149.72 | Indium tin oxide particles (average particle diameter: 20 nm) | 4.50 | 7.1 | 27.63 | 1.3 | 162.50 | 1.3 | 5.00 | | | |
| CP-C103 | | 45 | 4.50 | 5.0 | 150.76 | Sb-doped tin oxide particles (average | 4.50 | 6.6 | 25.87 | 1.3 | 163.95 | 1.3 | 5.00 | | | |

TABLE 21-continued

| Conductive-layer coating solution | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| | | | | | | particle diameter: 20 nm) | | | | | | | | | | |
| CP-C104 | W-doped tin oxide-coated titanium oxide particles (average particle diameter: 230 nm) | 45 | 4.50 | 5.2 | 153.50 | F-doped tin oxide particles (average particle diameter: 20 nm) | 4.50 | 6.6 | 25.90 | 1.3 | 163.92 | 1.3 | 5.00 | | | |
| CP-C105 | F-doped tin oxide-coated barium sulfate particles (average particle diameter: 230 nm) | 45 | 4.50 | 5.0 | 150.75 | | 4.50 | 6.6 | 25.90 | 1.3 | 163.92 | 1.3 | 5.00 | | | |

TABLE 44

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-421 | Nb-doped | 45 | 4.50 | 5.1 | 111.95 | Nb-doped | 3.60 | 7.0 | 3.07 | 1.3 | 266.63 | 1.3 | 5.00 | | None | |
| CP-422 | tin | 45 | 4.50 | 5.1 | 111.95 | tin oxide | 4.05 | 7.0 | 3.07 | 1.3 | 266.63 | 1.3 | 5.00 | | | |
| CP-423 | oxide- | 45 | 4.50 | 5.1 | 111.95 | particles | 4.50 | 7.0 | 3.07 | 1.3 | 266.63 | 1.3 | 5.00 | | | |
| CP-424 | coated | 45 | 4.50 | 5.1 | 111.95 | (average | 4.95 | 7.0 | 3.07 | 1.3 | 266.63 | 1.3 | 5.00 | | | |
| CP-425 | titanium | 45 | 4.50 | 5.1 | 111.95 | particle | 5.40 | 7.0 | 3.07 | 1.3 | 266.63 | 1.3 | 5.00 | | | |
| CP-426 | oxide | 45 | 4.50 | 5.1 | 108.30 | diameter: | 4.50 | 7.0 | 7.43 | 1.3 | 265.45 | 1.3 | 5.00 | | | |
| CP-427 | particles | 45 | 4.50 | 5.1 | 99.60 | 20 nm) | 3.60 | 7.0 | 17.77 | 1.3 | 262.72 | 1.3 | 5.00 | | | |
| CP-428 | (average | 45 | 4.50 | 5.1 | 99.60 | | 4.05 | 7.0 | 17.77 | 1.3 | 262.72 | 1.3 | 5.00 | | | |
| CP-429 | particle | 45 | 4.50 | 5.1 | 99.60 | | 4.50 | 7.0 | 17.77 | 1.3 | 262.72 | 1.3 | 5.00 | | | |
| CP-430 | diameter: | 45 | 4.50 | 5.1 | 99.60 | | 4.95 | 7.0 | 17.77 | 1.3 | 262.72 | 1.3 | 5.00 | | | |
| CP-431 | 230 nm) | 45 | 4.50 | 5.1 | 99.60 | | 5.40 | 7.0 | 17.77 | 1.3 | 262.72 | 1.3 | 5.00 | | | |
| CP-432 | | 45 | 4.50 | 5.1 | 93.10 | | 4.50 | 7.0 | 25.56 | 1.3 | 260.57 | 1.3 | 5.00 | | | |
| CP-433 | | 45 | 4.50 | 5.1 | 88.92 | | 3.60 | 7.0 | 30.51 | 1.3 | 259.28 | 1.3 | 5.00 | | | |
| CP-434 | | 45 | 4.50 | 5.1 | 88.92 | | 4.05 | 7.0 | 30.51 | 1.3 | 259.28 | 1.3 | 5.00 | | | |
| CP-435 | | 45 | 4.50 | 5.1 | 88.92 | | 4.50 | 7.0 | 30.51 | 1.3 | 259.28 | 1.3 | 5.00 | | | |
| CP-436 | | 45 | 4.50 | 5.1 | 88.92 | | 4.95 | 7.0 | 30.51 | 1.3 | 259.28 | 1.3 | 5.00 | | | |
| CP-437 | | 45 | 4.50 | 5.1 | 88.92 | | 5.40 | 7.0 | 30.51 | 1.3 | 259.28 | 1.3 | 5.00 | | | |
| CP-438 | | 45 | 4.50 | 5.1 | 135.45 | | 4.50 | 7.0 | 3.72 | 1.3 | 259.28 | 1.3 | 5.00 | | | |
| CP-439 | | 45 | 4.50 | 5.1 | 130.90 | | 3.60 | 7.0 | 8.98 | 1.3 | 225.20 | 1.3 | 5.00 | | | |
| CP-440 | | 45 | 4.50 | 5.1 | 130.90 | | 4.05 | 7.0 | 8.98 | 1.3 | 225.20 | 1.3 | 5.00 | | | |
| CP-441 | | 45 | 4.50 | 5.1 | 130.90 | | 4.50 | 7.0 | 8.98 | 1.3 | 225.20 | 1.3 | 5.00 | | | |
| CP-442 | | 45 | 4.50 | 5.1 | 130.90 | | 4.95 | 7.0 | 8.98 | 1.3 | 225.20 | 1.3 | 5.00 | | | |
| CP-443 | | 45 | 4.50 | 5.1 | 130.90 | | 5.40 | 7.0 | 8.98 | 1.3 | 225.20 | 1.3 | 5.00 | | | |
| CP-444 | | 45 | 4.50 | 5.1 | 120.15 | | 3.60 | 7.0 | 21.44 | 1.3 | 222.35 | 1.3 | 5.00 | | | |
| CP-445 | | 45 | 4.50 | 5.1 | 120.15 | | 4.05 | 7.0 | 21.44 | 1.3 | 222.35 | 1.3 | 5.00 | | | |
| CP-446 | | 45 | 4.50 | 5.1 | 120.15 | | 4.50 | 7.0 | 21.44 | 1.3 | 222.35 | 1.3 | 5.00 | | | |
| CP-447 | | 45 | 4.50 | 5.1 | 120.15 | | 4.95 | 7.0 | 21.44 | 1.3 | 222.35 | 1.3 | 5.00 | | | |
| CP-448 | | 45 | 4.50 | 5.1 | 120.15 | | 5.40 | 7.0 | 21.44 | 1.3 | 222.35 | 1.3 | 5.00 | | | |
| CP-449 | | 45 | 4.50 | 5.1 | 112.08 | | 3.60 | 7.0 | 30.77 | 1.3 | 220.25 | 1.3 | 5.00 | | | |
| CP-450 | | 45 | 4.50 | 5.1 | 112.08 | | 4.05 | 7.0 | 30.77 | 1.3 | 220.25 | 1.3 | 5.00 | | | |
| CP-451 | | 45 | 4.50 | 5.1 | 112.08 | | 4.50 | 7.0 | 30.77 | 1.3 | 220.25 | 1.3 | 5.00 | | | |
| CP-452 | | 45 | 4.50 | 5.1 | 112.08 | | 4.95 | 7.0 | 30.77 | 1.3 | 220.25 | 1.3 | 5.00 | | | |
| CP-453 | | 45 | 4.50 | 5.1 | 112.08 | | 5.40 | 7.0 | 30.77 | 1.3 | 220.25 | 1.3 | 5.00 | | | |
| CP-454 | | 45 | 4.50 | 5.1 | 106.95 | | 4.50 | 7.0 | 36.70 | 1.3 | 218.92 | 1.3 | 5.00 | | | |
| CP-455 | | 45 | 4.50 | 5.1 | 171.35 | | 3.60 | 7.0 | 4.70 | 1.3 | 164.92 | 1.3 | 5.00 | | | |
| CP-456 | | 45 | 4.50 | 5.1 | 171.35 | | 4.05 | 7.0 | 4.70 | 1.3 | 164.92 | 1.3 | 5.00 | | | |
| CP-457 | | 45 | 4.50 | 5.1 | 171.35 | | 4.50 | 7.0 | 4.70 | 1.3 | 164.92 | 1.3 | 5.00 | | | |
| CP-458 | | 45 | 4.50 | 5.1 | 171.35 | | 4.95 | 7.0 | 4.70 | 1.3 | 164.92 | 1.3 | 5.00 | | | |
| CP-459 | | 45 | 4.50 | 5.1 | 171.35 | | 5.40 | 7.0 | 4.70 | 1.3 | 164.92 | 1.3 | 5.00 | | | |
| CP-460 | | 45 | 4.50 | 5.1 | 165.37 | | 3.60 | 7.0 | 11.35 | 1.3 | 163.80 | 1.3 | 5.00 | | | |

TABLE 45

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-461 | Nb-doped | 45 | 4.50 | 5.1 | 165.37 | Nb-doped | 4.05 | 7.0 | 11.35 | 1.3 | 163.80 | 1.3 | 5.00 | | None | |
| CP-462 | tin | 45 | 4.50 | 5.1 | 165.37 | tin oxide | 4.50 | 7.0 | 11.35 | 1.3 | 163.80 | 1.3 | 5.00 | | | |
| CP-463 | oxide- | 45 | 4.50 | 5.1 | 165.37 | particles | 4.95 | 7.0 | 11.35 | 1.3 | 163.80 | 1.3 | 5.00 | | | |
| CP-464 | coated | 45 | 4.50 | 5.1 | 165.37 | (average | 5.40 | 7.0 | 11.35 | 1.3 | 163.80 | 1.3 | 5.00 | | | |
| CP-465 | titanium | 45 | 4.50 | 5.1 | 151.30 | particle | 3.60 | 7.0 | 27.00 | 1.3 | 161.17 | 1.3 | 5.00 | | | |
| CP-466 | oxide | 45 | 4.50 | 5.1 | 151.30 | diameter: | 4.05 | 7.0 | 27.00 | 1.3 | 161.17 | 1.3 | 5.00 | | | |
| CP-467 | particles | 45 | 4.50 | 5.1 | 151.30 | 20 nm) | 4.50 | 7.0 | 27.00 | 1.3 | 161.17 | 1.3 | 5.00 | | | |
| CP-468 | (average | 45 | 4.50 | 5.1 | 151.30 | | 4.95 | 7.0 | 27.00 | 1.3 | 161.17 | 1.3 | 5.00 | | | |
| CP-469 | particle | 45 | 4.50 | 5.1 | 151.30 | | 5.40 | 7.0 | 27.00 | 1.3 | 161.17 | 1.3 | 5.00 | | | |
| CP-470 | diameter: | 45 | 4.50 | 5.1 | 140.84 | | 3.60 | 7.0 | 38.66 | 1.3 | 159.17 | 1.3 | 5.00 | | | |
| CP-471 | 230 nm) | 45 | 4.50 | 5.1 | 140.84 | | 4.05 | 7.0 | 38.66 | 1.3 | 159.17 | 1.3 | 5.00 | | | |
| CP-472 | | 45 | 4.50 | 5.1 | 140.84 | | 4.50 | 7.0 | 38.66 | 1.3 | 159.17 | 1.3 | 5.00 | | | |
| CP-473 | | 45 | 4.50 | 5.1 | 140.84 | | 4.95 | 7.0 | 38.66 | 1.3 | 159.17 | 1.3 | 5.00 | | | |
| CP-474 | | 45 | 4.50 | 5.1 | 140.84 | | 5.40 | 7.0 | 38.66 | 1.3 | 159.17 | 1.3 | 5.00 | | | |
| CP-475 | | 45 | 4.50 | 5.1 | 134.20 | | 3.60 | 7.0 | 46.05 | 1.3 | 157.92 | 1.3 | 5.00 | | | |
| CP-476 | | 45 | 4.50 | 5.1 | 134.20 | | 4.05 | 7.0 | 46.05 | 1.3 | 157.92 | 1.3 | 5.00 | | | |
| CP-477 | | 45 | 4.50 | 5.1 | 134.20 | | 4.50 | 7.0 | 46.05 | 1.3 | 157.92 | 1.3 | 5.00 | | | |
| CP-478 | | 45 | 4.50 | 5.1 | 134.20 | | 4.95 | 7.0 | 46.05 | 1.3 | 157.92 | 1.3 | 5.00 | | | |
| CP-479 | | 45 | 4.50 | 5.1 | 134.20 | | 5.40 | 7.0 | 46.05 | 1.3 | 157.92 | 1.3 | 5.00 | | | |
| CP-480 | | 45 | 4.50 | 5.1 | 197.53 | | 4.50 | 7.0 | 5.43 | 1.3 | 120.07 | 1.3 | 5.00 | | | |
| CP-481 | | 45 | 4.50 | 5.1 | 190.45 | | 3.60 | 7.0 | 13.08 | 1.3 | 119.12 | 1.3 | 5.00 | | | |
| CP-482 | | 45 | 4.50 | 5.1 | 190.45 | | 4.05 | 7.0 | 13.08 | 1.3 | 119.12 | 1.3 | 5.00 | | | |
| CP-483 | | 45 | 4.50 | 5.1 | 190.45 | | 4.50 | 7.0 | 13.08 | 1.3 | 119.12 | 1.3 | 5.00 | | | |
| CP-484 | | 45 | 4.50 | 5.1 | 190.45 | | 4.95 | 7.0 | 13.08 | 1.3 | 119.12 | 1.3 | 5.00 | | | |
| CP-485 | | 45 | 4.50 | 5.1 | 190.45 | | 5.40 | 7.0 | 13.08 | 1.3 | 119.12 | 1.3 | 5.00 | | | |
| CP-486 | | 45 | 4.50 | 5.1 | 173.86 | | 3.60 | 7.0 | 31.02 | 1.3 | 116.87 | 1.3 | 5.00 | | | |
| CP-487 | | 45 | 4.50 | 5.1 | 173.86 | | 4.05 | 7.0 | 31.02 | 1.3 | 116.87 | 1.3 | 5.00 | | | |
| CP-488 | | 45 | 4.50 | 5.1 | 173.86 | | 4.50 | 7.0 | 31.02 | 1.3 | 116.87 | 1.3 | 5.00 | | | |
| CP-489 | | 45 | 4.50 | 5.1 | 173.86 | | 4.95 | 7.0 | 31.02 | 1.3 | 116.87 | 1.3 | 5.00 | | | |
| CP-490 | | 45 | 4.50 | 5.1 | 173.86 | | 5.40 | 7.0 | 31.02 | 1.3 | 116.87 | 1.3 | 5.00 | | | |
| CP-491 | | 45 | 4.50 | 5.1 | 161.54 | | 3.60 | 7.0 | 44.35 | 1.3 | 115.18 | 1.3 | 5.00 | | | |
| CP-492 | | 45 | 4.50 | 5.1 | 161.54 | | 4.05 | 7.0 | 44.35 | 1.3 | 115.18 | 1.3 | 5.00 | | | |
| CP-493 | | 45 | 4.50 | 5.1 | 161.54 | | 4.50 | 7.0 | 44.35 | 1.3 | 115.18 | 1.3 | 5.00 | | | |
| CP-494 | | 45 | 4.50 | 5.1 | 161.54 | | 4.95 | 7.0 | 44.35 | 1.3 | 115.18 | 1.3 | 5.00 | | | |
| CP-495 | | 45 | 4.50 | 5.1 | 161.54 | | 5.40 | 7.0 | 44.35 | 1.3 | 115.18 | 1.3 | 5.00 | | | |
| CP-496 | | 45 | 4.50 | 5.1 | 153.76 | | 4.50 | 7.0 | 52.76 | 1.3 | 114.13 | 1.3 | 5.00 | | | |
| CP-497 | | 45 | 4.50 | 5.1 | 208.14 | | 3.60 | 7.0 | 5.72 | 1.3 | 101.90 | 1.3 | 5.00 | | | |
| CP-498 | | 45 | 4.50 | 5.1 | 208.14 | | 4.05 | 7.0 | 5.72 | 1.3 | 101.90 | 1.3 | 5.00 | | | |
| CP-499 | | 45 | 4.50 | 5.1 | 208.14 | | 4.50 | 7.0 | 5.72 | 1.3 | 101.90 | 1.3 | 5.00 | | | |
| CP-500 | | 45 | 4.50 | 5.1 | 208.14 | | 4.95 | 7.0 | 5.72 | 1.3 | 101.90 | 1.3 | 5.00 | | | |

TABLE 46

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-501 | Nb-doped tin | 45 | 4.50 | 5.1 | 208.14 | Nb-doped | 5.40 | 7.0 | 5.72 | 1.3 | 101.90 | 1.3 | 5.00 | | None | |
| CP-502 | oxide-coated | 45 | 4.50 | 5.1 | 200.62 | tin oxide | 4.50 | 7.0 | 13.76 | 1.3 | 101.03 | 1.3 | 5.00 | | | |
| CP-503 | titanium | 45 | 4.50 | 5.1 | 182.95 | particles | 3.60 | 7.0 | 32.64 | 1.3 | 99.02 | 1.3 | 5.00 | | | |
| CP-504 | oxide | 45 | 4.50 | 5.1 | 182.95 | (average | 4.05 | 7.0 | 32.64 | 1.3 | 99.02 | 1.3 | 5.00 | | | |
| CP-505 | particles | 45 | 4.50 | 5.1 | 182.95 | particle | 4.50 | 7.0 | 32.64 | 1.3 | 99.02 | 1.3 | 5.00 | | | |
| CP-506 | (average | 45 | 4.50 | 5.1 | 182.95 | diameter: | 4.95 | 7.0 | 32.64 | 1.3 | 99.02 | 1.3 | 5.00 | | | |
| CP-507 | particle | 45 | 4.50 | 5.1 | 182.95 | 20 nm) | 5.40 | 7.0 | 32.64 | 1.3 | 99.02 | 1.3 | 5.00 | | | |
| CP-508 | diameter: | 45 | 4.50 | 5.1 | 169.87 | | 4.50 | 7.0 | 46.62 | 1.3 | 97.52 | 1.3 | 5.00 | | | |
| CP-509 | 230 nm) | 45 | 4.50 | 5.1 | 161.62 | | 3.60 | 7.0 | 55.45 | 1.3 | 96.55 | 1.3 | 5.00 | | | |
| CP-510 | | 45 | 4.50 | 5.1 | 161.62 | | 4.05 | 7.0 | 55.45 | 1.3 | 96.55 | 1.3 | 5.00 | | | |
| CP-511 | | 45 | 4.50 | 5.1 | 161.62 | | 4.50 | 7.0 | 55.45 | 1.3 | 96.55 | 1.3 | 5.00 | | | |
| CP-512 | | 45 | 4.50 | 5.1 | 161.62 | | 4.95 | 7.0 | 55.45 | 1.3 | 96.55 | 1.3 | 5.00 | | | |
| CP-513 | | 45 | 4.50 | 5.1 | 161.62 | | 5.40 | 7.0 | 55.45 | 1.3 | 96.55 | 1.3 | 5.00 | | | |
| CP-514 | | 45 | 4.50 | 5.1 | 135.25 | | 3.60 | 7.0 | 9.28 | 1.3 | 159.12 | 1.3 | 40.00 | Uncoated | 4.2 | 30.00 |
| CP-515 | | 45 | 4.50 | 5.1 | 135.25 | | 4.05 | 7.0 | 9.28 | 1.3 | 159.12 | 1.3 | 40.00 | titanium | 4.2 | 30.00 |
| CP-516 | | 45 | 4.50 | 5.1 | 135.25 | | 4.50 | 7.0 | 9.28 | 1.3 | 159.12 | 1.3 | 40.00 | oxide | 4.2 | 30.00 |
| CP-517 | | 45 | 4.50 | 5.1 | 135.25 | | 4.95 | 7.0 | 9.28 | 1.3 | 159.12 | 1.3 | 40.00 | particles | 4.2 | 30.00 |
| CP-518 | | 45 | 4.50 | 5.1 | 135.25 | | 5.40 | 7.0 | 9.28 | 1.3 | 159.12 | 1.3 | 40.00 | (average | 4.2 | 30.00 |
| CP-519 | | 45 | 4.50 | 5.1 | 124.13 | | 3.60 | 7.0 | 22.15 | 1.3 | 156.20 | 1.3 | 40.00 | particle | 4.2 | 30.00 |
| CP-520 | | 45 | 4.50 | 5.1 | 124.13 | | 4.05 | 7.0 | 22.15 | 1.3 | 156.20 | 1.3 | 40.00 | diameter: | 4.2 | 30.00 |
| CP-521 | | 45 | 4.50 | 5.1 | 124.13 | | 4.50 | 7.0 | 22.15 | 1.3 | 156.20 | 1.3 | 40.00 | 210 nm) | 4.2 | 30.00 |
| CP-522 | | 45 | 4.50 | 5.1 | 124.13 | | 4.95 | 7.0 | 22.15 | 1.3 | 156.02 | 1.3 | 40.00 | | 4.2 | 30.00 |
| CP-523 | | 45 | 4.50 | 5.1 | 124.13 | | 5.40 | 7.0 | 22.15 | 1.3 | 156.20 | 1.3 | 40.00 | | 4.2 | 30.00 |
| CP-524 | | 45 | 4.50 | 5.1 | 115.80 | | 3.60 | 7.0 | 31.79 | 1.3 | 154.02 | 1.3 | 40.00 | | 4.2 | 30.00 |
| CP-525 | | 45 | 4.50 | 5.1 | 115.80 | | 4.05 | 7.0 | 31.79 | 1.3 | 154.02 | 1.3 | 40.00 | | 4.2 | 30.00 |
| CP-526 | | 45 | 4.50 | 5.1 | 115.80 | | 4.50 | 7.0 | 31.79 | 1.3 | 154.02 | 1.3 | 40.00 | | 4.2 | 30.00 |
| CP-527 | | 45 | 4.50 | 5.1 | 115.80 | | 4.95 | 7.0 | 31.79 | 1.3 | 154.02 | 1.3 | 40.00 | | 4.2 | 30.00 |
| CP-528 | | 45 | 4.50 | 5.1 | 115.80 | | 5.40 | 7.0 | 31.79 | 1.3 | 154.02 | 1.3 | 40.00 | | 4.2 | 30.00 |
| CP-529 | | 45 | 4.50 | 5.1 | 170.85 | | 3.60 | 7.0 | 11.72 | 1.3 | 95.72 | 1.3 | 40.00 | | 4.2 | 30.00 |
| CP-530 | | 45 | 4.50 | 5.1 | 170.85 | | 4.05 | 7.0 | 11.72 | 1.3 | 95.72 | 1.3 | 40.00 | | 4.2 | 30.00 |
| CP-531 | | 45 | 4.50 | 5.1 | 170.85 | | 4.50 | 7.0 | 11.72 | 1.3 | 95.72 | 1.3 | 40.00 | | 4.2 | 30.00 |
| CP-532 | | 45 | 4.50 | 5.1 | 170.85 | | 4.95 | 7.0 | 11.72 | 1.3 | 95.72 | 1.3 | 40.00 | | 4.2 | 30.00 |
| CP-533 | | 45 | 4.50 | 5.1 | 170.85 | | 5.40 | 7.0 | 11.72 | 1.3 | 95.72 | 1.3 | 40.00 | | 4.2 | 30.00 |
| CP-534 | | 45 | 4.50 | 5.1 | 156.32 | | 3.60 | 7.0 | 27.90 | 1.3 | 92.97 | 1.3 | 40.00 | | 4.2 | 30.00 |
| CP-535 | | 45 | 4.50 | 5.1 | 156.32 | | 4.05 | 7.0 | 27.90 | 1.3 | 92.97 | 1.3 | 40.00 | | 4.2 | 30.00 |
| CP-536 | | 45 | 4.50 | 5.1 | 156.32 | | 4.50 | 7.0 | 27.90 | 1.3 | 92.97 | 1.3 | 40.00 | | 4.2 | 30.00 |
| CP-537 | | 45 | 4.50 | 5.1 | 156.32 | | 4.95 | 7.0 | 27.90 | 1.3 | 92.97 | 1.3 | 40.00 | | 4.2 | 30.00 |
| CP-538 | | 45 | 4.50 | 5.1 | 156.32 | | 5.40 | 7.0 | 27.90 | 1.3 | 92.97 | 1.3 | 40.00 | | 4.2 | 30.00 |
| CP-539 | | 45 | 4.50 | 5.1 | 145.50 | | 3.60 | 7.0 | 39.95 | 1.3 | 90.92 | 1.3 | 40.00 | | 4.2 | 30.00 |
| CP-540 | | 45 | 4.50 | 5.1 | 145.50 | | 4.05 | 7.0 | 39.95 | 1.3 | 90.92 | 1.3 | 40.00 | | 4.2 | 30.00 |

TABLE 47

| Conductive-layer coating solution | (1) A first metal oxide particle | | | | | (2) A second metal oxide particle | | | |
|---|---|---|---|---|---|---|---|---|---|
| | Kind | Coating ratio [%] | Doping ratio [%] | Density | Amount [part(s)] | Kind | Doping ratio [%] | Density | Amount [part(s)] |
| CP-541 | Nb-doped tin oxide-coated titanium oxide particles (average particle diameter: 230 nm) | 45 | 4.50 | 5.1 | 145.50 | Nb-doped tin oxide particles (average particle diameter: 20 nm) | 4.50 | 7.0 | 39.95 |
| CP-542 | | 45 | 4.50 | 5.1 | 145.50 | | 4.95 | 7.0 | 39.95 |
| CP-543 | | 45 | 4.50 | 5.1 | 145.50 | | 5.40 | 7.0 | 39.95 |
| CP-544 | | 45 | 4.50 | 5.1 | 196.78 | | 3.60 | 7.0 | 13.50 |
| CP-545 | | 45 | 4.50 | 5.1 | 196.78 | | 4.05 | 7.0 | 13.50 |
| CP-546 | | 45 | 4.50 | 5.1 | 196.78 | | 4.50 | 7.0 | 13.50 |
| CP-547 | | 45 | 4.50 | 5.1 | 196.78 | | 4.95 | 7.0 | 13.50 |
| CP-548 | | 45 | 4.50 | 5.1 | 196.78 | | 5.40 | 7.0 | 13.50 |
| CP-549 | | 45 | 4.50 | 5.1 | 179.62 | | 3.60 | 7.0 | 32.05 |
| CP-550 | | 45 | 4.50 | 5.1 | 179.62 | | 4.05 | 7.0 | 32.05 |
| CP-551 | | 45 | 4.50 | 5.1 | 179.62 | | 4.50 | 7.0 | 32.05 |
| CP-552 | | 45 | 4.50 | 5.1 | 179.62 | | 4.95 | 7.0 | 32.05 |
| CP-553 | | 45 | 4.50 | 5.1 | 179.62 | | 5.40 | 7.0 | 32.05 |
| CP-554 | | 45 | 4.50 | 5.1 | 166.90 | | 3.60 | 7.0 | 45.82 |
| CP-555 | | 45 | 4.50 | 5.1 | 166.90 | | 4.05 | 7.0 | 45.82 |
| CP-556 | | 45 | 4.50 | 5.1 | 166.90 | | 4.50 | 7.0 | 45.82 |
| CP-557 | | 45 | 4.50 | 5.1 | 166.90 | | 4.95 | 7.0 | 45.82 |
| CP-558 | | 45 | 4.50 | 5.1 | 166.90 | | 5.40 | 7.0 | 45.82 |
| CP-559 | | 45 | 4.50 | 5.1 | 156.32 | | 4.50 | 7.0 | 27.90 |
| CP-560 | | 45 | 4.50 | 5.0 | 159.70 | | 4.50 | 7.0 | 24.15 |

| Conductive-layer coating solution | (3) Binding material (phenol resin) | | (4) Silicone resin particles | | (5) Particles except (1) to (4) | | |
|---|---|---|---|---|---|---|---|
| | Density | Amount [part(s)] (resin solid content thereof is 60% by mass of the following) | Density | Amount [part(s)] | Kind | Density | Amount [part(s)] |
| CP-541 | 1.3 | 90.92 | 1.3 | 40.00 | Uncoated titanium oxide particles (average particle diameter: 210 nm) | 4.2 | 30.00 |
| CP-542 | 1.3 | 90.92 | 1.3 | 40.00 | | 4.2 | 30.00 |
| CP-543 | 1.3 | 90.92 | 1.3 | 40.00 | | 4.2 | 30.00 |
| CP-544 | 1.3 | 49.53 | 1.3 | 40.00 | | 4.2 | 30.00 |
| CP-545 | 1.3 | 49.53 | 1.3 | 40.00 | | 4.2 | 30.00 |
| CP-546 | 1.3 | 49.53 | 1.3 | 40.00 | | 4.2 | 30.00 |
| CP-547 | 1.3 | 49.53 | 1.3 | 40.00 | | 4.2 | 30.00 |
| CP-548 | 1.3 | 49.53 | 1.3 | 40.00 | | 4.2 | 30.00 |
| CP-549 | 1.3 | 47.22 | 1.3 | 40.00 | | 4.2 | 30.00 |
| CP-550 | 1.3 | 47.22 | 1.3 | 40.00 | | 4.2 | 30.00 |
| CP-551 | 1.3 | 47.22 | 1.3 | 40.00 | | 4.2 | 30.00 |
| CP-552 | 1.3 | 47.22 | 1.3 | 40.00 | | 4.2 | 30.00 |
| CP-553 | 1.3 | 47.22 | 1.3 | 40.00 | | 4.2 | 30.00 |
| CP-554 | 1.3 | 45.47 | 1.3 | 40.00 | | 4.2 | 30.00 |
| CP-555 | 1.3 | 45.47 | 1.3 | 40.00 | | 4.2 | 30.00 |
| CP-556 | 1.3 | 45.47 | 1.3 | 40.00 | | 4.2 | 30.00 |
| CP-557 | 1.3 | 45.47 | 1.3 | 40.00 | | 4.2 | 30.00 |
| CP-558 | 1.3 | 45.47 | 1.3 | 40.00 | | 4.2 | 30.00 |
| CP-559 | 1.3 | 92.97 | 1.3 | 40.00 | | 4.2 | 30.00 |
| CP-560 | 1.3 | 93.58 | 1.3 | 40.00 | | 4.2 | 30.00 |

TABLE 48

| Conductive-layer coating solution | (1) A first metal oxide particle | | | | | (2) A second metal oxide particle | | | |
|---|---|---|---|---|---|---|---|---|---|
| | Kind | Coating ratio [%] | Doping ratio [%] | Density | Amount [part(s)] | Kind | Doping ratio [%] | Density | Amount [part(s)] |
| CP-C107 | Nb-doped tin oxide-coated titanium oxide particles (average particle diameter: 230 nm) | 45 | 4.50 | 5.1 | 114.55 | None | | | |
| CP-C108 | | 45 | 4.50 | 5.1 | 175.58 | | | | |
| CP-C109 | | 45 | 4.50 | 5.1 | 213.48 | | | | |
| CP-C110 | | 45 | 4.50 | 5.1 | 113.25 | Nb-doped tin oxide particles (average particle diameter: 20 nm) | 4.50 | 7.0 | 1.55 |
| CP-C111 | | 45 | 4.50 | 5.1 | 173.45 | | 4.50 | 7.0 | 2.37 |
| CP-C112 | | 45 | 4.50 | 5.1 | 210.77 | | 4.50 | 7.0 | 2.90 |
| CP-C113 | | 45 | 4.50 | 5.1 | 85.10 | | 4.50 | 7.0 | 35.04 |
| CP-C114 | | 45 | 4.50 | 5.1 | 128.15 | | 4.50 | 7.0 | 52.76 |
| CP-C115 | | 45 | 4.50 | 5.1 | 154.12 | | 4.50 | 7.0 | 63.46 |
| CP-C116 | None | | | | | | 4.50 | 7.0 | 136.40 |
| CP-C117 | | | | | | | 4.50 | 7.0 | 195.35 |
| CP-C118 | | | | | | | 4.50 | 7.0 | 228.20 |

TABLE 48-continued

| Conductive-layer coating solution | (1) A first metal oxide particle | | | | | (2) A second metal oxide particle | | | |
|---|---|---|---|---|---|---|---|---|---|
| | Kind | Coating ratio [%] | Doping ratio [%] | Density | Amount [part(s)] | Kind | Doping ratio [%] | Density | Amount [part(s)] |
| CP-C119 | Nb-doped tin | 45 | 4.50 | 5.1 | 83.15 | | 4.50 | 7.0 | 2.28 |
| CP-C120 | oxide-coated | 45 | 4.50 | 5.1 | 80.50 | | 4.50 | 7.0 | 5.53 |
| CP-C121 | titanium | 45 | 4.50 | 5.1 | 74.24 | | 4.50 | 7.0 | 13.25 |
| CP-C122 | oxide | 45 | 4.50 | 5.1 | 69.55 | | 4.50 | 7.0 | 19.09 |
| CP-C123 | particles | 45 | 4.50 | 5.1 | 66.50 | | 4.50 | 7.0 | 22.82 |
| CP-C124 | (average | 45 | 4.50 | 5.1 | 217.47 | | 4.50 | 7.0 | 5.98 |
| CP-C125 | particle | 45 | 4.50 | 5.1 | 209.55 | | 4.50 | 7.0 | 14.37 |
| CP-C126 | diameter: | 45 | 4.50 | 5.1 | 190.95 | | 4.50 | 7.0 | 34.06 |
| CP-C127 | 230 nm) | 45 | 4.50 | 5.1 | 177.18 | | 4.50 | 7.0 | 48.63 |
| CP-C128 | | 45 | 4.50 | 5.1 | 168.49 | | 4.50 | 7.0 | 57.82 |

| Conductive-layer coating solution | (3) Binding material (phenol resin) | | (4) Silicone resin particles | | (5) Particles except) (1) to (4 | | |
|---|---|---|---|---|---|---|---|
| | Density | Amount [part(s)] (resin solid content thereof is 60% by mass of the following) | Density | Amount [part (s)] | Kind | Density | Amount [part (s)] |
| CP-C107 | 1.3 | 267.42 | 1.3 | 5.00 | | None | |
| CP-C108 | 1.3 | 165.70 | 1.3 | 5.00 | | | |
| CP-C109 | 1.3 | 102.53 | 1.3 | 5.00 | | | |
| CP-C110 | 1.3 | 267.00 | 1.3 | 5.00 | | | |
| CP-C111 | 1.3 | 165.30 | 1.3 | 5.00 | | | |
| CP-C112 | 1.3 | 102.22 | 1.3 | 5.00 | | | |
| CP-C113 | 1.3 | 258.10 | 1.3 | 5.00 | | | |
| CP-C114 | 1.3 | 156.82 | 1.3 | 5.00 | | | |
| CP-C115 | 1.3 | 95.70 | 1.3 | 5.00 | | | |
| CP-C116 | 1.3 | 231.00 | 1.3 | 5.00 | | | |
| CP-C117 | 1.3 | 132.75 | 1.3 | 5.00 | | | |
| CP-C118 | 1.3 | 78.00 | 1.3 | 5.00 | | | |
| CP-C119 | 1.3 | 315.95 | 1.3 | 5.00 | | | |
| CP-C120 | 1.3 | 314.95 | 1.3 | 5.00 | | | |
| CP-C121 | 1.3 | 312.52 | 1.3 | 5.00 | | | |
| CP-C122 | 1.3 | 310.60 | 1.3 | 5.00 | | | |
| CP-C123 | 1.3 | 309.47 | 1.3 | 5.00 | | | |
| CP-C124 | 1.3 | 85.92 | 1.3 | 5.00 | | | |
| CP-C125 | 1.3 | 85.13 | 1.3 | 5.00 | | | |
| CP-C126 | 1.3 | 83.32 | 1.3 | 5.00 | | | |
| CP-C127 | 1.3 | 81.98 | 1.3 | 5.00 | | | |
| CP-C128 | 1.3 | 81.15 | 1.3 | 5.00 | | | |

TABLE 49

| Conductive-layer coating solution | (1) A first metal oxide particle | | | | | (2) A second metal oxide particle | | | |
|---|---|---|---|---|---|---|---|---|---|
| | Kind | Coating ratio [%] | Doping ratio [%] | Density | Amount [part(s)] | Kind | Doping ratio [%] | Density | Amount [part(s)] |
| CP-561 | Ta- | 45 | 4.50 | 5.2 | 113.20 | Ta- | 3.60 | 7.3 | 3.18 |
| CP-562 | doped | 45 | 4.50 | 5.2 | 113.20 | doped | 4.05 | 7.3 | 3.18 |
| CP-563 | tin | 45 | 4.50 | 5.2 | 113.20 | tin oxide | 4.50 | 7.4 | 3.22 |
| CP-564 | oxide- | 45 | 4.50 | 5.2 | 113.20 | particles | 4.95 | 7.4 | 3.22 |
| CP-565 | coated | 45 | 4.50 | 5.2 | 113.20 | (average | 5.40 | 7.5 | 3.26 |
| CP-566 | titanium | 45 | 4.50 | 5.2 | 109.45 | particle | 4.50 | 7.4 | 7.79 |
| CP-567 | oxide | 45 | 4.50 | 5.2 | 100.60 | diameter: | 3.60 | 7.3 | 18.36 |
| CP-568 | particles | 45 | 4.50 | 5.2 | 100.60 | 20 nm) | 4.05 | 7.3 | 18.36 |
| CP-569 | (average | 45 | 4.50 | 5.2 | 100.50 | | 4.50 | 7.4 | 18.59 |
| CP-570 | particle | 45 | 4.50 | 5.2 | 100.50 | | 4.95 | 7.4 | 18.59 |
| CP-571 | diameter: | 45 | 4.50 | 5.2 | 100.43 | | 5.40 | 7.5 | 18.83 |
| CP-572 | 230 nm) | 45 | 4.50 | 5.2 | 93.80 | | 4.50 | 7.4 | 26.70 |
| CP-573 | | 45 | 4.50 | 5.2 | 89.70 | | 3.60 | 7.3 | 31.48 |
| CP-574 | | 45 | 4.50 | 5.2 | 89.70 | | 4.05 | 7.3 | 31.48 |
| CP-575 | | 45 | 4.50 | 5.2 | 89.57 | | 4.50 | 7.4 | 31.87 |
| CP-576 | | 45 | 4.50 | 5.2 | 89.57 | | 4.95 | 7.4 | 31.87 |
| CP-577 | | 45 | 4.50 | 5.2 | 89.42 | | 5.40 | 7.5 | 32.24 |
| CP-578 | | 45 | 4.50 | 5.2 | 136.70 | | 4.50 | 7.4 | 3.90 |
| CP-579 | | 45 | 4.50 | 5.2 | 132.05 | | 3.60 | 7.3 | 9.27 |
| CP-580 | | 45 | 4.50 | 5.2 | 132.05 | | 4.05 | 7.3 | 9.27 |
| CP-581 | | 45 | 4.50 | 5.2 | 132.00 | | 4.50 | 7.4 | 9.40 |
| CP-582 | | 45 | 4.50 | 5.2 | 132.00 | | 4.95 | 7.4 | 9.40 |

TABLE 49-continued

| | | | | | | | |
|---|---|---|---|---|---|---|---|
| CP-583 | 45 | 4.50 | 5.2 | 131.95 | 5.40 | 7.5 | 9.52 |
| CP-584 | 45 | 4.50 | 5.2 | 121.10 | 3.60 | 7.3 | 22.10 |
| CP-585 | 45 | 4.50 | 5.2 | 121.10 | 4.05 | 7.3 | 22.10 |
| CP-586 | 45 | 4.50 | 5.2 | 120.95 | 4.50 | 7.4 | 22.38 |

| Conductive-layer coating solution | (3) Binding material (phenol resin) Density | Amount [part(s)] (resin solid content thereof is 60% by mass of the following) | (4) Silicone resin particles Density | Amount [part(s)] | (5) Particles except (1) to (4) Kind | Density | Amount [part(s)] |
|---|---|---|---|---|---|---|---|
| CP-561 | 1.3 | 264.37 | 1.3 | 5.00 | | None | |
| CP-562 | 1.3 | 264.37 | 1.3 | 5.00 | | | |
| CP-563 | 1.3 | 264.30 | 1.3 | 5.00 | | | |
| CP-564 | 1.3 | 264.30 | 1.3 | 5.00 | | | |
| CP-565 | 1.3 | 264.23 | 1.3 | 5.00 | | | |
| CP-566 | 1.3 | 262.93 | 1.3 | 5.00 | | | |
| CP-567 | 1.3 | 260.07 | 1.3 | 5.00 | | | |
| CP-568 | 1.3 | 260.07 | 1.3 | 5.00 | | | |
| CP-569 | 1.3 | 259.85 | 1.3 | 5.00 | | | |
| CP-570 | 1.3 | 259.85 | 1.3 | 5.00 | | | |
| CP-571 | 1.3 | 259.57 | 1.3 | 5.00 | | | |
| CP-572 | 1.3 | 257.50 | 1.3 | 5.00 | | | |
| CP-573 | 1.3 | 256.37 | 1.3 | 5.00 | | | |
| CP-574 | 1.3 | 256.37 | 1.3 | 5.00 | | | |
| CP-575 | 1.3 | 255.93 | 1.3 | 5.00 | | | |
| CP-576 | 1.3 | 255.93 | 1.3 | 5.00 | | | |
| CP-577 | 1.3 | 255.57 | 1.3 | 5.00 | | | |
| CP-578 | 1.3 | 224.00 | 1.3 | 5.00 | | | |
| CP-579 | 1.3 | 222.80 | 1.3 | 5.00 | | | |
| CP-580 | 1.3 | 222.80 | 1.3 | 5.00 | | | |
| CP-581 | 1.3 | 222.67 | 1.3 | 5.00 | | | |
| CP-582 | 1.3 | 222.67 | 1.3 | 5.00 | | | |
| CP-583 | 1.3 | 222.55 | 1.3 | 5.00 | | | |
| CP-584 | 1.3 | 219.67 | 1.3 | 5.00 | | | |
| CP-585 | 1.3 | 219.67 | 1.3 | 5.00 | | | |
| CP-586 | 1.3 | 219.45 | 1.3 | 5.00 | | | |

TABLE 50

| Conductive- | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| layer coating solution | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part (s)] | Kind | Density | Amount [part (s)] |
| CP-601 | Ta-doped tin oxide-coated titanium oxide particles (average particle diameter: 230 nm) | 45 | 4.50 | 5.2 | 166.40 | Ta-doped tin oxide particles (average particle diameter: 20 nm) | 4.05 | 7.3 | 11.68 | 1.3 | 161.53 | 1.3 | 5.00 | | None | |
| CP-602 | | 45 | 4.50 | 5.2 | 166.30 | | 4.50 | 7.4 | 11.83 | 1.3 | 161.45 | 1.3 | 5.00 | | | |
| CP-603 | | 45 | 4.50 | 5.2 | 166.30 | | 4.95 | 7.4 | 11.83 | 1.3 | 161.45 | 1.3 | 5.00 | | | |
| CP-604 | | 45 | 4.50 | 5.2 | 166.22 | | 5.40 | 7.5 | 11.99 | 1.3 | 161.32 | 1.3 | 5.00 | | | |
| CP-605 | | 45 | 4.50 | 5.2 | 152.02 | | 3.60 | 7.3 | 27.75 | 1.3 | 158.72 | 1.3 | 5.00 | | | |
| CP-606 | | 45 | 4.50 | 5.2 | 152.02 | | 4.05 | 7.3 | 27.75 | 1.3 | 158.72 | 1.3 | 5.00 | | | |
| CP-607 | | 45 | 4.50 | 5.2 | 151.83 | | 4.50 | 7.4 | 28.09 | 1.3 | 158.47 | 1.3 | 5.00 | | | |
| CP-608 | | 45 | 4.50 | 5.2 | 151.83 | | 4.95 | 7.4 | 28.09 | 1.3 | 158.47 | 1.3 | 5.00 | | | |
| CP-609 | | 45 | 4.50 | 5.2 | 151.61 | | 5.40 | 7.5 | 28.43 | 1.3 | 158.27 | 1.3 | 5.00 | | | |
| CP-610 | | 45 | 4.50 | 5.2 | 141.37 | | 3.60 | 7.3 | 39.69 | 1.3 | 156.57 | 1.3 | 5.00 | | | |
| CP-611 | | 45 | 4.50 | 5.2 | 141.37 | | 4.05 | 7.3 | 39.69 | 1.3 | 156.57 | 1.3 | 5.00 | | | |
| CP-612 | | 45 | 4.50 | 5.2 | 141.10 | | 4.50 | 7.4 | 40.15 | 1.3 | 156.25 | 1.3 | 5.00 | | | |
| CP-613 | | 45 | 4.50 | 5.2 | 141.10 | | 4.95 | 7.4 | 40.15 | 1.3 | 156.25 | 1.3 | 5.00 | | | |
| CP-614 | | 45 | 4.50 | 5.2 | 140.82 | | 5.40 | 7.5 | 40.62 | 1.3 | 155.93 | 1.3 | 5.00 | | | |
| CP-615 | | 45 | 4.50 | 5.2 | 134.60 | | 3.60 | 7.3 | 47.24 | 1.3 | 155.27 | 1.3 | 5.00 | | | |
| CP-616 | | 45 | 4.50 | 5.2 | 134.60 | | 4.05 | 7.3 | 47.24 | 1.3 | 155.27 | 1.3 | 5.00 | | | |
| CP-617 | | 45 | 4.50 | 5.2 | 134.30 | | 4.50 | 7.4 | 47.78 | 1.3 | 154.87 | 1.3 | 5.00 | | | |
| CP-618 | | 45 | 4.50 | 5.2 | 134.30 | | 4.95 | 7.4 | 47.78 | 1.3 | 154.87 | 1.3 | 5.00 | | | |
| CP-619 | | 45 | 4.50 | 5.2 | 133.98 | | 5.40 | 7.5 | 48.31 | 1.3 | 154.52 | 1.3 | 5.00 | | | |
| CP-620 | | 45 | 4.50 | 5.2 | 198.45 | | 4.50 | 7.4 | 5.65 | 1.3 | 118.17 | 1.3 | 5.00 | | | |
| CP-621 | | 45 | 4.50 | 5.2 | 191.27 | | 3.60 | 7.3 | 13.43 | 1.3 | 117.17 | 1.3 | 5.00 | | | |
| CP-622 | | 45 | 4.50 | 5.2 | 191.27 | | 4.05 | 7.3 | 13.43 | 1.3 | 117.17 | 1.3 | 5.00 | | | |
| CP-623 | | 45 | 4.50 | 5.2 | 191.15 | | 4.50 | 7.4 | 13.60 | 1.3 | 117.08 | 1.3 | 5.00 | | | |
| CP-624 | | 45 | 4.50 | 5.2 | 191.15 | | 4.95 | 7.4 | 13.60 | 1.3 | 117.08 | 1.3 | 5.00 | | | |
| CP-625 | | 45 | 4.50 | 5.2 | 191.00 | | 5.40 | 7.5 | 13.78 | 1.3 | 117.03 | 1.3 | 5.00 | | | |
| CP-626 | | 45 | 4.50 | 5.2 | 174.32 | | 3.60 | 7.3 | 31.82 | 1.3 | 114.77 | 1.3 | 5.00 | | | |
| CP-627 | | 45 | 4.50 | 5.2 | 174.32 | | 4.05 | 7.3 | 31.82 | 1.3 | 114.77 | 1.3 | 5.00 | | | |
| CP-628 | | 45 | 4.50 | 5.2 | 174.05 | | 4.50 | 7.4 | 32.20 | 1.3 | 114.58 | 1.3 | 5.00 | | | |
| CP-629 | | 45 | 4.50 | 5.2 | 174.05 | | 4.95 | 7.4 | 32.20 | 1.3 | 114.58 | 1.3 | 5.00 | | | |
| CP-630 | | 45 | 4.50 | 5.2 | 173.78 | | 5.40 | 7.5 | 32.58 | 1.3 | 114.40 | 1.3 | 5.00 | | | |
| CP-631 | | 45 | 4.50 | 5.2 | 161.77 | | 3.60 | 7.3 | 45.42 | 1.3 | 113.02 | 1.3 | 5.00 | | | |
| CP-632 | | 45 | 4.50 | 5.2 | 161.77 | | 4.05 | 7.3 | 45.42 | 1.3 | 113.02 | 1.3 | 5.00 | | | |
| CP-633 | | 45 | 4.50 | 5.2 | 161.42 | | 4.50 | 7.4 | 45.95 | 1.3 | 112.72 | 1.3 | 5.00 | | | |
| CP-634 | | 45 | 4.50 | 5.2 | 161.42 | | 4.95 | 7.4 | 45.95 | 1.3 | 112.72 | 1.3 | 5.00 | | | |
| CP-635 | | 45 | 4.50 | 5.2 | 161.07 | | 5.40 | 7.5 | 46.46 | 1.3 | 112.45 | 1.3 | 5.00 | | | |
| CP-636 | | 45 | 4.50 | 5.2 | 153.46 | | 4.50 | 7.4 | 54.60 | 1.3 | 111.57 | 1.3 | 5.00 | | | |
| CP-637 | | 45 | 4.50 | 5.2 | 209.00 | | 3.60 | 7.3 | 5.87 | 1.3 | 100.22 | 1.3 | 5.00 | | | |
| CP-638 | | 45 | 4.50 | 5.2 | 209.00 | | 4.05 | 7.3 | 5.87 | 1.3 | 100.22 | 1.3 | 5.00 | | | |
| CP-639 | | 45 | 4.50 | 5.2 | 208.92 | | 4.50 | 7.4 | 5.96 | 1.3 | 100.20 | 1.3 | 5.00 | | | |
| CP-640 | | 45 | 4.50 | 5.2 | 208.92 | | 4.95 | 7.4 | 5.96 | 1.3 | 100.20 | 1.3 | 5.00 | | | |

TABLE 51

| Conductive-layer coating solution | (1) A first metal oxide particle | | | | | (2) A second metal oxide particle | | | |
|---|---|---|---|---|---|---|---|---|---|
| | Kind | Coating ratio [%] | Doping ratio [%] | Density | Amount [part(s)] | Kind | Doping ratio [%] | Density | Amount [part(s)] |
| CP-641 | Ta-doped tin oxide-coated titanium oxide particles (average particle diameter: 230 nm) | 45 | 4.50 | 5.2 | 208.87 | Ta-doped tin oxide particles (average particle diameter: 20 nm) | 5.40 | 7.5 | 6.03 |
| CP-642 | | 45 | 4.50 | 5.2 | 201.16 | | 4.50 | 7.4 | 14.30 |
| CP-643 | | 45 | 4.50 | 5.2 | 183.27 | | 3.60 | 7.3 | 33.45 |
| CP-644 | | 45 | 4.50 | 5.2 | 183.27 | | 4.05 | 7.3 | 33.45 |
| CP-645 | | 45 | 4.50 | 5.2 | 182.97 | | 4.50 | 7.4 | 33.85 |
| CP-646 | | 45 | 4.50 | 5.2 | 182.97 | | 4.95 | 7.4 | 33.85 |
| CP-647 | | 45 | 4.50 | 5.2 | 182.67 | | 5.40 | 7.5 | 34.25 |
| CP-648 | | 45 | 4.50 | 5.2 | 169.56 | | 4.50 | 7.4 | 48.27 |
| CP-649 | | 45 | 4.50 | 5.2 | 161.58 | | 3.60 | 7.3 | 56.71 |
| CP-650 | | 45 | 4.50 | 5.2 | 161.58 | | 4.05 | 7.3 | 56.71 |
| CP-651 | | 45 | 4.50 | 5.2 | 161.13 | | 4.50 | 7.4 | 57.32 |
| CP-652 | | 45 | 4.50 | 5.2 | 161.13 | | 4.95 | 7.4 | 57.32 |
| CP-653 | | 45 | 4.50 | 5.2 | 160.68 | | 5.40 | 7.5 | 57.94 |

| Conductive-layer coating solution | (3) Binding material (phenol resin) | | (4) Silicone resin particles | | (5) Particles except (1) to (4) | | |
|---|---|---|---|---|---|---|---|
| | Density | Amount [part(s)] (resin solid content thereof is 60% by mass of the following) | Density | Amount [part(s)] | Kind | Density | Amount [part(s)] |
| CP-641 | 1.3 | 100.17 | 1.3 | 5.00 | None | | |
| CP-642 | 1.3 | 99.23 | 1.3 | 5.00 | | | |
| CP-643 | 1.3 | 97.13 | 1.3 | 5.00 | | | |
| CP-644 | 1.3 | 97.13 | 1.3 | 5.00 | | | |
| CP-645 | 1.3 | 96.97 | 1.3 | 5.00 | | | |
| CP-646 | 1.3 | 96.97 | 1.3 | 5.00 | | | |
| CP-647 | 1.3 | 96.80 | 1.3 | 5.00 | | | |
| CP-648 | 1.3 | 95.28 | 1.3 | 5.00 | | | |
| CP-649 | 1.3 | 94.52 | 1.3 | 5.00 | | | |
| CP-650 | 1.3 | 94.52 | 1.3 | 5.00 | | | |
| CP-651 | 1.3 | 94.25 | 1.3 | 5.00 | | | |
| CP-652 | 1.3 | 94.25 | 1.3 | 5.00 | | | |
| CP-653 | 1.3 | 93.97 | 1.3 | 5.00 | | | |

TABLE 52

| Conductive-layer coating solution | (1) A first metal oxide particle | | | | | (2) A second metal oxide particle | | | | | (3) Binding material (phenol resin) | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part(s)] | Kind | Doping ratio [%] | Density | Amount [part(s)] | Density | Amount [part(s)] (resin solid content thereof is 60% by mass of the following) | Density | Amount [part(s)] | Kind | Density | Amount [part(s)] |
| CP-654 | Ta-doped tin oxide-coated titanium oxide particles (average particle diameter: 210 nm) | 45 | 4.50 | 5.2 | 136.45 | Ta-doped tin oxide-particles (average particle diameter: 20 nm) | 3.60 | 7.3 | 9.58 | 1.3 | 156.62 | 1.3 | 40.00 | Uncoated titanium oxide-particles (average particle diameter: 210 nm) | 4.2 | 30.00 |
| CP-655 | | 45 | 4.50 | 5.2 | 136.45 | | 4.05 | 7.3 | 9.58 | 1.3 | 156.62 | 1.3 | 40.00 | | 4.2 | 30.00 |
| CP-656 | | 45 | 4.50 | 5.2 | 136.40 | | 4.50 | 7.4 | 9.70 | 1.3 | 156.50 | 1.3 | 40.00 | | 4.2 | 30.00 |
| CP-657 | | 45 | 4.50 | 5.2 | 136.40 | | 4.95 | 7.4 | 9.70 | 1.3 | 156.50 | 1.3 | 40.00 | | 4.2 | 30.00 |
| CP-658 | | 45 | 4.50 | 5.2 | 136.34 | | 5.40 | 7.5 | 9.83 | 1.3 | 156.38 | 1.3 | 40.00 | | 4.2 | 30.00 |
| CP-659 | | 45 | 4.50 | 5.2 | 125.10 | | 3.60 | 7.3 | 22.83 | 1.3 | 153.45 | 1.3 | 40.00 | | 4.2 | 30.00 |
| CP-660 | | 45 | 4.50 | 5.2 | 125.10 | | 4.05 | 7.3 | 22.83 | 1.3 | 153.45 | 1.3 | 40.00 | | 4.2 | 30.00 |
| CP-661 | | 45 | 4.50 | 5.2 | 124.95 | | 4.50 | 7.4 | 23.12 | 1.3 | 153.22 | 1.3 | 40.00 | | 4.2 | 30.00 |
| CP-662 | | 45 | 4.50 | 5.2 | 124.95 | | 4.95 | 7.4 | 23.12 | 1.3 | 153.22 | 1.3 | 40.00 | | 4.2 | 30.00 |
| CP-663 | | 45 | 4.50 | 5.2 | 124.82 | | 5.40 | 7.5 | 23.40 | 1.3 | 152.97 | 1.3 | 40.00 | | 4.2 | 30.00 |
| CP-664 | | 45 | 4.50 | 5.2 | 116.60 | | 3.60 | 7.3 | 32.73 | 1.3 | 151.12 | 1.3 | 40.00 | | 4.2 | 30.00 |
| CP-665 | | 45 | 4.50 | 5.2 | 116.60 | | 4.05 | 7.3 | 32.73 | 1.3 | 151.12 | 1.3 | 40.00 | | 4.2 | 30.00 |
| CP-666 | | 45 | 4.50 | 5.2 | 116.42 | | 4.50 | 7.4 | 33.13 | 1.3 | 150.75 | 1.3 | 40.00 | | 4.2 | 30.00 |

TABLE 52-continued

| Conductive-layer coating solution | (1) A first metal oxide particle Kind | Coating ratio [%] | Doping ratio [%] | Density | Amount [part(s)] | (2) A second metal oxide particle Kind | Doping ratio [%] | Density | Amount [part(s)] | (3) Binding material (phenol resin) Density | Amount [part(s)] (resin solid content thereof is 60% by mass of the following) | (4) Silicone resin particles Density | Amount [part(s)] | (5) Particles except (1) to (4) Kind | Density | Amount [part(s)] |
|---|---|---|---|---|---|---|---|---|---|---|---|---|---|---|---|---|
| CP-667 | meter: | 45 | 4.50 | 5.2 | 116.42 | | 4.95 | 7.4 | 33.13 | 1.3 | 150.75 | 1.3 | 40.00 | | 4.2 | 30.00 |
| CP-668 | 230 | 45 | 4.50 | 5.2 | 116.25 | | 5.40 | 7.5 | 33.53 | 1.3 | 150.37 | 1.3 | 40.00 | | 4.2 | 30.00 |
| CP-669 | nm) | 45 | 4.50 | 5.2 | 171.92 | | 3.60 | 7.3 | 12.06 | 1.3 | 93.37 | 1.3 | 40.00 | | 4.2 | 30.00 |
| CP-670 | | 45 | 4.50 | 5.2 | 171.92 | | 4.05 | 7.3 | 12.06 | 1.3 | 93.37 | 1.3 | 40.00 | | 4.2 | 30.00 |
| CP-671 | | 45 | 4.50 | 5.2 | 171.82 | | 4.50 | 7.4 | 12.23 | 1.3 | 93.25 | 1.3 | 40.00 | | 4.2 | 30.00 |
| CP-672 | | 45 | 4.50 | 5.2 | 171.82 | | 4.95 | 7.4 | 12.23 | 1.3 | 93.25 | 1.3 | 40.00 | | 4.2 | 30.00 |
| CP-673 | | 45 | 4.50 | 5.2 | 171.72 | | 5.40 | 7.5 | 12.38 | 1.3 | 93.17 | 1.3 | 40.00 | | 4.2 | 30.00 |
| CP-674 | | 45 | 4.50 | 5.2 | 157.08 | | 3.60 | 7.3 | 28.67 | 1.3 | 90.42 | 1.3 | 40.00 | | 4.2 | 30.00 |
| CP-675 | | 45 | 4.50 | 5.2 | 157.08 | | 4.05 | 7.3 | 28.67 | 1.3 | 90.42 | 1.3 | 40.00 | | 4.2 | 30.00 |
| CP-676 | | 45 | 4.50 | 5.2 | 156.85 | | 4.50 | 7.4 | 29.02 | 1.3 | 90.22 | 1.3 | 40.00 | | 4.2 | 30.00 |
| CP-677 | | 45 | 4.50 | 5.2 | 156.85 | | 4.95 | 7.4 | 29.02 | 1.3 | 90.22 | 1.3 | 40.00 | | 4.2 | 30.00 |
| CP-678 | | 45 | 4.50 | 5.2 | 156.64 | | 5.40 | 7.5 | 29.37 | 1.3 | 89.98 | 1.3 | 40.00 | | 4.2 | 30.00 |
| CP-679 | | 45 | 4.50 | 5.2 | 146.04 | | 3.60 | 7.3 | 41.00 | 1.3 | 88.27 | 1.3 | 40.00 | | 4.2 | 30.00 |
| CP-680 | | 45 | 4.50 | 5.2 | 146.04 | | 4.05 | 7.3 | 41.00 | 1.3 | 88.27 | 1.3 | 40.00 | | 4.2 | 30.00 |
| CP-681 | | 45 | 4.50 | 5.2 | 145.76 | | 4.50 | 7.4 | 41.48 | 1.3 | 87.93 | 1.3 | 40.00 | | 4.2 | 30.00 |
| CP-682 | | 45 | 4.50 | 5.2 | 145.76 | | 4.95 | 7.4 | 41.48 | 1.3 | 87.93 | 1.3 | 40.00 | | 4.2 | 30.00 |
| CP-683 | | 45 | 4.50 | 5.2 | 145.48 | | 5.40 | 7.5 | 41.96 | 1.3 | 87.60 | 1.3 | 40.00 | | 4.2 | 30.00 |
| CP-684 | | 45 | 4.50 | 5.2 | 197.62 | | 3.60 | 7.3 | 13.86 | 1.3 | 47.53 | 1.3 | 40.00 | | 4.2 | 30.00 |
| CP-685 | | 45 | 4.50 | 5.2 | 197.62 | | 4.05 | 7.3 | 13.86 | 1.3 | 47.53 | 1.3 | 40.00 | | 4.2 | 30.00 |
| CP-686 | | 45 | 4.50 | 5.2 | 197.48 | | 4.50 | 7.4 | 14.05 | 1.3 | 47.45 | 1.3 | 40.00 | | 4.2 | 30.00 |
| CP-687 | | 45 | 4.50 | 5.2 | 197.48 | | 4.95 | 7.4 | 14.05 | 1.3 | 47.45 | 1.3 | 40.00 | | 4.2 | 30.00 |
| CP-688 | | 45 | 4.50 | 5.2 | 197.36 | | 5.40 | 7.5 | 14.22 | 1.3 | 47.37 | 1.3 | 40.00 | | 4.2 | 30.00 |
| CP-689 | | 45 | 4.50 | 5.2 | 180.09 | | 3.60 | 7.3 | 32.87 | 1.3 | 45.07 | 1.3 | 40.00 | | 4.2 | 30.00 |
| CP-690 | | 45 | 4.50 | 5.2 | 180.09 | | 4.05 | 7.3 | 32.87 | 1.3 | 45.07 | 1.3 | 40.00 | | 4.2 | 30.00 |

TABLE 53

| Conductive-layer coating solution | (1) A first metal oxide particle Kind | Coating ratio [%] | Doping ratio [%] | Density | Amount [part(s)] | (2) A second metal oxide particle Kind | Doping ratio [%] | Density | Amount [part(s)] | (3) Binding material (phenol resin) Density | Amount [part(s)] (resin solid content thereof is 60% by mass of the following) | (4) Silicone resin particles Density | Amount [part(s)] | (5) Particles except (1) to (4) Kind | Density | Amount [part(s)] |
|---|---|---|---|---|---|---|---|---|---|---|---|---|---|---|---|---|
| CP-691 | Ta- | 45 | 4.50 | 5.2 | 179.82 | Ta- | 4.50 | 7.4 | 33.26 | 1.3 | 44.87 | 1.3 | 40.00 | Uncoated | 4.2 | 30.00 |
| CP-692 | doped | 45 | 4.50 | 5.2 | 179.82 | doped | 4.95 | 7.4 | 33.26 | 1.3 | 44.87 | 1.3 | 40.00 | titanium | 4.2 | 30.00 |
| CP-693 | tin | 45 | 4.50 | 5.2 | 179.55 | tin | 5.40 | 7.5 | 33.66 | 1.3 | 44.65 | 1.3 | 40.00 | oxide- | 4.2 | 30.00 |
| CP-694 | oxide- | 45 | 4.50 | 5.2 | 167.15 | oxide- | 3.60 | 7.3 | 46.92 | 1.3 | 43.22 | 1.3 | 40.00 | particles | 4.2 | 30.00 |
| CP-695 | coated | 45 | 4.50 | 5.2 | 167.15 | particles | 4.05 | 7.3 | 46.92 | 1.3 | 43.22 | 1.3 | 40.00 | (average | 4.2 | 30.00 |
| CP-696 | titanium | 45 | 4.50 | 5.2 | 166.77 | (average | 4.50 | 7.4 | 47.46 | 1.3 | 42.95 | 1.3 | 40.00 | particle | 4.2 | 30.00 |
| CP-697 | oxide | 45 | 4.50 | 5.2 | 166.77 | particle | 4.95 | 7.4 | 47.46 | 1.3 | 42.95 | 1.3 | 40.00 | diameter: | 4.2 | 30.00 |
| CP-698 | particles | 45 | 4.50 | 5.2 | 166.40 | diameter: | 5.40 | 7.5 | 48.00 | 1.3 | 42.67 | 1.3 | 40.00 | 210 nm) | 4.2 | 30.00 |
| CP-699 | (average | 45 | 4.50 | 5.2 | 156.85 | 20 nm) | 4.50 | 7.4 | 29.02 | 1.3 | 90.22 | 1.3 | 40.00 | | 4.2 | 30.00 |
| CP-700 | particle diameter: 230 nm) | 45 | 4.50 | 5.2 | 160.36 | | 4.50 | 7.4 | 25.10 | 1.3 | 90.90 | 1.3 | 40.00 | | 4.2 | 30.00 |

TABLE 54

| Conductive-layer coating solution | (1) A first metal oxide particle Kind | Coating ratio [%] | Doping ratio [%] | Density | Amount [part (s)] | (2) A second metal oxide particle Kind | Doping ratio [%] | Density | Amount [part (s)] | (3) Binding material (phenol resin) Density | Amount [part (s)] (resin solid content thereof is 60% by mass of the following) | (4) Silicone resin particles Density | Amount [part (s)] | (5) Particles except (1) to (4) Kind | Density | Amount [part (s)] |
|---|---|---|---|---|---|---|---|---|---|---|---|---|---|---|---|---|
| CP-C129 | Ta-doped tin oxide-coated titanium oxide particles (average particle diameter: 230 nm) | 45 | 4.50 | 5.2 | 115.85 | None | | | | 1.3 | 265.25 | 1.3 | 5.00 | None | | |
| CP-C130 | | 45 | 4.50 | 5.2 | 176.85 | | | | | 1.3 | 163.58 | 1.3 | 5.00 | | | |
| CP-C131 | | 45 | 4.50 | 5.2 | 214.46 | | | | | 1.3 | 100.90 | 1.3 | 5.00 | | | |
| CP-C132 | | 45 | 4.50 | 5.2 | 114.50 | | 4.50 | 7.4 | 1.63 | 1.3 | 264.78 | 1.3 | 5.00 | | | |
| CP-C133 | | 45 | 4.50 | 5.2 | 174.63 | | 4.50 | 7.4 | 2.40 | 1.3 | 163.15 | 1.3 | 5.00 | | | |
| CP-C134 | | 45 | 4.50 | 5.2 | 211.67 | | 4.50 | 7.4 | 3.00 | 1.3 | 100.55 | 1.3 | 5.00 | | | |
| CP-C135 | | 45 | 4.50 | 5.2 | 85.65 | | 4.50 | 7.4 | 36.57 | 1.3 | 254.63 | 1.3 | 5.00 | | | |
| CP-C136 | | 45 | 4.50 | 5.2 | 128.12 | | 4.50 | 7.4 | 54.70 | 1.3 | 153.63 | 1.3 | 5.00 | | | |
| CP-C137 | | 45 | 4.50 | 5.2 | 153.49 | | 4.50 | 7.4 | 65.53 | 1.3 | 93.30 | 1.3 | 5.00 | | | |
| CP-C138 | None | | | | | Ta-doped tin oxide-particles (average particle diameter: 20 nm) | 4.50 | 7.4 | 140.30 | 1.3 | 224.50 | 1.3 | 5.00 | | | |
| CP-C139 | | | | | | | 4.50 | 7.4 | 198.60 | 1.3 | 127.33 | 1.3 | 5.00 | | | |
| CP-C140 | | | | | | | 4.50 | 7.4 | 230.50 | 1.3 | 74.17 | 1.3 | 5.00 | | | |
| CP-C141 | Ta-doped tin oxide-coated titanium oxide particles (average particle diameter: 230 nm) | 45 | 4.50 | 5.2 | 84.25 | | 4.50 | 7.4 | 2.40 | 1.3 | 313.92 | 1.3 | 5.00 | | | |
| CP-C142 | | 45 | 4.50 | 5.2 | 81.56 | | 4.50 | 7.4 | 5.80 | 1.3 | 312.73 | 1.3 | 5.00 | | | |
| CP-C143 | | 45 | 4.50 | 5.2 | 75.10 | | 4.50 | 7.4 | 13.89 | 1.3 | 310.02 | 1.3 | 5.00 | | | |
| CP-C144 | | 45 | 4.50 | 5.2 | 70.28 | | 4.50 | 7.4 | 20.00 | 1.3 | 307.87 | 1.3 | 5.00 | | | |
| CP-C145 | | 45 | 4.50 | 5.2 | 67.19 | | 4.50 | 7.4 | 23.90 | 1.3 | 306.57 | 1.3 | 5.00 | | | |
| CP-C146 | | 45 | 4.50 | 5.2 | 218.17 | | 4.50 | 7.4 | 6.20 | 1.3 | 84.38 | 1.3 | 5.00 | | | |
| CP-C147 | | 45 | 4.50 | 5.2 | 209.94 | | 4.50 | 7.4 | 14.95 | 1.3 | 83.52 | 1.3 | 5.00 | | | |
| CP-C148 | | 45 | 4.50 | 5.2 | 190.80 | | 4.50 | 7.4 | 35.30 | 1.3 | 81.50 | 1.3 | 5.00 | | | |
| CP-C149 | | 45 | 4.50 | 5.2 | 176.69 | | 4.50 | 7.4 | 50.30 | 1.3 | 80.02 | 1.3 | 5.00 | | | |
| CP-C150 | | 45 | 4.50 | 5.2 | 167.83 | | 4.50 | 7.4 | 59.72 | 1.3 | 79.08 | 1.3 | 5.00 | | | |

TABLE 55

| Conductive-layer coating solution | (1) A first metal oxide particle Kind | Coating ratio [%] | Doping ratio [%] | Density | Amount [part (s)] | (2) A second metal oxide particle Kind | Doping ratio [%] | Density | Amount [part (s)] | (3) Binding material (phenol resin) Density | Amount [part (s)] (resin solid content thereof is 60% by mass of the following) | (4) Silicone resin particles Density | Amount [part (s)] | (5) Particles except (1) to (4) Kind | Density | Amount [part (s)] |
|---|---|---|---|---|---|---|---|---|---|---|---|---|---|---|---|---|
| CP-C151 | Nb-doped tin oxide-coated titanium oxide particles (average particle diameter: 230 nm) | 45 | 4.50 | 5.1 | 151.95 | P-doped tin oxide-particles (average particle diameter: 20 nm) | 4.50 | 6.7 | 25.95 | 1.3 | 161.83 | 1.3 | 5.00 | None | | |
| CP-C152 | Ta-doped tin | 45 | 4.50 | 5.2 | 153.28 | | 4.50 | 6.7 | 25.68 | 1.3 | 160.07 | 1.3 | 5.00 | | | |

TABLE 55-continued

| Conductive-layer coating solution | (1) A first metal oxide particle Kind | Coating ratio [%] | Doping ratio [%] | Density | Amount [part (s)] | (2) A second metal oxide particle Kind | Doping ratio [%] | Density | Amount [part (s)] | (3) Binding material (phenol resin) Density | Amount [part (s)] (resin solid content thereof is 60% by mass of the following) | (4) Silicone resin particles Density | Amount [part (s)] | (5) Particles except (1) to (4) Kind | Density | Amount [part (s)] |
|---|---|---|---|---|---|---|---|---|---|---|---|---|---|---|---|---|
| | oxide-coated titanium oxide particles (average particle diameter: 230 nm) | | | | | | | | | | | | | | | |
| CP-C153 | P-doped tin oxide-coated titanium oxide particles (average particle diameter: 230 nm) | 45 | 4.50 | 5.1 | 151.30 | Nb-doped tin oxide-particles (average particle diameter: 20 nm) | 4.50 | 7.0 | 27.00 | 1.3 | 161.17 | 1.3 | 5.00 | | | |
| CP-C154 | | 45 | 4.50 | 5.1 | 150.48 | Ta-doped tin oxide-particles (average particle diameter: 20 nm) | 4.50 | 7.4 | 28.38 | 1.3 | 160.23 | 1.3 | 5.00 | | | |
| CP-C155 | Nb-doped tin oxide-coated titanium oxide particles (average particle diameter: 230 nm) | 45 | 4.50 | 5.1 | 150.28 | W-doped tin oxide-particles (average particle diameter: 20 nm) | 4.50 | 7.5 | 28.73 | 1.3 | 159.98 | 1.3 | 5.00 | | | |
| CP-C156 | Ta-doped tin oxide-coated titanium oxide particles (average particle diameter: 230 nm) | 45 | 4.50 | 5.2 | 151.63 | | 4.50 | 7.5 | 28.43 | 1.3 | 158.23 | 1.3 | 5.00 | | | |
| CP-C157 | W-doped tin oxide-coated titanium oxide particles (average | 45 | 4.50 | 5.2 | 152.65 | Nb-doped tin oxide-particles (average particle diameter: 20 nm) | 4.50 | 7.0 | 26.72 | 1.3 | 159.38 | 1.3 | 5.00 | | | |

TABLE 55-continued

| Conductive-layer coating solution | (1) A first metal oxide particle Kind | Coating ratio [%] | Doping ratio [%] | Density | Amount [part (s)] | (2) A second metal oxide particle Kind | Doping ratio [%] | Density | Amount [part (s)] | (3) Binding material (phenol resin) Density | Amount [part (s)] (resin solid content thereof is 60% by mass of the following) | (4) Silicone resin particles Density | Amount [part (s)] | (5) Particles except (1) to (4) Kind | Density | Amount [part (s)] |
|---|---|---|---|---|---|---|---|---|---|---|---|---|---|---|---|---|
| CP-C158 | particle diameter: 230 nm) | 45 | 4.50 | 5.2 | 151.83 | Ta doped tin oxide-particles (average particle diameter: 20 nm) | 4.50 | 7.4 | 28.08 | 1.3 | 158.48 | 1.3 | 5.00 | | | |

TABLE 56

| Conductive-layer coating solution | (1) A first metal oxide particle Kind | Coating ratio [%] | Doping ratio [%] | Density | Amount [part (s)] | (2) A second metal oxide particle Kind | Doping ratio [%] | Density | Amount [part (s)] | (3) Binding material (phenol resin) Density | Amount [part (s)] (resin solid content thereof is 60% by mass of the following) | (4) Silicone resin particles Density | Amount [part (s)] | (5) Particles except (1) to (4) Kind | Density | Amount [part (s)] |
|---|---|---|---|---|---|---|---|---|---|---|---|---|---|---|---|---|
| CP-C159 | Nb-doped tin oxide-coated titanium oxide particles (average particle diameter: 230 nm) | 45 | 4.50 | 5.1 | 152.15 | F-doped tin oxide-particles (average particle diameter: 20 nm) | 4.50 | 6.6 | 25.60 | 1.3 | 162.08 | 1.3 | 5.00 | None | | |
| CP-C160 | Ta-doped tin oxide-coated titanium oxide particles (average particle diameter: 230 nm) | 45 | 4.50 | 5.2 | 153.50 | | 4.50 | 6.6 | 25.32 | 1.3 | 160.30 | 1.3 | 5.00 | | | |
| CP-C161 | F-doped tin oxide-coated | 45 | 4.50 | 5.0 | 149.93 | Nb-doped tin oxide-particles | 4.50 | 7.0 | 27.29 | 1.3 | 162.97 | 1.3 | 5.00 | | | |

TABLE 56-continued

| Conductive-layer coating solution | (1) A first metal oxide particle Kind | Coating ratio [%] | Doping ratio [%] | Density | Amount [part(s)] | (2) A second metal oxide particle Kind | Doping ratio [%] | Density | Amount [part(s)] | (3) Binding material (phenol resin) Density | Amount [part(s)] (resin solid content thereof is 60% by mass of the following) | (4) Silicone resin particles Density | Amount [part(s)] | (5) Particles except (1) to (4) Kind | Density | Amount [part(s)] |
|---|---|---|---|---|---|---|---|---|---|---|---|---|---|---|---|---|
| | titanium oxide particles (average particle diameter: 230 nm) | | | | | (average particle diameter: 20 nm) | | | | | | | | | | |
| CP-C162 | | 45 | 4.50 | 5.0 | 149.10 | Ta-doped tin oxide-particles (average particle diameter: 20 nm) | 4.50 | 7.4 | 28.38 | 1.3 | 162.03 | 1.3 | 5.00 | | | |
| CP-C163 | Oxygen-deficient tin oxide-coated titanium oxide particles (average particle diameter: 230 nm) | 45 | — | 5.1 | 152.00 | | 4.50 | 7.0 | 26.00 | 1.3 | 161.67 | 1.3 | 5.00 | | | |
| CP-C164 | Oxygen-deficient tin oxide-coated barium sulfate particles (average particle diameter: 230 nm) | 45 | — | 5.1 | 152.00 | Nb-doped tin oxide-particles (average particle diameter: 20 nm) | 4.50 | 7.0 | 26.00 | 1.3 | 161.67 | 1.3 | 5.00 | | | |
| CP-C165 | Sb-doped tin oxide-coated titanium oxide particles (average particle diameter: 230 nm) | 45 | 4.50 | 5.1 | 152.00 | | 4.50 | 7.0 | 26.00 | 1.3 | 161.67 | 1.3 | 5.00 | | | |

TABLE 57

| Conductive-layer coating solution | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part (s)] | Kind | Doping ratio [%] | Density | Amount [part (s)] | Density | Amount [part (s)] (resin solid content thereof is 60% by mass of the following) | Density | Amount [part (s)] | Kind | Density | Amount [part (s)] |
| CP-C166 | Nb-doped tin oxide-coated titanium oxide particles (average particle diameter: 230 nm) | 45 | 4.50 | 5.1 | 152.20 | Oxygen-deficient tin oxide-particles (average particle diameter: 20 nm) | — | 6.6 | 25.60 | 1.3 | 162.00 | 1.3 | 5.00 | None | | |
| CP-C167 | | 45 | 4.50 | 5.1 | 151.10 | Indium tin oxide-particles (average particle diameter: 20 nm) | 4.50 | 7.1 | 27.35 | 1.3 | 160.92 | 1.3 | 5.00 | | | |
| CP-C168 | | 45 | 4.50 | 5.1 | 152.20 | Sb-doped tin oxide-particles (average particle diameter: 20 nm) | 4.50 | 6.6 | 25.60 | 1.3 | 162.00 | 1.3 | 5.00 | | | |
| CP-C169 | Ta-doped tin oxide-coated titanium oxide particles (average particle diameter: 230 nm) | 45 | 4.50 | 5.0 | 153.30 | Nb-doped tin oxide-particles (average particle diameter: 20 nm) | 4.50 | 7.0 | 25.70 | 1.3 | 160.00 | 1.3 | 5.00 | | | |
| CP-C170 | Nb-doped tin oxide-coated titanium oxide particles (average particle diameter: 230 nm) | 45 | 4.50 | 5.1 | 150.60 | Ta-doped tin oxide-particles (average particle diameter: 20 nm) | 4.50 | 7.0 | 26.25 | 1.3 | 163.58 | 1.3 | 5.00 | | | |
| CP-C171 | Nb-doped tin oxide-coated barium sulfate particles (average | 45 | 4.50 | 5.1 | 151.90 | Nb-doped tin oxide-particles (average particle diameter: 20 nm) | 4.50 | 7.0 | 26.00 | 1.3 | 161.83 | 1.3 | 5.00 | | | |

TABLE 57-continued

| Conductive-layer coating solution | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part (s)] | Kind | Doping ratio [%] | Density | Amount [part (s)] | Density | Amount [part (s)] (resin solid content thereof is 60% by mass of the following) | Density | Amount [part (s)] | Kind | Density | Amount [part (s)] |
| | particle diameter: 230 nm) | | | | | | | | | | | | | | | |

TABLE 58

| Conductive-layer coating solution | (1) A first metal oxide particle | | | | | (2) A second metal oxide particle | | | | (3) Binding material (phenol resin) | | (4) Silicone resin particles | | (5) Particles except (1) to (4) | | |
|---|---|---|---|---|---|---|---|---|---|---|---|---|---|---|---|---|
| | Kind | Coating ratio [%] | Doping ratio [%] | Density | Amount [part (s)] | Kind | Doping ratio [%] | Density | Amount [part (s)] | Density | Amount [part (s)] (resin solid content thereof is 60% by mass of the following) | Density | Amount [part (s)] | Kind | Density | Amount [part (s)] |
| CP-C172 | Oxygen-deficient tin oxide-coated titanium oxide particles (average particle diameter: 230 nm) | 45 | — | 5.1 | 152.00 | Ta-doped tin oxide-particles (average particle diameter: 20 nm) | 4.50 | 7.4 | 26.00 | 1.3 | 161.67 | 1.3 | 5.00 | None | | |
| CP-C173 | Oxygen-deficient tin oxide-coated barium sulfate particles (average particle diameter: 230 nm) | 45 | — | 5.1 | 152.00 | | 4.50 | 7.4 | 26.00 | 1.3 | 161.67 | 1.3 | 5.00 | | | |
| CP-C174 | Sb-doped tin oxide-coated titanium oxide particles | 45 | 4.50 | 5.1 | 152.00 | | 4.50 | 7.4 | 26.00 | 1.3 | 161.67 | 1.3 | 5.00 | | | |

TABLE 58-continued

| Conductive-layer coating solution | (1) A first metal oxide particle Kind | Coating ratio [%] | Doping ratio [%] | Density | Amount [part (s)] | (2) A second metal oxide particle Kind | Doping ratio [%] | Density | Amount [part (s)] | (3) Binding material (phenol resin) Density | Amount [part (s)] (resin solid content thereof is 60% by mass of the following) | (4) Silicone resin particles Density | Amount [part (s)] | (5) Particles except (1) to (4) Kind | Density | Amount [part (s)] |
|---|---|---|---|---|---|---|---|---|---|---|---|---|---|---|---|---|
| | (average particle diameter: 230 nm) | | | | | | | | | | | | | | | |
| CP-C175 | Ta-doped tin oxide-coated titanium oxide particles (average particle diameter: 230 nm) | 45 | 4.50 | 5.2 | 152.20 | Oxygen-deficent tin oxide-particles (average particle diameter: 20 nm) | — | 6.6 | 25.60 | 1.3 | 162.00 | 1.3 | 5.00 | | | |
| CP-C176 | | 45 | 4.50 | 5.2 | 151.10 | Indium tin oxide-particles (average particle diameter: 20 nm) | 4.50 | 7.1 | 27.35 | 1.3 | 160.92 | 1.3 | 5.00 | | | |
| CP-C177 | | 45 | 4.50 | 5.2 | 152.20 | Sb-doped tin oxide-particles (average particle diameter: 20 nm) | 4.50 | 6.6 | 25.60 | 1.3 | 162.00 | 1.3 | 5.00 | | | |
| CP-C178 | Ta-doped tin oxide-coated barium sulfate particles (average particle diameter: 230 nm) | 45 | 4.50 | 5.2 | 151.90 | Ta-doped tin oxide-particles (average particle diameter: 20 nm) | 4.50 | 7.0 | 26.00 | 1.3 | 161.83 | 1.3 | 5.00 | | | |
| CP-C179 | Oxygen-deficient tin oxide-coated barium sulfate particles (average particle diameter: 230 nm) | 45 | — | 5.1 | 152.20 | Oxygen-deficent tin oxide-particles (average particle diameter: 20 nm) | — | 6.6 | 25.60 | 1.3 | 162.00 | 1.3 | 5.00 | | | |

Example 1

Production Example of Electrophotographic Photosensitive Member 1

An aluminum cylinder (JIS-A3003, aluminum alloy) having a length of 251.5 mm, a diameter of 24 mm, and a thickness of 1.0 mm produced by a production method including an extrusion process and a drawing process was used as a support (cylindrical support).

The conductive-layer coating solution CP-1 was applied onto the support under a 22° C./55% RH environment by dip coating, and then the resultant coating film was dried and thermally cured for 30 minutes at 140° C. to form a conductive layer having a thickness of 20 μm.

The volume resistivity of the conductive layer was measured to be $2.2\times10^{13}$ Ω·cm.

Next, 4.5 parts of N-methoxymethylated nylon (trade name: Toresin EF-30T, manufactured by Teikoku Chemical Industry Co., Ltd.) and 1.5 parts of a copolymerized nylon resin (trade name: Amilan CM8000, manufactured by Toray Industries, Inc.) were dissolved in a mixed solvent of 65 parts of methanol and 30 parts of n-butanol to prepare an undercoat-layer coating solution. The undercoat-layer coating solution was applied onto the conductive layer by dip coating, and then the resultant coating film was dried for 6 minutes at 70° C. to form an undercoat layer having a thickness of 0.85 μm.

Next, 10 parts of a hydroxygallium phthalocyanine crystal (charge-generating substance) in a crystal form having strong peaks at Bragg angles)(2θ±0.2° in CuKα-characteristic X-ray diffraction of 7.5°, 9.9°, 16.3°, 18.6°, 25.1°, and 28.3°, 5 parts of a polyvinyl butyral (trade name: S-LEC BX-1, manufactured by SEKISUI CHEMICAL, CO., LTD.), and 250 parts of cyclohexanone were loaded into a sand mill using glass beads each having a diameter of 1 mm, and were then subjected to a dispersion treatment under the condition of a dispersion treatment time of 3 hours. After the dispersion treatment, 250 parts of ethyl acetate were added to the treated product to prepare a charge-generating-layer coating solution. The charge-generating-layer coating solution was applied onto the undercoat layer by dip coating, and then the resultant coating film was dried for 10 minutes at 100° C. to form a charge-generating layer having a thickness of 0.12 μm.

Next, 56 parts of an amine compound (charge-transporting substance) represented by the following formula (CT-1):

(CT-1)

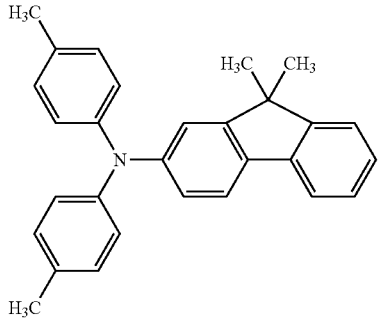

24 parts of an amine compound (charge-transporting substance) represented by the following formula (CT-2):

(CT-2)

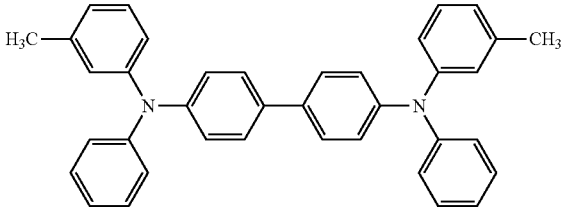

90 parts of a polycarbonate (trade name: Z200, manufactured by Mitsubishi Engineering-Plastics Corporation), 10 parts of a siloxane-modified polycarbonate having a repeating structural unit represented by the following formula (B-1) and a repeating structural unit represented by the following formula (B-2) ((B-1):(B-2)=98:2 (molar ratio)):

(B-1)

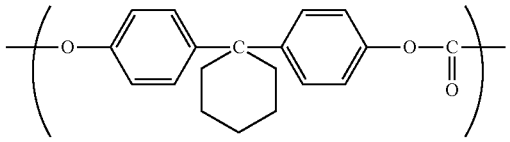

(B-2)

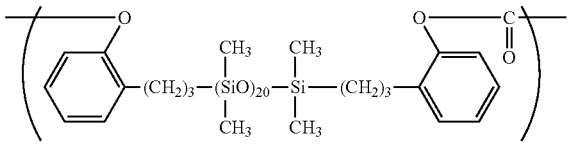

and 0.9 part of a siloxane-modified polycarbonate having a repeating structural unit represented by the following formula (B-3) and a repeating structural unit represented by the following formula (B-4), and having a terminal structure represented by the following formula (B-5) ((B-3):(B-4)=95:5 (molar ratio)):

(B-3)

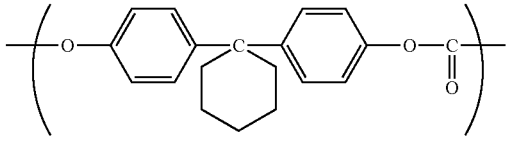

(B-4)

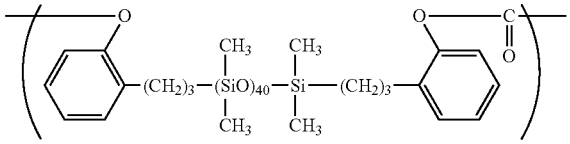

(B-5)

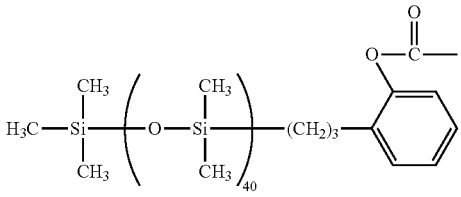

were dissolved in a mixed solvent of 300 parts of o-xylene, 250 parts of dimethoxymethane, and 27 parts of methyl benzoate to prepare a charge-transporting-layer coating solution. The charge-transporting-layer coating solution was applied onto the charge-generating layer by dip coating, and then the resultant coating film was dried for 30 minutes at 120° C. to form a charge-transporting layer having a thickness of 18.5 μm. Thus, an electrophotographic photosensitive member 1 including the charge-transporting layer as a surface layer was produced.

With regard to the electrophotographic photosensitive member 1, the abundance ratio of phosphorus to tin oxide in the P-doped tin oxide-coated titanium oxide particles and the abundance ratio of phosphorus to tin oxide in the P-doped tin oxide particles were each determined from an atomic ratio by employing the foregoing method.

Next, the volume of the P-doped tin oxide-coated titanium oxide particles and the volume of the P-doped tin oxide particles were measured by identifying the P-doped tin oxide-coated titanium oxide particles and the P-doped tin oxide particles based on their difference in contrast of the slice and view of the FIB-SEM by employing the foregoing method. The same holds true for the following examples.

Examples 2 to 700 and Comparative Examples 1 to 179

Production Examples of Electrophotographic Photosensitive Members 2 to 700 and C1 to C179

Electrophotographic photosensitive members 2 to 700 and C1 to C179 were produced by the same operations as those of Example 1 (production example of the electrophotographic photosensitive member 1) except that the conductive-layer coating solution was changed as shown in Tables 22 to 43 and Tables 59 to 73.

(Evaluation)

An evaluation for a crack was performed by observing the surface of a conductive layer at the stage of the formation of the conductive layer on a support with an optical microscope and by observing an image output from an electrophotographic apparatus (laser beam printer) mounted with a produced electrophotographic photosensitive member.

The image observation was performed as described below.

Figure 5:
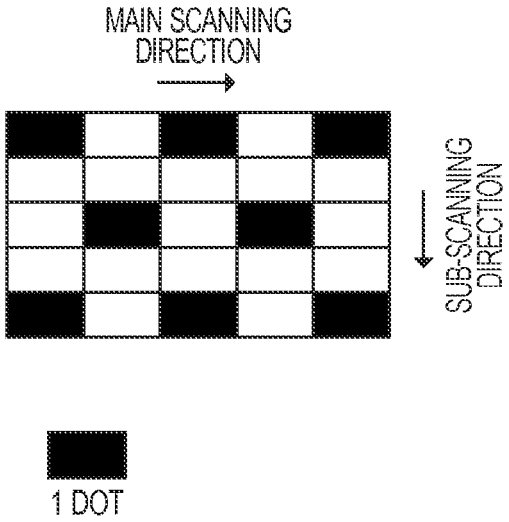
FIG. 5 is a view illustrating a one-dot keima pattern image.

The produced electrophotographic photosensitive member was mounted on a laser beam printer manufactured by Hewlett-Packard Company (trade name: LaserJet P2055dn) as an evaluation apparatus. The resultant was placed under a normal-temperature and normal-humidity (23° C./50% RH) environment, and then a solid black image, a solid white image, and a half-tone image of a one-dot keima pattern were output, followed by the observation of the output images. The half-tone image of a one-dot keima pattern is a half-tone image of a pattern illustrated in FIG. 5.

The degrees of the occurrence of the crack were classified into ranks based on the observation of the images and the following microscopic observation of the conductive layer as described below.

The case where the observation of the surface of the conductive layer with the optical microscope could not confirm the occurrence of any crack was defined as a rank 3. In addition, the case where the observation of the surface of the conductive layer with the optical microscope was able to confirm the occurrence of a crack but an image defect due to the crack was not observed on any one of the solid black image, the solid white image, and the half-tone image of a one-dot keima pattern was defined as a rank 2. In addition, the case where the observation of the surface of the conductive layer with the optical microscope was able to confirm the occurrence of a crack, and an image defect probably due to the crack was observed on any one of the solid black image, the solid white image, and the half-tone image of a one-dot keima pattern was defined as a rank 1. The half-tone image of a one-dot keima pattern is a half-tone image of a pattern illustrated in FIG. 5.

An evaluation for a residual potential and an evaluation for a pattern memory were also performed with a laser beam printer manufactured by Hewlett-Packard Company (trade name: LaserJet P2055dn) as an evaluation apparatus.

The evaluation for a pattern memory was performed as described below.

A produced electrophotographic photosensitive member was mounted on the laser beam printer manufactured by Hewlett-Packard Company. The resultant was placed under a low-temperature and low-humidity (15° C./7% RH) environment, and then a durability test involving continuously outputting 15,000 images of a 3-dot and 100-space vertical line pattern in a repeated manner was performed. The degrees of the occurrence of a pattern memory were classified into six ranks as shown in Table 74 according to the manner in which vertical streaks resulting from the hysteresis of the vertical lines were observed on each of four kinds of half-tone images and a solid black image shown in Table 74 output after the test. The number of the rank becomes larger as the extent to which the pattern memory is suppressed improves. It should be noted that the four kinds of half-tone images are a half-tone image of a one-dot keima pattern, a half-tone image with one-dot and one-space lateral lines, a half-tone image with two-dot and three-space lateral lines, and a half-tone image with one-dot and two-space lateral lines.

The evaluation for a residual potential was performed as described below.

Before and after the durability test, residual potentials after continuous output of three solid white images and five solid black images were measured. An increase in residual potential of 10 V or less was defined as a rank 4. In addition, an increase of more than 10 V and 20 V or less was defined as a rank 3. In addition, an increase of more than 20 V and 30 V or less was defined as a rank 2. In addition, an increase of more than 30 V was defined as a rank 1.

Tables 22 to 43 and Tables 59 to 73 show the results.

TABLE 22

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 1 | CP-1 | 1 | 2 | 15 | 0.8 | $2.2 \times 10^{13}$ | 4 | 3 | 3 |
| Example 2 | CP-2 | 2 | 2 | 15 | 0.9 | $2.2 \times 10^{13}$ | 5 | 3 | 3 |
| Example 3 | CP-3 | 3 | 2 | 15 | 1.0 | $2.2 \times 10^{13}$ | 5 | 3 | 3 |
| Example 9 | CP-4 | 4 | 2 | 15 | 1.1 | $2.2 \times 10^{13}$ | 5 | 3 | 3 |
| Example 5 | CP-5 | 5 | 2 | 15 | 1.2 | $2.2 \times 10^{13}$ | 4 | 3 | 3 |
| Example 6 | CP-6 | 6 | 5 | 15 | 1.0 | $2.1 \times 10^{13}$ | 6 | 3 | 3 |
| Example 7 | CP-7 | 7 | 13 | 15 | 0.8 | $2.0 \times 10^{13}$ | 5 | 3 | 3 |
| Example 8 | CP-8 | 8 | 13 | 15 | 0.9 | $2.0 \times 10^{13}$ | 6 | 3 | 3 |
| Example 9 | CP-9 | 9 | 13 | 15 | 1.0 | $2.0 \times 10^{13}$ | 6 | 3 | 3 |
| Example 10 | CP-10 | 10 | 13 | 15 | 1.1 | $2.0 \times 10^{13}$ | 6 | 3 | 3 |
| Example 11 | CP-11 | 11 | 13 | 15 | 1.2 | $2.0 \times 10^{13}$ | 5 | 3 | 3 |
| Example 12 | CP-12 | 12 | 20 | 15 | 1.0 | $1.9 \times 10^{13}$ | 6 | 3 | 3 |
| Example 13 | CP-13 | 13 | 25 | 15 | 0.8 | $1.8 \times 10^{13}$ | 3 | 3 | 3 |
| Example 14 | CP-14 | 14 | 25 | 15 | 0.9 | $1.8 \times 10^{13}$ | 4 | 3 | 3 |
| Example 15 | CP-15 | 15 | 25 | 15 | 1.0 | $1.8 \times 10^{13}$ | 4 | 3 | 3 |
| Example 16 | CP-16 | 16 | 25 | 15 | 1.1 | $1.8 \times 10^{13}$ | 4 | 3 | 3 |
| Example 17 | CP-17 | 17 | 25 | 15 | 1.2 | $1.8 \times 10^{13}$ | 3 | 3 | 3 |
| Example 18 | CP-18 | 16 | 2 | 20 | 1.0 | $6.6 \times 10^{12}$ | 5 | 4 | 3 |
| Example 19 | CP-19 | 19 | 5 | 20 | 0.8 | $6.3 \times 10^{12}$ | 5 | 4 | 3 |
| Example 10 | CP-20 | 20 | 5 | 20 | 0.9 | $6.3 \times 10^{12}$ | 6 | 4 | 3 |
| Example 21 | CP-21 | 21 | 5 | 20 | 1.0 | $6.3 \times 10^{12}$ | 6 | 4 | 3 |
| Example 22 | CP-22 | 22 | 5 | 20 | 1.1 | $6.3 \times 10^{12}$ | 6 | 4 | 3 |
| Example 23 | CP-23 | 23 | 5 | 20 | 1.2 | $6.3 \times 10^{12}$ | 5 | 4 | 3 |
| Example 29 | CP-24 | 24 | 13 | 20 | 0.8 | $5.8 \times 10^{12}$ | 5 | 4 | 3 |
| Example 25 | CP-25 | 25 | 13 | 20 | 0.9 | $5.8 \times 10^{12}$ | 6 | 4 | 3 |
| Example 26 | CP-26 | 26 | 13 | 20 | 1.0 | $5.8 \times 10^{12}$ | 6 | 4 | 3 |
| Example 27 | CP-27 | 27 | 13 | 20 | 1.1 | $5.8 \times 10^{12}$ | 6 | 4 | 3 |
| Example 28 | CP-28 | 28 | 13 | 20 | 1.2 | $5.8 \times 10^{12}$ | 5 | 4 | 3 |
| Example 29 | CP-29 | 29 | 20 | 20 | 0.8 | $5.4 \times 10^{12}$ | 5 | 4 | 3 |
| Example 30 | CP-30 | 30 | 20 | 20 | 0.9 | $5.5 \times 10^{12}$ | 6 | 4 | 3 |
| Example 31 | CP-31 | 31 | 20 | 20 | 1.0 | $5.5 \times 10^{12}$ | 6 | 4 | 3 |
| Example 32 | CP-32 | 32 | 20 | 20 | 1.1 | $5.5 \times 10^{12}$ | 6 | 4 | 3 |
| Example 33 | CP-33 | 33 | 20 | 20 | 1.2 | $5.5 \times 10^{12}$ | 5 | 4 | 3 |
| Example 34 | CP-34 | 34 | 25 | 20 | 1.0 | $5.2 \times 10^{12}$ | 4 | 4 | 3 |
| Example 35 | CP-35 | 35 | 2 | 30 | 0.8 | $3.6 \times 10^{11}$ | 4 | 4 | 3 |
| Example 36 | CP-36 | 36 | 2 | 30 | 0.9 | $3.6 \times 10^{11}$ | 5 | 4 | 3 |
| Example 37 | CP-37 | 37 | 2 | 30 | 1.0 | $3.6 \times 10^{11}$ | 5 | 4 | 3 |
| Example 38 | CP-38 | 38 | 2 | 30 | 1.1 | $3.6 \times 10^{11}$ | 5 | 4 | 3 |
| Example 39 | CP-39 | 39 | 2 | 30 | 1.2 | $3.6 \times 10^{11}$ | 4 | 4 | 3 |
| Example 40 | CP-40 | 40 | 5 | 30 | 0.2 | $3.4 \times 10^{11}$ | 5 | 4 | 3 |

TABLE 23

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 41 | CP-41 | 41 | 5 | 30 | 0.9 | $3.4 \times 10^{11}$ | 6 | 4 | 3 |
| Example 42 | CP-42 | 42 | 5 | 30 | 1.0 | $3.4 \times 10^{11}$ | 6 | 4 | 3 |
| Example 43 | CP-43 | 43 | 5 | 30 | 1.1 | $3.4 \times 10^{11}$ | 6 | 4 | 3 |
| Example 44 | CP-44 | 44 | 5 | 30 | 1.2 | $3.4 \times 10^{11}$ | 5 | 4 | 3 |
| Example 45 | CP-45 | 45 | 13 | 30 | 0.8 | $2.9 \times 10^{11}$ | 5 | 4 | 3 |
| Example 46 | CP-46 | 46 | 13 | 30 | 0.9 | $3.0 \times 10^{11}$ | 6 | 4 | 3 |
| Example 47 | CP-47 | 47 | 13 | 30 | 1.0 | $3.0 \times 10^{11}$ | 6 | 4 | 3 |
| Example 48 | CP-48 | 48 | 13 | 30 | 1.1 | $3.0 \times 10^{11}$ | 6 | 4 | 3 |
| Example 49 | CP-49 | 49 | 13 | 30 | 1.2 | $3.0 \times 10^{11}$ | 5 | 4 | 3 |
| Example 50 | CP-50 | 50 | 20 | 30 | 0.8 | $2.6 \times 10^{11}$ | 5 | 4 | 3 |
| Example 51 | CP-51 | 51 | 20 | 30 | 0.9 | $2.6 \times 10^{11}$ | 6 | 4 | 3 |
| Example 52 | CP-52 | 52 | 20 | 30 | 1.0 | $2.6 \times 10^{11}$ | 6 | 4 | 3 |
| Example 53 | CP-53 | 53 | 20 | 30 | 1.1 | $2.6 \times 10^{11}$ | 6 | 4 | 3 |
| Example 54 | CP-54 | 54 | 20 | 30 | 1.2 | $2.6 \times 10^{11}$ | 5 | 4 | 3 |
| Example 55 | CP-55 | 55 | 25 | 30 | 0.8 | $2.4 \times 10^{11}$ | 3 | 4 | 3 |
| Example 56 | CP-56 | 56 | 25 | 30 | 0.9 | $2.5 \times 10^{11}$ | 4 | 4 | 3 |
| Example 57 | CP-57 | 57 | 25 | 30 | 1.0 | $2.5 \times 10^{11}$ | 4 | 4 | 3 |

TABLE 23-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 58 | CP-58 | 56 | 25 | 30 | 1.1 | $2.5 \times 10^{11}$ | 4 | 4 | 3 |
| Example 59 | CP-59 | 59 | 25 | 30 | 1.2 | $2.5 \times 10^{11}$ | 3 | 4 | 3 |
| Example 60 | CP-60 | 60 | 2 | 40 | 1.0 | $7.7 \times 10^{9}$ | 5 | 4 | 3 |
| Example 61 | CP-61 | 61 | 5 | 40 | 0.8 | $6.9 \times 10^{9}$ | 5 | 4 | 3 |
| Example 62 | CP-62 | 62 | 5 | 40 | 0.9 | $7.0 \times 10^{9}$ | 6 | 4 | 3 |
| Example 63 | CP-63 | 63 | 5 | 40 | 1.0 | $7.0 \times 10^{9}$ | 6 | 4 | 3 |
| Example 69 | CP-64 | 64 | 5 | 40 | 1.1 | $7.0 \times 10^{9}$ | 6 | 4 | 3 |
| Example 65 | CP-65 | 65 | 5 | 40 | 1.2 | $7.0 \times 10^{9}$ | 5 | 4 | 3 |
| Example 66 | CP-66 | 66 | 13 | 40 | 0.8 | $5.4 \times 10^{9}$ | 5 | 4 | 3 |
| Example 67 | CP-67 | 67 | 13 | 40 | 0.9 | $5.5 \times 10^{9}$ | 6 | 4 | 3 |
| Example 68 | CP-68 | 62 | 13 | 40 | 1.0 | $5.5 \times 10^{9}$ | 6 | 4 | 3 |
| Example 69 | CP-69 | 69 | 13 | 40 | 1.1 | $5.5 \times 10^{9}$ | 6 | 4 | 3 |
| Example 70 | CP-70 | 70 | 13 | 40 | 1.2 | $5.5 \times 10^{9}$ | 5 | 4 | 3 |
| Example 71 | CP-71 | 71 | 20 | 40 | 0.8 | $4.5 \times 10^{9}$ | 5 | 4 | 3 |
| Example 72 | CP-72 | 72 | 20 | 40 | 0.9 | $4.6 \times 10^{9}$ | 6 | 4 | 3 |
| Example 73 | CP-73 | 73 | 20 | 40 | 1.0 | $4.6 \times 10^{9}$ | 6 | 4 | 3 |
| Example 74 | CP-74 | 74 | 20 | 40 | 1.1 | $4.8 \times 10^{9}$ | 6 | 4 | 3 |
| Example 75 | CP-75 | 75 | 20 | 40 | 1.2 | $4.6 \times 10^{9}$ | 5 | 4 | 3 |
| Example 76 | CP-76 | 76 | 25 | 40 | 1.0 | $4.1 \times 10^{9}$ | 4 | 4 | 3 |
| Example 77 | CP-77 | 77 | 2 | 45 | 0.8 | $6.4 \times 10^{8}$ | 4 | 4 | 2 |
| Example 78 | CP-78 | 78 | 2 | 45 | 0.9 | $6.6 \times 10^{8}$ | 5 | 4 | 2 |
| Example 79 | CP-79 | 79 | 2 | 45 | 1.0 | $6.6 \times 10^{8}$ | 5 | 4 | 2 |
| Example 80 | CP-80 | 20 | 2 | 45 | 1.1 | $6.6 \times 10^{8}$ | 5 | 4 | 2 |

TABLE 24

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 81 | CP-81 | 81 | 2 | 45 | 1.2 | $6.6 \times 10^{8}$ | 4 | 4 | 2 |
| Example 82 | CP-82 | 82 | 5 | 45 | 1.0 | $5.8 \times 10^{8}$ | 6 | 4 | 2 |
| Example 83 | CP-83 | 83 | 13 | 45 | 0.8 | $4.2 \times 10^{8}$ | 5 | 4 | 2 |
| Example 84 | CP-84 | 84 | 13 | 45 | 0.9 | $4.4 \times 10^{8}$ | 6 | 4 | 2 |
| Example 85 | CP-85 | 85 | 13 | 45 | 1.0 | $4.4 \times 10^{8}$ | 6 | 4 | 2 |
| Example 86 | CP-26 | 26 | 13 | 45 | 1.1 | $4.4 \times 10^{8}$ | 6 | 4 | 2 |
| Example 87 | CP-87 | 87 | 13 | 45 | 1.2 | $4.4 \times 10^{8}$ | 5 | 4 | 2 |
| Example 88 | CP-88 | 88 | 20 | 45 | 1.0 | $3.5 \times 10^{8}$ | 6 | 4 | 2 |
| Example 89 | CP-89 | 89 | 25 | 45 | 0.8 | $3.0 \times 10^{8}$ | 3 | 4 | 2 |
| Example 90 | CP-90 | 90 | 25 | 45 | 0.9 | $3.1 \times 10^{8}$ | 4 | 4 | 2 |
| Example 91 | CP-91 | 91 | 25 | 45 | 1.0 | $3.1 \times 10^{8}$ | 4 | 4 | 2 |
| Example 92 | CP-92 | 92 | 25 | 45 | 1.1 | $3.1 \times 10^{8}$ | 4 | 4 | 2 |
| Example 93 | CP-93 | 93 | 25 | 45 | 1.2 | $3.1 \times 10^{8}$ | 3 | 4 | 2 |
| Example 94 | CP-94 | 94 | 5 | 20 | 0.8 | $4.8 \times 10^{12}$ | 5 | 4 | 3 |
| Example 95 | CP-95 | 95 | 5 | 20 | 0.9 | $4.8 \times 10^{12}$ | 6 | 4 | 3 |
| Example 96 | CP-96 | 96 | 5 | 20 | 1.0 | $4.2 \times 10^{12}$ | 6 | 4 | 3 |
| Example 97 | CP-97 | 97 | 5 | 20 | 1.1 | $4.8 \times 10^{12}$ | 6 | 4 | 3 |
| Example 98 | CP-98 | 98 | 5 | 20 | 1.2 | $4.8 \times 10^{12}$ | 5 | 4 | 3 |
| Example 99 | CP-99 | 99 | 13 | 20 | 0.8 | $4.3 \times 10^{12}$ | 5 | 4 | 3 |
| Example 100 | CP-100 | 100 | 13 | 20 | 0.9 | $4.4 \times 10^{12}$ | 6 | 4 | 3 |
| Example 101 | CP-101 | 101 | 13 | 20 | 1.0 | $4.4 \times 10^{12}$ | 6 | 4 | 3 |
| Example 102 | CP-102 | 102 | 13 | 20 | 1.1 | $4.4 \times 10^{12}$ | 6 | 4 | 3 |
| Example 103 | CP-103 | 103 | 13 | 20 | 1.2 | $4.4 \times 10^{12}$ | 5 | 4 | 3 |
| Example 104 | CP-104 | 104 | 20 | 20 | 0.8 | $4.0 \times 10^{12}$ | 5 | 4 | 3 |
| Example 105 | CP-105 | 105 | 20 | 20 | 0.9 | $4.1 \times 10^{12}$ | 6 | 4 | 3 |
| Example 106 | CP-106 | 106 | 20 | 20 | 1.0 | $4.1 \times 10^{12}$ | 6 | 4 | 3 |
| Example 107 | CP-107 | 107 | 20 | 20 | 1.1 | $4.1 \times 10^{12}$ | 6 | 4 | 3 |
| Example 108 | CP-108 | 108 | 20 | 20 | 1.2 | $4.1 \times 10^{12}$ | 5 | 4 | 3 |
| Example 109 | CP-109 | 109 | 5 | 30 | 0.8 | $1.7 \times 10^{11}$ | 5 | 4 | 3 |
| Example 110 | CP-110 | 110 | 5 | 30 | 0.9 | $1.8 \times 10^{11}$ | 6 | 4 | 3 |
| Example 111 | CP-111 | 111 | 5 | 30 | 1.0 | $1.8 \times 10^{11}$ | 6 | 4 | 3 |
| Example 112 | CP-112 | 112 | 5 | 30 | 1.1 | $1.8 \times 10^{11}$ | 6 | 4 | 3 |
| Example 113 | CP-113 | 113 | 5 | 30 | 1.2 | $1.2 \times 10^{11}$ | 5 | 4 | 3 |
| Example 114 | CP-114 | 114 | 13 | 30 | 0.8 | $1.4 \times 10^{11}$ | 5 | 4 | 3 |

TABLE 24-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 115 | CP-115 | 115 | 13 | 30 | 0.9 | $1.5 \times 10^{11}$ | 6 | 4 | 3 |
| Example 116 | CP-116 | 116 | 13 | 30 | 1.0 | $1.5 \times 10^{11}$ | 6 | 4 | 3 |
| Example 117 | CP-117 | 117 | 13 | 30 | 1.1 | $1.5 \times 10^{11}$ | 6 | 4 | 3 |
| Example 118 | CP-118 | 118 | 13 | 30 | 1.2 | $1.5 \times 10^{11}$ | 5 | 4 | 3 |
| Example 119 | CP-119 | 119 | 20 | 30 | 0.8 | $1.3 \times 10^{11}$ | 5 | 4 | 3 |
| Example 120 | CP-120 | 120 | 20 | 30 | 0.9 | $1.3 \times 10^{11}$ | 6 | 4 | 3 |

TABLE 25

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 121 | CP-121 | 121 | 20 | 30 | 1.0 | $1.3 \times 10^{11}$ | 6 | 4 | 3 |
| Example 122 | CP-122 | 122 | 20 | 30 | 1.1 | $1.3 \times 10^{11}$ | 6 | 4 | 3 |
| Example 123 | CP-123 | 123 | 20 | 30 | 1.2 | $1.3 \times 10^{11}$ | 5 | 4 | 3 |
| Example 124 | CP-124 | 124 | 5 | 40 | 0.8 | $1.6 \times 10^{9}$ | 5 | 4 | 3 |
| Example 125 | CP-125 | 125 | 5 | 40 | 0.9 | $1.6 \times 10^{9}$ | 6 | 4 | 3 |
| Example 126 | CP-126 | 126 | 5 | 40 | 1.0 | $1.6 \times 10^{9}$ | 6 | 4 | 3 |
| Example 127 | CP-127 | 127 | 5 | 40 | 1.1 | $1.6 \times 10^{9}$ | 6 | 4 | 3 |
| Example 128 | CP-128 | 128 | 5 | 40 | 1.2 | $1.6 \times 10^{9}$ | 5 | 4 | 3 |
| Example 129 | CP-129 | 129 | 13 | 40 | 0.8 | $1.2 \times 10^{9}$ | 5 | 4 | 3 |
| Example 130 | CP-130 | 130 | 13 | 40 | 0.9 | $1.2 \times 10^{9}$ | 6 | 4 | 3 |
| Example 131 | CP-131 | 131 | 13 | 40 | 1.0 | $1.2 \times 10^{9}$ | 6 | 4 | 3 |
| Example 132 | CP-132 | 132 | 13 | 40 | 1.1 | $1.2 \times 10^{9}$ | 6 | 4 | 3 |
| Example 133 | CP-133 | 133 | 13 | 40 | 1.2 | $1.2 \times 10^{9}$ | 5 | 4 | 3 |
| Example 134 | CP-134 | 134 | 20 | 40 | 0.8 | $9.5 \times 10^{8}$ | 5 | 4 | 3 |
| Example 135 | CP-135 | 135 | 20 | 40 | 0.9 | $9.9 \times 10^{8}$ | 6 | 4 | 3 |
| Example 136 | CP-136 | 136 | 20 | 40 | 1.0 | $9.9 \times 10^{8}$ | 6 | 4 | 3 |
| Example 137 | CP-137 | 137 | 20 | 40 | 1.1 | $9.9 \times 10^{8}$ | 6 | 4 | 3 |
| Example 138 | CP-138 | 138 | 20 | 40 | 1.2 | $9.9 \times 10^{8}$ | 5 | 4 | 3 |
| Example 139 | CP-139 | 139 | 13 | 30 | 1.0 | $2.5 \times 10^{11}$ | 6 | 4 | 3 |
| Example 140 | CP-140 | 140 | 13 | 30 | 1.0 | $5.5 \times 10^{11}$ | 6 | 4 | 3 |

TABLE 26

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 1 | CP-C1 | C1 | — | — | — | $2.2 \times 10^{13}$ | 1 | 3 | 3 |
| Comparative Example 2 | CP-C2 | C2 | — | — | — | $3.8 \times 10^{11}$ | 1 | 4 | 3 |
| Comparative Example 3 | CP-C3 | C3 | — | — | — | $7.1 \times 10^{8}$ | 1 | 4 | 2 |
| Comparative Example 9 | CP-C4 | C4 | 1 | 15 | 1.0 | $2.2 \times 10^{13}$ | 2 | 3 | 3 |
| Comparative Example 5 | CP-C5 | C5 | 1 | 30 | 1.0 | $3.7 \times 10^{11}$ | 2 | 4 | 3 |
| Comparative Example 6 | CP-C6 | C6 | 1 | 45 | 1.2 | $6.8 \times 10^{8}$ | 2 | 4 | 2 |
| Comparative Example 7 | CP-C7 | C7 | 30 | 15 | 1.0 | $1.8 \times 10^{13}$ | 2 | 3 | 3 |
| Comparative Example 8 | CP-C8 | C8 | 30 | 30 | 1.0 | $2.3 \times 10^{11}$ | 2 | 4 | 3 |
| Comparative Example 9 | CP-C9 | C9 | 30 | 45 | 1.0 | $2.7 \times 10^{8}$ | 2 | 4 | 2 |
| Comparative Example 10 | CP-C10 | C10 | — | — | — | $9.0 \times 10^{12}$ | 1 | 3 | 3 |
| Comparative Example 11 | CP-C11 | C11 | — | — | — | $4.3 \times 10^{10}$ | 1 | 4 | 3 |
| Comparative Example 12 | CP-C12 | C12 | — | — | — | $1.1 \times 10^{7}$ | 1 | 4 | 2 |
| Comparative Example 13 | CP-C13 | C13 | 2 | 10 | 1.0 | $6.3 \times 10^{13}$ | 5 | 1 | 3 |
| Comparative Example 14 | CP-C14 | C14 | 5 | 10 | 1.0 | $6.2 \times 10^{13}$ | 6 | 1 | 3 |
| Comparative Example 15 | CP-C15 | C15 | 13 | 10 | 1.0 | $5.9 \times 10^{13}$ | 6 | 1 | 3 |

TABLE 26-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 16 | CP-C16 | C16 | 20 | 10 | 1.0 | $5.8 \times 10^{13}$ | 6 | 1 | 3 |
| Comparative Example 17 | CP-C17 | C17 | 25 | 10 | 1.0 | $5.7 \times 10^{13}$ | 4 | 1 | 3 |
| Comparative Example 18 | CP-C18 | C18 | 2 | 50 | 1.0 | $3.4 \times 10^{7}$ | 5 | 4 | 1 |
| Comparative Example 19 | CP-C19 | C19 | 5 | 50 | 1.0 | $3.0 \times 10^{7}$ | 6 | 4 | 1 |
| Comparative Example 20 | CP-C20 | C20 | 13 | 50 | 1.0 | $2.1 \times 10^{7}$ | 6 | 4 | 1 |
| Comparative Example 21 | CP-C21 | C21 | 20 | 50 | 1.0 | $1.6 \times 10^{7}$ | 6 | 4 | 1 |
| Comparative Example 22 | CP-C22 | C22 | 25 | 50 | 1.0 | $1.4 \times 10^{7}$ | 4 | 4 | 1 |

TABLE 27

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 23 | CP-023 | C23 | — | — | — | $2.9 \times 10^{11}$ | 1 | 4 | 3 |
| Comparative Example 29 | CP-C24 | C24 | — | — | — | $2.9 \times 10^{11}$ | 1 | 4 | 3 |
| Comparative Example 25 | CP-C25 | C25 | — | — | — | $2.9 \times 10^{11}$ | 1 | 4 | 3 |
| Comparative Example 26 | CP-C26 | C26 | — | — | — | $3.0 \times 10^{11}$ | 1 | 4 | 3 |
| Comparative Example 27 | CP-C27 | C27 | — | — | — | $2.8 \times 10^{11}$ | 1 | 4 | 3 |
| Comparative Example 28 | CP-020 | C28 | — | — | — | $3.0 \times 10^{11}$ | 1 | 4 | 3 |
| Comparative Example 29 | CP-C29 | C29 | — | — | — | $2.6 \times 10^{11}$ | 1 | 4 | 3 |

TABLE 28

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 30 | CP-C3C | C30 | — | — | — | $3.3 \times 10^{11}$ | 1 | 4 | 3 |
| Comparative Example 31 | CP-C31 | C31 | — | — | — | $2.6 \times 10^{11}$ | 1 | 4 | 3 |
| Comparative Example 32 | CP-C32 | C32 | — | — | — | $3.0 \times 10^{11}$ | 1 | 4 | 3 |
| Comparative Example 33 | CP-C33 | C33 | — | — | — | $3.0 \times 10^{11}$ | 1 | 4 | 3 |
| Comparative Example 34 | CP-C34 | C34 | — | — | — | $3.0 \times 10^{11}$ | 1 | 4 | 3 |
| Comparative Example 35 | CP-C35 | C35 | — | — | — | $3.0 \times 10^{11}$ | 1 | 4 | 3 |

TABLE 29

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 141 | CP-141 | 141 | 2 | 15 | 0.9 | $2.0 \times 10^{13}$ | 4 | 3 | 3 |
| Example 142 | CP-142 | 142 | 2 | 15 | 0.9 | $2.0 \times 10^{13}$ | 5 | 3 | 3 |
| Example 143 | CP-143 | 143 | 2 | 15 | 1.0 | $2.0 \times 10^{13}$ | 5 | 3 | 3 |
| Example 144 | CP-144 | 144 | 2 | 15 | 1.1 | $2.0 \times 10^{13}$ | 5 | 3 | 3 |
| Example 145 | CP-145 | 145 | 2 | 15 | 1.2 | $2.0 \times 10^{13}$ | 4 | 3 | 3 |
| Example 146 | CP-146 | 146 | 5 | 15 | 1.0 | $2.0 \times 10^{13}$ | 6 | 3 | 3 |

TABLE 29-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 147 | CP-147 | 147 | 13 | 15 | 0.8 | $1.8 \times 10^{13}$ | 5 | 3 | 3 |
| Example 148 | CP-148 | 143 | 13 | 15 | 0.9 | $1.8 \times 10^{13}$ | 6 | 3 | 3 |
| Example 149 | CP-149 | 149 | 13 | 15 | 1.0 | $1.8 \times 10^{13}$ | 6 | 3 | 3 |
| Example 150 | CP-150 | 150 | 13 | 15 | 1.1 | $1.8 \times 10^{13}$ | 6 | 3 | 3 |
| Example 151 | CP-151 | 151 | 13 | 15 | 1.2 | $1.8 \times 10^{13}$ | 5 | 3 | 3 |
| Example 152 | CP-152 | 152 | 20 | 15 | 1.0 | $1.7 \times 10^{13}$ | 6 | 3 | 3 |
| Example 153 | CP-153 | 153 | 25 | 15 | 0.8 | $1.6 \times 10^{13}$ | 3 | 3 | 3 |
| Example 154 | CP-154 | 154 | 25 | 15 | 0.9 | $1.6 \times 10^{13}$ | 4 | 3 | 3 |
| Example 155 | CP-155 | 155 | 25 | 15 | 1.0 | $1.6 \times 10^{13}$ | 4 | 3 | 3 |
| Example 156 | CP-156 | 156 | 25 | 15 | 1.1 | $1.6 \times 10^{13}$ | 4 | 3 | 3 |
| Example 157 | CP-157 | 157 | 25 | 15 | 1.2 | $1.6 \times 10^{13}$ | 3 | 3 | 3 |
| Example 158 | CP-158 | 158 | 2 | 20 | 1.0 | $6.0 \times 10^{12}$ | 5 | 4 | 3 |
| Example 159 | CP-159 | 159 | 5 | 20 | 0.8 | $5.8 \times 10^{12}$ | 5 | 4 | 3 |
| Example 160 | CP-160 | 160 | 5 | 20 | 0.9 | $5.7 \times 10^{12}$ | 6 | 4 | 3 |
| Example 161 | CP-161 | 161 | 5 | 20 | 1.0 | $5.7 \times 10^{12}$ | 6 | 4 | 3 |
| Example 162 | CP-162 | 162 | 5 | 20 | 1.1 | $5.7 \times 10^{12}$ | 6 | 4 | 3 |
| Example 163 | CP-163 | 163 | 5 | 20 | 1.2 | $5.7 \times 10^{12}$ | 5 | 4 | 3 |
| Example 164 | CP-164 | 164 | 13 | 20 | 0.8 | $5.1 \times 10^{12}$ | 5 | 4 | 3 |
| Example 165 | CP-165 | 165 | 13 | 20 | 0.9 | $5.1 \times 10^{12}$ | 6 | 4 | 3 |
| Example 166 | CP-166 | 166 | 13 | 20 | 1.0 | $5.1 \times 10^{12}$ | 6 | 4 | 3 |
| Example 167 | CP-167 | 167 | 13 | 20 | 1.1 | $5.0 \times 10^{12}$ | 6 | 4 | 3 |
| Example 168 | CP-168 | 168 | 13 | 20 | 1.2 | $5.0 \times 10^{12}$ | 5 | 4 | 3 |
| Example 169 | CP-169 | 169 | 20 | 20 | 0.8 | $4.7 \times 10^{12}$ | 5 | 4 | 3 |
| Example 170 | CP-170 | 170 | 20 | 20 | 0.9 | $4.6 \times 10^{12}$ | 6 | 4 | 3 |
| Example 171 | CP-171 | 171 | 20 | 20 | 1.0 | $4.6 \times 10^{12}$ | 6 | 4 | 3 |
| Example 172 | CP-172 | 172 | 20 | 20 | 1.1 | $4.5 \times 10^{12}$ | 6 | 4 | 3 |
| Example 173 | CP-173 | 173 | 20 | 20 | 1.2 | $4.5 \times 10^{12}$ | 5 | 4 | 3 |
| Example 174 | CP-174 | 174 | 25 | 20 | 1.0 | $4.3 \times 10^{12}$ | 4 | 4 | 3 |
| Example 175 | CP-175 | 175 | 2 | 30 | 0.8 | $3.1 \times 10^{11}$ | 4 | 4 | 3 |
| Example 176 | CP-176 | 176 | 2 | 30 | 0.9 | $3.1 \times 10^{11}$ | 5 | 4 | 3 |
| Example 177 | CP-177 | 177 | 2 | 30 | 1.0 | $3.1 \times 10^{11}$ | 5 | 4 | 3 |
| Example 178 | CP-178 | 178 | 2 | 30 | 1.1 | $3.1 \times 10^{11}$ | 5 | 4 | 3 |
| Example 179 | CP-179 | 179 | 2 | 30 | 1.2 | $3.1 \times 10^{11}$ | 4 | 4 | 3 |
| Example 180 | CP-180 | 180 | 5 | 30 | 0.B | $2.9 \times 10^{11}$ | 5 | 4 | 3 |

TABLE 30

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 181 | CP-181 | 181 | 5 | 30 | 0.9 | $2.9 \times 10^{11}$ | 6 | 4 | 3 |
| Example 182 | CP-182 | 182 | 5 | 30 | 1.0 | $2.9 \times 10^{11}$ | 6 | 4 | 3 |
| Example 183 | CP-183 | 183 | 5 | 30 | 1.1 | $2.9 \times 10^{11}$ | 6 | 4 | 3 |
| Example 189 | CP-184 | 184 | 5 | 30 | 1.2 | $2.9 \times 10^{11}$ | 5 | 4 | 3 |
| Example 185 | CP-185 | 185 | 13 | 30 | 0.8 | $2.4 \times 10^{11}$ | 5 | 4 | 3 |
| Example 186 | CP-186 | 196 | 13 | 30 | 0.9 | $2.3 \times 10^{11}$ | 6 | 4 | 3 |
| Example 187 | CP-187 | 187 | 13 | 30 | 1.0 | $2.3 \times 10^{11}$ | 6 | 4 | 3 |
| Example 188 | CP-188 | 183 | 13 | 30 | 1.1 | $2.3 \times 10^{11}$ | 6 | 4 | 3 |
| Example 189 | CP-189 | 189 | 13 | 30 | 1.2 | $2.3 \times 10^{11}$ | 5 | 4 | 3 |
| Example 190 | CP-190 | 190 | 20 | 30 | 0.8 | $2.0 \times 10^{11}$ | 5 | 4 | 3 |
| Example 191 | CP-191 | 191 | 20 | 30 | 0.9 | $2.0 \times 10^{11}$ | 6 | 4 | 3 |
| Example 192 | CP-192 | 192 | 20 | 30 | 1.0 | $2.0 \times 10^{11}$ | 6 | 4 | 3 |
| Example 193 | CP-193 | 193 | 20 | 30 | 1.1 | $1.9 \times 10^{11}$ | 6 | 4 | 3 |
| Example 194 | CP-194 | 194 | 20 | 30 | 1.2 | $1.9 \times 10^{11}$ | 5 | 4 | 3 |
| Example 195 | CP-195 | 195 | 25 | 30 | 0.8 | $1.8 \times 10^{11}$ | 3 | 4 | 3 |
| Example 196 | CP-196 | 196 | 25 | 30 | 0.9 | $1.8 \times 10^{11}$ | 4 | 4 | 3 |
| Example 197 | CP-197 | 197 | 25 | 30 | 1.0 | $1.8 \times 10^{11}$ | 4 | 4 | 3 |
| Example 198 | CP-198 | 198 | 25 | 30 | 1.1 | $1.7 \times 10^{11}$ | 4 | 4 | 3 |
| Example 199 | CP-199 | 199 | 25 | 30 | 1.2 | $1.7 \times 10^{11}$ | 3 | 4 | 3 |
| Example 200 | CP-200 | 200 | 2 | 40 | 1.0 | $6.0 \times 10^{9}$ | 5 | 4 | 3 |
| Example 201 | CP-201 | 201 | 5 | 40 | 0.8 | $5.3 \times 10^{9}$ | 5 | 4 | 3 |
| Example 202 | CP-202 | 202 | 5 | 40 | 0.9 | $5.3 \times 10^{9}$ | 6 | 4 | 3 |
| Example 203 | CP-203 | 203 | 5 | 40 | 1.0 | $5.3 \times 10^{9}$ | 6 | 4 | 3 |
| Example 209 | CP-204 | 204 | 5 | 40 | 1.1 | $5.2 \times 10^{9}$ | 6 | 4 | 3 |

TABLE 30-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 205 | CP-205 | 205 | 5 | 40 | 1.2 | $5.2 \times 10^9$ | 5 | 4 | 3 |
| Example 206 | CP-206 | 206 | 13 | 40 | 0.8 | $3.9 \times 10^9$ | 5 | 4 | 3 |
| Example 207 | CP-207 | 207 | 13 | 40 | 0.9 | $3.8 \times 10^9$ | 6 | 4 | 3 |
| Example 208 | CP-208 | 208 | 13 | 40 | 1.0 | $3.9 \times 10^9$ | 6 | 4 | 3 |
| Example 209 | CP-209 | 209 | 13 | 40 | 1.1 | $3.7 \times 10^9$ | 6 | 4 | 3 |
| Example 210 | CP-210 | 210 | 13 | 40 | 1.2 | $3.7 \times 10^9$ | 5 | 4 | 3 |
| Example 211 | CP-211 | 211 | 20 | 40 | 0.8 | $3.1 \times 10^9$ | 5 | 4 | 3 |
| Example 212 | CP-212 | 212 | 20 | 40 | 0.9 | $3.0 \times 10^9$ | 6 | 4 | 3 |
| Example 213 | CP-213 | 213 | 20 | 40 | 1.0 | $3.0 \times 10^9$ | 6 | 4 | 3 |
| Example 214 | CP-214 | 214 | 20 | 40 | 1.1 | $2.9 \times 10^9$ | 6 | 4 | 3 |
| Example 215 | CP-215 | 215 | 20 | 40 | 1.2 | $2.9 \times 10^9$ | 5 | 4 | 3 |
| Example 216 | CP-216 | 216 | 25 | 40 | 1.0 | $2.5 \times 10^9$ | 4 | 4 | 3 |
| Example 217 | CP-217 | 217 | 2 | 45 | 0.8 | $4.9 \times 10^8$ | 4 | 4 | 2 |
| Example 218 | CP-218 | 218 | 2 | 45 | 0.9 | $4.9 \times 10^8$ | 5 | 4 | 2 |
| Example 219 | CP-219 | 219 | 2 | 45 | 1.0 | $4.9 \times 10^8$ | 5 | 4 | 2 |
| Example 220 | CP-220 | 220 | 2 | 45 | 1.1 | $4.9 \times 10^8$ | 5 | 4 | 2 |

TABLE 31

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 221 | CP-221 | 221 | 2 | 45 | 1.2 | $4.9 \times 10^8$ | 4 | 4 | 2 |
| Example 222 | CP-222 | 222 | 5 | 45 | 1.0 | $4.2 \times 10^8$ | 6 | 4 | 2 |
| Example 223 | CP-223 | 223 | 13 | 45 | 0.8 | $2.9 \times 10^8$ | 5 | 4 | 2 |
| Example 224 | CP-224 | 224 | 13 | 45 | 0.9 | $2.8 \times 10^8$ | 6 | 4 | 2 |
| Example 225 | CP-225 | 225 | 13 | 45 | 1.0 | $2.8 \times 10^8$ | 6 | 4 | 2 |
| Example 226 | CP-226 | 226 | 13 | 45 | 1.1 | $2.7 \times 10^8$ | 6 | 4 | 2 |
| Example 227 | CP-227 | 227 | 13 | 45 | 1.2 | $2.7 \times 10^8$ | 5 | 4 | 2 |
| Example 228 | CP-228 | 228 | 20 | 45 | 1.0 | $2.0 \times 10^8$ | 6 | 4 | 2 |
| Example 229 | CP-229 | 229 | 25 | 45 | 0.8 | $1.8 \times 10^8$ | 3 | 4 | 2 |
| Example 230 | CP-230 | 230 | 25 | 45 | 0.9 | $1.7 \times 10^8$ | 4 | 4 | 2 |
| Example 231 | CP-231 | 231 | 25 | 45 | 1.0 | $1.7 \times 10^8$ | 4 | 4 | 2 |
| Example 232 | CP-232 | 232 | 25 | 45 | 1.1 | $1.6 \times 10^8$ | 4 | 4 | 2 |
| Example 233 | CP-233 | 233 | 25 | 45 | 1.2 | $1.6 \times 10^8$ | 3 | 4 | 2 |

TABLE 32

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 234 | CP-234 | 234 | 5 | 20 | 0.8 | $4.3 \times 10^{12}$ | 5 | 4 | 3 |
| Example 235 | CP-235 | 235 | 5 | 20 | 0.9 | $4.3 \times 10^{12}$ | 6 | 4 | 3 |
| Example 236 | CP-236 | 236 | 5 | 20 | 1.0 | $4.3 \times 10^{12}$ | 6 | 4 | 3 |
| Example 237 | CP-237 | 237 | 5 | 20 | 1.1 | $4.3 \times 10^{12}$ | 6 | 4 | 3 |
| Example 238 | CP-238 | 238 | 5 | 20 | 1.2 | $4.3 \times 10^{12}$ | 5 | 4 | 3 |
| Example 239 | CP-239 | 239 | 13 | 20 | 0.8 | $3.8 \times 10^{12}$ | 5 | 4 | 3 |
| Example 240 | CP-240 | 240 | 13 | 20 | 0.9 | $3.7 \times 10^{12}$ | 6 | 4 | 3 |
| Example 241 | CP-241 | 241 | 13 | 20 | 1.0 | $3.7 \times 10^{12}$ | 6 | 4 | 3 |
| Example 242 | CP-242 | 242 | 13 | 20 | 1.1 | $3.7 \times 10^{12}$ | 6 | 4 | 3 |
| Example 243 | CP-243 | 243 | 13 | 20 | 1.2 | $3.7 \times 10^{12}$ | 5 | 4 | 3 |
| Example 244 | CP-244 | 244 | 20 | 20 | 0.8 | $3.4 \times 10^{12}$ | 5 | 4 | 3 |
| Example 245 | CP-245 | 245 | 20 | 20 | 0.9 | $3.4 \times 10^{12}$ | 6 | 4 | 3 |
| Example 246 | CP-246 | 246 | 20 | 20 | 1.0 | $3.4 \times 10^{12}$ | 6 | 4 | 3 |
| Example 247 | CP-247 | 247 | 20 | 20 | 1.1 | $3.3 \times 10^{12}$ | 6 | 4 | 3 |
| Example 248 | CP-248 | 243 | 20 | 20 | 1.2 | $3.3 \times 10^{12}$ | 5 | 4 | 3 |

TABLE 32-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 249 | CP-249 | 249 | 5 | 30 | 0.8 | $1.4 \times 10^{11}$ | 5 | 4 | 3 |
| Example 250 | CP-250 | 250 | 5 | 30 | 0.9 | $1.4 \times 10^{11}$ | 6 | 4 | 3 |
| Example 251 | CP-251 | 251 | 5 | 30 | 1.0 | $1.4 \times 10^{11}$ | 6 | 4 | 3 |
| Example 252 | CP-252 | 252 | 5 | 30 | 1.1 | $1.4 \times 10^{11}$ | 6 | 4 | 3 |
| Example 253 | CP-253 | 253 | 5 | 30 | 1.2 | $1.4 \times 10^{11}$ | 5 | 4 | 3 |
| Example 254 | CP-254 | 254 | 13 | 30 | 0.8 | $1.1 \times 10^{11}$ | 5 | 4 | 3 |
| Example 255 | CP-255 | 255 | 13 | 30 | 0.9 | $1.1 \times 10^{11}$ | 6 | 4 | 3 |
| Example 256 | CP-256 | 256 | 13 | 30 | 1.0 | $1.1 \times 10^{11}$ | 6 | 4 | 3 |
| Example 257 | CP-257 | 257 | 13 | 30 | 1.1 | $1.1 \times 10^{11}$ | 6 | 4 | 3 |
| Example 258 | CP-258 | 258 | 13 | 30 | 1.2 | $1.1 \times 10^{11}$ | 5 | 4 | 3 |
| Example 259 | CP-259 | 259 | 20 | 30 | 0.8 | $9.5 \times 10^{10}$ | 5 | 4 | 3 |
| Example 260 | CP-260 | 260 | 20 | 30 | 0.9 | $9.2 \times 10^{10}$ | 6 | 4 | 3 |
| Example 261 | CP-261 | 261 | 20 | 30 | 1.0 | $9.2 \times 10^{10}$ | 6 | 4 | 3 |
| Example 262 | CP-262 | 262 | 20 | 30 | 1.1 | $9.0 \times 10^{10}$ | 6 | 4 | 3 |
| Example 263 | CP-263 | 263 | 20 | 30 | 1.2 | $9.0 \times 10^{10}$ | 5 | 4 | 3 |
| Example 269 | CP-264 | 264 | 5 | 40 | 0.8 | $1.2 \times 10^{9}$ | 5 | 4 | 3 |
| Example 265 | CP-265 | 265 | 5 | 40 | 0.9 | $1.2 \times 10^{9}$ | 6 | 4 | 3 |
| Example 266 | CP-266 | 266 | 5 | 40 | 1.0 | $1.2 \times 10^{9}$ | 6 | 4 | 3 |
| Example 267 | CP-267 | 267 | 5 | 40 | 1.1 | $1.1 \times 10^{9}$ | 6 | 4 | 3 |
| Example 268 | CP-268 | 268 | 5 | 40 | 1.2 | $1.1 \times 10^{9}$ | 5 | 4 | 3 |
| Example 269 | CP-269 | 269 | 13 | 40 | 0.8 | $7.9 \times 10^{8}$ | 5 | 4 | 3 |
| Example 270 | CP-270 | 270 | 13 | 40 | 0.9 | $7.6 \times 10^{8}$ | 6 | 4 | 3 |

TABLE 33

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 271 | CP-271 | 271 | 13 | 40 | 1.0 | $7.6 \times 10^{8}$ | 6 | 4 | 3 |
| Example 272 | CP-272 | 272 | 13 | 40 | 1.1 | $7.3 \times 10^{8}$ | 6 | 4 | 3 |
| Example 273 | CP-273 | 273 | 13 | 40 | 1.2 | $7.3 \times 10^{8}$ | 5 | 4 | 3 |
| Example 274 | CP-274 | 274 | 20 | 40 | 0.8 | $5.9 \times 10^{8}$ | 5 | 4 | 3 |
| Example 275 | CP-275 | 275 | 20 | 40 | 0.9 | $5.6 \times 10^{8}$ | 6 | 4 | 3 |
| Example 276 | CP-276 | 276 | 20 | 40 | 1.0 | $5.6 \times 10^{8}$ | 6 | 4 | 3 |
| Example 277 | CP-277 | 277 | 20 | 40 | 1.1 | $5.3 \times 10^{8}$ | 6 | 4 | 3 |
| Example 278 | CP-278 | 278 | 20 | 40 | 1.2 | $5.3 \times 10^{8}$ | 5 | 4 | 3 |
| Example 279 | CP-279 | 279 | 13 | 30 | 1.0 | $2.1 \times 10^{11}$ | 6 | 4 | 3 |
| Example 280 | CP-280 | 280 | 13 | 30 | 1.0 | $5.1 \times 10^{11}$ | 6 | 4 | 3 |

TABLE 34

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Comparative Example 42 | CP-C42 | C42 | — | — | — | $2.1 \times 10^{13}$ | 1 | 3 | 3 |
| Comparative Example 43 | CP-C43 | C43 | — | — | — | $3.3 \times 10^{11}$ | 1 | 4 | 3 |
| Comparative Example 44 | CP-C44 | C44 | — | — | — | $5.5 \times 10^{8}$ | 1 | 4 | 2 |
| Comparative Example 45 | CP-C45 | C45 | 1 | 15 | 1.0 | $2.1 \times 10^{13}$ | 2 | 3 | 3 |
| Comparative Example 46 | CP-C46 | C46 | 1 | 30 | 1.0 | $3.2 \times 10^{11}$ | 2 | 4 | 3 |
| Comparative Example 47 | CP-C47 | C47 | 1 | 45 | 1.0 | $5.2 \times 10^{8}$ | 2 | 4 | 2 |
| Comparative Example 48 | CP-C48 | C48 | 30 | 15 | 1.0 | $1.6 \times 10^{13}$ | 2 | 3 | 3 |
| Comparative Example 49 | CP-C49 | C49 | 30 | 30 | 1.0 | $1.6 \times 10^{11}$ | 2 | 4 | 3 |
| Comparative Example 50 | CP-C50 | C50 | 30 | 45 | 1.0 | $1.4 \times 10^{8}$ | 2 | 4 | 2 |
| Comparative Example 51 | CP-C51 | C51 | — | — | — | $5.8 \times 10^{12}$ | 1 | 3 | 3 |
| Comparative Example 52 | CP-C52 | C52 | — | — | — | $1.5 \times 10^{10}$ | 1 | 4 | 3 |
| Comparative Example 53 | CP-C53 | C53 | — | — | — | $1.5 \times 10^{6}$ | 1 | 4 | 2 |

TABLE 34-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 54 | CP-C54 | C54 | 2 | 10 | 1.0 | $6.0 \times 10^{13}$ | 5 | 1 | 3 |
| Comparative Example 55 | CP-C55 | C55 | 5 | 10 | 1.0 | $5.9 \times 10^{13}$ | 6 | 1 | 3 |
| Comparative Example 56 | CP-C56 | C56 | 13 | 10 | 1.0 | $5.6 \times 10^{13}$ | 6 | 1 | 3 |
| Comparative Example 57 | CP-C57 | C57 | 20 | 10 | 1.0 | $5.4 \times 10^{13}$ | 6 | 1 | 3 |
| Comparative Example 58 | CP-C58 | C58 | 25 | 10 | 1.0 | $5.2 \times 10^{13}$ | 4 | 1 | 3 |
| Comparative Example 59 | CP-C59 | C59 | 2 | 50 | 1.0 | $2.4 \times 10^{7}$ | 5 | 4 | 1 |
| Comparative Example 60 | CP-C60 | C60 | 5 | 50 | 1.0 | $2.0 \times 10^{7}$ | 6 | 4 | 1 |
| Comparative Example 61 | CP-C61 | C61 | 13 | 50 | 1.0 | $1.2 \times 10^{7}$ | 6 | 4 | 1 |
| Comparative Example 62 | CP-C62 | C62 | 20 | 50 | 1.0 | $8.3 \times 10^{6}$ | 6 | 4 | 1 |
| Comparative Example 63 | CP-C63 | C63 | 25 | 50 | 1.0 | $6.5 \times 10^{6}$ | 4 | 4 | 1 |

TABLE 35

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 64 | CP-C64 | C64 | — | — | — | $2.6 \times 10^{11}$ | 1 | 4 | 3 |
| Comparative Example 65 | CP-C65 | C65 | — | — | — | $2.6 \times 10^{11}$ | 1 | 4 | 3 |
| Comparative Example 66 | CP-C66 | C66 | — | — | — | $2.3 \times 10^{11}$ | 1 | 4 | 3 |
| Comparative Example 67 | CP-C67 | C67 | — | — | — | $2.7 \times 10^{11}$ | 1 | 4 | 3 |
| Comparative Example 68 | CP-C68 | C68 | — | — | — | $2.5 \times 10^{11}$ | 1 | 4 | 3 |
| Comparative Example 69 | CP-C69 | C69 | — | — | — | $2.7 \times 10^{11}$ | 1 | 4 | 3 |
| Comparative Example 70 | CP-C70 | C70 | — | — | — | $3.0 \times 10^{11}$ | 1 | 4 | 3 |
| Comparative Example 71 | CP-C71 | C71 | — | — | — | $2.3 \times 10^{11}$ | 1 | 4 | 3 |

35

TABLE 36

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 281 | CP-281 | 281 | 2 | 15 | 0.8 | $2.3 \times 10^{13}$ | 4 | 3 | 3 |
| Example 282 | CP-282 | 282 | 2 | 15 | 0.9 | $2.3 \times 10^{13}$ | 5 | 3 | 3 |
| Example 283 | CP-283 | 283 | 2 | 15 | 1.0 | $2.3 \times 10^{13}$ | 5 | 3 | 3 |
| Example 289 | CP-284 | 284 | 2 | 15 | 1.1 | $2.3 \times 10^{13}$ | 5 | 3 | 3 |
| Example 285 | CP-285 | 285 | 2 | 15 | 1.2 | $2.3 \times 10^{13}$ | 4 | 3 | 3 |
| Example 286 | CP-286 | 286 | 5 | 15 | 1.0 | $2.2 \times 10^{13}$ | 6 | 3 | 3 |
| Example 287 | CP-287 | 287 | 13 | 15 | 0.8 | $2.1 \times 10^{13}$ | 5 | 3 | 3 |
| Example 288 | CP-288 | 283 | 13 | 15 | 0.9 | $2.1 \times 10^{13}$ | 6 | 3 | 3 |
| Example 289 | CP-289 | 289 | 13 | 15 | 1.0 | $2.1 \times 10^{13}$ | 6 | 3 | 3 |
| Example 290 | CP-290 | 290 | 13 | 15 | 1.1 | $2.1 \times 10^{13}$ | 6 | 3 | 3 |
| Example 291 | CP-291 | 291 | 13 | 15 | 1.2 | $2.1 \times 10^{13}$ | 5 | 3 | 3 |
| Example 292 | CP-292 | 292 | 20 | 15 | 1.0 | $2.0 \times 10^{13}$ | 6 | 3 | 3 |
| Example 293 | CP-293 | 293 | 25 | 15 | 0.8 | $1.9 \times 10^{13}$ | 3 | 3 | 3 |
| Example 294 | CP-294 | 294 | 25 | 15 | 0.9 | $1.9 \times 10^{13}$ | 4 | 3 | 3 |
| Example 295 | CP-295 | 295 | 25 | 15 | 1.0 | $2.0 \times 10^{13}$ | 4 | 3 | 3 |
| Example 296 | CP-296 | 296 | 25 | 15 | 1.1 | $2.0 \times 10^{13}$ | 4 | 3 | 3 |
| Example 297 | CP-297 | 297 | 25 | 15 | 1.2 | $2.0 \times 10^{13}$ | 3 | 3 | 3 |
| Example 298 | CP-290 | 298 | 2 | 20 | 1.0 | $7.1 \times 10^{12}$ | 5 | 4 | 3 |
| Example 299 | CP-299 | 299 | 5 | 20 | 0.8 | $6.9 \times 10^{12}$ | 5 | 4 | 3 |
| Example 300 | CP-300 | 300 | 5 | 20 | 0.9 | $6.9 \times 10^{12}$ | 6 | 4 | 3 |
| Example 301 | CP-301 | 301 | 5 | 20 | 1.0 | $6.9 \times 10^{12}$ | 6 | 4 | 3 |
| Example 302 | CP-302 | 302 | 5 | 20 | 1.1 | $6.9 \times 10^{12}$ | 6 | 4 | 3 |
| Example 303 | CP-303 | 303 | 5 | 20 | 1.2 | $6.9 \times 10^{12}$ | 5 | 4 | 3 |
| Example 309 | CP-304 | 304 | 13 | 20 | 0.8 | $6.3 \times 10^{12}$ | 5 | 4 | 3 |
| Example 305 | CP-305 | 305 | 13 | 20 | 0.9 | $6.3 \times 10^{12}$ | 6 | 4 | 3 |
| Example 306 | CP-306 | 306 | 13 | 20 | 1.0 | $6.3 \times 10^{12}$ | 6 | 4 | 3 |

TABLE 36-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 307 | CP-307 | 307 | 13 | 20 | 1.1 | $6.3 \times 10^{12}$ | 6 | 4 | 3 |
| Example 308 | CP-300 | 308 | 13 | 20 | 1.2 | $6.3 \times 10^{12}$ | 5 | 4 | 3 |
| Example 309 | CP-309 | 309 | 20 | 20 | 0.8 | $5.8 \times 10^{12}$ | 5 | 4 | 3 |
| Example 310 | CP-310 | 310 | 20 | 20 | 0.9 | $5.8 \times 10^{12}$ | 6 | 4 | 3 |
| Example 311 | CP-311 | 311 | 20 | 20 | 1.0 | $5.9 \times 10^{12}$ | 6 | 4 | 3 |
| Example 312 | CP-312 | 312 | 20 | 20 | 1.1 | $5.9 \times 10^{12}$ | 6 | 4 | 3 |
| Example 313 | CP-313 | 313 | 20 | 20 | 1.2 | $5.9 \times 10^{12}$ | 5 | 4 | 3 |
| Example 314 | CP-314 | 314 | 25 | 20 | 1.0 | $5.7 \times 10^{12}$ | 4 | 4 | 3 |
| Example 315 | CP-315 | 315 | 2 | 30 | 0.8 | $4.1 \times 10^{11}$ | 4 | 4 | 3 |
| Example 316 | CP-316 | 316 | 2 | 30 | 0.9 | $4.1 \times 10^{11}$ | 5 | 4 | 3 |
| Example 317 | CP-317 | 317 | 2 | 30 | 1.0 | $4.2 \times 10^{11}$ | 5 | 4 | 3 |
| Example 318 | CP-318 | 318 | 2 | 30 | 1.1 | $4.2 \times 10^{11}$ | 5 | 4 | 3 |
| Example 319 | CP-319 | 319 | 2 | 30 | 1.2 | $4.2 \times 10^{11}$ | 4 | 4 | 3 |
| Example 320 | CP-320 | 320 | 5 | 30 | 0.6 | $3.9 \times 10^{11}$ | 5 | 4 | 3 |

TABLE 37

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 321 | CP-321 | 321 | 5 | 30 | 0.9 | $3.9 \times 10^{11}$ | 6 | 4 | 3 |
| Example 322 | CP-322 | 322 | 5 | 30 | 1.0 | $3.9 \times 10^{11}$ | 6 | 4 | 3 |
| Example 323 | CP-323 | 323 | 5 | 30 | 1.1 | $3.9 \times 10^{11}$ | 6 | 4 | 3 |
| Example 329 | CP-324 | 324 | 5 | 30 | 1.2 | $3.9 \times 10^{11}$ | 5 | 4 | 3 |
| Example 325 | CP-325 | 325 | 13 | 30 | 0.8 | $3.3 \times 10^{11}$ | 5 | 4 | 3 |
| Example 326 | CP-326 | 326 | 13 | 30 | 0.9 | $3.3 \times 10^{11}$ | 6 | 4 | 3 |
| Example 327 | CP-327 | 327 | 13 | 30 | 1.0 | $3.4 \times 10^{11}$ | 6 | 4 | 3 |
| Example 328 | CP-328 | 323 | 13 | 30 | 1.1 | $3.4 \times 10^{11}$ | 6 | 4 | 3 |
| Example 329 | CP-329 | 329 | 13 | 30 | 1.2 | $3.4 \times 10^{11}$ | 5 | 4 | 3 |
| Example 330 | CP-330 | 330 | 20 | 30 | 0.8 | $3.0 \times 10^{11}$ | 5 | 4 | 3 |
| Example 331 | CP-331 | 331 | 20 | 30 | 0.9 | $3.0 \times 10^{11}$ | 6 | 4 | 3 |
| Example 332 | CP-332 | 332 | 20 | 30 | 1.0 | $3.0 \times 10^{11}$ | 6 | 4 | 3 |
| Example 333 | CP-333 | 333 | 20 | 30 | 1.1 | $3.0 \times 10^{11}$ | 6 | 4 | 3 |
| Example 334 | CP-334 | 334 | 20 | 30 | 1.2 | $3.0 \times 10^{11}$ | 5 | 4 | 3 |
| Example 335 | CP-335 | 335 | 25 | 30 | 0.8 | $2.7 \times 10^{11}$ | 3 | 4 | 3 |
| Example 336 | CP-336 | 336 | 25 | 30 | 0.9 | $2.7 \times 10^{11}$ | 4 | 4 | 3 |
| Example 337 | CP-337 | 337 | 25 | 30 | 1.0 | $2.8 \times 10^{11}$ | 4 | 4 | 3 |
| Example 338 | CP-330 | 338 | 25 | 30 | 1.1 | $2.8 \times 10^{11}$ | 4 | 4 | 3 |
| Example 339 | CP-339 | 339 | 25 | 30 | 1.2 | $2.8 \times 10^{11}$ | 3 | 4 | 3 |
| Example 340 | CP-340 | 340 | 2 | 40 | 1.0 | $9.5 \times 10^{9}$ | 5 | 4 | 3 |
| Example 341 | CP-341 | 341 | 5 | 40 | 0.8 | $8.4 \times 10^{9}$ | 5 | 4 | 3 |
| Example 342 | CP-342 | 342 | 5 | 40 | 0.9 | $8.4 \times 10^{9}$ | 6 | 4 | 3 |
| Example 343 | CP-343 | 343 | 5 | 40 | 1.0 | $8.6 \times 10^{9}$ | 6 | 4 | 3 |
| Example 349 | CP-344 | 344 | 5 | 40 | 1.1 | $8.6 \times 10^{9}$ | 6 | 4 | 3 |
| Example 345 | CP-345 | 345 | 5 | 40 | 1.2 | $8.6 \times 10^{9}$ | 5 | 4 | 3 |
| Example 346 | CP-346 | 346 | 13 | 40 | 0.8 | $6.7 \times 10^{9}$ | 5 | 4 | 3 |
| Example 347 | CP-347 | 347 | 13 | 40 | 0.9 | $6.7 \times 10^{9}$ | 6 | 4 | 3 |
| Example 348 | CP-340 | 348 | 13 | 40 | 1.0 | $6.0 \times 10^{9}$ | 6 | 4 | 3 |
| Example 349 | CP-349 | 349 | 13 | 40 | 1.1 | $6.0 \times 10^{9}$ | 6 | 4 | 3 |
| Example 350 | CP-350 | 350 | 13 | 40 | 1.2 | $6.8 \times 10^{9}$ | 5 | 4 | 3 |
| Example 351 | CP-351 | 351 | 20 | 40 | 0.8 | $5.6 \times 10^{9}$ | 5 | 4 | 3 |
| Example 352 | CP-352 | 352 | 20 | 40 | 0.9 | $5.6 \times 10^{9}$ | 6 | 4 | 3 |
| Example 353 | CP-353 | 353 | 20 | 40 | 1.0 | $5.7 \times 10^{9}$ | 6 | 4 | 3 |
| Example 354 | CP-354 | 354 | 20 | 40 | 1.1 | $5.7 \times 10^{9}$ | 6 | 4 | 3 |
| Example 355 | CP-355 | 355 | 20 | 40 | 1.2 | $5.7 \times 10^{9}$ | 5 | 4 | 3 |
| Example 356 | CP-356 | 356 | 25 | 40 | 1.0 | $5.1 \times 10^{9}$ | 4 | 4 | 3 |
| Example 357 | CP-357 | 357 | 2 | 45 | 0.8 | $8.4 \times 10^{8}$ | 4 | 4 | 2 |
| Example 358 | CP-358 | 358 | 2 | 45 | 0.9 | $8.4 \times 10^{8}$ | 5 | 4 | 2 |
| Example 359 | CP-359 | 359 | 2 | 45 | 1.0 | $8.5 \times 10^{8}$ | 5 | 4 | 2 |
| Example 360 | CP-360 | 360 | 2 | 45 | 1.1 | $8.5 \times 10^{8}$ | 5 | 4 | 2 |

TABLE 38

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 361 | CP-361 | 361 | 2 | 45 | 1.2 | $8.5 \times 10^8$ | 4 | 4 | 2 |
| Example 362 | CP-362 | 362 | 5 | 45 | 1.0 | $7.6 \times 10^8$ | 6 | 4 | 2 |
| Example 363 | CP-363 | 363 | 13 | 45 | 0.8 | $5.6 \times 10^8$ | 5 | 4 | 2 |
| Example 364 | CP-364 | 364 | 13 | 45 | 0.9 | $5.6 \times 10^8$ | 6 | 4 | 2 |
| Example 365 | CP-365 | 365 | 13 | 45 | 1.0 | $5.7 \times 10^8$ | 6 | 4 | 2 |
| Example 366 | CP-366 | 366 | 13 | 45 | 1.1 | $5.7 \times 10^8$ | 6 | 4 | 2 |
| Example 367 | CP-367 | 367 | 13 | 45 | 1.2 | $5.7 \times 10^8$ | 5 | 4 | 2 |
| Example 368 | CP-368 | 368 | 20 | 45 | 1.0 | $4.7 \times 10^8$ | 6 | 4 | 2 |
| Example 369 | CP-369 | 369 | 25 | 45 | 0.8 | $3.8 \times 10^8$ | 3 | 4 | 2 |
| Example 370 | CP-370 | 370 | 25 | 45 | 0.9 | $3.8 \times 10^8$ | 4 | 4 | 2 |
| Example 371 | CP-371 | 371 | 25 | 45 | 1.0 | $4.1 \times 10^8$ | 4 | 4 | 2 |
| Example 372 | CP-372 | 372 | 25 | 45 | 1.1 | $4.1 \times 10^8$ | 4 | 4 | 2 |
| Example 373 | CP-373 | 373 | 25 | 45 | 1.2 | $4.1 \times 10^8$ | 3 | 4 | 2 |

20

TABLE 39

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 374 | CP-374 | 374 | 5 | 20 | 0.8 | $5.2 \times 10^{12}$ | 5 | 4 | 3 |
| Example 375 | CP-375 | 375 | 5 | 20 | 0.9 | $5.2 \times 10^{12}$ | 6 | 4 | 3 |
| Example 376 | CP-376 | 376 | 5 | 20 | 1.0 | $5.2 \times 10^{12}$ | 6 | 4 | 3 |
| Example 377 | CP-377 | 377 | 5 | 20 | 1.1 | $5.2 \times 10^{12}$ | 6 | 4 | 3 |
| Example 378 | CP-378 | 378 | 5 | 20 | 1.2 | $5.2 \times 10^{12}$ | 5 | 4 | 3 |
| Example 379 | CP-379 | 379 | 13 | 20 | 0.9 | $4.7 \times 10^{12}$ | 5 | 4 | 3 |
| Example 380 | CP-380 | 380 | 13 | 20 | 0.9 | $4.7 \times 10^{12}$ | 6 | 4 | 3 |
| Example 381 | CP-381 | 381 | 13 | 20 | 1.0 | $4.8 \times 10^{12}$ | 6 | 4 | 3 |
| Example 382 | CP-382 | 382 | 13 | 20 | 1.1 | $4.8 \times 10^{12}$ | 6 | 4 | 3 |
| Example 383 | CP-383 | 383 | 13 | 20 | 1.2 | $4.2 \times 10^{12}$ | 5 | 4 | 3 |
| Example 384 | CP-384 | 384 | 20 | 20 | 0.6 | $4.4 \times 10^{12}$ | 5 | 4 | 3 |
| Example 385 | CP-385 | 385 | 20 | 20 | 0.9 | $4.4 \times 10^{12}$ | 6 | 4 | 3 |
| Example 386 | CP-386 | 386 | 20 | 20 | 1.0 | $4.4 \times 10^{12}$ | 6 | 4 | 3 |
| Example 387 | CP-387 | 387 | 20 | 20 | 1.1 | $4.4 \times 10^{12}$ | 6 | 4 | 3 |
| Example 388 | CP-388 | 388 | 20 | 20 | 1.2 | $4.4 \times 10^{12}$ | 5 | 4 | 3 |
| Example 389 | CP-389 | 399 | 5 | 30 | 0.8 | $2.0 \times 10^{11}$ | 5 | 4 | 3 |
| Example 390 | CP-390 | 390 | 5 | 30 | 0.9 | $2.0 \times 10^{11}$ | 6 | 4 | 3 |
| Example 391 | CP-391 | 391 | 5 | 30 | 1.0 | $2.1 \times 10^{11}$ | 6 | 4 | 3 |
| Example 392 | CP-392 | 392 | 5 | 30 | 1.1 | $2.1 \times 10^{11}$ | 6 | 4 | 3 |
| Example 393 | CP-393 | 393 | 5 | 30 | 1.2 | $2.1 \times 10^{11}$ | 5 | 4 | 3 |
| Example 394 | CP-394 | 394 | 13 | 30 | 0.8 | $1.7 \times 10^{11}$ | 5 | 4 | 3 |
| Example 395 | CP-395 | 395 | 13 | 30 | 0.9 | $1.7 \times 10^{11}$ | 6 | 4 | 3 |
| Example 396 | CP-396 | 396 | 13 | 30 | 1.0 | $1.7 \times 10^{11}$ | 6 | 4 | 3 |
| Example 397 | CP-397 | 397 | 13 | 30 | 1.1 | $1.7 \times 10^{11}$ | 6 | 4 | 3 |
| Example 398 | CP-398 | 393 | 13 | 30 | 1.2 | $1.7 \times 10^{11}$ | 5 | 4 | 3 |
| Example 399 | CP-399 | 399 | 20 | 30 | 0.8 | $1.5 \times 10^{11}$ | 5 | 4 | 3 |
| Example 400 | CP-400 | 400 | 20 | 30 | 0.9 | $1.5 \times 10^{11}$ | 6 | 4 | 3 |
| Example 401 | CP-401 | 401 | 20 | 30 | 1.0 | $1.5 \times 10^{11}$ | 6 | 4 | 3 |
| Example 402 | CP-402 | 402 | 20 | 30 | 1.1 | $1.5 \times 10^{11}$ | 6 | 4 | 3 |
| Example 403 | CP-403 | 403 | 20 | 30 | 1.2 | $1.5 \times 10^{11}$ | 5 | 4 | 3 |
| Example 404 | CP-404 | 404 | 5 | 40 | 0.8 | $2.1 \times 10^9$ | 5 | 4 | 3 |

TABLE 40

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Example 405 | CP-405 | 405 | 5 | 40 | 0.9 | $2.1 \times 10^9$ | 6 | 4 | 3 |
| Example 406 | CP-406 | 406 | 5 | 40 | 1.0 | $2.1 \times 10^9$ | 6 | 4 | 3 |
| Example 407 | CP-407 | 407 | 5 | 40 | 1.1 | $2.1 \times 10^9$ | 6 | 4 | 3 |
| Example 408 | CP-408 | 408 | 5 | 40 | 1.2 | $2.1 \times 10^9$ | 5 | 4 | 3 |
| Example 409 | CP-409 | 409 | 13 | 40 | 0.8 | $1.6 \times 10^9$ | 5 | 4 | 3 |
| Example 410 | CP-410 | 410 | 13 | 40 | 0.9 | $1.6 \times 10^9$ | 6 | 4 | 3 |
| Example 411 | CP-411 | 411 | 13 | 40 | 1.0 | $1.6 \times 10^9$ | 6 | 4 | 3 |
| Example 412 | CP-412 | 412 | 13 | 40 | 1.1 | $1.6 \times 10^9$ | 6 | 4 | 3 |
| Example 413 | CP-413 | 413 | 13 | 40 | 1.2 | $1.6 \times 10^9$ | 5 | 4 | 3 |
| Example 414 | CP-414 | 414 | 20 | 40 | 0.8 | $1.2 \times 10^9$ | 5 | 4 | 3 |
| Example 415 | CP-415 | 415 | 20 | 40 | 0.9 | $1.2 \times 10^9$ | 6 | 4 | 3 |
| Example 416 | CP-416 | 416 | 20 | 40 | 1.0 | $1.3 \times 10^9$ | 6 | 4 | 3 |
| Example 417 | CP-417 | 417 | 20 | 40 | 1.1 | $1.3 \times 10^9$ | 6 | 4 | 3 |
| Example 418 | CP-418 | 418 | 20 | 40 | 1.2 | $1.3 \times 10^9$ | 5 | 4 | 3 |
| Example 419 | CP-419 | 419 | 13 | 30 | 1.0 | $2.7 \times 10^{11}$ | 6 | 4 | 3 |
| Example 420 | CP-420 | 420 | 13 | 30 | 1.0 | $5.8 \times 10^{11}$ | 6 | 4 | 3 |

TABLE 41

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Comparative Example 76 | CP-C76 | C76 | — | — | — | $2.3 \times 10^{13}$ | 1 | 3 | 3 |
| Comparative Example 77 | CP-C77 | C77 | — | — | — | $4.4 \times 10^{11}$ | 1 | 4 | 3 |
| Comparative Example 78 | CP-C78 | C73 | — | — | — | $9.2 \times 10^8$ | 1 | 4 | 2 |
| Comparative Example 79 | CP-C79 | C79 | 1 | 15 | 1.0 | $2.3 \times 10^{13}$ | 2 | 3 | 3 |
| Comparative Example 80 | CP-C80 | C80 | 1 | 30 | 1.0 | $4.3 \times 10^{11}$ | 2 | 4 | 3 |
| Comparative Example 81 | CP-C81 | C81 | 1 | 45 | 1.2 | $2.8 \times 10^8$ | 2 | 4 | 2 |
| Comparative Example 82 | CP-C82 | C82 | 30 | 15 | 1.0 | $1.9 \times 10^{13}$ | 2 | 3 | 3 |
| Comparative Example 83 | CP-C83 | C83 | 30 | 30 | 1.0 | $2.6 \times 10^{11}$ | 2 | 4 | 3 |
| Comparative Example 84 | CP-C84 | C84 | 30 | 45 | 1.0 | $3.5 \times 10^8$ | 2 | 4 | 2 |
| Comparative Example 85 | CP-C85 | C85 | — | — | — | $9.6 \times 10^{12}$ | 1 | 3 | 3 |
| Comparative Example 86 | CP-C86 | C86 | — | — | — | $5.0 \times 10^{10}$ | 1 | 4 | 3 |
| Comparative Example 87 | CP-C87 | C87 | — | — | — | $1.5 \times 10^7$ | 1 | 4 | 2 |
| Comparative Example 88 | CP-C88 | C83 | 2 | 10 | 1.0 | $6.5 \times 10^{13}$ | 5 | 1 | 3 |
| Comparative Example 89 | CP-C89 | C89 | 5 | 10 | 1.0 | $6.4 \times 10^{13}$ | 6 | 1 | 3 |
| Comparative Example 90 | CP-C90 | C90 | 13 | 10 | 1.0 | $6.1 \times 10^{13}$ | 6 | 1 | 3 |
| Comparative Example 91 | CP-C91 | C91 | 20 | 10 | 1.0 | $6.0 \times 10^{13}$ | 6 | 1 | 3 |
| Comparative Example 92 | CP-C92 | C92 | 25 | 10 | 1.0 | $5.8 \times 10^{13}$ | 4 | 1 | 3 |
| Comparative Example 93 | CP-C93 | C93 | 2 | 50 | 1.0 | $4.8 \times 10^7$ | 5 | 4 | 1 |
| Comparative Example 94 | CP-C94 | C94 | 5 | 50 | 1.0 | $4.1 \times 10^7$ | 6 | 4 | 1 |
| Comparative Example 95 | CP-C95 | C95 | 13 | 50 | 1.0 | $2.9 \times 10^7$ | 6 | 4 | 1 |
| Comparative Example 96 | CP-C96 | C96 | 20 | 50 | 1.0 | $2.2 \times 10^7$ | 6 | 4 | 1 |
| Comparative Example 97 | CP-C97 | C97 | 25 | 50 | 1.0 | $1.9 \times 10^7$ | 4 | 4 | 1 |

TABLE 42

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation: Pattern memory | Residual potential | Crack |
|---|---|---|---|---|---|---|---|---|---|
| Comparative Example 98 | CP-C98 | C98 | — | — | — | $3.0 \times 10^{11}$ | 1 | 4 | 3 |
| Comparative Example 99 | CP-C99 | C99 | — | — | — | $3.0 \times 10^{11}$ | 1 | 4 | 3 |
| Comparative Example 100 | CP-C100 | C100 | — | — | — | $2.7 \times 10^{11}$ | 1 | 4 | 3 |
| Comparative Example 101 | CP-C101 | C101 | — | — | — | $3.4 \times 10^{11}$ | 1 | 4 | 3 |
| Comparative Example 102 | CP-C102 | C102 | — | — | — | $3.1 \times 10^{11}$ | 1 | 4 | 3 |
| Comparative Example 103 | CP-C103 | C103 | — | — | — | $3.4 \times 10^{11}$ | 1 | 4 | 3 |

TABLE 42-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 109 | CP-C104 | C104 | — | — | — | $2.7 \times 10^{11}$ | 1 | 4 | 3 |
| Comparative Example 105 | CP-C105 | C105 | — | — | — | $3.4 \times 10^{11}$ | 1 | 4 | 3 |

TABLE 43

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Comparative Example 36 | CP-C36 | C36 | — | — | — | $8.0 \times 10^{6}$ | 1 | 4 | 3 |
| Comparative Example 37 | CP-C37 | C37 | — | — | — | $1.0 \times 10^{7}$ | 1 | 4 | 3 |
| Comparative Example 38 | CP-C38 | C38 | — | — | — | $4.4 \times 10^{10}$ | 1 | 4 | 3 |
| Comparative Example 39 | CP-C39 | C39 | — | — | — | $2.0 \times 10^{13}$ | 1 | 4 | 3 |
| Comparative Example 40 | CP-C40 | C40 | — | — | — | $2.1 \times 10^{9}$ | 1 | 4 | 3 |
| Comparative Example 41 | CP-C41 | C41 | — | — | — | $3.1 \times 10^{9}$ | 1 | 4 | 3 |
| Comparative Example 72 | CP-C72 | C72 | — | — | — | $3.5 \times 10^{10}$ | 1 | 4 | 3 |
| Comparative Example 73 | CP-C73 | C73 | — | — | — | $2.0 \times 10^{13}$ | 1 | 4 | 3 |
| Comparative Example 74 | CP-C74 | C74 | — | — | — | $4.0 \times 10^{9}$ | 1 | 4 | 3 |
| Comparative Example 75 | CP-C75 | C75 | — | — | — | $5.8 \times 10^{9}$ | 1 | 4 | 3 |
| Comparative Example 106 | CP-C106 | C106 | — | — | — | $3.5 \times 10^{10}$ | 1 | 4 | 3 |

TABLE 59

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 421 | CP-421 | 421 | 2 | 15 | 0.9 | $2.2 \times 10^{13}$ | 4 | 3 | 3 |
| Example 422 | CP-422 | 422 | 2 | 15 | 0.9 | $2.2 \times 10^{13}$ | 5 | 3 | 3 |
| Example 423 | CP-423 | 423 | 2 | 15 | 1.0 | $2.2 \times 10^{13}$ | 5 | 3 | 3 |
| Example 429 | CP-424 | 424 | 2 | 15 | 1.1 | $2.2 \times 10^{13}$ | 5 | 3 | 3 |
| Example 425 | CP-425 | 425 | 2 | 15 | 1.2 | $2.2 \times 10^{13}$ | 4 | 3 | 3 |
| Example 426 | CP-426 | 426 | 5 | 15 | 1.0 | $2.1 \times 10^{13}$ | 6 | 3 | 3 |
| Example 427 | CP-427 | 427 | 13 | 15 | 0.8 | $2.0 \times 10^{13}$ | 5 | 3 | 3 |
| Example 428 | CP-428 | 423 | 13 | 15 | 0.9 | $2.0 \times 10^{13}$ | 6 | 3 | 3 |
| Example 429 | CP-429 | 429 | 13 | 15 | 1.0 | $2.0 \times 10^{13}$ | 6 | 3 | 3 |
| Example 430 | CP-430 | 430 | 13 | 15 | 1.1 | $2.0 \times 10^{13}$ | 6 | 3 | 3 |
| Example 431 | CP-431 | 431 | 13 | 15 | 1.2 | $2.0 \times 10^{13}$ | 5 | 3 | 3 |
| Example 432 | CP-432 | 432 | 20 | 15 | 1.0 | $1.9 \times 10^{13}$ | 6 | 3 | 3 |
| Example 433 | CP-433 | 433 | 25 | 15 | 0.8 | $1.8 \times 10^{13}$ | 3 | 3 | 3 |
| Example 434 | CP-434 | 434 | 25 | 15 | 0.9 | $1.8 \times 10^{13}$ | 4 | 3 | 3 |
| Example 435 | CP-435 | 435 | 25 | 15 | 1.0 | $1.8 \times 10^{13}$ | 4 | 3 | 3 |
| Example 436 | CP-436 | 436 | 25 | 15 | 1.1 | $1.8 \times 10^{13}$ | 4 | 3 | 3 |
| Example 437 | CP-437 | 437 | 25 | 15 | 1.2 | $1.8 \times 10^{13}$ | 3 | 3 | 3 |
| Example 438 | CP-438 | 438 | 2 | 20 | 1.0 | $6.6 \times 10^{12}$ | 5 | 4 | 3 |
| Example 439 | CP-439 | 439 | 5 | 20 | 0.8 | $6.3 \times 10^{12}$ | 5 | 4 | 3 |
| Example 440 | CP-440 | 440 | 5 | 20 | 0.9 | $6.3 \times 10^{12}$ | 6 | 4 | 3 |
| Example 441 | CP-441 | 441 | 5 | 20 | 1.0 | $6.3 \times 10^{12}$ | 6 | 4 | 3 |
| Example 442 | CP-442 | 442 | 5 | 20 | 1.1 | $6.3 \times 10^{12}$ | 6 | 4 | 3 |
| Example 443 | CP-443 | 443 | 5 | 20 | 1.2 | $6.3 \times 10^{12}$ | 5 | 4 | 3 |
| Example 444 | CP-444 | 444 | 13 | 20 | 0.8 | $5.7 \times 10^{12}$ | 5 | 4 | 3 |
| Example 445 | CP-445 | 445 | 13 | 20 | 0.9 | $5.7 \times 10^{12}$ | 6 | 4 | 3 |
| Example 446 | CP-446 | 446 | 13 | 20 | 1.0 | $5.7 \times 10^{12}$ | 6 | 4 | 3 |
| Example 447 | CP-447 | 447 | 13 | 20 | 1.1 | $5.7 \times 10^{12}$ | 6 | 4 | 3 |
| Example 448 | CP-448 | 448 | 13 | 20 | 1.2 | $5.7 \times 10^{12}$ | 5 | 4 | 3 |
| Example 449 | CP-449 | 449 | 20 | 20 | 0.8 | $5.3 \times 10^{12}$ | 5 | 4 | 3 |
| Example 450 | CP-450 | 450 | 20 | 20 | 0.9 | $5.3 \times 10^{12}$ | 6 | 4 | 3 |

TABLE 59-continued

| | Conductive-layer coating solution | Production example of electrophotographic photosensitive member | $\{(V_2/V_T)/(V_1/V_T)\} \times 100$ | $\{(V_1/V_T)/(V_2/V_T)\} \times 100$ | $R_2/R_1$ | Volume resistivity of conductive layer [Ω · cm] | Result of evaluation Pattern memory | Residual potential | Crack |
|---|---|---|---|---|---|---|---|---|---|
| Example 451 | CP-451 | 451 | 20 | 20 | 1.0 | $5.3 \times 10^{12}$ | 6 | 4 | 3 |
| Example 452 | CP-452 | 452 | 20 | 20 | 1.1 | $5.3 \times 10^{12}$ | 6 | 4 | 3 |
| Example 453 | CP-453 | 453 | 20 | 20 | 1.2 | $5.3 \times 10^{12}$ | 5 | 4 | 3 |
| Example 454 | CP-454 | 454 | 25 | 20 | 1.0 | $5.0 \times 10^{12}$ | 4 | 4 | 3 |
| Example 455 | CP-455 | 455 | 2 | 30 | 0.8 | $3.6 \times 10^{11}$ | 4 | 4 | 3 |
| Example 456 | CP-456 | 456 | 2 | 30 | 0.9 | $3.6 \times 10^{11}$ | 5 | 4 | 3 |
| Example 457 | CP-457 | 457 | 2 | 30 | 1.0 | $3.6 \times 10^{11}$ | 5 | 4 | 3 |
| Example 458 | CP-458 | 458 | 2 | 30 | 1.1 | $3.6 \times 10^{11}$ | 5 | 4 | 3 |
| Example 459 | CP-459 | 459 | 2 | 30 | 1.2 | $3.6 \times 10^{11}$ | 4 | 4 | 3 |
| Example 460 | CP-460 | 460 | 5 | 30 | 0.6 | $3.4 \times 10^{11}$ | 5 | 4 | 3 |

TABLE 60

| | Conductive layer-coating solution | Production example of electrophotographic photo-sensitive member | $\{(V_2/V_T)/V_1/V_T)\} \times 100$ | $\{(V_2/V_T) + (V_2/V_T)\} \times 100$ | $R_2/R_1$ | Volume resistivity of conductive layer [Ω·cm] | Result of evaluation Pattern memory | Residual potential | Crack |
|---|---|---|---|---|---|---|---|---|---|
| Example 461 | CP-461 | 461 | 5 | 30 | 0.9 | $3.4 \times 10^{11}$ | 6 | 4 | 3 |
| Example 962 | CP-462 | 462 | 5 | 30 | 1.0 | $3.4 \times 10^{11}$ | 6 | 4 | 3 |
| Example 463 | CP-463 | 463 | 5 | 30 | 1.1 | $3.4 \times 10^{11}$ | 6 | 4 | 3 |
| Example 969 | CP-464 | 464 | 5 | 30 | 1.2 | $3.4 \times 10^{11}$ | 5 | 4 | 3 |
| Example 965 | CP-465 | 465 | 13 | 30 | 0.8 | $2.8 \times 10^{11}$ | 5 | 4 | 3 |
| Example 466 | CP-466 | 466 | 13 | 30 | 0.9 | $2.9 \times 10^{11}$ | 6 | 4 | 3 |
| Example 967 | CP-467 | 467 | 13 | 30 | 1.0 | $2.8 \times 10^{11}$ | 6 | 4 | 3 |
| Example 468 | CP-468 | 463 | 13 | 30 | 1.1 | $2.8 \times 10^{11}$ | 6 | 4 | 3 |
| Example 469 | CP-469 | 469 | 13 | 30 | 1.2 | $2.5 \times 10^{11}$ | 5 | 4 | 3 |
| Example 470 | CP-470 | 470 | 20 | 30 | 0.3 | $2.5 \times 10^{11}$ | 5 | 4 | 3 |
| Example 471 | CP-471 | 471 | 20 | 30 | 0.9 | $2.5 \times 10^{11}$ | 6 | 4 | 3 |
| Example 472 | CP-472 | 472 | 20 | 30 | 1.0 | $2.5 \times 10^{11}$ | 6 | 4 | 3 |
| Example 473 | CP-473 | 473 | 20 | 30 | 1.1 | $2.5 \times 10^{11}$ | 6 | 4 | 3 |
| Example 474 | CP-474 | 474 | 20 | 30 | 1.2 | $2.5 \times 10^{11}$ | 5 | 4 | 3 |
| Example 475 | CP-475 | 475 | 25 | 30 | 0.3 | $2.3 \times 10^{11}$ | 3 | 4 | 3 |
| Example 476 | CP-476 | 476 | 25 | 30 | 0.9 | $2.3 \times 10^{11}$ | 4 | 4 | 3 |
| Example 477 | CP-477 | 477 | 25 | 30 | 1.0 | $2.3 \times 10^{11}$ | 4 | 4 | 3 |
| Example 478 | CP-478 | 478 | 25 | 30 | 1.1 | $2.3 \times 10^{11}$ | 4 | 4 | 3 |
| Example 479 | CP-479 | 479 | 25 | 30 | 1.2 | $2.3 \times 10^{11}$ | 3 | 4 | 3 |
| Example 480 | CP-480 | 480 | 2 | 40 | 1.0 | $7.6 \times 10^{9}$ | 5 | 4 | 3 |
| Example 481 | CP-481 | 481 | 5 | 40 | 0.3 | $6.8 \times 10^{9}$ | 5 | 4 | 3 |
| Example 482 | CP-482 | 482 | 5 | 40 | 0.9 | $6.8 \times 10^{9}$ | 6 | 4 | 3 |
| Example 483 | CP-483 | 483 | 5 | 40 | 1.0 | $6.8 \times 10^{9}$ | 6 | 4 | 3 |
| Example 989 | CP-484 | 484 | 5 | 40 | 1.1 | $6.8 \times 10^{9}$ | 6 | 4 | 3 |
| Example 985 | CP-485 | 485 | 5 | 40 | 1.2 | $6.8 \times 10^{9}$ | 5 | 4 | 3 |
| Example 486 | CP-486 | 486 | 13 | 40 | 0.3 | $5.2 \times 10^{9}$ | 5 | 4 | 3 |
| Example 987 | CP-487 | 487 | 13 | 40 | 0.9 | $5.2 \times 10^{9}$ | 6 | 4 | 3 |
| Example 488 | CP-498 | 488 | 13 | 40 | 1.0 | $5.2 \times 10^{9}$ | 6 | 4 | 3 |
| Example 989 | CP-489 | 989 | 13 | 90 | 1.1 | $5.2 \times 10^{9}$ | 6 | 4 | 3 |
| Example 990 | CP-490 | 490 | 13 | 40 | 1.2 | $5.2 \times 10^{9}$ | 5 | 4 | 3 |
| Example 991 | CP-491 | 491 | 20 | 40 | 0.8 | $4.2 \times 10^{9}$ | 5 | 4 | 3 |
| Example 492 | CP-492 | 492 | 20 | 40 | 0.9 | $4.2 \times 10^{9}$ | 6 | 4 | 3 |
| Example 993 | CP-493 | 493 | 20 | 40 | 1.0 | $4.2 \times 10^{9}$ | 6 | 4 | 3 |
| Example 494 | CP-494 | 499 | 20 | 40 | 1.1 | $4.2 \times 10^{9}$ | 6 | 4 | 3 |
| Example 495 | CP-495 | 495 | 20 | 40 | 1.2 | $4.2 \times 10^{9}$ | 5 | 4 | 3 |
| Example 996 | CP-496 | 496 | 25 | 40 | 1.0 | $3.7 \times 10^{9}$ | 4 | 4 | 3 |
| Example 497 | CP-497 | 497 | 2 | 45 | 0.8 | $6.5 \times 10^{8}$ | 4 | 4 | 2 |
| Example 998 | CP-498 | 498 | 2 | 45 | 0.9 | $6.5 \times 10^{8}$ | 5 | 4 | 2 |
| Example 999 | CP-499 | 499 | 2 | 45 | 1.0 | $6.5 \times 10^{8}$ | 5 | 4 | 2 |
| Example 500 | CP-500 | 500 | 2 | 45 | 1.1 | $6.5 \times 10^{8}$ | 5 | 4 | 2 |

TABLE 61

| | Conductive layer-coating solution | Production example of electrophotographic photo-sensitive member | $\{(V_2/V_T)/(V_1/V_T)\} \times 100$ | $\{(V_2/V_T)+(V_2/V_T)\} \times 100$ | $R_2/R_1$ | Volume resistivity of conductive layer [Ω·cm] | Result of evaluation | | |
|---|---|---|---|---|---|---|---|---|---|
| | | | | | | | Pattern memory | Residual potential | Crack |
| Example 501 | CP-501 | 501 | 2 | 45 | 1.2 | $6.5 \times 10^8$ | 4 | 4 | 2 |
| Example 502 | CP-502 | 502 | 5 | 45 | 1.0 | $5.7 \times 10^8$ | 6 | 4 | 2 |
| Example 503 | CP-503 | 503 | 13 | 45 | 0.8 | $4.1 \times 10^8$ | 5 | 4 | 2 |
| Example 504 | CP-504 | 504 | 13 | 45 | 0.9 | $4.1 \times 10^8$ | 6 | 4 | 2 |
| Example 505 | CP-505 | 505 | 13 | 45 | 1.0 | $4.1 \times 10^8$ | 6 | 4 | 2 |
| Example 506 | CP-506 | 506 | 13 | 45 | 1.1 | $4.1 \times 10^8$ | 6 | 4 | 2 |
| Example 507 | CP-507 | 507 | 13 | 45 | 1.2 | $4.1 \times 10^8$ | 5 | 4 | 2 |
| Example 508 | CP-508 | 508 | 20 | 45 | 1.0 | $3.2 \times 10^8$ | 6 | 4 | 2 |
| Example 509 | CP-509 | 509 | 25 | 45 | 0.8 | $2.7 \times 10^8$ | 3 | 4 | 2 |
| Example 510 | CP-510 | 510 | 25 | 45 | 0.9 | $2.7 \times 10^8$ | 4 | 4 | 2 |
| Example 511 | CP-511 | 511 | 25 | 45 | 1.0 | $2.7 \times 10^8$ | 4 | 4 | 2 |
| Example 512 | CP-512 | 512 | 25 | 45 | 1.1 | $2.7 \times 10^8$ | 4 | 4 | 2 |
| Example 513 | CP-513 | 513 | 25 | 45 | 1.2 | $2.7 \times 10^8$ | 3 | 4 | 2 |
| Example 514 | Cl-514 | 514 | 5 | 20 | 0.8 | $4.8 \times 10^{12}$ | 5 | 4 | 3 |
| Example 515 | CP-515 | 515 | 5 | 20 | 0.9 | $4.8 \times 10^{12}$ | 6 | 4 | 3 |
| Example 516 | CP-516 | 516 | 5 | 20 | 1.0 | $4.2 \times 10^{12}$ | 6 | 4 | 3 |
| Example 517 | CP-517 | 517 | 5 | 20 | 1.1 | $4.8 \times 10^{12}$ | 6 | 4 | 3 |
| Example 518 | CP-518 | 518 | 5 | 20 | 1.2 | $4.8 \times 10^{12}$ | 5 | 4 | 3 |
| Example 519 | CP-519 | 519 | 13 | 20 | 0.8 | $4.3 \times 10^{12}$ | 5 | 4 | 3 |
| Example 520 | CP-520 | 520 | 13 | 20 | 0.9 | $4.3 \times 10^{12}$ | 6 | 4 | 3 |
| Example 521 | CP-521 | 521 | 13 | 20 | 1.0 | $4.3 \times 10^{12}$ | 6 | 4 | 3 |
| Example 522 | CP-522 | 522 | 13 | 20 | 1.1 | $4.3 \times 10^{12}$ | 6 | 4 | 3 |
| Example 523 | CP-523 | 523 | 13 | 20 | 1.2 | $4.3 \times 10^{12}$ | 5 | 4 | 3 |
| Example 524 | CP-524 | 524 | 20 | 20 | 0.8 | $3.9 \times 10^{12}$ | 5 | 4 | 3 |
| Example 525 | CP-525 | 525 | 20 | 20 | 0.9 | $3.9 \times 10^{12}$ | 6 | 4 | 3 |
| Example 526 | CP-526 | 526 | 20 | 20 | 1.0 | $3.9 \times 10^{12}$ | 6 | 4 | 3 |
| Example 527 | CP-527 | 527 | 20 | 20 | 1.1 | $3.9 \times 10^{12}$ | 6 | 4 | 3 |
| Example 528 | CP-528 | 528 | 20 | 20 | 1.2 | $3.9 \times 10^{12}$ | 5 | 4 | 3 |
| Example 529 | CP-529 | 529 | 5 | 30 | 0.8 | $1.7 \times 10^{11}$ | 5 | 4 | 3 |
| Example 530 | CP-530 | 530 | 5 | 30 | 0.9 | $1.7 \times 10^{11}$ | 6 | 4 | 3 |
| Example 531 | CP-531 | 531 | 5 | 30 | 1.0 | $1.7 \times 10^{11}$ | 6 | 4 | 3 |
| Example 532 | CP-532 | 532 | 5 | 30 | 1.1 | $1.7 \times 10^{11}$ | 6 | 4 | 3 |
| Example 533 | CP-533 | 533 | 5 | 30 | 1.2 | $1.7 \times 10^{11}$ | 5 | 4 | 3 |
| Example 539 | CP-534 | 534 | 13 | 30 | 0.8 | $1.4 \times 10^{11}$ | 5 | 4 | 3 |
| Example 535 | CP-535 | 535 | 13 | 30 | 0.9 | $1.4 \times 10^{11}$ | 6 | 4 | 3 |
| Example 536 | CP-536 | 536 | 13 | 30 | 1.0 | $1.4 \times 10^{11}$ | 6 | 4 | 3 |
| Example 537 | CP-537 | 537 | 13 | 30 | 1.1 | $1.4 \times 10^{11}$ | 6 | 4 | 3 |
| Example 538 | CP-538 | 538 | 13 | 30 | 1.2 | $1.4 \times 10^{11}$ | 5 | 4 | 3 |
| Example 539 | CP-539 | 539 | 20 | 30 | 0.8 | $1.2 \times 10^{11}$ | 5 | 4 | 3 |
| Example 540 | CP-540 | 540 | 20 | 30 | 0.9 | $1.2 \times 10^{11}$ | 6 | 4 | 3 |

TABLE 62

| | Conductive layer-coating solution | Production example of electrophotographic photo-sensitive member | $\{(V_2/V_T)/(V_1/V_T)\} \times 100$ | $\{(V_2/V_T)+(V_2/V_T)\} \times 100$ | $R_2/R_1$ | Volume resistivity of conductive layer [Ω·cm] | Result of evaluation | | |
|---|---|---|---|---|---|---|---|---|---|
| | | | | | | | Pattern memory | Residual potential | Crack |
| Example 541 | CP-541 | 541 | 20 | 30 | 1.0 | $1.2 \times 10^{11}$ | 6 | 4 | 3 |
| Example 542 | CP-542 | 542 | 20 | 30 | 1.1 | $1.2 \times 10^{11}$ | 6 | 4 | 3 |
| Example 543 | CP-543 | 543 | 20 | 30 | 1.2 | $1.2 \times 10^{11}$ | 5 | 4 | 3 |
| Example 544 | CP-544 | 544 | 5 | 40 | 0.8 | $1.6 \times 10^9$ | 5 | 4 | 3 |
| Example 545 | CP-545 | 545 | 5 | 40 | 0.9 | $1.6 \times 10^9$ | 6 | 4 | 3 |
| Example 546 | CP-546 | 546 | 5 | 40 | 1.0 | $1.6 \times 10^9$ | 6 | 4 | 3 |
| Example 547 | CP-547 | 547 | 5 | 40 | 1.1 | $1.6 \times 10^9$ | 6 | 4 | 3 |
| Example 548 | CP-548 | 548 | 5 | 40 | 1.2 | $1.6 \times 10^9$ | 5 | 4 | 3 |
| Example 549 | CP-549 | 549 | 13 | 40 | 0.8 | $1.1 \times 10^9$ | 5 | 4 | 3 |
| Example 550 | CP-550 | 550 | 13 | 40 | 0.9 | $1.1 \times 10^9$ | 6 | 4 | 3 |
| Example 551 | CP-551 | 551 | 13 | 40 | 1.0 | $1.1 \times 10^9$ | 6 | 4 | 3 |
| Example 552 | CP-552 | 552 | 13 | 40 | 1.1 | $1.1 \times 10^9$ | 6 | 4 | 3 |
| Example 553 | CP-553 | 553 | 13 | 40 | 1.2 | $1.1 \times 10^9$ | 5 | 4 | 3 |
| Example 554 | CP-554 | 554 | 20 | 40 | 0.8 | $8.7 \times 10^{11}$ | 5 | 4 | 3 |
| Example 555 | CP-555 | 555 | 20 | 40 | 0.9 | $8.7 \times 10^{11}$ | 6 | 4 | 3 |
| Example 556 | CP-556 | 556 | 20 | 40 | 1.0 | $8.7 \times 10^{11}$ | 6 | 4 | 3 |
| Example 557 | CP-557 | 557 | 20 | 40 | 1.1 | $8.7 \times 10^{11}$ | 6 | 4 | 3 |
| Example 558 | CP-550 | 558 | 20 | 40 | 1.2 | $8.7 \times 10^{11}$ | 5 | 4 | 3 |

TABLE 62-continued

| | Conductive layer-coating solution | Production example of electrophotographic photo-sensitive member | $\{(V_2/V_T)/V_1/V_T)\} \times 100$ | $\{(V_2/V_T) + (V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 559 | CP-559 | 559 | 13 | 30 | 1.0 | $1.4 \times 10^{11}$ | 6 | 4 | 3 |
| Example 560 | CP-560 | 560 | 11 | 30 | 1.0 | $4.8 \times 10^{11}$ | 6 | 4 | 3 |

TABLE 63

| | Conductive layer-coating solution | Production example of electrophotographic photo-sensitive member | $\{(V_2/V_T)/V_1/V_T)\} \times 100$ | $\{(V_2/V_T) + (V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Comparative Example 107 | CP-C107 | C107 | — | — | — | $2.2 \times 10^{13}$ | 1 | 3 | 3 |
| Comparative Example 108 | CP-C108 | C108 | — | — | — | $3.8 \times 10^{11}$ | 1 | 4 | 3 |
| Comparative Example 109 | CP-C109 | C109 | — | — | — | $7.2 \times 10^{8}$ | 1 | 4 | 2 |
| Comparative Example 110 | CP-C11C | C110 | 1 | 15 | 1.0 | $2.2 \times 10^{11}$ | 2 | 3 | 3 |
| Comparative Example 111 | CP-C111 | C111 | 1 | 30 | 1.0 | $3.7 \times 10^{11}$ | 2 | 4 | 3 |
| Comparative Example 112 | CP-C112 | C112 | 1 | 45 | 1.0 | $6.8 \times 10^{8}$ | 2 | 4 | 2 |
| Comparative Example 113 | CP-C113 | C113 | 30 | 15 | 1.0 | $1.7 \times 10^{11}$ | 2 | 3 | 3 |
| Comparative Example 114 | CP-C114 | C114 | 30 | 30 | 1.0 | $2.1 \times 10^{11}$ | 2 | 4 | 3 |
| Comparative Example 115 | CP-C115 | C115 | 30 | 45 | 1.0 | $2.3 \times 10^{8}$ | 2 | 4 | 2 |
| Comparative Example 116 | CP-C116 | C116 | — | — | — | $7.7 \times 10^{12}$ | 1 | 3 | 3 |
| Comparative Example 117 | CP-C117 | C117 | — | — | — | $2.9 \times 10^{11}$ | 1 | 4 | 3 |
| Comparative Example 118 | CP-C119 | C118 | — | — | — | $5.3 \times 10^{6}$ | 1 | 4 | 2 |
| Comparative Example 119 | CP-C119 | C119 | 2 | 10 | 1.0 | $6.3 \times 10^{13}$ | 5 | 1 | 3 |
| Comparative Example 120 | CP-C120 | C120 | 5 | 10 | 1.0 | $6.1 \times 10^{13}$ | 6 | 1 | 3 |
| Comparative Example 121 | CP-C121 | C121 | 13 | 10 | 1.0 | $5.9 \times 10^{11}$ | 6 | 1 | 3 |
| Comparative Example 122 | CP-C122 | C122 | 20 | 10 | 1.0 | $5.7 \times 10^{11}$ | 6 | 1 | 3 |
| Comparative Example 123 | CP-C123 | C123 | 25 | 10 | 1.0 | $5.5 \times 10^{13}$ | 4 | 1 | 3 |
| Comparative Example 124 | CP-C124 | C124 | 2 | 50 | 1.0 | $3.4 \times 10^{7}$ | 5 | 4 | 1 |
| Comparative Example 125 | CP-C125 | C125 | 5 | 50 | 1.0 | $2.9 \times 10^{7}$ | 6 | 4 | 1 |
| Comparative Example 126 | CP-C126 | C126 | 13 | 50 | 1.0 | $1.9 \times 10^{7}$ | 6 | 4 | 1 |
| Comparative Example 127 | CP-C127 | C127 | 20 | 50 | 1.0 | $1.4 \times 10^{7}$ | 6 | 4 | 1 |
| Comparative Example 128 | CP-C128 | C128 | 25 | 50 | 1.0 | $1.2 \times 10^{7}$ | 4 | 4 | 1 |

TABLE 64

| | Conductive layer-coating solution | Production example of electrophotographic photo-sensitive member | $\{(V_2/V_T)/V_1/V_T)\} \times 100$ | $\{(V_2/V_T) + (V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 561 | CP-561 | 561 | 2 | 15 | 0.8 | $2.0 \times 10^{13}$ | 4 | 3 | 3 |
| Example 562 | CP-562 | 562 | 2 | 15 | 0.9 | $2.0 \times 10^{13}$ | 5 | 3 | 3 |
| Example 563 | CP-563 | 563 | 2 | 15 | 1.0 | $2.0 \times 10^{13}$ | 5 | 3 | 3 |
| Example 569 | CP-564 | 564 | 2 | 15 | 1.1 | $2.0 \times 10^{13}$ | 5 | 3 | 3 |
| Example 565 | CP-565 | 565 | 2 | 15 | 1.2 | $2.0 \times 10^{13}$ | 4 | 3 | 3 |
| Example 566 | CP-566 | 566 | 5 | 15 | 1.0 | $2.0 \times 10^{13}$ | 6 | 3 | 3 |
| Example 567 | CP-567 | 567 | 13 | 15 | 0.8 | $1.8 \times 10^{13}$ | 5 | 3 | 3 |
| Example 568 | CP-568 | 568 | 13 | 15 | 0.9 | $1.8 \times 10^{13}$ | 6 | 3 | 3 |
| Example 569 | CP-569 | 569 | 13 | 15 | 1.0 | $1.8 \times 10^{13}$ | 6 | 3 | 3 |
| Example 570 | CP-570 | 570 | 13 | 15 | 1.1 | $1.8 \times 10^{13}$ | 6 | 3 | 3 |
| Example 571 | CP-571 | 571 | 13 | 15 | 1.2 | $1.8 \times 10^{13}$ | 5 | 3 | 3 |
| Example 572 | CP-572 | 572 | 20 | 15 | 1.0 | $1.7 \times 10^{13}$ | 6 | 3 | 3 |
| Example 573 | CP-573 | 573 | 25 | 15 | 0.8 | $1.7 \times 10^{13}$ | 3 | 3 | 3 |
| Example 574 | CP-574 | 574 | 25 | 15 | 0.9 | $1.7 \times 10^{13}$ | 4 | 3 | 3 |
| Example 575 | CP-575 | 575 | 25 | 15 | 1.0 | $1.6 \times 10^{13}$ | 4 | 3 | 3 |
| Example 576 | CP-576 | 576 | 25 | 15 | 1.1 | $1.6 \times 10^{13}$ | 4 | 3 | 3 |
| Example 577 | CP-577 | 577 | 25 | 15 | 1.2 | $1.6 \times 10^{13}$ | 3 | 3 | 3 |
| Example 578 | CP-578 | 578 | 2 | 20 | 1.0 | $6.0 \times 10^{12}$ | 5 | 4 | 3 |
| Example 579 | CP-579 | 579 | 5 | 20 | 0.8 | $5.8 \times 10^{12}$ | 5 | 4 | 3 |
| Example 580 | CP-580 | 580 | 5 | 20 | 0.9 | $5.8 \times 10^{12}$ | 6 | 4 | 3 |

TABLE 64-continued

| | Conductive layer-coating solution | Production example of electrophotographic photo-sensitive member | $\{(V_2/V_T)/(V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 581 | CP-581 | 581 | 5 | 20 | 1.0 | $5.8 \times 10^{12}$ | 6 | 4 | 3 |
| Example 582 | CP-582 | 582 | 5 | 20 | 1.1 | $5.8 \times 10^{12}$ | 6 | 4 | 3 |
| Example 583 | CP-583 | 583 | 5 | 20 | 1.2 | $5.7 \times 10^{12}$ | 5 | 4 | 3 |
| Example 589 | CP-584 | 584 | 13 | 20 | 0.8 | $5.2 \times 10^{12}$ | 5 | 4 | 3 |
| Example 585 | CP-585 | 585 | 13 | 20 | 0.9 | $5.2 \times 10^{12}$ | 6 | 4 | 3 |
| Example 586 | CP-586 | 586 | 13 | 20 | 1.0 | $5.1 \times 10^{12}$ | 6 | 4 | 3 |
| Example 587 | CP-587 | 587 | 13 | 20 | 1.1 | $5.1 \times 10^{12}$ | 6 | 4 | 3 |
| Example 588 | CP-580 | 588 | 13 | 20 | 1.2 | $5.1 \times 10^{12}$ | 5 | 4 | 3 |
| Example 589 | CP-589 | 589 | 20 | 20 | 0.8 | $4.7 \times 10^{12}$ | 5 | 4 | 3 |
| Example 590 | CP-590 | 590 | 20 | 20 | 0.9 | $4.7 \times 10^{12}$ | 6 | 4 | 3 |
| Example 591 | CP-591 | 591 | 20 | 20 | 1.0 | $4.7 \times 10^{12}$ | 6 | 4 | 3 |
| Example 592 | CP-592 | 592 | 20 | 20 | 1.1 | $4.7 \times 10^{12}$ | 6 | 4 | 3 |
| Example 593 | CP-593 | 593 | 20 | 20 | 1.2 | $4.6 \times 10^{12}$ | 5 | 4 | 3 |
| Example 594 | CP-594 | 594 | 25 | 20 | 1.0 | $4.4 \times 10^{12}$ | 4 | 4 | 3 |
| Example 595 | CP-595 | 595 | 2 | 30 | 0.8 | $3.1 \times 10^{11}$ | 4 | 4 | 3 |
| Example 596 | CP-596 | 596 | 2 | 30 | 0.9 | $3.1 \times 10^{11}$ | 5 | 4 | 3 |
| Example 597 | CP-597 | 597 | 2 | 30 | 1.0 | $3.1 \times 10^{11}$ | 5 | 4 | 3 |
| Example 598 | CP-598 | 598 | 2 | 30 | 1.1 | $3.1 \times 10^{11}$ | 5 | 4 | 3 |
| Example 599 | CP-599 | 599 | 2 | 30 | 1.2 | $3.1 \times 10^{11}$ | 4 | 4 | 3 |
| Example 600 | CP-600 | 600 | 5 | 30 | 0.6 | $2.9 \times 10^{11}$ | 5 | 4 | 3 |

TABLE 65

| | Conductive layer-coating solution | Production example of electrophotographic photo-sensitive member | $\{(V_2/V_T)/(V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 601 | CP-601 | 601 | 5 | 30 | 0.9 | $2.9 \times 10^{11}$ | 6 | 4 | 3 |
| Example 602 | CP-602 | 602 | 5 | 30 | 1.0 | $2.9 \times 10^{11}$ | 6 | 4 | 3 |
| Example 603 | CP-603 | 603 | 5 | 30 | 1.1 | $2.9 \times 10^{11}$ | 6 | 4 | 3 |
| Example 609 | CP-604 | 604 | 5 | 30 | 1.2 | $2.9 \times 10^{11}$ | 5 | 4 | 3 |
| Example 605 | CP-605 | 605 | 13 | 30 | 0.8 | $2.4 \times 10^{11}$ | 5 | 4 | 3 |
| Example 606 | CP-606 | 606 | 13 | 30 | 0.9 | $2.4 \times 10^{11}$ | 6 | 4 | 3 |
| Example 607 | CP-607 | 607 | 13 | 30 | 1.0 | $2.4 \times 10^{11}$ | 6 | 4 | 3 |
| Example 608 | CP-608 | 608 | 13 | 30 | 1.1 | $2.4 \times 10^{11}$ | 6 | 4 | 3 |
| Example 609 | CP-609 | 609 | 13 | 30 | 1.2 | $2.3 \times 10^{11}$ | 5 | 4 | 3 |
| Example 610 | CP-610 | 610 | 20 | 30 | 0.8 | $2.1 \times 10^{11}$ | 5 | 4 | 3 |
| Example 611 | CP-611 | 611 | 20 | 30 | 0.9 | $2.1 \times 10^{11}$ | 6 | 4 | 3 |
| Example 612 | CP-612 | 612 | 20 | 30 | 1.0 | $2.0 \times 10^{11}$ | 6 | 4 | 3 |
| Example 613 | CP-613 | 613 | 20 | 30 | 1.1 | $2.0 \times 10^{11}$ | 6 | 4 | 3 |
| Example 614 | CP-614 | 614 | 20 | 30 | 1.2 | $2.0 \times 10^{11}$ | 5 | 4 | 3 |
| Example 615 | CP-615 | 615 | 25 | 30 | 0.8 | $1.9 \times 10^{11}$ | 3 | 4 | 3 |
| Example 616 | CP-616 | 616 | 25 | 30 | 0.9 | $1.9 \times 10^{11}$ | 4 | 4 | 3 |
| Example 617 | CP-617 | 617 | 25 | 30 | 1.0 | $1.8 \times 10^{11}$ | 4 | 4 | 3 |
| Example 618 | CP-618 | 618 | 25 | 30 | 1.1 | $1.8 \times 10^{11}$ | 4 | 4 | 3 |
| Example 619 | CP-619 | 619 | 25 | 30 | 1.2 | $1.8 \times 10^{11}$ | 3 | 4 | 3 |
| Example 620 | CP-620 | 620 | 2 | 40 | 1.0 | $6.1 \times 10^{9}$ | 5 | 4 | 3 |
| Example 621 | CP-621 | 621 | 5 | 40 | 0.8 | $5.4 \times 10^{9}$ | 5 | 4 | 3 |
| Example 622 | CP-622 | 622 | 5 | 40 | 0.9 | $5.4 \times 10^{9}$ | 6 | 4 | 3 |
| Example 623 | CP-623 | 623 | 5 | 40 | 1.0 | $5.3 \times 10^{9}$ | 6 | 4 | 3 |
| Example 629 | CP-624 | 624 | 5 | 40 | 1.1 | $5.3 \times 10^{9}$ | 6 | 4 | 3 |
| Example 625 | CP-625 | 625 | 5 | 40 | 1.2 | $5.3 \times 10^{9}$ | 5 | 4 | 3 |
| Example 626 | CP-626 | 626 | 13 | 40 | 0.8 | $4.0 \times 10^{9}$ | 5 | 4 | 3 |
| Example 627 | CP-627 | 627 | 13 | 40 | 0.9 | $4.0 \times 10^{9}$ | 6 | 4 | 3 |
| Example 628 | CP-628 | 628 | 13 | 40 | 1.0 | $3.9 \times 10^{9}$ | 6 | 4 | 3 |
| Example 629 | CP-629 | 629 | 13 | 40 | 1.1 | $3.9 \times 10^{9}$ | 6 | 4 | 3 |
| Example 630 | CP-630 | 630 | 13 | 40 | 1.2 | $3.8 \times 10^{9}$ | 5 | 4 | 3 |
| Example 631 | CP-631 | 631 | 20 | 40 | 0.8 | $3.2 \times 10^{9}$ | 5 | 4 | 3 |
| Example 632 | CP-632 | 632 | 20 | 40 | 0.9 | $3.2 \times 10^{9}$ | 6 | 4 | 3 |
| Example 633 | CP-633 | 633 | 20 | 40 | 1.0 | $3.1 \times 10^{9}$ | 6 | 4 | 3 |
| Example 634 | CP-634 | 634 | 20 | 40 | 1.1 | $3.1 \times 10^{9}$ | 6 | 4 | 3 |
| Example 635 | CP-635 | 635 | 20 | 40 | 1.2 | $3.0 \times 10^{9}$ | 5 | 4 | 3 |
| Example 636 | CP-636 | 636 | 25 | 40 | 1.0 | $2.6 \times 10^{9}$ | 4 | 4 | 3 |
| Example 637 | CP-637 | 637 | 2 | 45 | 0.8 | $5.0 \times 10^{8}$ | 4 | 4 | 2 |
| Example 638 | CP-638 | 638 | 2 | 45 | 0.9 | $5.0 \times 10^{8}$ | 5 | 4 | 2 |

TABLE 65-continued

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 639 | CP-639 | 639 | 2 | 45 | 1.0 | $5.0 \times 10^8$ | 5 | 4 | 2 |
| Example 640 | CP-640 | 640 | 2 | 45 | 1.1 | $5.0 \times 10^8$ | 5 | 4 | 2 |

TABLE 66

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 641 | CP-641 | 641 | 2 | 45 | 1.2 | $4.9 \times 10^8$ | 4 | 4 | 2 |
| Example 642 | CP-642 | 642 | 5 | 45 | 1.0 | $4.2 \times 10^8$ | 6 | 4 | 2 |
| Example 643 | CP-643 | 643 | 13 | 45 | 0.8 | $3.0 \times 10^8$ | 5 | 4 | 2 |
| Example 644 | CP-644 | 644 | 13 | 45 | 0.9 | $2.9 \times 10^8$ | 6 | 4 | 2 |
| Example 645 | CP-645 | 645 | 13 | 45 | 1.0 | $2.9 \times 10^8$ | 6 | 4 | 2 |
| Example 646 | CP-646 | 646 | 13 | 45 | 1.1 | $2.9 \times 10^8$ | 6 | 4 | 2 |
| Example 647 | CP-647 | 647 | 13 | 45 | 1.2 | $2.8 \times 10^8$ | 5 | 4 | 2 |
| Example 648 | CP-648 | 648 | 20 | 45 | 1.0 | $2.1 \times 10^8$ | 6 | 4 | 2 |
| Example 649 | CP-649 | 649 | 25 | 45 | 0.8 | $1.9 \times 10^8$ | 3 | 4 | 2 |
| Example 650 | CP-650 | 650 | 25 | 45 | 0.9 | $1.9 \times 10^8$ | 4 | 4 | 2 |
| Example 651 | CP-651 | 651 | 25 | 45 | 1.0 | $1.8 \times 10^8$ | 4 | 4 | 2 |
| Example 652 | CP-652 | 652 | 25 | 45 | 1.1 | $1.8 \times 10^8$ | 4 | 4 | 2 |
| Example 653 | CP-653 | 653 | 25 | 45 | 1.2 | $1.7 \times 10^8$ | 3 | 4 | 2 |

TABLE 67

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 654 | CP-654 | 654 | 5 | 20 | 0.8 | $4.3 \times 10^{12}$ | 5 | 4 | 3 |
| Example 655 | CP-655 | 655 | 5 | 20 | 0.9 | $4.3 \times 10^{12}$ | 6 | 4 | 3 |
| Example 656 | CP-656 | 656 | 5 | 20 | 1.0 | $4.3 \times 10^{12}$ | 6 | 4 | 3 |
| Example 657 | CP-657 | 657 | 5 | 20 | 1.1 | $4.3 \times 10^{12}$ | 6 | 4 | 3 |
| Example 658 | CP-658 | 656 | 5 | 20 | 1.2 | $4.3 \times 10^{11}$ | 5 | 4 | 3 |
| Example 659 | CP-659 | 659 | 13 | 20 | 0.8 | $3.2 \times 10^{12}$ | 5 | 4 | 3 |
| Example 660 | CP-660 | 660 | 13 | 20 | 0.9 | $3.8 \times 10^{12}$ | 6 | 4 | 3 |
| Example 661 | CP-661 | 661 | 13 | 20 | 1.0 | $3.8 \times 10^{12}$ | 6 | 4 | 3 |
| Example 662 | CP-662 | 662 | 13 | 20 | 1.1 | $3.8 \times 10^{12}$ | 6 | 4 | 3 |
| Example 663 | CP-663 | 663 | 13 | 20 | 1.2 | $3.7 \times 10^{12}$ | 5 | 4 | 3 |
| Example 664 | CP-664 | 664 | 20 | 20 | 0.8 | $3.5 \times 10^{12}$ | 5 | 4 | 3 |
| Example 665 | CP-665 | 665 | 20 | 20 | 0.9 | $3.5 \times 10^{12}$ | 6 | 4 | 3 |
| Example 666 | CP-666 | 666 | 20 | 20 | 1.0 | $3.4 \times 10^{12}$ | 6 | 4 | 3 |
| Example 667 | CP-667 | 667 | 20 | 20 | 1.1 | $3.4 \times 10^{12}$ | 6 | 4 | 3 |
| Example 668 | CP-668 | 668 | 20 | 20 | 1.2 | $3.4 \times 10^{12}$ | 5 | 4 | 3 |
| Example 669 | CP-669 | 669 | 5 | 30 | 0.8 | $1.5 \times 10^{11}$ | 5 | 4 | 3 |
| Example 670 | CP-670 | 670 | 5 | 30 | 0.9 | $1.5 \times 10^{11}$ | 6 | 4 | 3 |
| Example 671 | CP-671 | 671 | 5 | 30 | 1.0 | $1.4 \times 10^{11}$ | 6 | 4 | 3 |
| Example 672 | CP-672 | 672 | 5 | 30 | 1.1 | $1.4 \times 10^{11}$ | 6 | 4 | 3 |
| Example 673 | CP-673 | 673 | 5 | 30 | 1.2 | $1.4 \times 10^{11}$ | 5 | 4 | 3 |
| Example 674 | CP-674 | 674 | 13 | 30 | 0.8 | $1.2 \times 10^{11}$ | 5 | 4 | 3 |
| Example 675 | CP-675 | 675 | 13 | 30 | 0.9 | $1.2 \times 10^{11}$ | 6 | 4 | 3 |
| Example 676 | CP-676 | 676 | 13 | 30 | 1.0 | $1.1 \times 10^{11}$ | 6 | 4 | 3 |
| Example 677 | CP-677 | 677 | 13 | 30 | 1.1 | $1.1 \times 10^{11}$ | 6 | 4 | 3 |
| Example 678 | CP-678 | 678 | 13 | 30 | 1.2 | $1.1 \times 10^{11}$ | 5 | 4 | 3 |
| Example 679 | CP-679 | 679 | 20 | 30 | 0.8 | $9.8 \times 10^{10}$ | 5 | 4 | 3 |
| Example 680 | CP-680 | 680 | 20 | 30 | 0.9 | $9.8 \times 10^{10}$ | 6 | 4 | 3 |
| Example 681 | CP-691 | 621 | 20 | 30 | 1.0 | $9.5 \times 10^{10}$ | 6 | 4 | 3 |
| Example 682 | CP-692 | 682 | 20 | 30 | 1.1 | $9.5 \times 10^{10}$ | 6 | 4 | 3 |

TABLE 67-continued

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 683 | CP-683 | 683 | 20 | 30 | 1.2 | $9.3 \times 10^{10}$ | 5 | 4 | 3 |
| Example 689 | CP-684 | 684 | 5 | 40 | 0.8 | $1.2 \times 10^{9}$ | 5 | 4 | 3 |
| Example 685 | CP-685 | 685 | 5 | 40 | 0.9 | $1.0 \times 10^{9}$ | 6 | 4 | 3 |
| Example 686 | CP-686 | 686 | 5 | 40 | 1.0 | $1.2 \times 10^{9}$ | 6 | 4 | 3 |
| Example 687 | CP-697 | 687 | 5 | 40 | 1.1 | $1.2 \times 10^{9}$ | 6 | 4 | 3 |
| Example 688 | CP-688 | 688 | 5 | 40 | 1.2 | $1.0 \times 10^{9}$ | 5 | 4 | 3 |
| Example 689 | CP-689 | 689 | 13 | 40 | 0.8 | $8.2 \times 10^{8}$ | 5 | 4 | 3 |
| Example 690 | CP-690 | 690 | 13 | 40 | 0.9 | $8.2 \times 10^{8}$ | 6 | 4 | 3 |

TABLE 68

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Example 691 | CP-691 | 691 | 13 | 40 | 1.0 | $8.0 \times 10^{8}$ | 6 | 4 | 3 |
| Example 692 | CP-692 | 692 | 13 | 40 | 1.1 | $8.0 \times 10^{8}$ | 6 | 4 | 3 |
| Example 693 | CP-693 | 693 | 13 | 40 | 1.2 | $7.7 \times 10^{8}$ | 5 | 4 | 3 |
| Example 694 | CP-694 | 694 | 20 | 40 | 0.8 | $6.2 \times 10^{8}$ | 5 | 4 | 3 |
| Example 695 | CP-695 | 695 | 20 | 40 | 0.9 | $6.2 \times 10^{8}$ | 6 | 4 | 3 |
| Example 696 | CP-696 | 696 | 20 | 40 | 1.0 | $5.9 \times 10^{8}$ | 6 | 4 | 3 |
| Example 697 | CP-697 | 697 | 20 | 40 | 1.1 | $5.9 \times 10^{8}$ | 6 | 4 | 3 |
| Example 698 | CP-698 | 698 | 20 | 40 | 1.2 | $5.6 \times 10^{8}$ | 5 | 4 | 3 |
| Example 699 | CP-699 | 699 | 13 | 30 | 1.0 | $1.1 \times 10^{11}$ | 6 | 4 | 3 |
| Example 700 | CP-700 | 700 | 13 | 30 | 1.0 | $4.7 \times 10^{11}$ | 6 | 4 | 3 |

35

TABLE 69

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Comparative Example 129 | CP-C129 | C129 | — | — | — | $2.1 \times 10^{13}$ | 1 | 3 | 3 |
| Comparative Example 130 | CP-C130 | C130 | — | — | — | $3.3 \times 10^{11}$ | 1 | 4 | 3 |
| Comparative Example 131 | CP-C131 | C131 | — | — | — | $5.5 \times 10^{8}$ | 1 | 4 | 2 |
| Comparative Example 132 | CP-C132 | C132 | 1 | 15 | 1.0 | $2.1 \times 10^{13}$ | 2 | 3 | 3 |
| Comparative Example 133 | CP-C133 | C133 | 1 | 31 | 1.0 | $3.2 \times 10^{11}$ | 2 | 4 | 3 |
| Comparative Example 134 | CP-C134 | C134 | 1 | 47 | 1.0 | $5.2 \times 10^{8}$ | 2 | 4 | 2 |
| Comparative Example 135 | CP-C135 | C135 | 30 | 15 | 1.0 | $1.6 \times 10^{13}$ | 2 | 3 | 3 |
| Comparative Example 136 | CP-C136 | C136 | 30 | 31 | 1.0 | $1.7 \times 10^{11}$ | 2 | 4 | 3 |
| Comparative Example 137 | CP-C137 | C137 | 30 | 47 | 1.0 | $1.5 \times 10^{8}$ | 2 | 4 | 2 |
| Comparative Example 138 | CP-C138 | C133 | — | — | — | $6.1 \times 10^{12}$ | 1 | 3 | 3 |
| Comparative Example 139 | CP-C139 | C139 | — | — | — | $1.7 \times 10^{10}$ | 1 | 4 | 3 |
| Comparative Example 140 | CP-C140 | C140 | — | — | — | $1.9 \times 10^{6}$ | 1 | 4 | 2 |
| Comparative Example 141 | CP-C141 | C141 | 2 | 10 | 1.0 | $6.0 \times 10^{13}$ | 5 | 1 | 3 |
| Comparative Example 142 | CP-C142 | C142 | 5 | 10 | 1.0 | $5.9 \times 10^{13}$ | 6 | 1 | 3 |
| Comparative Example 143 | CP-C143 | C143 | 13 | 10 | 1.0 | $5.6 \times 10^{13}$ | 6 | 1 | 3 |
| Comparative Example 144 | CP-C144 | C144 | 20 | 10 | 1.0 | $5.4 \times 10^{13}$ | 6 | 1 | 3 |
| Comparative Example 145 | CP-C145 | C145 | 25 | 10 | 1.0 | $5.2 \times 10^{13}$ | 4 | 1 | 3 |
| Comparative Example 146 | CP-C146 | C146 | 2 | 52 | 1.0 | $2.4 \times 10^{7}$ | 5 | 4 | 1 |
| Comparative Example 147 | CP-C147 | C147 | 5 | 52 | 1.0 | $2.0 \times 10^{7}$ | 6 | 4 | 1 |
| Comparative Example 148 | CP-C148 | C143 | 13 | 52 | 1.0 | $1.3 \times 10^{7}$ | 6 | 4 | 1 |
| Comparative Example 149 | CP-C149 | C149 | 20 | 52 | 1.0 | $8.8 \times 10^{6}$ | 6 | 4 | 1 |
| Comparative Example 150 | CP-C150 | C150 | 25 | 52 | 1.0 | $7.0 \times 10^{6}$ | 4 | 4 | 1 |

TABLE 70

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Comparative Example 151 | CP-C151 | C151 | — | — | — | $3.0 \times 10^{11}$ | 1 | 4 | 3 |
| Comparative Example 152 | CP-C152 | C152 | — | — | — | $2.6 \times 10^{11}$ | 1 | 4 | 3 |
| Comparative Example 153 | CP-C153 | C153 | — | — | — | $2.8 \times 10^{11}$ | 1 | 4 | 3 |
| Comparative Example 154 | CP-C154 | C154 | — | — | — | $2.7 \times 10^{11}$ | 1 | 4 | 3 |
| Comparative Example 155 | CP-C155 | C155 | — | — | — | $2.6 \times 10^{11}$ | 1 | 4 | 3 |
| Comparative Example 156 | CP-C156 | C156 | — | — | — | $2.3 \times 10^{11}$ | 1 | 4 | 3 |
| Comparative Example 157 | CP-C157 | C157 | — | — | — | $2.5 \times 10^{11}$ | 1 | 4 | 3 |
| Comparative Example 158 | CP-C158 | C153 | — | — | — | $2.4 \times 10^{11}$ | 1 | 4 | 3 |

TABLE 71

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Comparative Example 159 | CP-C159 | C159 | — | — | — | $3.0 \times 10^{11}$ | 1 | 4 | 3 |
| Comparative Example 160 | CP-C160 | C160 | — | — | — | $2.7 \times 10^{11}$ | 1 | 4 | 3 |
| Comparative Example 161 | CP-C161 | C161 | — | — | — | $3.2 \times 10^{11}$ | 1 | 4 | 3 |
| Comparative Example 162 | CP-C162 | C162 | — | — | — | $3.0 \times 10^{11}$ | 1 | 4 | 3 |
| Comparative Example 163 | CP-C163 | C163 | — | — | — | $2.9 \times 10^{11}$ | 1 | 4 | 3 |
| Comparative Example 164 | CP-C164 | C164 | — | — | — | $2.9 \times 10^{11}$ | 1 | 4 | 3 |
| Comparative Example 165 | CP-C165 | C165 | — | — | — | $2.9 \times 10^{11}$ | 1 | 4 | 3 |

TABLE 72

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Comparative Example 166 | CP-C166 | C166 | — | — | — | $3.0 \times 10^{11}$ | 1 | 4 | 3 |
| Comparative Example 167 | CP-C167 | C167 | — | — | — | $2.8 \times 10^{11}$ | 1 | 4 | 3 |
| Comparative Example 168 | CP-C168 | C168 | — | — | — | $3.0 \times 10^{11}$ | 1 | 4 | 3 |
| Comparative Example 169 | CP-C169 | C169 | — | — | — | $2.6 \times 10^{11}$ | 1 | 4 | 3 |
| Comparative Example 170 | CP-C170 | C170 | — | — | — | $3.3 \times 10^{11}$ | 1 | 4 | 3 |
| Comparative Example 171 | CP-C171 | C171 | — | — | — | $3.0 \times 10^{11}$ | 1 | 4 | 3 |

TABLE 73

| | Conductive layer-coating solution | Production example of electrophotographic photo-sensitive member | $\{(V_2/V_T)/V_1/V_T)\} \times 100$ | $\{(V_2/V_T)+(V_2/V_T)\} \times 100$ | $R_2/R_1$ | Volume resistivity of conductive layer [Ω·cm] | Result of evaluation: Pattern memory | Residual potential | Crack |
|---|---|---|---|---|---|---|---|---|---|
| Comparative Example 172 | CP-C172 | C172 | — | — | — | $2.9 \times 10^{11}$ | 1 | 4 | 3 |
| Comparative Example 173 | CP-C173 | C173 | — | — | — | $2.9 \times 10^{11}$ | 1 | 4 | 3 |
| Comparative Example 174 | CP-C174 | C174 | — | — | — | $2.9 \times 10^{11}$ | 1 | 4 | 3 |
| Comparative Example 175 | CP-C175 | C175 | — | — | — | $3.0 \times 10^{11}$ | 1 | 4 | 3 |
| Comparative Example 176 | CP-C176 | C176 | — | — | — | $2.8 \times 10^{11}$ | 1 | 4 | 3 |
| Comparative Example 177 | CP-C177 | C177 | — | — | — | $3.0 \times 10^{11}$ | 1 | 4 | 3 |
| Comparative Example 178 | CP-C178 | C178 | — | — | — | $3.0 \times 10^{11}$ | 1 | 4 | 3 |
| Comparative Example 179 | CP-C179 | C179 | — | — | — | $1.9 \times 10^{12}$ | 1 | 4 | 3 |

TABLE 74

| | | Rank of pattern memory | | | | | |
|---|---|---|---|---|---|---|---|
| | | 6 | 5 | 4 | 3 | 2 | 1 |
| Half-tone image | Solid black image | Unobservable | Observable | Observable | Observable | Observable | Observable |
| | One-dot keima pattern | Unobservable | Unobservable | Observable | Observable | Observable | Observable |
| | One-dot and one-space lateral line | Unobservable | Unobservable | Unobservable | Observable | Observable | Observable |
| | Two-dot and three-space lateral line | Unobservable | Unobservable | Unobservable | Unobservable | Observable | Observable |
| | One-dot and two-space lateral line | Unobservable | Unobservable | Unobservable | Unobservable | Unobservable | Observable |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-189532, filed on Aug. 30, 2012, No. 2013-077617, filed on Apr. 3, 2013, and No. 2013-177141, filed on Aug. 28, 2013, which are hereby incorporated by reference herein in its entirety.

REFERENCE SIGNS LIST

1 electrophotographic photosensitive member
2 axis
3 charging device (primary charging device)
4 exposure light (image exposure light)
5 developing device
6 transferring device (such as transfer roller)
7 cleaning device (such as cleaning blade)
8 fixing device
9 process cartridge
10 guiding device
11 pre-exposure light
P transfer material (such as paper)

The invention claimed is:

1. An electrophotographic photosensitive member, comprising:
a support;
a conductive layer formed on the support; and
a photosensitive layer formed on the conductive layer, wherein:
the conductive layer comprises:
a titanium oxide particle coated with tin oxide doped with phosphorus,
a tin oxide particle doped with phosphorus, and
a binding material; and
when a total volume of the conductive layer is represented by $V_T$, a total volume of the titanium oxide particle coated with tin oxide doped with phosphorus in the conductive layer is represented by $V_{1P}$, and a total volume of the tin oxide particle doped with phosphorus in the conductive layer is represented by $V_{2P}$, the $V_T$, the $V_{1P}$, and the $V_{2P}$ satisfy the following expressions (1) and (2)

$$2 \leq \{(V_{2P}/V_T)/(V_{1P}/V_T)\} \times 100 \leq 25 \quad (1)$$

$$15 \leq \{(V_{1P}/V_T)+(V_{2P}/V_T)\} \times 100 \leq 45 \quad (2).$$

2. The electrophotographic photosensitive member according to claim 1, wherein the $V_T$, the $V_{1P}$, and the $V_{2P}$ satisfy the following expression (3)

$$5 \leq \{(V_{2P}/V_T)/(V_{1P}/V_T)\} \times 100 \leq 20 \quad (3).$$

3. The electrophotographic photosensitive member according to claim 1, wherein the $V_T$, the $V_{1P}$, and the $V_{2P}$ satisfy the following expression (4)

$$20 \leq \{(V_{1P}/V_T)+(V_{2P}/V_T)\} \times 100 \leq 40 \quad (4).$$

4. The electrophotographic photosensitive member according to claim 1, wherein when an abundance ratio of phosphorus to tin oxide in the titanium oxide particle coated with tin oxide doped with phosphorus is represented by $R_{1P}$ [atom %] and an abundance ratio of phosphorus to tin oxide in the tin oxide particle doped with phosphorus is represented by $R_{2P}$ [atom %], the $R_{1P}$ and the $R_{2P}$ satisfy the following expression (5)

$$0.9 \leq R_{2P}/R_{1P} \leq 1.1 \quad (5).$$

5. A process cartridge detachably mountable to a main body of an electrophotographic apparatus, wherein the process cartridge integrally supports:
the electrophotographic photosensitive member according to claim 1; and
at least one device selected from the group consisting of a charging device, a developing device, a transferring device, and a cleaning device.

6. An electrophotographic apparatus, comprising:
the electrophotographic photosensitive member according to claim 1;
a charging device;
an exposing device;
a developing device; and
a transferring device.

7. An electrophotographic photosensitive member, comprising:
a support;
a conductive layer formed on the support; and
a photosensitive layer formed on the conductive layer, wherein:
the conductive layer comprises:
a titanium oxide particle coated with tin oxide doped with tungsten,
a tin oxide particle doped with tungsten, and
a binding material; and
when a total volume of the conductive layer is represented by $V_T$, a total volume of the titanium oxide particle coated with tin oxide doped with tungsten in the conductive layer is represented by $V_{1W}$, and a total volume of the tin oxide particle doped with tungsten in the conductive layer is represented by $V_{2W}$, the $V_T$, the $V_{1W}$, and the $V_{2W}$ satisfy the following expressions (6) and (7)

$$2 \leq \{(V_{2W}/V_T)/(V_{1W}/V_T)\} \times 100 \leq 25 \quad (6)$$

$$15 \leq \{(V_{1W}/V_T)+(V_{2W}/V_T)\} \times 100 \leq 45 \quad (7).$$

8. The electrophotographic photosensitive member according to claim 7, wherein the $V_T$, the $V_{1W}$, and the $V_{2W}$ satisfy the following expression (8)

$$5 \leq \{(V_{2W}/V_T)/(V_{1W}/V_T)\} \times 100 \leq 20 \quad (8).$$

9. The electrophotographic photosensitive member according to claim 7, wherein the $V_T$, the $V_{1W}$, and the $V_{2W}$ satisfy the following expression (9)

$$20 \leq \{(V_{1W}/V_T)+(V_{2W}/V_T)\} \times 100 \leq 40 \quad (9).$$

10. The electrophotographic photosensitive member according to claim 7, wherein when an abundance ratio of tungsten to tin oxide in the titanium oxide particle coated with tin oxide doped with tungsten is represented by $R_{1W}$ [atom %] and an abundance ratio of tungsten to tin oxide in the tin oxide particle doped with tungsten is represented by $R_{2W}$ [atom %], the $R_{iw}$ and the $R_{2W}$ satisfy the following expression (10)

$$0.9 \leq R_{2W}/R_{1W} \leq 1.1 \quad (10).$$

11. An electrophotographic photosensitive member, comprising:

a support;

a conductive layer formed on the support; and a photosensitive layer formed on the conductive layer, wherein:

the conductive layer comprises:

a titanium oxide particle coated with tin oxide doped with fluorine, a tin oxide particle doped with fluorine, and a binding material; and when a total volume of the conductive layer is represented by $V_T$, a total volume of the titanium oxide particle coated with tin oxide doped with fluorine in the conductive layer is represented by $V_{1F}$, and a total volume of the tin oxide particle doped with fluorine in the conductive layer is represented by $V_{2F}$, the $V_T$, the $V_{1F}$, and the $V_{2F}$ satisfy the following expressions (11) and (12)

$$2 \leq \{(V_{2F}/V_T)/(V_{1F}/V_T)\} \times 100 \leq 25 \quad (11)$$

$$15 \leq \{(V_{1F}/V_T)+(V_{2F}/V_T)\} \times 100 \leq 45 \quad (12).$$

12. The electrophotographic photosensitive member according to claim 11, wherein the $V_T$, the $V_{1F}$, and the $V_{2F}$ satisfy the following expression (13)

$$5 \leq \{(V_{2F}/V_T)/(V_{1F}/V_T)\} \times 100 \leq 20 \quad (13).$$

13. The electrophotographic photosensitive member according to claim 11, wherein the $V_T$, the $V_{1F}$, and the $V_{2F}$ satisfy the following expression (14).

$$20 \leq \{(V_{1F}/V_T)+(V_{2F}/V_T)\} \times 100 \leq 40 \quad (14).$$

14. The electrophotographic photosensitive member according to claim 11, wherein when an abundance ratio of fluorine to tin oxide in the titanium oxide particle coated with tin oxide doped with fluorine is represented by $R_{1F}$ [atom %] and an abundance ratio of fluorine to tin oxide in the tin oxide particle doped with fluorine is represented by $R_{2F}$ [atom %], the $R_{1F}$ and the $R_{2F}$ satisfy the following expression (15)

$$0.9 \leq R_{2F}/R_{1F} \leq 1.1 \quad (15).$$

15. An electrophotographic photosensitive member, comprising:

a support;

a conductive layer formed on the support; and a photosensitive layer formed on the conductive layer, wherein:

the conductive layer comprises:

a titanium oxide particle coated with tin oxide doped with niobium, a tin oxide particle doped with niobium, and a binding material; and when a total volume of the conductive layer is represented by $V_T$, a total volume of the titanium oxide particle coated with tin oxide doped with niobium in the conductive layer is represented by $V_{1Nb}$, and a total volume of the tin oxide particle doped with niobium in the conductive layer is represented by $V_{2Nb}$, the $V_T$, the $V_{1Nb}$, and the $V_{2Nb}$ satisfy the following expressions (16) and (17)

$$2 \leq \{(V_{2Nb}/V_T)/(V_{1Nb}/V_T)\} \times 100 \leq 25 \quad (16)$$

$$15 \leq \{(V_{1Nb}/V_T)+(V_{2Nb}/V_T)\} \times 100 \leq 45 \quad (17).$$

16. The electrophotographic photosensitive member according to claim 15, wherein the $V_T$, the $V_{1Nb}$, and the $V_{2Nb}$ satisfy the following expression (18)

$$5 \leq \{(V_{2Nb}/V_T)/(V_{1Nb}/V_T)\} \times 100 \leq 20 \quad (18).$$

17. The electrophotographic photosensitive member according to claim 15, wherein the $V_T$, the $V_{1Nb}$, and the $V_{2Nb}$ satisfy the following expression (19)

$$20 \leq \{(V_{1Nb}/V_T)+(V_{2Nb}/V_T)\} \times 100 \leq 40 \quad (19).$$

18. The electrophotographic photosensitive member according to claim 15, wherein when an abundance ratio of niobium to tin oxide in the titanium oxide particle coated with tin oxide doped with niobium is represented by $R_{1Nb}$ [atom %] and an abundance ratio of niobium to tin oxide in the tin oxide particle doped with niobium is represented by $R_{2Nb}$ [atom %], the $R_{1Nb}$ and the $R_{2Nb}$ satisfy the following expression (20)

$$0.9 \leq R_{2Nb}/R_{1Nb} \leq 1.1 \quad (20).$$

19. An electrophotographic photosensitive member, comprising:

a support;

a conductive layer formed on the support; and a photosensitive layer formed on the conductive layer, wherein:

the conductive layer comprises:

a titanium oxide particle coated with tin oxide doped with tantalum, a tin oxide particle doped with tantalum, and a binding material; and when a total volume of the conductive layer is represented by $V_T$, a total volume of the titanium oxide particle coated with tin oxide doped with tantalum in the conductive layer is represented by $V_{1Ta}$, and a total volume of the tin oxide particle doped with tantalum in the conductive layer is represented by $V_{2Ta}$, the $V_T$, the $V_{1Ta}$, and the $V_{2Ta}$ satisfy the following expressions (21) and (22)

$$2 \leq \{(V_{2Ta}/V_T)/(V_{1Ta}/V_T)\} \times 100 \leq 25 \quad (21)$$

$$15 \leq \{(V_{1Ta}/V_T)+(V_{2Ta}/V_T)\} \times 100 \leq 45 \quad (22).$$

20. The electrophotographic photosensitive member according to claim 19, wherein the $V_T$, the $V_{1TA}$, and the $V_{2Ta}$ satisfy the following expression (23)

$$5 \leq \{(V_{2Ta}/V_T)/(V_{1Ta}/V_T)\} \times 100 \leq 20 \quad (23).$$

21. The electrophotographic photosensitive member according to claim 19, wherein the $V_T$, the $V_{1Ta}$, and the $V_{2Ta}$ satisfy the following expression (24)

$$20 \leq \{(V_{1Ta}/V_T)+(V_{2Ta}/V_T)\} \times 100 \leq 40 \quad (24).$$

22. The electrophotographic photosensitive member according to claim 19, wherein when an abundance ratio of tantalum to tin oxide in the titanium oxide particle coated with tin oxide doped with tantalum is represented by $R_{1Ta}$ [atom %] and an abundance ratio of tantalum to tin oxide in the tin oxide particle doped with tantalum is represented by $R_{2Ta}$ [atom %], the $R_{1Ta}$ and the $R_{2Ta}$ satisfy the following expression (25)

$$0.9 \leq R_{2Ta}/R_{1Ta} \leq 1.1 \quad (25).$$

* * * * *